US006121533A

United States Patent [19]

Kay

[11] Patent Number: 6,121,533

[45] Date of Patent: Sep. 19, 2000

[54] METHOD AND APPARATUS FOR GENERATING RANDOM WEIGHTED MUSICAL CHOICES

[76] Inventor: Stephen Kay, 140 Madison Ave., Westfield, N.J. 07090

[21] Appl. No.: 09/239,438

[22] Filed: Jan. 28, 1999

Related U.S. Application Data

[60] Provisional application No. 60/072,919, Jan. 28, 1998.

[51] Int. Cl.[7] ..... G10H 1/057; G10H 1/06; G10H 1/20; G10H 1/42; G10H 7/00

[52] U.S. Cl. ..... 84/616; 84/619; 84/622; 84/627; 84/635; 84/645; 84/DIG. 12

[58] Field of Search ..... 84/600–602, 609–614, 84/634–638, 649–652, 666–669, DIG. 12, 712–717, 615–620, 622–633, 645

[56] References Cited

U.S. PATENT DOCUMENTS

| | | | |
|---|---|---|---|
| 3,629,480 | 12/1971 | Harris | 84/DIG. 12 |
| 4,122,743 | 10/1978 | Tomisawa et al. | 84/1.24 |
| 4,181,059 | 1/1980 | Weber | 84/1.24 |
| 4,198,892 | 4/1980 | Gross | 84/1.25 |
| 4,208,938 | 6/1980 | Kondo | 84/DIG. 12 |
| 4,217,804 | 8/1980 | Yamaga et al. | 84/1.03 |
| 4,307,644 | 12/1981 | Aoki | 84/DIG. 12 |
| 4,399,731 | 8/1983 | Aoki | 84/1.03 |
| 4,526,078 | 7/1985 | Chadabe | 84/1.03 |
| 4,708,046 | 11/1987 | Kozuki | 84/DIG. 12 |
| 4,901,616 | 2/1990 | Matsubara et al. | 84/1.03 |
| 4,915,007 | 4/1990 | Wachi et al. | 84/82 |
| 4,930,390 | 6/1990 | Kellogg et al. | 84/611 |
| 4,969,384 | 11/1990 | Kawasaki et al. | 84/612 |
| 4,998,960 | 3/1991 | Rose et al. | 84/622 |
| 5,099,738 | 3/1992 | Hotz | 84/617 |
| 5,136,914 | 8/1992 | Letts et al. | 84/619 |
| 5,146,833 | 9/1992 | Lui | 84/462 |
| 5,159,141 | 10/1992 | Iba | 84/619 |
| 5,160,799 | 11/1992 | Tozuka et al. | 84/653 |
| 5,248,842 | 9/1993 | Saito | 84/602 |
| 5,281,754 | 1/1994 | Farrett et al. | 84/609 |
| 5,357,048 | 10/1994 | Sgroi | 84/645 |
| 5,375,501 | 12/1994 | Okuda | 84/611 |
| 5,451,709 | 9/1995 | Minamitaka | 84/609 |
| 5,488,196 | 1/1996 | Zimmerman et al. | 84/612 |

(List continued on next page.)

OTHER PUBLICATIONS

M and Jam Factory, David Zicarelli, Computer Music Journal, vol. 11, No. 4, Winter 1987.

M—The Intelligent Composing and Performing System, Software Operator's Manual, David Zicarelli, et al., Version 2.5, Aug. 1997.

*Primary Examiner*—Stanley J. Witkowski

*Attorney, Agent, or Firm*—Lerner, David, Littenberg, Krumholz & Mentlik, LLP

[57] ABSTRACT

An initial note series is collected from a real-time source of musical input material such as a keyboard or a sequencer playing back musical data, or extracted from musical data stored in memory. The initial note series may be altered to create variations of the initial note series using various mathematical operations. The resulting altered note series, or other data stored in memory is read out according to one or more patterns. The patterns may have steps containing pools of independently selectable items from which random selections are made. A pseudo-random number generator is employed to perform the random selections during processing, where the random sequences thereby generated have the ability to be repeated at specific musical intervals. The resulting musical effect may additionally incorporate a repeated effect, or a repeated effect can be independently performed from input notes in the musical input material. The repeated notes are generated according to one or more patterns, which may also have steps containing pools of random selections. A duration control means is used to avoid polyphony problems and provide novel effects. Pitch-bending effects may be additionally generated as part of the musical effect, or can be independently performed. A sliding control window may be utilized to achieve accurate and realistic pitch-bending effects. This method and the apparatus that can perform such a method have application to music and other data in general as well.

74 Claims, 94 Drawing Sheets

U.S. PATENT DOCUMENTS

| | | | |
|---|---|---|---|
| 5,495,072 | 2/1996 | Kumagi | 84/601 |
| 5,496,962 | 3/1996 | Meier et al. | 84/601 |
| 5,502,274 | 3/1996 | Hotz | 84/613 |
| 5,512,704 | 4/1996 | Adachi | 84/605 |
| 5,565,640 | 10/1996 | Hasebe | 84/612 |
| 5,612,501 | 3/1997 | Kondo et al. | 84/637 |
| 5,619,003 | 4/1997 | Hotz | 84/615 |
| 5,627,335 | 5/1997 | Rigopulos et al. | 84/635 |
| 5,714,705 | 2/1998 | Kishimoto et al. | 84/651 |
| 5,726,374 | 3/1998 | Vandervoort | 84/638 |
| 5,739,453 | 4/1998 | Chihana et al. | 84/615 |
| 5,763,804 | 6/1998 | Rigopulos et al. | 84/635 |
| 5,864,079 | 1/1999 | Matsuda | 87/619 |
| 5,883,325 | 3/1999 | Peirce | 84/615 |

| x | y |
|---|---|
| 0 | 0 |
| 1 | 0 |
| 2 | 0 |
| 3 | 0 |
| 4 | 0 |
| 5 | 0 |
| 6 | 0 |
| 7 | 0 |
| 8 | 0 |
| 9 | 0 |
| 10 | 0 |
| 11 | 0 |
| 12 | 0 |
| 13 | 0 |
| 14 | 0 |
| 15 | 0 |
| 16 | 0 |
| 17 | 0 |
| 18 | 0 |
| 19 | 0 |
| 20 | 0 |
| 21 | 0 |
| 22 | 0 |
| 23 | 0 |
| 24 | 0 |
| 25 | 0 |
| 26 | 0 |
| 27 | 0 |
| 28 | 0 |
| 29 | 0 |
| 30 | 0 |
| 31 | 1 |

| x | y |
|---|---|
| 32 | 1 |
| 33 | 1 |
| 34 | 1 |
| 35 | 1 |
| 36 | 1 |
| 37 | 1 |
| 38 | 1 |
| 39 | 1 |
| 40 | 1 |
| 41 | 1 |
| 42 | 1 |
| 43 | 2 |
| 44 | 2 |
| 45 | 2 |
| 46 | 2 |
| 47 | 2 |
| 48 | 2 |
| 49 | 2 |
| 50 | 3 |
| 51 | 3 |
| 52 | 3 |
| 53 | 3 |
| 54 | 3 |
| 55 | 3 |
| 56 | 4 |
| 57 | 4 |
| 58 | 4 |
| 59 | 4 |
| 60 | 5 |
| 61 | 5 |
| 62 | 5 |
| 63 | 5 |

| x | y |
|---|---|
| 64 | 6 |
| 65 | 6 |
| 66 | 6 |
| 67 | 7 |
| 68 | 7 |
| 69 | 7 |
| 70 | 8 |
| 71 | 8 |
| 72 | 9 |
| 73 | 9 |
| 74 | 10 |
| 75 | 10 |
| 76 | 11 |
| 77 | 11 |
| 78 | 12 |
| 79 | 12 |
| 80 | 13 |
| 81 | 14 |
| 82 | 14 |
| 83 | 15 |
| 84 | 16 |
| 85 | 17 |
| 86 | 17 |
| 87 | 18 |
| 88 | 19 |
| 89 | 20 |
| 90 | 21 |
| 91 | 22 |
| 92 | 23 |
| 93 | 25 |
| 94 | 26 |
| 95 | 27 |

| x | y |
|---|---|
| 96 | 29 |
| 97 | 30 |
| 98 | 31 |
| 99 | 33 |
| 100 | 35 |
| 101 | 36 |
| 102 | 38 |
| 103 | 40 |
| 104 | 42 |
| 105 | 44 |
| 106 | 46 |
| 107 | 49 |
| 108 | 51 |
| 109 | 53 |
| 110 | 56 |
| 111 | 59 |
| 112 | 62 |
| 113 | 65 |
| 114 | 68 |
| 115 | 71 |
| 116 | 75 |
| 117 | 78 |
| 118 | 82 |
| 119 | 86 |
| 120 | 91 |
| 121 | 95 |
| 122 | 100 |
| 123 | 105 |
| 124 | 110 |
| 125 | 115 |
| 126 | 121 |
| 127 | 127 |

EXPONENTIAL EQUATION - WEIGHT 30

FIG. 9

1400

POSSIBLE POOL VALUE CHOICES:

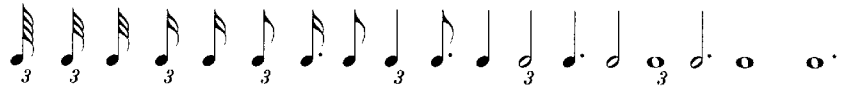

| | | | | | | | | | | | | | | | | | | |
|---|---|---|---|---|---|---|---|---|---|---|---|---|---|---|---|---|---|---|
| POOL BIT MAPPING TABLE: | 1 | 2 | **3** | 4 | **6** | 8 | 9 | **12** | 16 | **18** | 24 | 32 | 36 | **48** | 64 | 72 | 96 | 144 |
| EXAMPLE 18 BIT VALUE: | 0 | 0 | 1 | 0 | 1 | 0 | 0 | 1 | 0 | 1 | 0 | 0 | 0 | 1 | 0 | 0 | 0 | 0 |
| BIT LOCATIONS: | 1 | 2 | 3 | 4 | 5 | 6 | 7 | 8 | 9 | 10 | 11 | 12 | 13 | 14 | 15 | 16 | 17 | 18 |
| ON-BIT INDEXES: | | | 1 | | 2 | | | 3 | | 4 | | | | 5 | | | | |
| POOL SIZE: | 5 | | | | | | | | | | | | | | | | | |

EXPONENTIAL EQUATION - WEIGHT 0 (LINEAR)

1402

| | | | | | | | | | | |
|---|---|---|---|---|---|---|---|---|---|---|
| SELECT BIT REQUEST: | 1 | 2 | 3 | 4 | 5 | 6 | 7 | 8 | 9 | 10 |
| PSEUDO-RANDOM NUMBER (0-127) X-VALUE: | 65 | 22 | 39 | 98 | 116 | 21 | 89 | 28 | 63 | 121 |
| WEIGHTED EQUATION Y-VALUE FROM X: | 65 | 22 | 39 | 98 | 116 | 21 | 89 | 28 | 63 | 121 |
| SCALE Y-VALUE INTO ON-BIT INDEX (1-5): | 3 | 1 | 2 | 4 | 5 | 1 | 4 | 2 | 3 | 5 |
| MAP BITS TO RHYTHM: | 12 | 3 | 6 | 18 | 48 | 3 | 18 | 6 | 12 | 48 |

RESULTING RHYTHM:

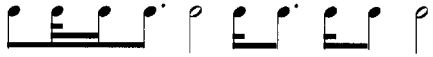

EXPONENTIAL EQUATION - WEIGHT 30

1404

| | | | | | | | | | | |
|---|---|---|---|---|---|---|---|---|---|---|
| SELECT BIT REQUEST: | 1 | 2 | 3 | 4 | 5 | 6 | 7 | 8 | 9 | 10 |
| PSEUDO-RANDOM NUMBER (0-127) X-VALUE: | 65 | 22 | 39 | 98 | 116 | 21 | 89 | 28 | 63 | 121 |
| WEIGHTED EQUATION Y-VALUE FROM X: | 6 | 0 | 1 | 31 | 75 | 0 | 20 | 0 | 5 | 95 |
| SCALE Y-VALUE INTO ON-BIT INDEX (1-5): | 1 | 1 | 1 | 2 | 3 | 1 | 1 | 1 | 1 | 4 |
| MAP BITS TO RHYTHM: | 3 | 3 | 3 | 6 | 12 | 3 | 3 | 3 | 3 | 18 |

RESULTING RHYTHM:

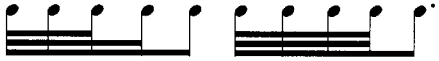

FIG. 14

| STEP | RHYTHM VALUE | TIE FLAG |
|---|---|---|
| 1 | RHYTHM VALUE | TIE FLAG |
| 2 | RHYTHM VALUE | TIE FLAG |
| 3 | RHYTHM VALUE | TIE FLAG |
| 4 | RHYTHM VALUE | TIE FLAG |
| ...N | RHYTHM VALUE | TIE FLAG |

FIG. 15

| STEP | RHYTHM VALUE | TIE FLAG |
|---|---|---|
| 1 | 16TH | |
| 2 | 16TH | X |
| 3 | 16TH | X |
| 4 | 16TH | X |
| 5 | 16TH | |
| 6 | 16TH | X |
| 7 | 16TH | X |
| 8 | 16TH | X |
| 9 | 16TH | |
| 10 | 16TH | X |
| 11 | 16TH | X |
| 12 | 16TH | X |
| 13 | 32ND | |
| 14 | 32ND | X |
| 15 | 32ND | X |
| 16 | 32ND | X |
| 17 | 32ND | X |
| 18 | 32ND | X |
| 19 | 32ND | X |
| 20 | 32ND | X |

FIG. 17

FIG. 16

| BIT | MODE | POLY | ALWAYS |
|---|---|---|---|
| 9 | | | |
| 8 | CRASH | 0 | 0 |
| 7 | HI TOM | 0 | 0 |
| 6 | MID TOM | 0 | 0 |
| 5 | LOW TOM | 0 | 0 |
| 4 | HI-HAT | 1 | 1 |
| 3 | SNARE | 1 | 0 |
| 2 | KICK | 1 | 0 |
| 1 | STICK | 0 | 0 |

FIG. 20

| BIT | DRUM SOUND | | ON-BIT INDEX |
|---|---|---|---|
| 8 | CRASH | 0 | |
| 7 | HI TOM | 0 | |
| 6 | MID TOM | 0 | |
| 5 | LOW TOM | 1 | 3 — POOL SIZE |
| 4 | HI-HAT | 0 | |
| 3 | SNARE | 1 | 2 |
| 2 | KICK | 1 | 1 |
| 1 | NULL | 0 | |
| | DECIMAL | 22 | |

FIG. 19

EXTRACTION AREA

0 ↓ 186

| DELTA | ACCUM_DELTA | EVENT | PITCH | VELOCITY | CONTROL # | VALUE | EVENT GROUPS |
|---|---|---|---|---|---|---|---|
| 0 | 0 | PRG CHANGE | | | | 21 | |
| 0 | 0 | NOTE-ON | 60 | 117 | | | |
| 0 | 0 | CONTROLLER | | | 10 | 0 | 1 |
| 1 | 1 | NOTE-ON | 67 | 127 | | | |
| 3 | 4 | NOTE-ON | 64 | 100 | | | |
| 2 | 6 | NOTE-ON | 71 | 105 | | | |
| 42 | 48 | NOTE-ON | 60 | 0* | | | |
| 0 | 48 | CONTROLLER | | | 10 | 32 | |
| 1 | 49 | NOTE-ON | 67 | 0* | | | 2 |
| 2 | 51 | NOTE-ON | 64 | 0* | | | |
| 2 | 53 | NOTE-ON | 71 | 0* | | | |
| 19 | 72 | NOTE-ON | 62 | 113 | | | 3 |
| 12 | 84 | NOTE-ON | 62 | 0* | | | 4 |
| 12 | 96 | PRG CHANGE | | | | 33 | |
| 0 | 96 | CONTROLLER | | | 10 | 64 | |
| 1 | 97 | NOTE-ON | 72 | 114 | | | 5 |
| 0 | 97 | NOTE-ON | 69 | 102 | | | |
| 1 | 98 | NOTE-ON | 65 | 117 | | | |
| 22 | 120 | NOTE-ON | 72 | 0* | | | |
| 2 | 122 | NOTE-ON | 69 | 0* | | | 6 |
| 3 | 125 | NOTE-ON | 65 | 0* | | | |
| 19 | 144 | CONTROLLER | | | 10 | 96 | 7 |
| 0 | 144 | NOTE-ON | 70 | 115 | | | |
| 12 | 156 | NOTE-ON | 70 | 0* | | | 8 |
| 11 | 167 | NOTE-ON | 67 | 117 | | | 9 |
| 13 | 180 | NOTE-ON | 67 | 0* | | | 10 |

*NOTE-OFF

FIG. 28

| EVENT GROUPS | PITCH | DELTA_ACCUM NOTE-ON | NOTE-OFF | DURATION |
|---|---|---|---|---|
| 1,2 | 60 | 0 | 48 | **48** |
| | 67 | 1 | 49 | 48 |
| | 64 | 4 | 51 | 47 |
| | 71 | 6 | 53 | 47 |
| 3,4 | 62 | 72 | 84 | **12** |
| 5,6 | 72 | 97 | 120 | 23 |
| | 69 | 97 | 122 | 25 |
| | 65 | 98 | 125 | **27** |
| 7,8 | 70 | 144 | 156 | **12** |
| 9,10 | 67 | 167 | 180 | **13** |

DURATION PATTERN

| | | | | | |
|---|---|---|---|---|---|
| QUANTIZED: | 48 | 12 | 24 | 12 | 12 |
| 24 CPQ: | 12 | 3 | 6 | 3 | 3 |

3000

| EVENT GROUPS | PITCH | VELOCITY |
|---|---|---|
| 1 | 60 | 117 |
| | 67 | **127** |
| | 64 | 100 |
| | 71 | 105 |
| 3 | 62 | **113** |
| 5 | 72 | 114 |
| | 69 | 112 |
| | 65 | **117** |
| 7 | 70 | **115** |
| 9 | 67 | **117** |

VELOCITY PATTERN

| | | | | | |
|---|---|---|---|---|---|
| ABSOLUTE: | 127 | 113 | 117 | 115 | 117 |
| MODIFY: | 0 | -14 | -10 | -12 | -10 |

| | | | | | |
|---|---|---|---|---|---|
| | 127 | | | | |
| | 117 | | 117 | | |
| | 100 | | 114 | | |
| | 105 | 113 | 112 | 115 | 117 |
| POOL SIZE: | 4 | 1 | 3 | 1 | 1 |

3002

| EVENT GROUPS | PITCH | DELTA_ ACCUM NOTE-ON | DISTANCE FROM 1ST NOTE-ON IN NEXT EVENT GROUP |
|---|---|---|---|
| 1 | 60 | 0 | **72** |
| | 67 | 1 | 72 |
| | 64 | 4 | 71 |
| | 71 | 6 | 71 |
| 3 | 62 | 72 | **25** |
| 5 | 72 | 97 | **47** |
| | 69 | 97 | 47 |
| | 65 | 98 | 46 |
| 7 | 70 | 144 | **23** |
| 9 | 67 | 167 | **25** |

RHYTHM PATTERN

| | | | | | |
|---|---|---|---|---|---|
| QUANTIZED: | 72 | 24 | 48 | 24 | 24 |
| 24 CPQ: | 18 | 6 | 12 | 6 | 6 |

3004

FIG. 30

| EVENT GROUPS | NOTE-ONS IN GROUP |
|---|---|
| 1 | 4 |
| 3 | 1 |
| 5 | 3 |
| 7 | 1 |
| 9 | 1 |

| CLUSTER PATTERN | 4 | 1 | 3 | 1 | 1 |
|---|---|---|---|---|---|
| BIT 4 | X | | | | |
| BIT 3 | X | | X | | |
| BIT 2 | X | | X | | |
| BIT 1 | X | X | X | X | X |

3100

| EVENT GROUPS | PITCH |
|---|---|
| 1 | **60** |
| | 67 |
| | 64 |
| | **71** |
| 5 | **72** |
| | 69 |
| | **65** |

STRUM PATTERN

| UP | DOWN |
|---|---|

3102

| EVENT GROUPS | PITCH | DISTANCE TO NEXT FIRST | DISTANCE TO NEXT ALL |
|---|---|---|---|
| 1 | **60** | 2 | 7 |
| | 67 | | -3 |
| | 64 | | 7 |
| | 71 | | -9 |
| 3 | **62** | 10 | 10 |
| 5 | **72** | -2 | -3 |
| | 69 | | -4 |
| | 65 | | 5 |
| 7 | **70** | -3 | -3 |
| 9 | **67** | -7 | -7 |

INDEX PATTERN

| | | | | | |
|---|---|---|---|---|---|
| | 2 | 10 | -2 | -3 | -7 |
| SCALED/LIMITED: | 1 | 4 | -1 | -1 | -3 |

| | | | | | |
|---|---|---|---|---|---|
| | 7 | | 5 | | |
| | -3 | | -3 | | |
| | -9 | 10 | -4 | -3 | -7 |
| POOL SIZE: | 3 | 1 | 3 | 1 | 1 |

3104

FIG. 31

| EVENT GROUPS | CONTROLLER | VALUE |
|---|---|---|
| 1 | 10 | 0 |
| 2 | 10 | 32 |
| 5 | 10 | 64 |
| 7 | 10 | 96 |

PAN PATTERN

| | | | |
|---|---|---|---|
| 0 | 32 | 64 | 96 |

3200

| EVENT GROUPS | PROGRAM CHANGE | NOTE-ONS IN GROUP |
|---|---|---|
| 1 | 21 | 4 |
| 3 | | 1 |
| 5 | 33 | 3 |
| 7 | | 1 |
| 9 | | 1 |

VOICE CHANGE PATTERN

| | |
|---|---|
| 21 | 33 |
| 5 | 5 |

3202

| EVENT GROUPS | PITCH |
|---|---|
| 1 | **60** |
| | 67 |
| | 64 |
| | 71 |
| 3 | **62** |
| 5 | 72 |
| | 69 |
| | **65** |
| 7 | **70** |
| 9 | **67** |

DRUM PATTERN

| | | | | |
|---|---|---|---|---|
| 60 | 62 | 65 | 70 | 67 |

| | | | | |
|---|---|---|---|---|
| 60 | | | | |
| 67 | | 72 | | |
| 64 | | 69 | | |
| 71 | 62 | 65 | 70 | 67 |

| POOL SIZE: | | | | | |
|---|---|---|---|---|---|
| | 4 | 1 | 3 | 1 | 1 |

3204

FIG. 32

| | | | | | | | | | | | | | | | | |
|---|---|---|---|---|---|---|---|---|---|---|---|---|---|---|---|---|
| DRUM PATTERN | K | - | K | K | S | - | - | S | K | - | S | S | T1 | T2 | T3 | T3 |
| | 36 | 0 | 36 | 36 | 38 | 0 | 0 | 38 | 36 | 0 | 38 | 38 | 47 | 45 | 43 | 43 |
| PATTERN STEPS: | 1 | 2 | 3 | 4 | 5 | 6 | 7 | 8 | 9 | 10 | 11 | 12 | 13 | 14 | 15 | 16 |

3402

| | | | | | | | | | | | | | | | | |
|---|---|---|---|---|---|---|---|---|---|---|---|---|---|---|---|---|
| DRUM PATTERN | HH | - | HH | HH | HH | - | HH | HH | HH | - | HH | HH | HH | - | HH | HH |
| | 42 | 0 | 42 | 42 | 42 | 0 | 42 | 42 | 42 | 0 | 42 | 42 | 42 | 0 | 42 | 42 |
| PATTERN STEPS: | 1 | 2 | 3 | 4 | 5 | 6 | 7 | 8 | 9 | 10 | 11 | 12 | 13 | 14 | 15 | 16 |

3404

| | | | | | | | | | | | | | | | | |
|---|---|---|---|---|---|---|---|---|---|---|---|---|---|---|---|---|
| CLUSTER PATTERN | 3 | 1 | 2 | 2 | 2 | 1 | 1 | 2 | 2 | 1 | 2 | 2 | 3 | 1 | 2 | 2 |
| PATTERN STEPS: | 1 | 2 | 3 | 4 | 5 | 6 | 7 | 8 | 9 | 10 | 11 | 12 | 13 | 14 | 15 | 16 |

| | | | | | | | | | | | | |
|---|---|---|---|---|---|---|---|---|---|---|---|---|
| CLUSTER PATTERN | 3 | 2 | 2 | 2 | 1 | 2 | 2 | 2 | 2 | 3 | 1 | 2 | 2 |
| PATTERN STEPS: | 1 | 2 | 3 | 4 | 5 | 6 | 7 | 8 | 9 | 10 | 11 | 12 | 13 |

3406

EXTRACTION AREAS

| | DELTA | ACCUM DELTA | EVENT | PITCH | VELOCITY |
|---|---|---|---|---|---|
| 0 | 0 | 0 | **NOTE-ON** | **60** | 117 |
| | 1 | 1 | **NOTE-ON** | **67** | 127 |
| | 3 | 4 | **NOTE-ON** | **64** | 100 |
| | 2 | 6 | **NOTE-ON** | **71** | 105 |
| | 42 | 48 | NOTE-ON | 60 | 0* |
| | 1 | 49 | NOTE-ON | 67 | 0* |
| | 2 | 51 | NOTE-ON | 64 | 0* |
| | 2 | 53 | NOTE-ON | 71 | 0* |
| | 19 | 72 | **NOTE-ON** | **62** | 113 |
| 90 | 12 | 84 | NOTE-ON | 62 | 0* |
| 96 | 13 | 97 | **NOTE-ON** | **72** | 114 |
| | 0 | 97 | **NOTE-ON** | **69** | 102 |
| | 1 | 98 | **NOTE-ON** | **65** | 117 |
| | 22 | 120 | NOTE-ON | 72 | 0* |
| | 2 | 122 | NOTE-ON | 69 | 0* |
| | 3 | 125 | NOTE-ON | 65 | 0* |
| | 19 | 144 | **NOTE-ON** | **70** | 115 |
| | 12 | 156 | NOTE-ON | 70 | 0* |
| | 11 | 167 | **NOTE-ON** | **67** | 117 |
| 186 | 13 | 180 | NOTE-ON | 67 | 0* |

*NOTE-OFF

3700

| | | | | | | |
|---|---|---|---|---|---|---|
| ORIGINAL PITCH: | 40 | 47 | 52 | 56 | 59 | 64 |
| PITCH: | 40 | 47 | 52 | 56 | 59 | 64 |
| VELOCITY: | 117 | 127 | 127 | 107 | 115 | 118 |
| DAL ID: | 1 | 2 | 3 | 4 | 5 | 6 |

| | | | | | | | | |
|---|---|---|---|---|---|---|---|---|
| NOTE SERIES PITCH: | 60 | 64 | 67 | 71 | 72 | 76 | 79 | 83 |
| NOTE SERIES VELOCITY: | 115 | 127 | 112 | 120 | 115 | 127 | 112 | 120 |
| STEPS: | 1 | 2 | 3 | 4 | 5 | 6 | 7 | 8 |

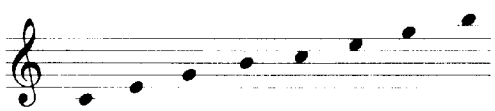

5600

FIG. 56

PHASE 1

| | | | | | | | | |
|---|---|---|---|---|---|---|---|---|
| RHYTHM PATTERN: | 6 | | | | | | | |
| CLUSTER PATTERN: | 1 | | | | | | | |
| VELOCITY PATTERN: | 0 | -20 | | | | | | |
| INDEX PATTERN: | 1 | 1 | 2 | -1 | -1 | | | |
| SPATIAL LOC. PATTERN: | 0 | 32 | 64 | 96 | 127 | 96 | 64 | 32 |

PHASE 2

| | | | | |
|---|---|---|---|---|
| RHYTHM PATTERN: | 12 | 6 | 3 | 3 |
| CLUSTER PATTERN: | 1 | | | |
| VELOCITY PATTERN: | 0 | -10 | -20 | |
| INDEX PATTERN: | 3 | -1 | 2 | -1 |
| SPATIAL LOC. PATTERN: | 0 | 127 | | |

5602

| | | | | | | | | | | | | | | | | | | | | | |
|---|---|---|---|---|---|---|---|---|---|---|---|---|---|---|---|---|---|---|---|---|---|
| RHYTHM EVENTS | 1 | 2 | 3 | 4 | 5 | 6 | 7 | 8 | 9 | 10 | 11 | 12 | 13 | **14** | 15 | 16 | 17 | 18 | 19 | 20 | 21 |
| RHYTHM PATTERN VALUE: | 6 | 6 | 6 | 6 | 6 | 6 | 6 | 6 | 6 | 6 | 6 | 6 | 6 | **12** | 6 | 3 | 3 | 12 | 6 | 3 | 3 |
| INDEX PATTERN VALUE: | | 1 | 1 | 2 | -1 | -1 | 1 | 1 | 2 | -1 | -1 | 1 | 1 | **2** | 3 | -1 | 2 | -1 | 3 | -1 | -2 |
| NOTE SERIES INDEX: | 1 | 2 | 3 | 5 | 4 | 3 | 4 | 5 | 7 | 6 | 5 | 6 | 7 | **8** | 5 | 6 | 4 | 5 | 2 | 3 | 1 |
| RETRIEVED PITCH: | 60 | 64 | 67 | 72 | 71 | 67 | 71 | 72 | 79 | 76 | 72 | 76 | 79 | **83** | 72 | 76 | 71 | 72 | 64 | 67 | 60 |
| VELOCITY PATTERN VALUE: | 0 | -20 | 0 | -20 | 0 | -20 | 0 | -20 | 0 | -20 | 0 | -20 | 0 | **0** | -10 | -20 | 0 | -10 | -20 | 0 | -10 |
| GENERATED VELOCITY: | 115 | 107 | 112 | 95 | 120 | 92 | 120 | 95 | 112 | 107 | 115 | 107 | 112 | **120** | 105 | 107 | 120 | 105 | 107 | 112 | 105 |
| PAN: | 0 | 32 | 64 | 96 | 127 | 96 | 64 | 32 | 0 | 32 | 64 | 96 | 127 | **0** | 127 | 0 | 127 | 0 | 127 | 0 | 127 |

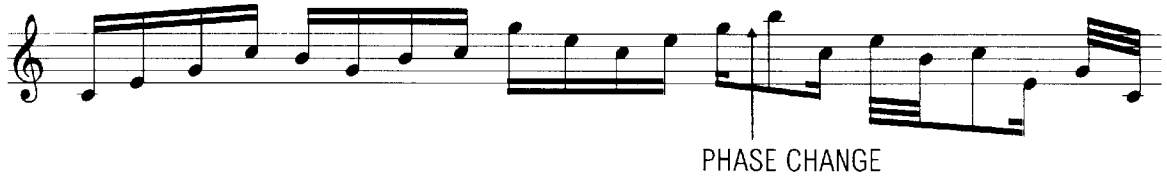

5604

CLUSTER ADVANCE MODE = SINGLE
5900
5902
5904
DRUM PATTERN:
STEP:
RESULTING DRUM NOTES RETRIEVED PER RHYTHM EVENT:
CLUSTER PATTERN:
NOTE SERIES INDEX AT BEGINNING OF CLUSTER:
RHYTHM EVENT:
MEASURE 1
MEASURE 2
MEASURE 3
MEASURE 1:
MEASURE 2:
MEASURE 3:
KICK
SNARE

CLUSTER ADVANCE MODE = CLUSTER
6000
6002
6004
DRUM PATTERN:
STEP:
MEASURE 1
RESULTING DRUM NOTES RETRIEVED PER RHYTHM EVENT:
CLUSTER PATTERN:
NOTE SERIES INDEX AT BEGINNING OF CLUSTER:
RHYTHM EVENT:
MEASURE 2
MEASURE 3
MEASURE 1:
MEASURE 2:
MEASURE 3:
KICK
SNARE

FIG. 65

6500

| | | | | | | | | | | | | | |
|---|---|---|---|---|---|---|---|---|---|---|---|---|---|
| NOTE SERIES PITCH: | 60 | 62 | 64 | 67 | 69 | 71 | 72 | 74 | 76 | 79 | 81 | 83 |
| NOTE SERIES VELOCITY: | 115 | 127 | 112 | 120 | 113 | 111 | 115 | 127 | 112 | 120 | 113 | 111 |
| STEPS: | 1 | 2 | 3 | 4 | 5 | 6 | 7 | 8 | 9 | 10 | 11 | 12 |

6502

PHASE 1

| | | | | | |
|---|---|---|---|---|---|
| PAN PATTERN: | 0 | 32 | 64 | 96 | 127 | 96 | 64 | 32 |
| DURATION PATTERN: | 12 | | | | | | | |
| VELOCITY PATTERN: | 0 | -20 | | | | | | |

6504

| | | | | | | | | | | | | |
|---|---|---|---|---|---|---|---|---|---|---|---|---|
| BUTTONS PLAYED: (NOTE SERIES INDEX) | 1 | | 2 | 3 | 4 | | 7 | 6 | 5 | | 4 | 3 | 2 | | 5 | 7 | 10 | | 11 | 12 |

6506

| | | | | | | | | | | | | | | | | | | | | |
|---|---|---|---|---|---|---|---|---|---|---|---|---|---|---|---|---|---|---|---|---|
| RETRIEVED PITCH: | 60 | | 62 | 64 | 67 | | 72 | 71 | 69 | | 67 | 64 | 62 | | 69 | 72 | 79 | | 81 | 83 |
| VELOCITY PATTERN VALUE: | 0 | | -20 | 0 | -20 | | 0 | -20 | 0 | | -20 | 0 | -20 | | 0 | -20 | 0 | | -20 | 0 |
| MODIFIED VELOCITY: | 115 | | 107 | 112 | 100 | | 115 | 91 | 113 | | 100 | 112 | 107 | | 113 | 95 | 120 | | 93 | 111 |
| PAN: | 0 | | 32 | 64 | 96 | | 127 | 96 | 64 | | 32 | 0 | 32 | | 64 | 96 | 127 | | 96 | 64 |

FIG. 66
6600
| | | | | | | | | | | | | | |
|---|---|---|---|---|---|---|---|---|---|---|---|---|---|
| NOTE SERIES PITCH: | 60 | 62 | 64 | 67 | 69 | 71 | 72 | 74 | 76 | 79 | 81 | 83 |
| NOTE SERIES VELOCITY: | 115 | 127 | 112 | 120 | 113 | 111 | 115 | 127 | 112 | 120 | 113 | 111 |
| STEPS: | 1 | 2 | 3 | 4 | 5 | 6 | 7 | 8 | 9 | 10 | 11 | 12 |
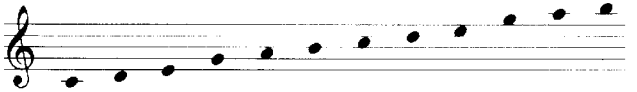
6602
PHASE 1
| | | | | | | | |
|---|---|---|---|---|---|---|---|
| SPATIAL LOC. PATTERN: | 0 | 32 | 64 | 96 | 127 | 96 | 64 | 32 |
6604
| | | | | | | | | | | | | |
|---|---|---|---|---|---|---|---|---|---|---|---|---|
| RESULT OF SCALING | 60 | <-> | 62 | = | 1 | 74 | <-> | 75 | = | 7 |
| PITCH RANGE 60 <-> 84 INTO | 63 | <-> | 64 | = | 2 | 76 | <-> | 77 | = | 8 |
| NOTE SERIES INDEX 1 <-> 12 | 65 | <-> | 66 | = | 3 | 78 | <-> | 79 | = | 9 |
| | 67 | <-> | 68 | = | 4 | 80 | <-> | 81 | = | 10 |
| | 69 | <-> | 70 | = | 5 | 82 | <-> | 83 | = | 11 |
| | 71 | <-> | 73 | = | 6 | 84 | <-> | 84 | = | 12 |
6606
| | | | | | | | | | | | | | |
|---|---|---|---|---|---|---|---|---|---|---|---|---|---|
| PITCHES PLAYED: | 60 | | 63 | 66 | 67 | | 74 | 73 | 72 | | 68 | 65 | 64 | | 70 | 74 | 81 | | 83 | 84 |
| VELOCITIES PLAYED: | 116 | | 120 | 127 | 113 | | 111 | 115 | 107 | | 95 | 99 | 106 | | 125 | 85 | 93 | | 94 | 100 |
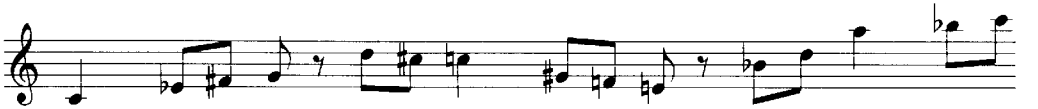
6608
| | | | | | | | | | | | | | | | | | | | | |
|---|---|---|---|---|---|---|---|---|---|---|---|---|---|---|---|---|---|---|---|---|
| NOTE SERIES INDEX: | 0 | | 1 | 2 | 3 | | 6 | 5 | 4 | | 3 | 2 | 1 | | 4 | 6 | 9 | | 10 | 11 |
| RETRIEVED PITCH: | 60 | | 62 | 64 | 67 | | 72 | 71 | 69 | | 67 | 64 | 62 | | 69 | 72 | 79 | | 81 | 83 |
| ACTUAL VELOCITY: | 116 | | 120 | 127 | 113 | | 111 | 115 | 107 | | 95 | 99 | 106 | | 125 | 85 | 93 | | 94 | 100 |
| PAN: | 0 | | 32 | 64 | 96 | | 127 | 96 | 64 | | 32 | 0 | 32 | | 64 | 96 | 127 | | 96 | 64 |
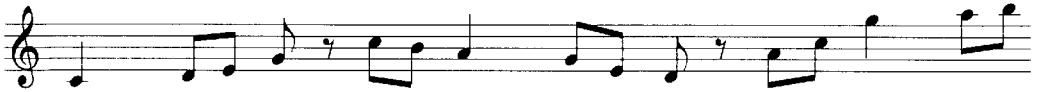

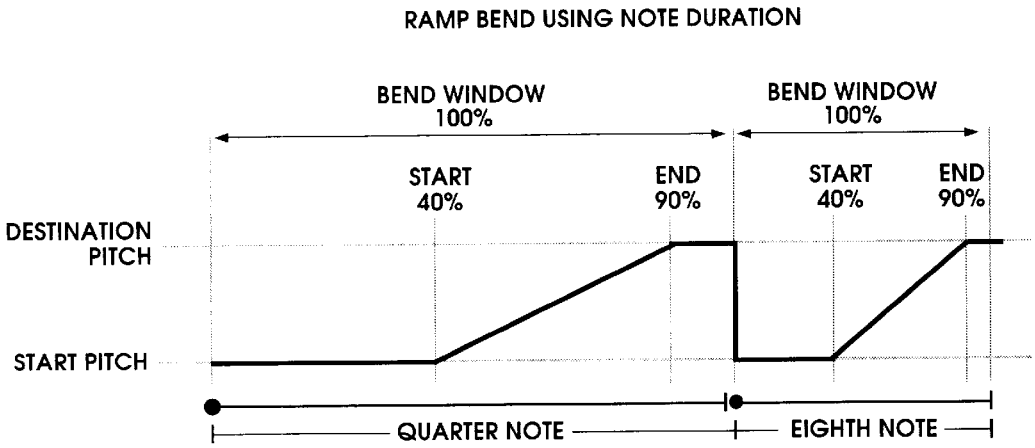
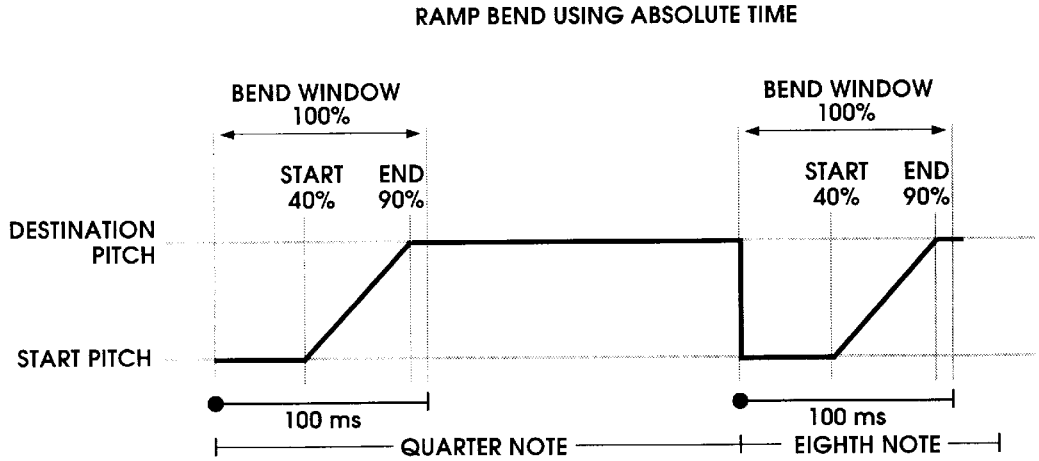
FIG. 69

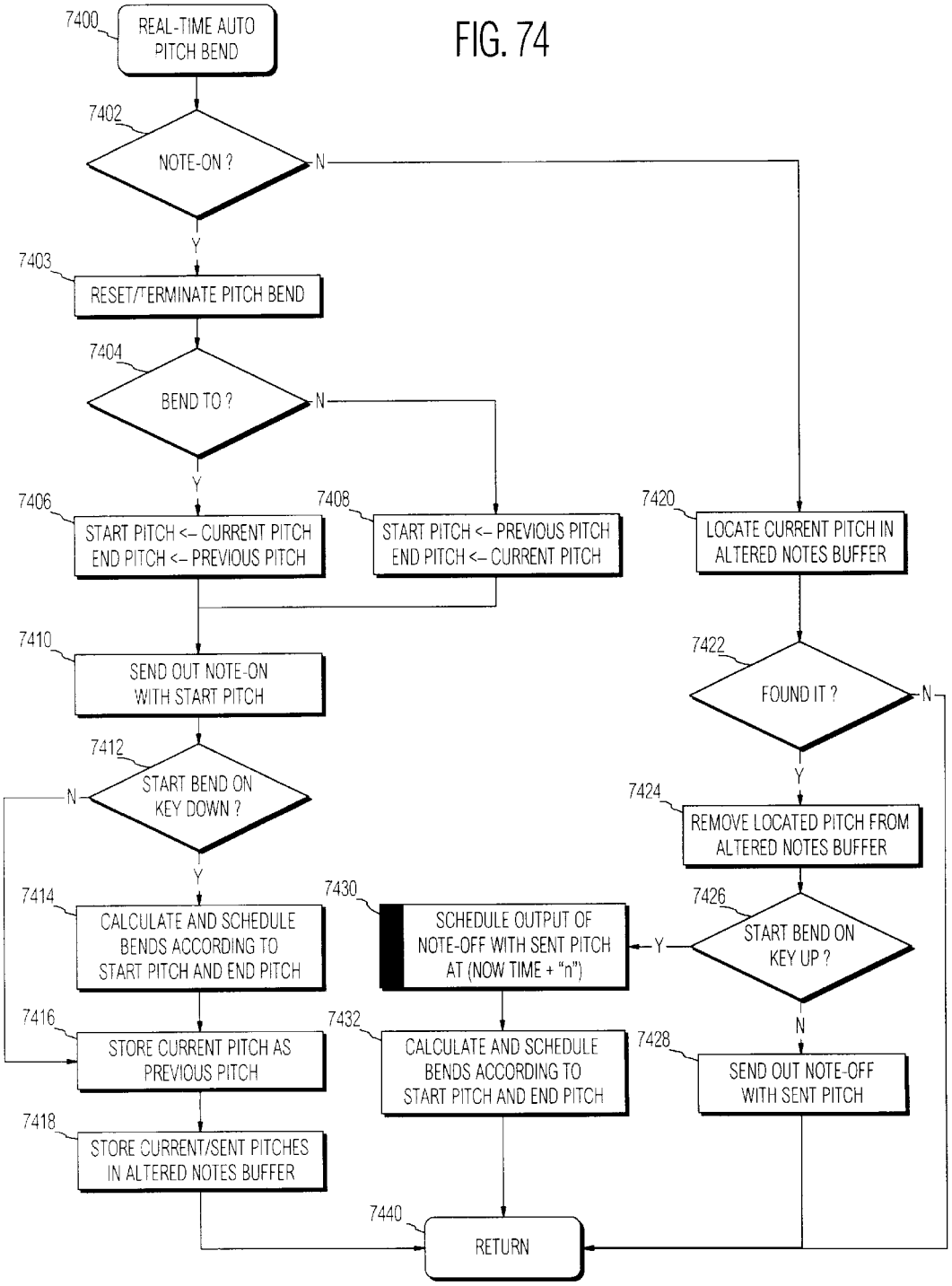
FIG. 74
7400
REAL-TIME AUTO PITCH BEND
7402
NOTE-ON ?
N
Y
7403
RESET/TERMINATE PITCH BEND
7404
BEND TO ?
N
Y
7406
START PITCH <– CURRENT PITCH
END PITCH <– PREVIOUS PITCH
7408
START PITCH <– PREVIOUS PITCH
END PITCH <– CURRENT PITCH
7420
LOCATE CURRENT PITCH IN ALTERED NOTES BUFFER
7410
SEND OUT NOTE-ON WITH START PITCH
7422
FOUND IT ?
N
Y
7412
START BEND ON KEY DOWN ?
N
Y
7424
REMOVE LOCATED PITCH FROM ALTERED NOTES BUFFER
7414
CALCULATE AND SCHEDULE BENDS ACCORDING TO START PITCH AND END PITCH
7430
SCHEDULE OUTPUT OF NOTE-OFF WITH SENT PITCH AT (NOW TIME + "n")
Y
7426
START BEND ON KEY UP ?
N
7416
STORE CURRENT PITCH AS PREVIOUS PITCH
7432
CALCULATE AND SCHEDULE BENDS ACCORDING TO START PITCH AND END PITCH
7428
SEND OUT NOTE-OFF WITH SENT PITCH
7418
STORE CURRENT/SENT PITCHES IN ALTERED NOTES BUFFER
7440
RETURN

METHOD AND APPARATUS FOR GENERATING RANDOM WEIGHTED MUSICAL CHOICES

CROSS-REFERENCES TO RELATED APPLICATIONS

This application claims benefit of U.S. Provisional Patent Application Ser. No. 60/072,919 which was filed on Jan. 28, 1998, the disclosure of which is incorporated by reference herein.

This application relates to Disclosure Document No. 402249, received by the United States Patent and Trademark Office on Jul. 9, 1996, and Disclosure Document No. 414040, received by the United States Patent and Trademark Office on Feb. 13, 1997.

BACKGROUND

Electronic musical instruments that can perform automatic arpeggios are well known, in which data of depressed keys in a keyboard are stored in shift registers, and the tones of the depressed keys are selected one-by-one by scanning the shift registers. However, the means of selecting the order of the tones are generally very simple and produce very repetitive, mechanical sounding musical phrases. Also well known are electronic musical instruments that provide more complicated methods of selecting data from the shift registers, such as basing the choice of data and direction of movement on previously received data. However, the resulting patterns, while more complicated, still sound repetitive and mechanical and are of limited variety.

In U.S. Pat. No. 5,714,705 Kishimoto et. al., an arpeggiator is shown in which key depressions are scanned according to independent rhythm and scanning patterns. This reference also discloses a method whereby key data may be maintained in a buffer in the order entered by the user in a step-time fashion. However, the resulting arpeggios are thereby limited to producing only the notes the user has depressed, or the keys entered in a preentered fashion, thereby limiting the tonal complexity of the resulting arpeggios.

In the Computer Music Journal, Vol. 11, No. 4, Winter 1987, Zicarelli describes software that allows a musical pattern of notes to be played back with independent rhythm, duration, and accent patterns. However, the musical pattern of notes must be constructed in non-real-time, or entered from a keyboard in a cumbersome step-entry fashion. The rhythm, duration and accent pattern steps may contain a contiguous random range corresponding to values in a lookup table. However, no means of mathematically weighting the random choice is provided other than assigning more than one location in the lookup table to the same value. The values within the steps are not independently selectable, and there is no way to repeat a certain random sequence if desired. Furthermore, the rhythmic and tonal patterns resulting from the use of the disclosed randomness are unpredictable and difficult to utilize in a convincing musical fashion.

Electronic musical devices that allow a musical note to be repeated are also well known. However, the rhythmic interval of repetition is typically fixed, and the effect itself is of such simplicity as to rapidly become too familiar. Furthermore, if the repeated tones overlap, each overlap requires an additional voice of the tone module for processing, and problems result whereby the polyphony of the instrument is negatively affected by the number of repeats being generated. U.S. Pat. No. 4,901,616 issued to Matsubara, et al. shows a method for allowing repeated notes to be generated even if the input notes exceed the polyphony of an associated tone module. However, the resulting repeated notes do not have any associated polyphony control scheme. Furthermore, the repeated notes have a fixed rhythm and no pitch modification, resulting in a repeated effect that offers very little further diversity.

Electronic musical devices are also well known, in both hardware and software form, that are capable of recording and playing back a performance from a keyboard or other controller as MIDI data. However, many traditional musical effects such as guitar strumming and harp glissandi are difficult to program in a convincing fashion from a keyboard-type controller.

Electronic musical instruments that allow the user to bend the pitches of a note are also well known. The MIDI Standard provides for the pitch bend message, which is used to bend the pitch of a note or notes while they are being sustained. Many popular keyboards provide a lever or wheel that is used to bend the pitch in this manner. This can be used to imitate various bending techniques utilized by stringed instrument players (e.g. guitarists) and ethnic instrument players (e.g. the bending of a shakuhachi), among others. Furthermore, it can be used to simulate gliding from one pitch to the next. Many of these techniques generally require bending to a previously played pitch, bending to a pitch to be played next by the user, or bending to a precise musical pitch. However, it is traditionally difficult for a musician to perform these bending effects convincingly due to the nature of the pitch bend wheel or other provided lever and the degree of coordination required.

It is an object of the present invention to provide a means whereby musical effects of an exceedingly complex nature and almost infinite variety can be generated, such musical effects having a non-mechanical, non-repetitive nature and being created and varied in real-time.

It is another object of the present invention to provide a means of generating music randomly based on input source material, where the randomness is controlled in a musical fashion, and randomly generated musical sequences are repeatable as desired.

It is another object of the present invention to provide a means by which a non-musical user can trigger musically correct notes and effects during the playback of pre-recorded music.

It is another object of the present invention to provide a method of manipulating MIDI pitch bend data in a fashion that realistically recreates several challenging performance-based nuances of stringed and ethnic instruments, in addition to other useful and novel effects.

It is another object of the present invention to provide a means whereby musical effects traditionally difficult to achieve, such as harp glissandi, guitar strumming, and string-bending effects are made easy to realize by any user.

SUMMARY OF THE INVENTION

The present invention of a general purpose computer-based system for generating information related to music includes a set of available data items, the data items representing a characteristic of the music, at least one step, the step including a subset of the set of available data items, a pool within each step representing a set of at least two selected data items, each data item being independently selectable to appear within the pool, and a random selector for selecting at least one of the data items from the pool for use in generating the musical information.

The method of the present invention of a general purpose computer-implemented method of generating musical information related to music including a processor and an operatively coupled electronic memory, the memory storing at least one step, includes the steps of selecting a subset of data items from a set of available data items, the data items being representative of a characteristic of the music, associating the subset of data items with the step, selecting independently at least two data items from the step, the selected data items comprising a pool, selecting randomly at least one of the data items from the pool, and returning the selected data items to the processor for use in generating the musical information.

Another embodiment of the apparatus for a general purpose computer-based system for generating musical information related to music includes a random selector for controlling a process of generating a sequence of musical information wherein the random selector comprises a pseudo-random number generator, the pseudo-random number generator having a first seed, the seed being used to generate a first sequence of musical information and the first seed being reset so as to repetitively generate the first sequence of musical information.

Another embodiment of the method of the invention of a general purpose computer-implemented method for generating musical information related to music includes the steps of selecting randomly from a first sequence of musical information at least one of a plurality of items representative of a characteristic of the music, the items being selected by a pseudo random number generator seeded with a first seed, generating a first sequence of musical information based on the plurality of items, resetting the pseudo-random number generator to the first seed at a particular point in the musical generation, selecting randomly at least one of a plurality of items representative of a characteristic of the music, and regenerating the first sequence of musical information based on the plurality of items.

Another embodiment of the apparatus for a general purpose computer-based system for generating musical information related to music includes a pattern including of a plurality of sequential steps, each of the steps including at least a rhythm value indicating a time interval of the music and a tie flag, the pattern having a pattern index indicating a current step, a random selector for randomly determining a tie based upon the tie flag of at least one of a next sequential step or the current step, and wherein the current rhythm value is incremented by the rhythm value of the next sequential step and the pattern index is advanced to the next sequential step dependent upon the randomly determined tie and the pattern index is repeatedly advanced and the random determination is repeatedly performed so as to generate a sequence of rhythm values.

Another embodiment of the method of the invention of a general purpose computer-implemented method of generating rhythmic information related to music operating in a musical generation system comprising a pattern having at least two steps, the steps including data representing a rhythm and a tie flag, includes the steps of indicating a current step of a pattern with a pattern index, determining randomly a tie to a next step based upon the tie flag of at least one of the next step and the current step, accumulating the rhythm value of the next step to the rhythm value of the current step depending upon the randomly determined tie, and advancing the pattern index to the next step depending upon the randomly determined tie.

Another embodiment of the apparatus for a general purpose computer-based system for generating musical information related to music, includes an input sequence of musical data stored in the electronic memory, the input sequence of music being divided into beats, the input sequence including data items representing a characteristic of the music, at least one extraction area indicative of a period of musical time spanning predetermined periods of the beats, a pool within the extraction area, the pool including at least one data item, a random selector for selecting at least one of the data items from the pool, and an output sequence of musical data including the selected data items and all other data items not included within the pool.

Another embodiment of the method of the invention of a general purpose computer-implemented method of generating musical information related to music operating in a musical generation system including a processor and an operatively coupled electronic memory, the memory storing at least one step, includes the steps of inputting a sequence of musical data into the electronic memory, the input sequence including data items representing a characteristic of the music, dividing the input sequence of music into beats, creating at least one extraction area indicative of a period of musical time spanning predetermined periods of the beats, selecting at least one of the data items within the extraction area, the selected data items comprising a pool, selecting randomly at least one of the data items from the pool, and outputting a sequence of musical data including the selected data items and all other data items not included within the pool.

Another embodiment of the apparatus for a general purpose computer-based system for generating musical information related to music includes an input sequence of musical data stored in the electronic memory in an electronic musical format comprising musical events, the input sequence of music being divided into a musical time reference, at least one extraction area indicative of a period of musical time spanning predetermined periods of the musical time reference, at least one event group including at least one musical event within the extraction area, the event group being determined by distance between events according to the musical time reference, and at least one pattern comprising at least one step within the pattern, the step including at least one data item representative of a musical characteristic of the input sequence of musical data, the data item being derived from the events, the patterns being stored in the electronic memory for use in generating other musical information.

Another embodiment of the method of the invention of a general purpose computer-implemented method of creating patterns characteristic of musical information includes the steps of inputting a sequence of musical data stored in the electronic memory in an electronic musical format comprising musical events, dividing the sequence of musical data into a musical time reference, creating at least one extraction area indicative of a period of musical time spanning predetermined periods of the musical time reference, grouping the events into event groups within the extraction area, the event group being determined by distance between events according to the musical time reference, deriving from the event groups at least one data item representative of a musical characteristic of the input sequence of musical data, and creating at least one pattern in the electronic memory, the pattern comprised of at least one step including the data items.

Broadly, this method and apparatus concern the collection of musical data from a source, the extraction of patterns from the musical data, the creation of at least one addressable series, the reading out of data from the addressable series, the generation of a repeated effect, and the generation of automatic pitch-bending effects.

Collecting musical data may comprise the step of retrieving a predetermined set of pitches or a set of pitches corresponding to a predetermined chord type, or collecting musical data from a source of MIDI data or other musical data for a predetermined interval of time. Collecting musical data may comprise the step of recording digital audio for a predetermined interval of time, into one or more locations in memory. Collecting musical data may comprise the step of retrieving a predetermined section of MIDI data or other musical data.

Once the musical data has been collected, patterns can be obtained by extracting a plurality of rhythm, pitch, duration, velocity, bend, and/or pan, program, and/or other MIDI controller values from the musical data. Selective derivation of rhythm, index, cluster, strum, drum, duration, velocity, bend, and/or spatial location, voice change, and/or other MIDI controller patterns from one or more of the pluralities of the extracted values may be performed; and/or predetermined or preexisting patterns, which may have been derived from musical data or created independently of musical data may be obtained. These patterns may be of equal or varying lengths.

The addressable series may be a note series derived from the musical data. An initial note series consisting of pitch, pitch and velocity, or pitch and null values can be extracted or derived from the musical data. The initial note series may also contain identifiers of the locations in memory of digital audio data. Next, one or more of the following steps can be performed:

1. constrain selected portions of the initial note series to a predetermined range;
2. remove selected duplicate pitch values;
3. sort selected portions of the initial note series by pitch or velocity;
4. shift selected portions of the initial note series by an interval;
5. replicate selected portions of the initial note series, and shift selected portions of the replicated initial note series by an interval;
6. substitute new data for selected portions of the initial note series, substituting tonal pitches for any atonal pitches or substituting new data according to a conversion table;
7. create an intermediate note series from the initial note series and create a new note series by retrieving selected portions of the intermediate note series by moving through the intermediate note series according to an indexing pattern; and
8. remove selected portions of the note series.

The addressable series may be a drum pattern of one or more notes and one or more null values, or pools of one or more notes or one or more notes and null values. This drum pattern can be derived from the musical data, or can be created independently of the musical data.

The addressable series may be a pointer series created by acquiring the addresses of the pitches, or the pitches and velocities, from a selected portion of MIDI data or other musical data, at selected points in the data.

The individual notes of the note series with or without digital audio data location identifiers, or the individual notes and null values or pools of notes or notes and null values of the drum pattern, or the acquired addresses of pitches or pitches and velocities in the pointer series, are then placed in a plurality of memory locations in a memory.

Having stored data in memory, the contents of the memory locations are read. The read out of the data may be performed using multiple groups of patterns and parameters. A group of patterns and parameters may contain from one to all of the various patterns and parameters used during the read out of the data. The process can switch between groups of patterns and parameters on demand or according to a phase pattern, at a predetermined time, or after reading or processing a quantity of data.

The process of reading the data in the memory may comprise at least one application of one or more of the following steps:

1. reading from one or more memory locations at specific intervals according to a predetermined or extracted rhythm pattern, by counting clock or demand events and moving through the rhythm pattern in response to predetermined counts;
2. reading selected memory locations by reading selected memory locations according to a pattern of memory location addresses, moving through the memory locations according to an indexing pattern, or reading selected memory locations on demand, and performing one or more of the following:
   a. reading one or more memory locations according to a predetermined or extracted cluster pattern, and selectively moving through the memory locations according to the cluster pattern;
   b. reading one or more memory locations by using a pseudo-random number generator to select one or more locations at random, with or without using a weighting method to influence the random selections;
   c. reading one or more additional memory locations according to a replication algorithm; and
   d. reading a plurality of memory locations and issuing or processing the notes, notes and null values, or pitches in an ordered sequence according to a predetermined or extracted strum pattern, where sequential notes, notes and null values, or pitches are separated by predetermined time intervals;
3. selectively modifying or replacing the velocity of the notes according to a predetermined or extracted velocity pattern;
4. selectively constraining the pitch of the notes to a predetermined range;
5. selectively disregarding duplicate pitch values when compared to previous pitch values;
6. selectively shifting the pitch of the note by an interval;
7. selectively substituting a new pitch for the pitch, by substituting tonal values for atonal values, or substituting according to a conversion table;
8. selectively disregarding pitch values;
9. selectively utilizing one or more envelope generators and performing one or more of the following with the output of the envelope generator functions:
   a. modifying or replacing the velocity of the notes as they are produced;
   b. modifying or controlling the tempo of a clock event generator driving the process of the reading out of data; and
   c. outputting pitch bend and/or other MIDI controller values.
10. deriving duration, velocity, bend and/or pan, program, and/or other MIDI controller values from respective predetermined or extracted duration, velocity, bend and/or spatial location, voice change, and/or other MIDI controller patterns, over a predetermined time interval or for a predetermined quantity of notes;

11. using a pseudo-random number generator to derive random values from the patterns, with or without using a weighting method to influence the derived random values;
12. applying independently received actual velocity and/or duration values to the notes;
13. reading one or more notes of the note series, deriving pitch bend, duration, and/or spatial location, voice change, and/or other MIDI controller values from the notes, and selectively scaling the resulting values;
14. switching between groups of patterns and parameters according to a phase pattern;
15. moving through each pattern independently of other patterns, in a predetermined or random order;
16. selectively and independently moving to predetermined points in one or more patterns; and
17. playing back digital audio data corresponding to one or more of the read out memory locations, and performing one or more of the following:
    a. using pitches derived from the read out memory location(s) to transpose the pitch of the digital audio data; and
    b. using velocities derived from the read out memory location(s) to modify the amplitude of the digital audio data.

The process of reading out of data may be independently and selectively started, stopped, paused, resumed, and initialized to starting values on demand. Envelope generators utilized during the process may also be independently and selectively started, stopped, paused, and resumed. The reading out of data may be accompanied by the generation of automatic pitch bending effects.

After the data has been read out, it may be optionally repeated. Alternately or in conjunction, the source data may be repeated, or the collected musical data may be repeated. A group of patterns and parameters may contain from one to all of the various patterns and parameters used during the repetition of the data. The process can switch between groups of patterns and parameters on demand or according to a phase pattern, at a predetermined time, or after repeating or processing a quantity of data.

The process of generating a repeated effect may comprise at least one application of one or more of the following steps:

1. repeating the data at specific intervals according to a predetermined or extracted rhythm pattern, rhythm modifier and rhythm offset;
2. generating additional repeated data at each interval according to a predetermined or extracted cluster pattern, cluster modifier and cluster offset;
3. issuing the repeated data at each interval in an ordered sequence according to a predetermined or extracted strum pattern, where sequential data are separated by predetermined time intervals;
4. transposing the pitches of notes at each repeated interval according to a predetermined or extracted transposition pattern, transposition modifier and transposition offset;
5. locating an input pitch or the closest match to an input pitch in a table of stored musical pitches, and performing one of the following:
    a. moving sequentially forward or backward through the table at each interval and selecting pitches to be generated;
    b. selecting pitches in the table at each interval according to a pattern of table location addresses; or
    c. moving through the table and selecting pitches at each interval according to an index pattern, index modifier and index offset.
6. generating additional data at each interval according to a replication algorithm;
7. selectively modifying or replacing the velocity of the notes at each interval according to a predetermined or extracted velocity pattern, velocity modifier, and velocity offset;
8. selectively constraining the pitch of the notes to a predetermined range;
9. selectively disregarding duplicate pitch values when compared to previous pitch values;
10. selectively substituting a new pitch for the pitch, by substituting tonal values for atonal values, or substituting according to a conversion table;
11. selectively disregarding pitch values;
12. selectively utilizing one or more envelope generators and performing one or more of the following with the output of the envelope generator functions:
    a. modifying or replacing the velocity of the notes as they are produced;
    b. modifying or controlling the tempo of a clock event generator driving the process of the reading out of data; and
    c. outputting pitch bend and/or other MIDI controller values.
13. deriving duration, velocity, and/or pan, program, and/or other MIDI controller values from respective predetermined or extracted duration, velocity, and/or spatial location, voice change, and/or other MIDI controller patterns, over a predetermined time interval or for a predetermined quantity of repetitions;
14. using a pseudo-random number generator to derive random values from the patterns, with or without using a weighting method to influence the derived random values;
15. switching between groups of patterns and parameters according to a phase pattern;
16. moving through each pattern independently of other patterns, in a predetermined or random order;
17. selectively and independently moving to predetermined points in one or more patterns; and
18. playing back digital audio data at each interval, and performing one or more of the following:
    a. using the pitches of the notes at each interval to transpose the pitch of the digital audio data; and
    b. using the velocities of the notes at each interval to modify the amplitude of the digital audio data.

The process of generating a repeated effect may be independently and selectively started and stopped on demand. Envelope generators utilized during the process may also be independently and selectively started, stopped, paused, and resumed. The generation of the repeated effect may be accompanied by the generation of automatic pitch bending effects.

Once the foregoing has been completed, the resultant MIDI (or other format) data can be transmitted, stored, utilized as a guide for the playback of digital audio, or otherwise used. As desired, the foregoing process can be performed one or more times simultaneously and each performance can be done independently of the others.

In addition to the method described above, music can be generated using a hardware rendition of this method. Such an apparatus can be a general-purpose computer programmed to perform the method or dedicated hardware specifically configured to perform the process. Moreover, the method and hardware may be used in a stand-alone fashion or as part of a system.

BRIEF DESCRIPTION OF THE DRAWINGS

FIG. 9 is a table showing the corresponding y-values for an x-value, using an exponential equation with a weight of 30.

FIG. 14 is a diagram showing examples of the select bit request routine in operation.

FIG. 15 is a diagram showing one example of the form for a rhythm pattern with random ties.

FIG. 16 is a diagram showing an example random tie rhythm pattern.

FIGS. 19 and 20 are diagrams showing two different forms for a step of a drum pattern.

FIG. 28 is a diagram showing an example of data from a Standard MIDI File.

FIGS. 30, 31, and 32 are examples of the extraction of patterns from a section of MIDI data.

FIGS. 56 and 57 are examples of the process of FIG. 55.

FIGS. 64, 65 and 66 are examples of the process of FIG. 63.

FIG. 69 is a diagram showing the difference between using the note's duration or a fixed duration as a bend window.

FIG. 74 is a flowchart showing the process of generating an automatic pitch-bending effect according to another embodiment.

DETAILED DESCRIPTION OF THE INVENTION

In the device and method described here, the MIDI standard (Musical Instrument Digital Interface) is utilized to define which note is to be played and the volume (velocity) at which that note is to be played. This allows for both note pitch and note velocity information to be received from keyboards or other controlling devices, and transmitted to devices incorporating tone generation means. The MIDI standard also allows for other types of data to be transmitted to such devices, such as panning information that controls the stereo placement of a note in a left-to-right stereo field, program information that changes which instrument is playing, pitch bend information that controls a bending in pitch of the sound, and others. The MIDI standard also provides a way of storing MIDI data representing an entire song or melody, known as the Standard MIDI File, which provides for multiple streams of MIDI data with timing information for each event.

The MIDI standard is well known and the Complete MIDI Detailed Specification 1.0, including the Standard MIDI Files 1.0 Specification, is incorporated herein by reference. In lieu of the MIDI standard, other standards and conventions could be employed.

Figure 1:
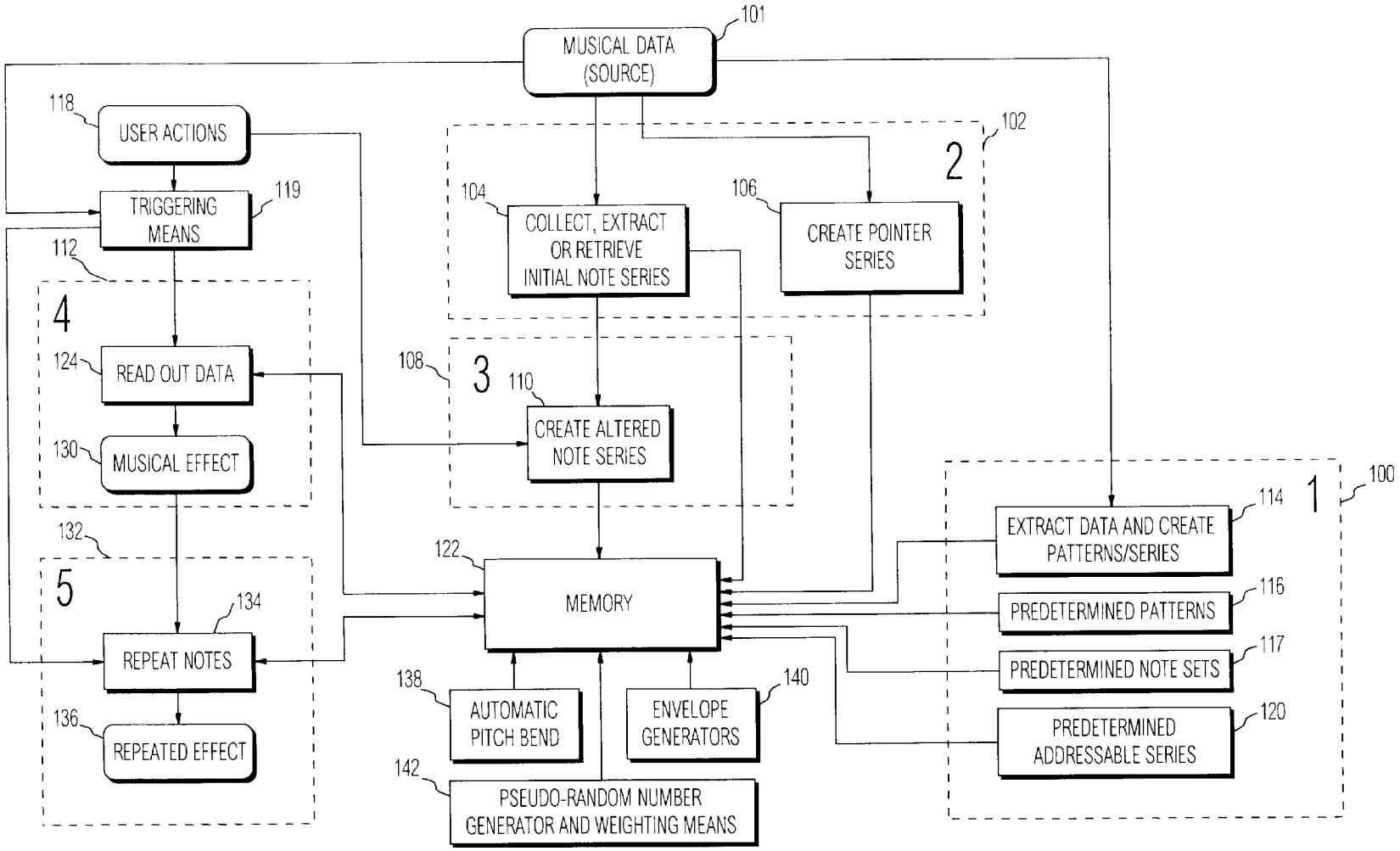
FIG. 1 is a block diagram showing an overview of a method of generating music effects.

The method of generating musical effects can be broadly divided into five steps, as illustrated in FIG. 1: the extraction and/or selection of patterns and/or addressable series, creating an addressable series, altering an initial note series, reading out data, and generating a repeated effect.

(1) Extraction and/or Selection Of Patterns and/or Addressable Series 100

One or more patterns can be obtained by extracting a plurality of rhythm, pitch, duration, velocity, bend, and/or pan, program, and/or other MIDI controller values from a source of MIDI data or other musical data 101; and selectively deriving rhythm, index, cluster, strum, drum, duration, velocity, bend, and/or pan, program, and/or other MIDI controller patterns from one or more of the pluralities of the extracted values 114. These patterns may be stored as predetermined patterns 116. Certain patterns may also be stored as predetermined addressable series 120. Predetermined patterns and addressable series may also be obtained which were not extracted, but created independently and stored in memory 122.

(2) Creation Of An Addressable Series 102

An initial note series consisting of pitch, pitch and null values, pools of pitch or pitch and null values, or pitch and digital audio location identifiers, with or without associated velocity information, is collected or extracted from a source of musical data such as incoming audio data or MIDI data or stored MIDI data 104. The series may equivalently be retrieved from predetermined addressable series 120, retrieved from predetermined note sets 117, and stored in memory 122; or a pointer series consisting of a series of links or pointers pointing to memory addresses of pitch or pitch and velocity information in a source of musical data in memory is created 106, and stored in memory 122.

(3) Creation Of An Altered Note Series 108

The initial note series created in step one can be modified by one or more operations to produce an altered note series 110, either directly from the initial note series 104 and/or as directed by the user 118.

(4) Reading Out Data 112

A musical effect is generated on user demand by reading out the data in the addressable series 124, along with other predetermined data, stored in memory 122. The reading out step is performed according to user actions 118 and various parameters, triggering means 119, envelope generators 140, pseudo-random number generator and weighting means 142, and predetermined patterns 116 or patterns extracted from musical source data 114 that control the timing of the reading out, which locations of the data in memory are read out and in which order, the amount of data being read out, and various other attributes. Automatic pitch-bending effects may be applied to the data as it is read out 138. The resulting data may be sent out or stored as MIDI data, or utilized to control the playback of digital audio data.

(5) Generating A Repeated Effect 132

The resulting data read out in step four, or notes from input source material 101 may be repeated 134, along with other predetermined data stored in memory 122. The repetitions are performed according to user actions 118 and various parameters, triggering means 119, envelope generators 140, pseudo-random number generator and weighting means 142, and predetermined patterns 116 or patterns extracted from musical source data 114 that control the timing of the repetitions, the pitches of the repetitions, the velocity of the repetitions, the number of repetitions, and various other attributes. The resulting data may be sent out or stored as MIDI data, or utilized to control the playback of digital audio data.

Step 1 can be performed independently as desired, in order to supply or supplement the preexisting patterns and addressable series 116 and 120. Steps 2 through 4 can be performed sequentially in real-time, or the results of a plurality of operations of steps 2 and 3 can be stored in multiple memory locations as predetermined addressable series 120, whereupon step 4 can be performed on the predetermined addressable series without performing steps 2 and 3. Furthermore, step 4 can be performed on other types of data stored in memory in general without being restricted to operating on an addressable series. Step 5 can be performed as an additional optional step after the performance of steps 2 through 4, or may be performed independently as desired.

Figure 2:
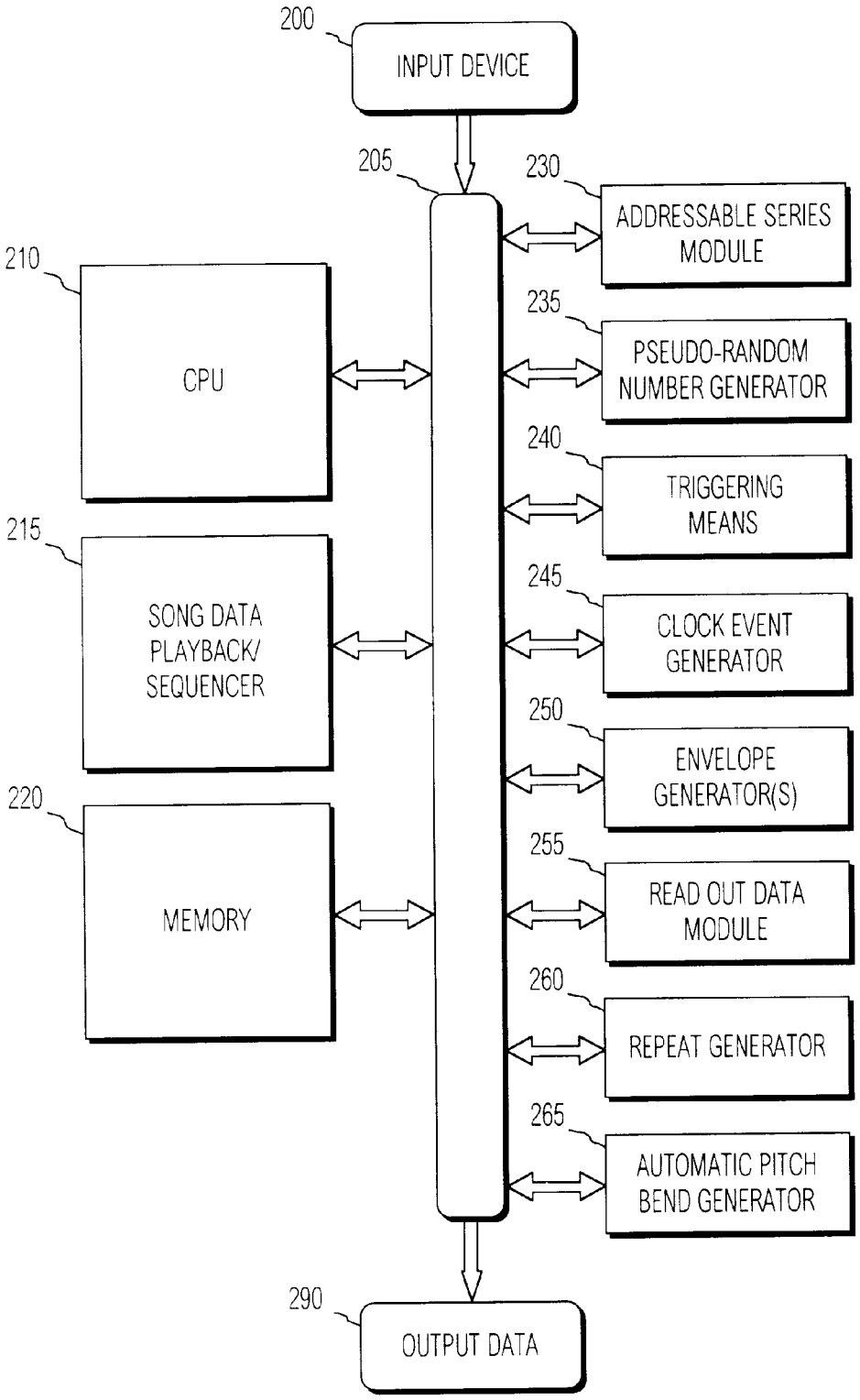
FIG. 2 is a block diagram of a system of generating musical effects.

A system for the generation of musical effects according to a preferred embodiment is shown in FIG. 2. Attached to a buss 205 are a suitable input device such as a keyboard or other controller 200 which provides input notes, input musical source data, control data and other user input utilized by the system.

A CPU 210 of sufficient processing power handles processing. Song data playback means 215 capable of playing and/or recording musical data such as a sequencer is also provided. A memory 220 of sufficient size stores the various predetermined and/or extracted patterns, addressable series, note sets, and other parameters. Also stored in the memory 220 are a current collection of patterns and parameters chosen by the user to be utilized in the processing, song data for the song playback means 215, and the data from which data will be read out, such as an addressable series or note series.

An addressable series module 230 creates addressable series in the memory 220 from musical data received from the input device 200 or song data playback means 215. A pseudo-random number generator 235 allows random pool patterns and their associated weighting methods and parameters in the memory 220 to be utilized. A triggering means 240 allows various actions to control the starting, stopping, and other aspects of the processing. A clock event generator 245 generates timed pulses utilized during the read out of the data, based on a current tempo and base time resolution, such as 24 clocks per quarter. One or more envelope generators 250 may be utilized during the processing. One of the envelope generators may be utilized to control the clock event generator 245, thereby producing clock events that have an irregular nature, such as increasing or decreasing the amount of time between the clock events over a period of time. A read out data module 255 reads data out of the memory 220 according to patterns and other parameters in the memory 220, and events generated by the clock event generator 245, the input device 200, and/or the song data playback means 215. A repeat generator 260 generates repeated effects from the data read out by the read out data module 255, or from input notes from the input device 200 or song data playback means 215. An automatic pitch bend generator 265 generates pitch bend effects under the control of the read out data module 255 or repeat generator 260, or generates pitch bend effects independently using the notes from the input device 200 or the song data playback means 215.

The processing of the system produces output data 290. This may be sent to an external tone generator as MIDI data, for example, or sent to an internal tone generator to produce musical tones, or stored in memory 220 in some form for later use.

The five steps of the process of generating a musical effect shown in FIG. 1 will now be discussed in detail.

(1) EXTRACTION AND/OR SELECTION OF PATTERNS AND/OR ADDRESSABLE SERIES

Patterns are used in the reading out of data, and certain patterns may be utilized as an addressable series, from which other patterns read out data. Therefore, the methods of the invention that pertain to patterns, the use of certain pattern types, and extraction of patterns from preexisting musical data shall be described first.

PATTERNS

A pattern in general is a sequential list of any length consisting of one or more steps. Each pattern may be of any length with relation to any other pattern. Each step consists of a data item or data location. The meaning of the data item or contents of the location is different for each type of pattern. For example, some patterns may represent musical characteristics such as pitch, duration, rhythm, and so on. Other patterns may represent indexes or pointers to memory locations utilized during processing, or indicate other functions of processing or processing instructions, such as a number of times to perform a certain procedure, and so on.

Each pattern is accessed by a pattern index, indicating the next step of the pattern to be used during processing. Each pattern index can be moved independently of any other pattern index. In this example, each time a pattern is accessed, the pattern index moves to the next sequential step in the pattern, whereupon reaching the end the index is moved back to the first step. Other methods of movement such as backwards, forwards/backwards, random, or movement of the index according to an algorithm (e.g. every other or every third index, or forward by two, back by one and so on) may be employed.

The various patterns can be part of a predetermined collection of parameters loaded as a whole by the user, or each type of pattern can be individually selected from pluralities of patterns of the same type stored elsewhere in memory. The data contained in each pattern step may be held in the predetermined pattern steps, or may be independently selected and/or entered and changed in real-time by a user.

Patterns in general may be broadly divided into two different categories: specific value patterns and random pool patterns. A specific value pattern in general is a pattern consisting of one or more steps, with each step in the pattern consisting of one data item, or more than one data item to be used in conjunction with each other (set of data items). Because there is only one predetermined data item or set of data items, the specific values indicated by the data items are utilized as each step of the pattern is selected for use.

A random pool pattern in general is a pattern consisting of one or more steps, with each step in the pattern constituting a pool of one or more data items, from which one or more selections will be made at random. Each step may contain a predetermined number of other locations into which data items may be stored, and a value indicating the number of total items currently stored in the location. Therefore, each step may be considered a pool containing a certain number of actual values indicated by the data items from which to make a random selection. This shall be referred to as the actual values pool method.

Alternately, each step may contain a single value representing a pool of possible data items from which one will be chosen at random. For example, a single "n"-bit number can represent a pool of "n" different items, where the value of 1 for each bit represents the inclusion of the bit in a pool of choices (on-bits). When the step is selected for use, one of the on-bits can be selected at random, and mapped to a table of corresponding data items to use. This shall be referred to as the on-bits pool method.

The data items represented by the steps of the pattern may form a subset of a larger set of available data items. For example, a random pool pattern step may be capable of indicating up to sixteen data items, from a total available set of 128 different data items.

During processing, a pseudo-random number is generated within a certain range using a seed value as a starting point. From this starting point the calculation of a string of apparently random numbers is performed. The starting point may be reset at any time, so that the same string of random numbers may be repeatedly generated. The random number is then modified by one of several weighting methods, which allow the selections to be influenced by favoring certain areas of the range. The resulting value is then scaled as necessary and used to select a data item or bit from the pool contained in the current step of the pattern, after which the resulting value can be used in the generation of musical data.

The weighting methods may be varied in real-time. Therefore, a predetermined pattern that is repeating can be caused to produce radically different results, such as moving gradually from the generation of selections from the larger values of the pool(s) to selections from the smaller values of the pools. For example, in the case of a rhythm, this could produce a rhythm pattern that can be changed from very simple and slow to something very fast and complex, even though the same pattern is being used. The data items and number of data items that the pools refer to can be changed in real-time, and the weighting methods varied in real-time, giving great control over the way that random selections are generated.

PATTERN TYPES

Various types of patterns shall now be described in detail. These pattern types may be constructed according to either of the two previously explained categories. Throughout the following discussion and elsewhere herein, the terms "derived value" or "value derived from a step of a pattern" shall indicate either a data item or set of data items indicated by a step of a specific value pattern, or a value derived by further processing from a data item within a step of a random pool.

A rhythm pattern controls when and how often data will be read out, with each derived value indicating either an absolute time value or a number of clock events between instances of reading out data. An example of derived values from an absolute rhythm pattern may take the form {2000, 1000, 1000} where the values are specified in milliseconds, although other time divisions could be used. This indicates that some data will be read out, then 2000 ms later more data will be read out, then 1000 ms later more data will be read out, and so on. An example of derived values from a clock event rhythm pattern may take the form {12, 6, 6}, where the values indicate a certain musical time interval with relation to a current tempo and base time resolution, such as ticks per beat, or clocks per quarter note (cpq). In this example the values are based on a value of 24 cpq. Other values may be employed for the base time resolution. Here, a count of 24 represents a quarter note, 12 represents an eighth note, 6 represents a sixteenth note, and so on. The clock event rhythm pattern shown in the example {12, 6, 6} indicates an eighth note followed by two sixteenth notes. This indicates that data will be read out, then an 8th note later more data will be read out, then a 16th note later more data will be read out, and so on. Although the clock event rhythm pattern is employed in this example and throughout these explanations, the absolute rhythm pattern could also have been utilized.

An index pattern controls which memory locations data will be read out of in a buffer of sequential data locations numbered 1 to "n," with each derived value indicating either an absolute location, or a distance to travel either forwards or backwards from a starting location. An example of derived values from an absolute index pattern may take the form {1, 5, 3, 4}. This pattern will access the 1st item, then the 5th item, then the 3rd item, then the 4th item before repeating. An example of derived values from a traveling index pattern is {1, 2, −1}. This indicates that given the starting location of 1, after location 1 was accessed, then location 2 (1+1) would be accessed, then location 4 (2+2), then location 3 (4−1), then location 4 (3+1) and so on. Although the traveling index pattern is employed in this example and throughout these explanations, the absolute index pattern could also have been utilized.

A cluster pattern controls how many items of data will be read out, with each derived value indicating a number of items of data to read out. An example of derived values from a cluster pattern may take the form {3, 1, 2}. This indicates that the first instance of reading out data would retrieve three items, the next instance would retrieve one item, the next instance two items, then back to the beginning of the pattern and so on. The cluster pattern can be used in place of the index pattern to move through the data in one of several ways. For example, after reading three sequential items of data, the index at which to next begin reading data is advanced by three items. After reading one item of data the index is advanced by a count of one. After reading two items of data the index is advanced by a count of two and so on. This shall be referred to as a cluster advance mode of "cluster." Alternately, a constant such as 1 can be used to advance the index regardless of the size of the current cluster pattern value and the amount of data read out. This shall be referred to as a cluster advance mode of "single." Furthermore, the cluster pattern can be used to modify the index pattern if using both of them together. In this case, a cluster advance mode of "single" indicates that regardless of where the index is after the end of a cluster due to application of the index pattern, it will be adjusted so that a net advance of only 1 or other such constant has occurred. A cluster advance mode of "cluster" indicates that at the end of the cluster, the index will remain where it is after modification according to the index pattern.

A velocity pattern is used to either modify, replace or select a velocity for a note about to be generated, with each derived value indicating either an absolute velocity value or an amount by which to modify a retrieved or actual velocity value. An example of derived values from an absolute velocity pattern may take the form {127, 110, 100}. This indicates that a first note would be generated with a velocity of 127, the second note with a velocity of 110, the third with a velocity of 100, then back to the beginning of the pattern for the next note. An example of derived values from a modify velocity pattern may take the form {0, −10, −20}. This indicates that the actual velocity of the first note to be generated would have 0 added to it, the next note would have −10 added to its velocity, the third note would have −20 added to its velocity, and so on. The second method preserves the actual velocities with which the notes were stored while allowing a pattern of accents to be applied to them. Although the modify velocity pattern is employed in this example and throughout these explanations, the absolute velocity pattern could also have been utilized.

A duration pattern controls the duration of the generated notes, with each derived value indicating one of the following: an absolute time value, an absolute value in clock events, a time or clock value amount representing an amount to overlap a previous note based on the current rhythm pattern's target value, or a value representing a percentage of the current rhythm pattern's target value. An example of derived values from an absolute time duration pattern may take the form {2000, 500, 1000}, where the values are specified in milliseconds, although other time divisions could be used. This example means the first note would be generated with a duration of 2000 ms, the second note with a duration of 500 ms, the third note 1000 ms, before returning to the beginning of the pattern and so on. An example of derived values from an absolute clock duration pattern may take the form {12, 6, 6}, where the values indicate the number of counts assigned to each note. In this example the values are based on a value of 24 cpq. Other values may be employed for the time base. Here, the first note would be generated with a duration equivalent to an eighth note at the current tempo, the second and third notes with sixteenth note durations, then the 4th note again with an eight note duration and so on. An example of derived values from an overlap time duration pattern may take the form {50, −100}, where the values are specified in milliseconds. With this type of pattern, the values are added to a current rhythm target value (calculated from the current rhythm pattern as described later) to achieve a new value. With these example values, the duration of the first note is lengthened by 50 ms thereby overlapping the next note. For the second note, 100 ms is subtracted, leaving a slight space between the second note and the following note, and so on. An example of derived values from an overlap clock duration pattern may take the form {3, −3}, using clock counts in the same fashion as the overlap time duration pattern. Here, the example would indicate the addition of a 32nd note duration to a rhythm target value for a first note and subtraction of the same amount of time from a rhythm target value for a second note, and so on. Finally, an example of derived values from a percentage duration pattern may take the form {100, 75, 150}, where the values indicate a percentage of the current rhythm target values to be applied (i.e. 100%, 75%, and 150% of the rhythm target value of sequential notes). Although the absolute clock duration pattern method is employed in this example and throughout these explanations, the other methods could also have been utilized.

A spatial location pattern controls the spatial location of a generated note in a stereo field or other multi-dimensional field, with each step containing spatial location data. In this example, MIDI pan values are derived from the spatial location data. This may also be referred to in the following discussions as a pan pattern, with each derived value indicating a position from left to right, with 0 being far left and 127 being far right. Duplicate values in succession may be filtered on output. An example of derived values from a spatial location pattern may take the form {0, 32, 64, 96, 127}, which means that as each note is generated the notes would move from left to right. Although MIDI pan values are employed in this example and throughout these explanations, spatial location data can be comprised of one or more data items. These data items can represent other types of data including data required to move a sound in a multi-dimensional field, or data indicative of a position in a multi-speaker setup such as Dolby Surround Sound or other commercial movie production systems.

A voice change pattern controls the tonal characteristics of the instrument which will be used as the notes are generated, in this example being a pair of derived values representing a MIDI program number and a number of operations to be performed before changing to the next value. The number of operations may be a number of clock events to count, a number of notes to generate, a number of repetitions to perform, or an absolute measure of time. An example of derived values from a voice change pattern may take the form {21 12, 25 6, 28 6}. This indicates that program number 21 is used for 12 sequential notes, program number 25 is used for the next 6 notes, program number 28 is used for the next 6 notes, and so on. Although a number of notes to generate is employed in this example and throughout these explanations, the other methods could also have been utilized. Furthermore, the voice change data may be any other specific data related to changing the instrumental sound of a tone generation module, for example from a trumpet to a violin, or from a guitar to a different type of guitar, and not be restricted to the MIDI Program change message.

An assignable pattern controls any other parameter of a tone generation module. In this example, MIDI controller 17 values are derived, which may be assigned to control a tone module's resonant filter frequency cutoff parameter, with each derived value indicating a position from low to high cutoff, with 0 being low and 127 being high. Duplicate values in succession may be filtered on output. An example of derived values from an assignable pattern may take the form {0, 32, 64, 96, 127}, which would cause notes to change from low cutoff to high cutoff as they are generated. Although MIDI controller values are employed in this example and throughout these explanations, assignable data can refer to any type of data that may be either sent to a tone module via MIDI or that may be used internally to control some aspect of a tone module's sound generation capabilities. Although a single assignable pattern is employed in this example and throughout these explanations, multiple assignable patterns controlling different aspects of a tone module in real-time can also be utilized.

A strum pattern controls the order in which a plurality of notes generated simultaneously will be issued, separated by a predetermined time interval. The notes may be read out during one instance of reading out data, or one repetition of a repeated effect. Each derived value indicates a direction. Here, 0 arbitrarily indicates "up" while 1 indicates "down." Using this arbitrary convention, an example of derived values from a strum pattern may take the form {1, 1, 0, 0}. This indicates that the first two groups of notes will be issued in a downward direction, i.e., with the highest pitched note in the group first and the lowest pitched note in the group last, while the next 2 groups of notes will be issued in an upwards direction, with the lowest pitched note in the group first and the highest pitched note last, and so on. The strum pattern may also include in each step data indicating time interval values paired with the data indicating strum order, so that a time interval value may be derived and used to issue the notes with an individually-set amount of time delay between them. While throughout this discussion a strum pattern consisting only up or down strokes is utilized, there could be other types of strokes included, such as a partial up stroke or partial down stroke, where only portions of the plurality of notes read out or repeated are actually issued. For example, if 6 notes were to be issued, a partial up stroke might only issue the first 3 notes and a partial down stroke might only issue the last 3 notes in a downward direction.

A bend pattern controls an automatic pitch-bending effect applied while notes are being generated, with each derived value indicating either an absolute bend value or an amount in semitones to bend. An example of derived values from an absolute bend pattern may take the form {127, 64, 0}. This indicates a pitch bend from center (64) or the current value to 127, then a bend from center or the current value to 64, then a bend from center or the current value to 0, and so on. Although 7-bit precision values are shown here in the range {0–127}, 14-bit double-precision values may also be employed, in the range {0–16383}. An example of derived values from a semitone bend pattern may take the form {6, −5, 12}, indicating a bend of 6 semitones up, then 5 semitones down, then 12 semitones up, and so on. The derived values may also indicate bending to a next or previously generated pitch, rather than a fixed amount. A derived value may also indicate that no bend is to be performed at that step of the pattern, such as a bend of 0 semitones. Although the semitone bend pattern is employed in this example and throughout these explanations, the absolute bend pattern could also have been utilized. The bend pattern may also include in each step data indicating one or more bend shapes paired with the data indicating bend amount, so that a bend shape may be derived and utilized during the automatic pitch-bending procedure. Alternately or in conjunction, the bend pattern may also include in each step data indicating a number of operations to be performed before generating an automatic pitch-bending effect, such as a number of notes to generate, a number of clock events to have passed, and so on. Alternately or in conjunction, the bend pattern may also include in each step data indicating the overall length of the resulting bend in time.

A drum pattern is a special type of pattern that may be utilized as an addressable series during the reading out of data. It contains pitch or pitch and null values, with or without associated velocity information. A null value is a certain value that has been chosen to represent the absence of a note. Here, the value 0 is used, but other values are possible. An example of derived values from a drum pattern may take the form {36, 0, 0, 0, 38, 0, 0, 38}, where 36 indicates a kick drum sound, 38 indicates a snare drum sound, and 0 indicates a null value (absence of a sound). This type of pattern or addressable series will be referred to throughout this description as a drum pattern, since it is particularly effective for creation of drum effects when used with the reading out methods which will be described later. However, this is an arbitrary designation and this type of pattern can be used in the creation of musical effects for instrument sounds other than drums.

A phase pattern controls the order of switching between groups of patterns and other parameters. A phase is a discrete, self-contained exercise of the method, including all of the parameters and patterns used in the reading out of data or generation of repeated notes. One or more such phases may be utilized and each phase may be unique. In other words, in the case of two or more phases, the second phase could have a different rhythm pattern and/or a different cluster pattern than the first phase, and so on. An example of derived values from a phase pattern may take the form {1, 1, 2} indicating that phase 1 will be run twice in succession, then phase 2's memory locations will be used once, then phase 1 again twice, and so on. Each step of the phase pattern may contain additional data indicating one or more parameters to change and new values to change them to. When the phase is changed, the indicated parameters can be changed to the new values, thereby controlling other portions of the process. The additional data may also indicate that procedure calls are to be made to other portions of the process, or that random seeds are to be reset to stored, repeatable values.

Each of the patterns described may have an associated pattern modifier parameter that is used to further modify the values retrieved from the associated pattern in real-time. For example, the rhythm pattern may have an associated rhythm modifier, which is used to calculate a rhythm target. If the current rhythm pattern derived value is 6 (at an arbitrary resolution of 24 cpq) and the rhythm modifier is 2, then the rhythm target value is (6*2)=12, indicating an 8th note. If the rhythm modifier is 0.5, then the rhythm target value is (6*0.5)=3, indicating a 32nd note. Another example is the velocity pattern, which may have an associated velocity modifier parameter, used to calculate a velocity modification value. For example, if the velocity pattern derived value is −10 and the velocity modifier is 200%, then the velocity modification value is (−10*2.0)=−20. In this manner, the values derived from the steps of the patterns can be compressed, expanded, or further altered. Although the pattern modifiers in these examples use multiplication or percentage to modify the pattern values, division, addition or subtraction could also be used as alternate methods of modification.

As described previously, patterns may represent musical characteristics and processing instructions. Pattern types that may be considered to have data items representing a musical characteristic include rhythm, velocity, duration, spatial location, voice change, bend, assignable, and drum patterns. Patterns that may be considered to have data items representing processing instructions include index, cluster, strum, and phase patterns.

Since any of the pattern types can belong to either the specific value pattern category or the random pool value category, such designation may prefix the pattern names in the following descriptions, indicating patterns constructed according to either category. For example, when discussing a rhythm pattern, a specific value rhythm pattern has steps containing a single specified data item. A random pool rhythm pattern has steps comprised of a pool of actual data items or an "n"-bit number representing a pool of possible data item choices.

Any of the patterns could be modified to include an additional parameter for each step directing that a particular operation be performed a number of times before moving on to the next step.

METHOD FOR GENERATING RANDOM WEIGHTED CHOICES

Figure 3:
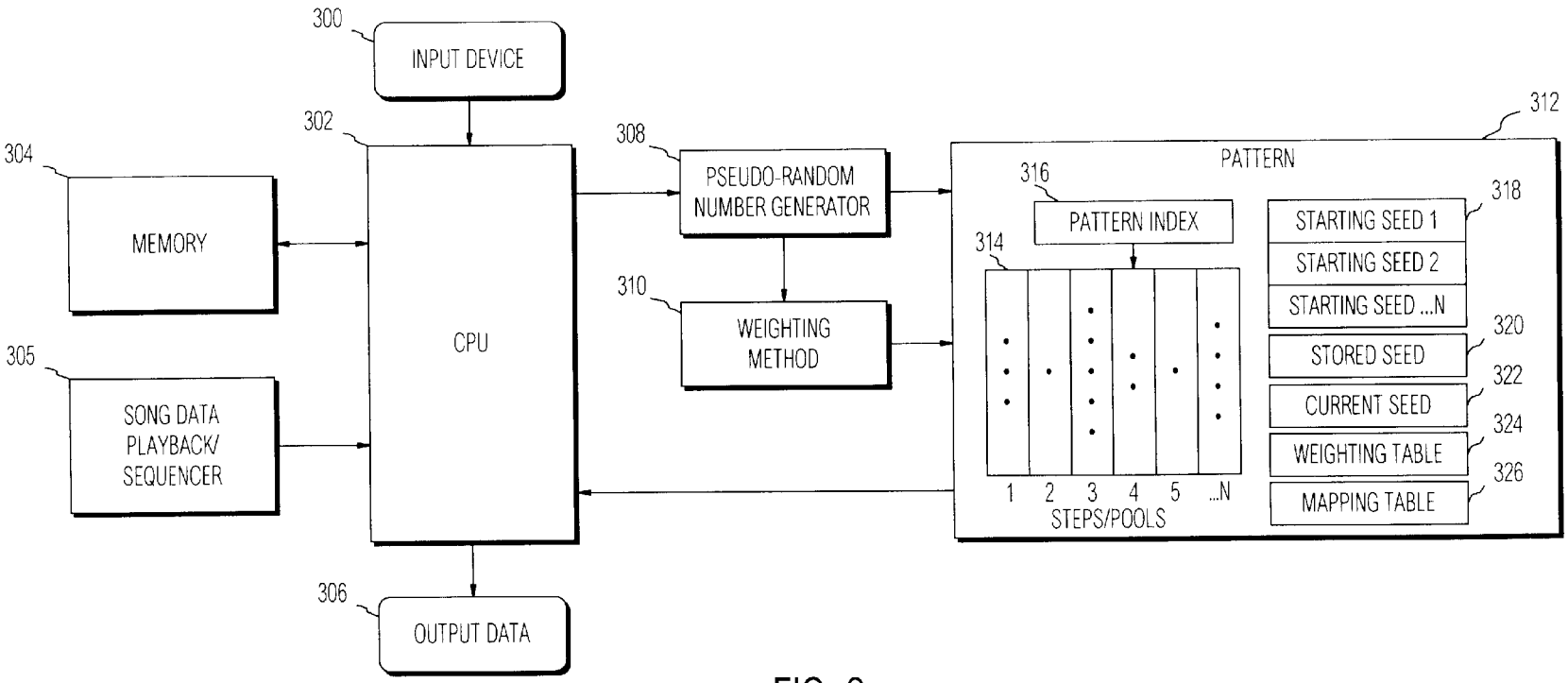
FIG. 3 is a block diagram of one preferred embodiment of a system utilizing random pool patterns.

FIG. 3 is a block diagram of one embodiment of a system utilizing random pool patterns. This may be an integrated part of the system shown in FIG. 2, or a separate system. An input device 300, such as a keyboard or computer keyboard, allows user input to the system. A CPU of sufficient processing power 302 handles processing, using sufficient memory 304. The memory also stores various patterns according to the invention, and other values used during the processing. Song data playback means 305 capable of playing musical data such as a sequencer is also connected to the CPU. The processing of the system produces output data 306. This could be sent to an external tone generator as MIDI data, for example, or sent to an internal tone generator to produce musical tones, or stored in memory in some form for later use.

A random pool pattern is shown 312, being a collection of associated memory locations existing within the memory 304. It contains a number of 1 to "n" data locations 314, each of which shall be referred to as a step. This number can be of any length with relation to any other pattern used during processing. Each step in the pattern constitutes a pool from which one or more selections will be made at random. A pattern has an associated pattern index in memory 316, that indicates which step of the pattern is to be used next during processing. There can be a plurality of independent patterns in use at any given time, although for clarity only one is shown.

During processing by the CPU 302, a pseudo-random number generator is used to generate a random number 308, using a seed value as a starting point. Each pattern may have associated with it a number of pre-selected starting seeds 318, a stored seed 320, and a current seed 322 which shall be explained in detail later.

When a pseudo-random number has been generated, a weighting method 310 associated with each pattern provides a means to modify the random number. Each pattern may have a weighting curve lookup table 324, or the weighting method may calculate values in real-time according to other parameters associated with the pattern. The weighted random number is then used to derive a value from the pool in the step of the pattern indicated by the pattern index 316. The pattern index may then be moved to a new location, indicating a new pattern step to be used next during processing, or several random selections may be made from the current step before changing the pattern index. In the case of the on-bits pool method, each pattern may have an associated pool-bit mapping table 326. The value determined thereby is then passed back to the CPU for use in further processing.

PSEUDO-RANDOM NUMBER GENERATOR

There are well known methods of generating pseudo-random numbers in computer code that involve the use of a seed value as a starting point from which the calculation of a string of apparently random numbers is performed. If the same seed is used as a starting point again, the exact same string of random numbers can be generated. Appendix C contains the C Code used in the present invention to achieve this, which is illustrated in the flowchart of FIG. 5.

Figure 4:
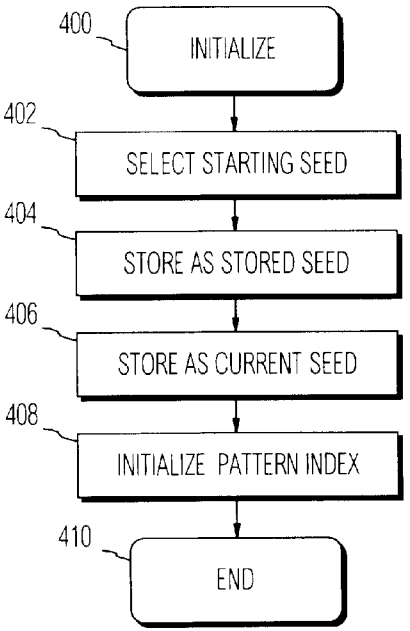
FIG. 4 is a flowchart showing an initialization routine.

Various procedures and routines in general shall be referred to in the following descriptions by a name enclosed with square brackets. FIG. 4 shows the operation of an [Initialize Seeds] routine 400, where a starting seed is selected by one of several methods 402. One or more starting seeds of any value may be associated with each pattern as previously shown in possible sequences of random numbers that can thereby be generated, since the provided starting seeds are fixed. One of the starting values can be selected by a user, or may be predetermined as desired. Alternatively, a starting seed may be chosen by getting a number that is theoretically different each time, such as the current date and time in milliseconds on a computer CPU that is performing the processing, or some other such method, in which case the number of sequences of random numbers possible will be theoretically infinite. Alternately, the user may enter any value within a predetermined range directly in memory through some editing means, where it can be retrieved as a starting seed. By experimentation, the user can thereby accumulate a working knowledge of values that cause preferred results.

Once the starting seed has been selected, it is placed in a memory location associated with the pattern as the stored seed 404. A copy of this value is then placed in another associated memory location as the current seed 406. This value will be modified each time a random number is requested. The pattern index indicating the next step of the pattern to use during processing is set to a predetermined location 408, and the routine is finished 410.

Figure 5:
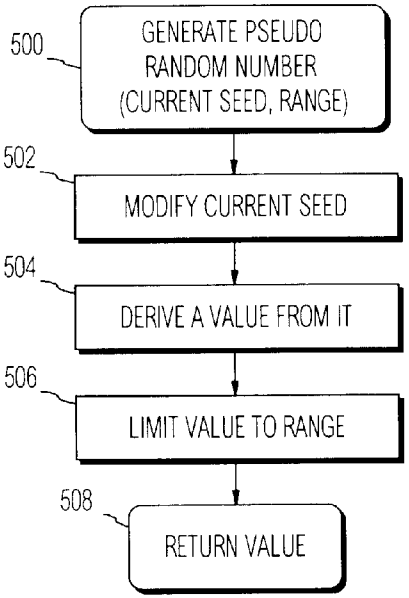
FIG. 5 is a flowchart showing the operation of a pseudo-random number generator routine.

FIG. 5 shows the operation of the [Generate Pseudo-Random Number] routine 500, which illustrates in general form the operation of the computer code in Appendix C. Each time the routine is called, it is passed the address in memory of a current seed to use, and a range within which to generate a result 500. The current seed is mathematically changed to a different value 502, and a temporary value is derived from it 504. The temporary value is then limited to the specified range 506, and the value is returned 508.

Figure 6:
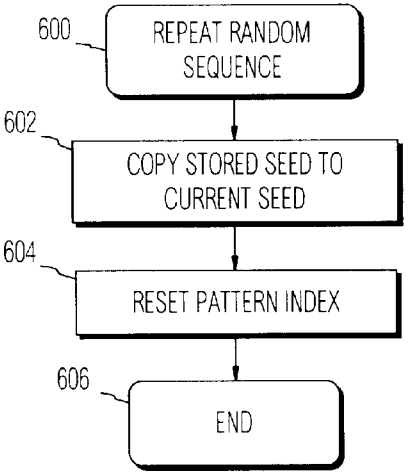
FIG. 6 is a flowchart showing the operation of a repeat random sequence routine.

FIG. 6 shows the operation of the [Repeat Random Sequence] routine 600, which will cause the generation of the same sequence of pseudo-random values. This is done by copying the pattern's associated stored seed to the current seed 602, where it will be passed to the pseudo-random number generator routine next time a random number is requested. Typically, the pattern index indicating the next location to use during processing is reset to the same starting location it was initialized with 604, but this step may be omitted if desired, and the routine is finished 606.

The [Repeat Random Sequence] routine 600 can be called as a result of user actions, such as a user operated control, or a certain number of notes played on an external keyboard. It can also be called over periods of time, such as a number of measures of music having been played, or a number of times through the pattern having been completed, or a number of events from the pattern having been selected, or a number of musical events having been generated by the processing system, or at the beginning of selected sections of processing, and so on. If this routine is never called, the random selections will continue to appear random with no discernible repetition of sequence. The [Initialize Seeds] routine 400 may also be called by the same actions, so as to allow a new starting seed to be chosen at any time.

The pattern steps 314 shown in FIG. 3 may be replaced by a single pool of user choices, with a starting seed, stored seed, and current seed, and remain within the scope of the invention. In this case, the steps in FIGS. 4 and 6 referring to the pattern index may be omitted.

WEIGHTING METHODS

WEIGHTING CURVES

One method of influencing the random selections that will be made from the steps of the random pool patterns during processing uses mathematical curves calculated according to mathematical formula. Curves of this type shall be referred to as a weighting curve. In the present example, the curves consist of (x, y) values from (0–127); this range is arbitrary and other ranges could be used. There are well-known mathematical equations for generating curves of varying shapes. Appendix A and B include the computer C Code used in the present example; other equations may also be used.

Figure 7:
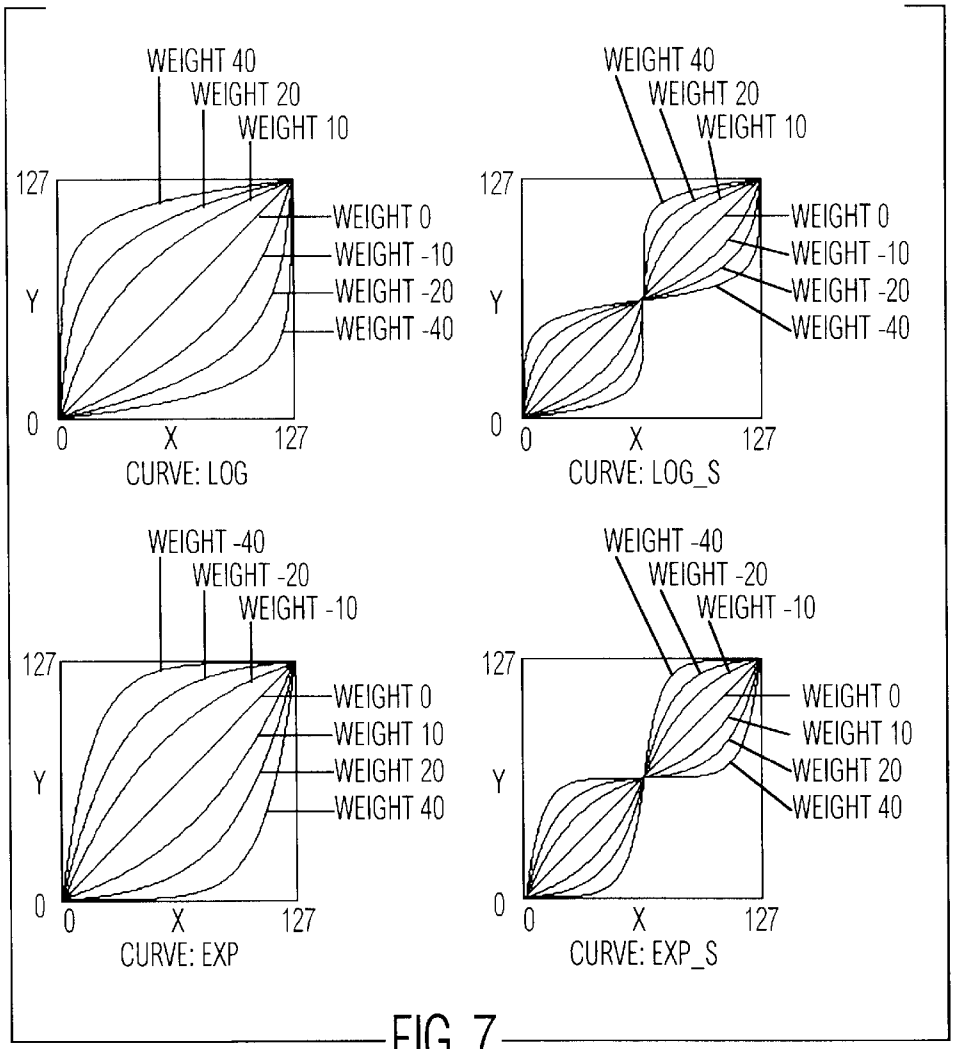
FIG. 7 is a diagram showing 4 different weighting curve types, and curves of different weights for each.

FIG. 7 shows four different types of weighting curves produced by the equations in this example, which consist of logarithmic (log), logarithmic s-curve (log_s), exponential (exp), and exponential s-curve (exp_s). Each equation has a weight value, which changes the shape of the curve. In this example, the weight may be a positive or negative number from {−99 to 99}, controlling the shape of each curve. Shown are examples of 7 different degrees of weighting for each of the 4 curve types as produced by the code in Appendix A and B; a weighting of 0 with any curve type yielding a linear curve (straight line, x=y). Other mathematical equations may be used to produce curves of a different shape than those shown.

The curve may be pre-calculated and stored in memory as a lookup table or array, where the x-value is located in the table and a corresponding y-value is retrieved, or the equation may be performed in real-time, with an x-value producing a corresponding y-value. If stored in memory as a lookup table, a plurality of tables may be stored in ROM. Alternately, the table may reside in RAM, and can be recalculated in real-time if desired, as shall be described shortly.

The step of a random pool pattern may contain either actual values to be chosen from, or may be a single value with the on-bits indicating a number of selections to be chosen from. In the actual pool method, the items in the pool may be stored in a sorted order, such as smallest to largest, or lowest to highest, depending on the intended use of the pattern; in the on-bits pool method, the bit locations may be mapped to values stored in a similar, sorted fashion. The number of items in the pool, or the number of on-bits, shall be referred to as the pool size.

Figure 8:
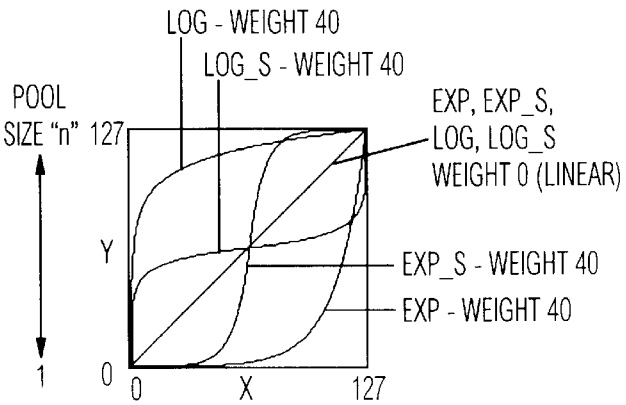
FIG. 8 is a diagram showing the relationship of the weighting curve to the pool size.

FIG. 8 shows the relationship between the four different types of weighting curves in this example (each with a weight of 40), a table of 0 weight (linear), and the pool size (1 to "n" values).

When a value is calculated from the mathematical equation or retrieved from a stored table, a pseudo-random input random number is generated in the range {0–127}, and used as the x-axis value. The equation or the stored weighting curve produces a corresponding y-axis value, also in the range {0–127}, which will be influenced by the shape of the curve. This resulting y-value is then scaled into a range corresponding to the pool size, so that one of the items in the pool may be selected. For example, if the pool size was 5, the resulting y-value would be scaled into a relative number from {1–5}, indicating a location in the pool. Although in the present embodiment the (x, y) values are {0–127}, it can be seen that other ranges of values are possible, since the resulting y-value is always scaled to the current pool size. Furthermore, it is possible to use the pool size itself as the range. For example, using a pool size of 5, a pseudo-random x-value in the range of {1–5} is generated, and an equation or lookup table produces a corresponding y-value in the range of {1–5}, in which case no further scaling is required.

The following table summarizes the effect of the weighting curve on selections from the pools, where items or on-bits in the pools are considered to be arranged from low (1) to high (pool size):

| | |
|---|---|
| Weight of 0 (linear) | |
| any | equal chance of any location in the pool being selected |
| Positive weighting values | |
| log | select higher locations in the pool more often |
| exp | select lower locations in the pool more often |
| log_s | select locations in the middle of the pool more often |
| exp_s | select locations at either end of the pool more often |
| Negative weighting values | |
| log | select lower locations in the pool more often |
| exp | select higher locations in the pool more often |
| log_s | select locations at either end of the pool more often |
| exp_s | select locations in the middle of the pool more often |

FIG. 9 shows the resulting y-values for an x-value of {0–127} produced by an example exponential equation with a weight of 30. As described, this can be stored in memory as a lookup table, or the equation can be used in real-time to produce the same result.

POOL RANGE WEIGHTING

Another method of weighting shall now be described. Rather than using a mathematical formula, a pseudo-random number is generated as previously described, but using the range of the pool size. For example, if the pool contains 5 items, then a random value is generated in the range {1 to 5}, representing the 5 possible selections. The resulting number is then scaled into a smaller section of the overall pool, for example the range {2 to 4}, or the range {1 to 3}. This limits the actual resulting selection to a certain area of the pool.

This could also be accomplished by generating a pseudo-random number in a range less than the number of items in the pool, and optionally adding an offset to the resulting number. For example, if the pool has 5 items, a random number is generated between {1 and 3}, representing 3 possible values. The resulting number may then be used directly to select items from the pool (which would limit selection to the bottom 3 items of the pool), an offset of 1 may be added to the number (which would limit selections to the center 3 items of the pool), or an offset of 2 may be added to the number (which would limit selections to the top 3 items of the pool).

WEIGHTING OF A TWO VALUE CHOICE

Several of the processes to be described make use of a random choice between "0" and "1" indicating a result of one of two possible outcomes (also known as a true/false or yes/no choice). This choice can be weighted by one of several methods. The previously described mathematical curve method can be used, where the pseudo-random number generator may be employed to generate an x-value from {0 to "n"}. A corresponding y-value may then be calculated or retrieved using the weighting curve; if the value is greater than (n/2), it can be considered "1"; if less than or equal to (n/2) it can be considered "0." By changing the weight of the curve, "1" can be made to occur more often or less often than "0." Alternately, the random x-value can be generated, and a threshold within the range moved, effectively creating a step weighting function. For example, if the range of pseudo-random numbers was {1–10}, a total of 10 possible outcomes exist. If the threshold is 3 (representing 30%), a value between 1 and 3 would result in a choice of "0," and a value between 4 and 10 would result in a choice of "1." Therefore, the outcome of a "1" would be 70% more likely than a "0." Other ranges and percentage amounts are also possible.

RANDOM POOL PATTERN USING THE ACTUAL VALUE POOL METHOD

A description of one method of utilizing the pseudo-random number generator and weighting methods previously described shall now be explained. In this embodiment, a pattern consists of one or more steps, with each step of the pattern being a pool containing a certain number of actual data items representing values from which to make one or more random selections. If no items are stored in the pool, a default value associated with the pattern may be used. Alternately, the pattern step may be ignored, or another pattern step selected and processed.

The pool can be of any predetermined size, with each pool containing as many memory locations as there are corresponding selections. The location of items in a pool starts at 1 and goes up to "n," being the number of items in the pool. This location shall be referred to as the pool index, and the number of items in the pool as the pool size. The pool contains at any given time a selection of one or more, or all of the possible selections. For example, a rhythm pool might be capable of holding up to 18 items corresponding to different rhythmic values. A rhythm pattern will have one or more steps with each step constituting a rhythm pool, with each pool containing anywhere from {0–18} values.

The following example will use the weighting curve method previously described when making random selections; the other weighting methods could alternately be used. Also, the weighting curve with the desired weight value has been pre-calculated and stored in a lookup table. The weighting value is retrieved from it during processing.

Figure 10:
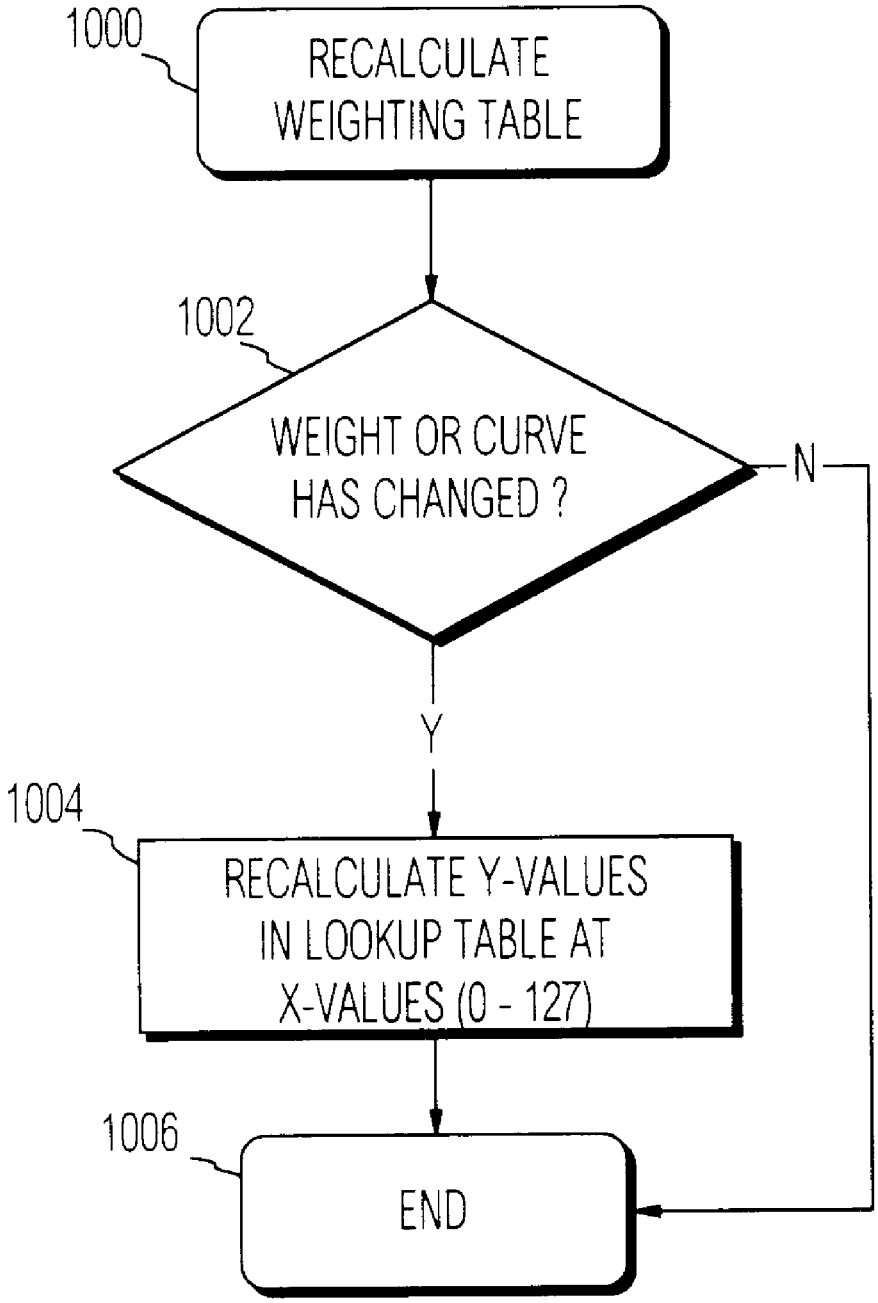
FIG. 10 is a flowchart showing the operation of a recalculate weighting table routine.

In this example, the weighting curve lookup table is stored in RAM and can be changed in real-time so that the weighting table is re-calculated, with the table being immediately updated and used in the processing. This may be achieved by a user operated control or other operation causing a new mathematical curve equation or a new weight to be chosen, as shown in FIG. 10. If the weight or curve has been changed 1002, the y-values in the pattern's corresponding weighting curve lookup table at the x-value locations of {0–127} are recalculated with the new equation or weight 1004.

Figure 11:
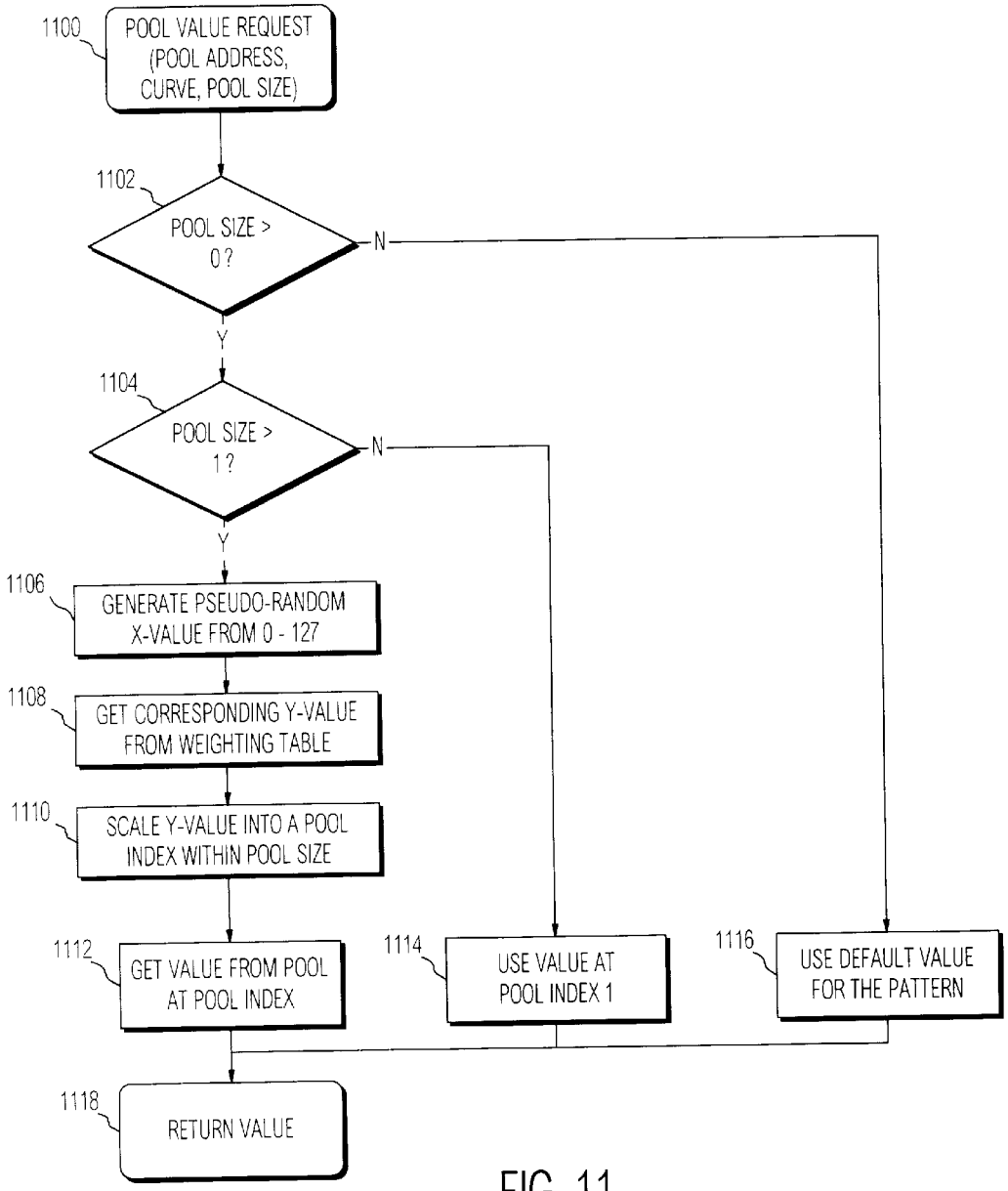
FIG. 11 is a flowchart showing the operation of a pool value request routine.

FIG. 11 is a flowchart explaining the operation of a [Pool Value Request] routine is called, it is passed the address in memory of a pool from the current step of a pattern, the pool size, and a weighting curve lookup table address 1100. Therefore, it can be used to get a value from any pool, regardless of what values are associated, the size of the pool, and so on. For the purposes of the following discussion, the pool that is being operated on shall be referred to as "the pool," and the weighting curve lookup table that is being used as "the weighting table."

If the pool size is not greater than "0" (meaning it is empty) 1102, processing goes to 1116, where the default value for the pattern is returned 1118 and the routine is finished. If the pool size is greater than "0" 1102, it is then checked if the pool size is greater than "1" 1104. If not, (meaning there is only a single item in the pool at index 1), the value at the pool index 1 is returned 1114. If the pool size is greater than "1" 1104, a random selection is to be made from the pool.

A pseudo-random number in the range {0–127} is generated 1106, using the previously described [Pseudo-Random Number Generator] routine and the pattern's current seed; this value becomes a temporary x-value to be looked up in the weighting table. The y-value of the weighting table corresponding to the x-location is then retrieved 1108. The y-value is then scaled from a number in the range {0–127} into a relative number in the range {1–pool size} 1110, so it can now be used as a pool index 1112, where the value of the pool at the indicated location is returned 1118.

Figure 12:
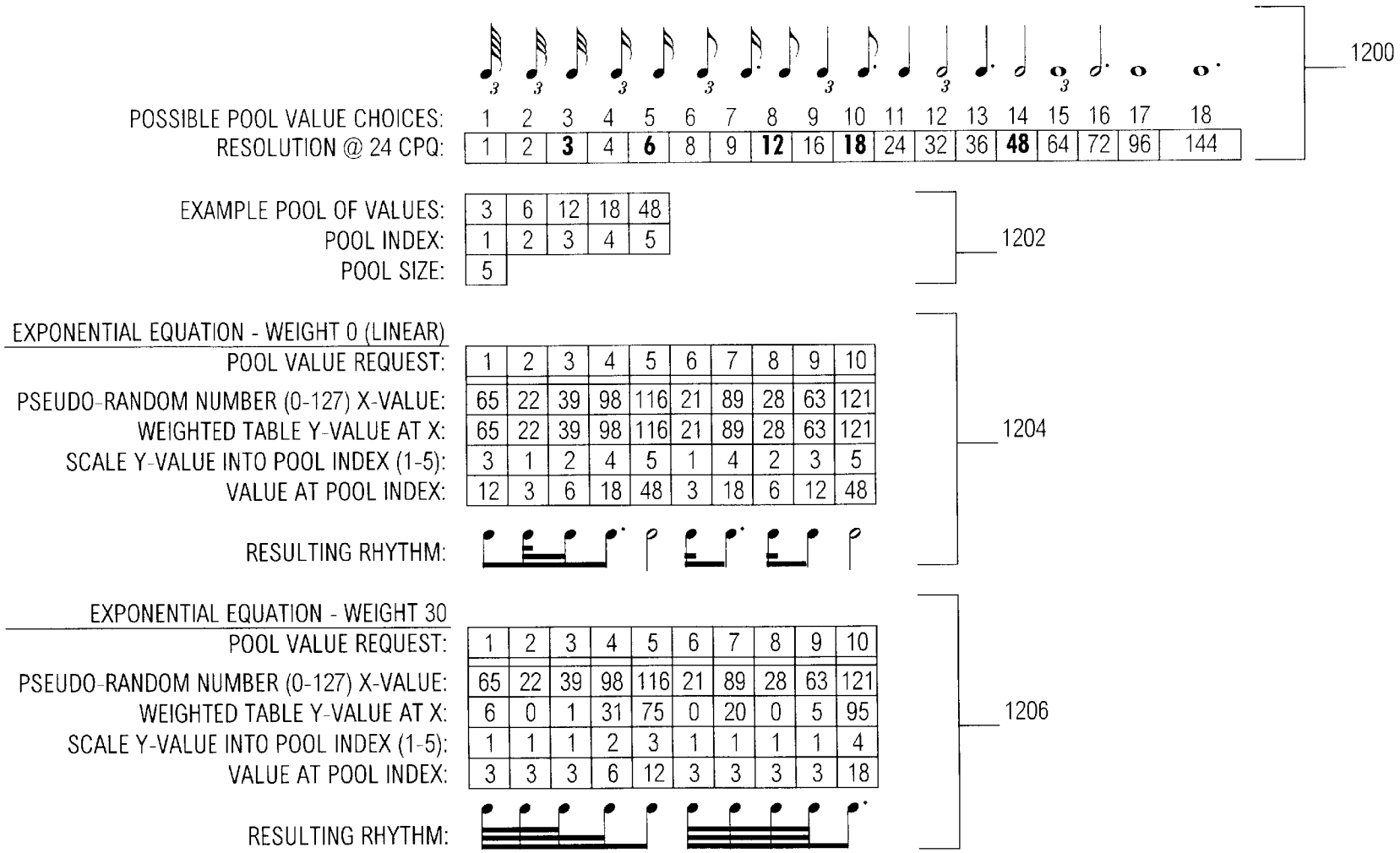
FIG. 12 is a diagram showing examples of the pool value request routine in operation.

FIG. 12 shows an example of the previously described method choosing values at random from a pool. 18 different rhythmic values have been arbitrarily chosen from all available rhythm values to form the total possible number of selections in a rhythm pattern pool 1200. These values are shown corresponding to a resolution of 24 cpq (clocks per quarter note) used in the present example; other resolutions are possible. The numbers in bold type represent 5 data items that have been designated to comprise the pool for this example, either by selection by the user, or by the current step of a predetermined random pool pattern as previously described. The actual values comprising the pool 1202 are shown in an ascending order from shortest to longest although other arrangements are possible. The pool index (location) of each pool item is also shown, along with the pool size (number of items in the pool).

The [Pool Value Request] routine is shown in operation 1204, with a weighting curve lookup table in memory that was calculated with an exponential equation of 0 weight (linear, y=x). At pool value request 1, a pseudo-random number is generated in the range {0–127}, becoming an x-value of 65. Since the table is linear, the y-value in the table at {x=65} is also 65. The y-value is then scaled into a pool index in the range 1 to pool size {1–5}, yielding a pool index of 3. The rhythm pool value at pool index 3 is 12. Therefore an 8th note rhythm has been chosen. At pool request 2, the random x-value is 22, the y-value in the weighting table is also 22. Scaling into {1–5} yields a pool index of 1. The value at index 1 of the pool is 3, and a 32nd note rhythm is chosen. Processing continues in a like fashion and the resulting rhythmic selections are shown in musical notation.

1206 shows the exact same sequence of random numbers, except now the weighting curve lookup table was calculated with an exponential equation having a weight of 30, as previously described in FIG. 9. At request 1, the random x-value 65 is generated; the y-value in the weighting table at {x=65} is 6. Scaling the y-value into a pool index of {1–5} yields 1. The value at index 1 of the pool is 3, and a 32nd note rhythm is chosen. At request 2, the random x-value 22 is generated. The y-value in the weighting table at {x=22} is 0. Scaling this number into a pool index again results in 1. The value at index 1 of the pool is 3, and a 32nd note rhythm is again chosen. Processing continues in a like fashion, with the resulting rhythmic selections shown in musical notation. As can be seen, using the weighting curve table with a different weight on the selections from the pool has resulted in selections from the lower indexes of the pool more often than the higher indexes.

If the value of the current seed associated with the pattern was stored in the stored seed directly before pool request 1, after pool request 10 it could be reset using the procedure of FIG. 6, and the exact same sequence of randomly weighted selections could be repeated. Alternately, the seed does not need to be reset and the random sequence can continue, with different values being generated.

RANDOM POOL PATTERN USING THE ON-BIT POOL METHOD

A description of a second method of utilizing the pseudo-random number generator and weighting methods previously described shall now be explained. In this embodiment, a pattern consists of one or more steps, with each step containing a single value representing a pool of possible values from which one will be chosen at random. For example, a single "n"-bit number can represent a pool of "n" different items, where the value of 1 for each bit represents the inclusion of the bit in a pool of selections (on-bits). When the step is selected for use, one or more of the on-bits can be selected at random, and mapped to a table of corresponding data items to use. If no bits are on, a default value associated with the pattern may be used, or the pattern location may be ignored.

The value can contain any number of bits that can be mapped to a corresponding number of data items to use. The location of bits in the value starts at 1 and goes up to "n," being the total number of bits to be used. The pool therefore consists at any time of a number of bits that have been set to the on position, which can be none, or from one up to the total number of bits. For example, a rhythm on-bits pool might be an 18-bit number, with each bit corresponding to a data item representing one of 18 different rhythmic values from within a possibly larger set of available rhythm data items. A rhythm on-bits pattern will have one or more steps with each step constituting a rhythm on-bits pool, with each pool containing anywhere from {0–18} bits set in the on position. An example rhythm on-bits pool may take the form {000000000000100101}, where the first, third and sixth bits are turned on (from right to left). The total number of bits set to the on position shall be referred to as the pool size, and the on-bit index shall refer to the locations of the individual on-bits within the on-bits pool. Therefore, in this example the pool size is 3. The on-bit index of bit one is 1 (first on-bit), the on-bit index of bit three is 2 (second on-bit), and the on-bit index of bit six is 3 (third on-bit).

The following example will use the weighting curve method previously described when making random selections. The other weighting methods could alternately be used. The weighting curve value shall be calculated in real-time from a mathematical equation, rather than retrieved from a lookup table.

Figure 13:
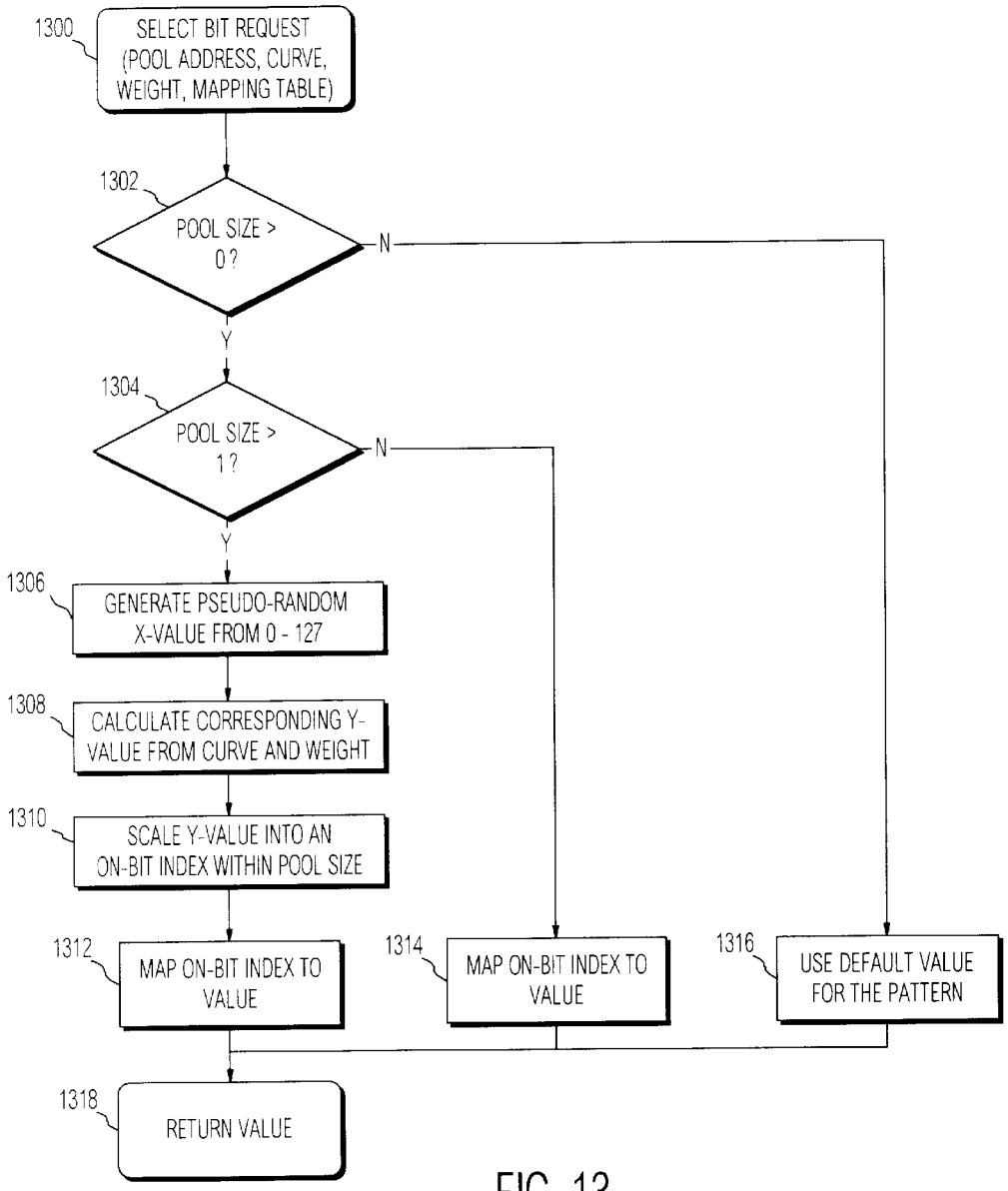
FIG. 13 is a flowchart showing the operation of a select bit request routine.

FIG. 13 is a flowchart explaining the operation of a [Select Bit Request] routine. When this routine is called, it is passed the address in memory of a pool from the current step of a pattern, a weighting curve, a weight, and an associated pool-bit mapping table 1300. Therefore, it can be used to select a bit and return a data item or value associated with a data item from any pool, regardless of what values are associated, the size of the pool, and so on. For the purposes of the following discussion, the pool that is being operated on shall be referred to as "the pool." The curve value is an identifier indicating one of several possible mathematical equations to be used, and the weight value influences the shape of the curve as has been previously described. The mapping table indicates what data items the bits refer to; for example, the different rhythmic values previously described.

If the pool size is not greater than "0" (meaning there are no on-bits) 1302, processing steps to 1316, where the default value for the pattern is returned 1318 and the routine is finished. If the pool size is greater than "0" 1302, it is then checked if the pool size is greater than "1" 1304. If not, (meaning there is only a single on-bit in the pool), the on-bit index of the single on-bit is used to return a corresponding data item from the mapping table 1314. If the pool size is greater than "1" 1304, a random selection is to be made from the pool.

A pseudo-random number in the range {0–127} is generated 1306, using the previously described [Pseudo-Random Number Generator] routine and the pattern's current seed; this value becomes a temporary x-value, which is then use to calculate a y-value, using the specified curve and weight 1308. The y-value is then scaled from a number in the range {0–127} into a relative number in the range {1–pool size} 1310, so it can now be used as an on-bit index 1312, and a corresponding data item from the mapping table is returned 1318.

FIG. 14 shows an example of the previously described method choosing data items at random from a pool. 18 different rhythmic values have been arbitrarily chosen from all available rhythm values to form the total possible number of selections in a rhythm pattern pool 1400. The pool-bit mapping table is shown, where the rhythmic selections correspond to a resolution of 24 cpq used in the present example; other resolutions are possible. An example 18-bit value is shown, with one bit location for each of the 18 possible rhythmic selections. In this example, the bit locations are shown from left to right for clarity, although typically they proceed from right to left. Five of the bits are shown in the on position, along with their corresponding on-bit index from 1 to 5; the pool size is therefore 5. The corresponding values of the mapping table data items for the five on-bits are shown in bold type.

The [Select Bit Request] routine is shown in operation 1402, using an exponential equation with a weight of 0 (linear, y=x). At select bit request 1, a pseudo-random number is generated in the range {0–127}, becoming an x-value of 65. Since the equation is linear, the resulting y-value is also 65. The y-value is then scaled into an on-bit index in the range 1 to pool size {1–5}, yielding an on-bit index of 3. The mapping table value at on-bit index 3 is 12. Therefore an 8th note rhythm has been chosen. At select bit request 2, the random x-value is 22, the corresponding y-value is also 22. Scaling into {1–5} yields an on-bit index of 1. The mapping value at index 1 of the pool is 3, and a 32nd note rhythm is chosen. Processing continues in a like fashion and the resulting rhythmic selections are shown in musical notation.

FIG. 1404 shows the exact same sequence of random numbers, except now the exponential equation uses a weight of 30, as previously described in FIG. 9. At request 1, the random x-value 65 is generated. The corresponding y-value calculated is 6. Scaling the y-value into a on-bit index yields 1. The mapping value at index 1 of the pool is 3, and a 32nd note rhythm is chosen. Processing continues in a like fashion, with the resulting rhythmic selections shown in musical notation.

As can be seen by comparing. FIG. 12 and FIG. 14, the actual values pool method and the on-bits pool method can produce identical results. While this discussion so far has employed the actual pool method and the on-bits pool method separately, it is possible to combine the two methods. In this case, the pool would always store the complete "n" actual data items, and a corresponding bit or flag would indicate an item's inclusion into a pool of selections. In this case the pool size would be indicated by the number of bits or flags turned on. Random selections would then be made from the indicated items as previously described.

For clarity, the previous examples show the use of only a single non-changing pool from which values are chosen at random, however, as previously described a random pool pattern may have a different pool of values at every step. With each performance of the routines, the pool itself may change as the next step of the pattern is utilized, before the random selections are made.

Although this description shows the use of rhythmic values and data items, any type of musical data can form a pool, such as a pool of velocity values, a pool of pan values, a pool of cluster values indicating a number of notes to be generated, a pool of digital audio data or digital audio data memory location addresses, and so on.

RANDOM TIE RHYTHM PATTERN

While a random pool rhythm pattern constructed according to the methods previously described may generate random rhythms in a musical, controlled fashion, it is best described as being syncopated. If rhythmic values are chosen randomly, it is difficult to determine with any degree of certainty where a note will fall in any given area of a beat, measure, or other musical time designation. A further embodiment shall now be described, providing the advantage of controlling random rhythms within certain predetermined areas of a musical time frame with a greater degree of control.

A tie is a musical term indicating that two or more rhythmic values are to be added together to become a single rhythmic event occupying the space of the sum total. A random tie rhythm pattern has two or more steps, each step containing at least data indicating a rhythmic value, and a location that can be set to indicate a potential tie to a next or previous step. In this example, the tie flag (when set) will indicate a potential tie to a previous step. FIG. 15 shows an example of one basic form of the pattern, which has from 1 to "n" steps. It should be noted that the rhythm value indicated could also be a pool of rhythm values or an "n"-bit rhythm pool value as described in earlier examples.

As explained in previous examples, a current index is associated with the pattern indicating the next step to be used in processing. During processing, when a musical event is desired to be generated, the current step of the rhythm pattern is accessed. If the next step of the rhythm pattern does not have a tie flag set to "yes," then the value derived from the current step's rhythm value is used as is to determine the rhythmic duration of the event. However, if the next step of the pattern has a tie flag set to "yes," then a random choice is made as to whether to tie or not. If a tie is chosen, the value derived from the next step's rhythm value is added to the current step, and the test is made again on the next step of the rhythm pattern. This process continues until either no more tie flags indicate potential ties, or the random choice indicates no tie. At this point, the pattern will have advanced by the number of ties that occurred, and the rhythm value to be used will have accumulated the additional values, thereby creating a rhythm value with a longer duration.

An example random tie rhythm pattern consisting of 20 steps is shown in FIG. 16. Steps in which the tie flag is set to "yes" are indicated with "X." As each step of this pattern is used sequentially during processing, steps 1, 5, 9, and 13 will always cause a new rhythm value to be derived (since the tie flags in those steps are set to "no"). The settings of the tie flags in between will allow ties between some of the steps to be randomly selected, so that rhythmic durations longer than those contained in the pattern are realized, by accumulating the values of some of the steps. In this manner, the pattern indicates an absolute amount of rhythmic time that will be covered by an indefinite number of rhythmic events. In other words, the sum total of all rhythmic events generated from the pattern will equal the total time of all steps in the pattern.

Figure 17:
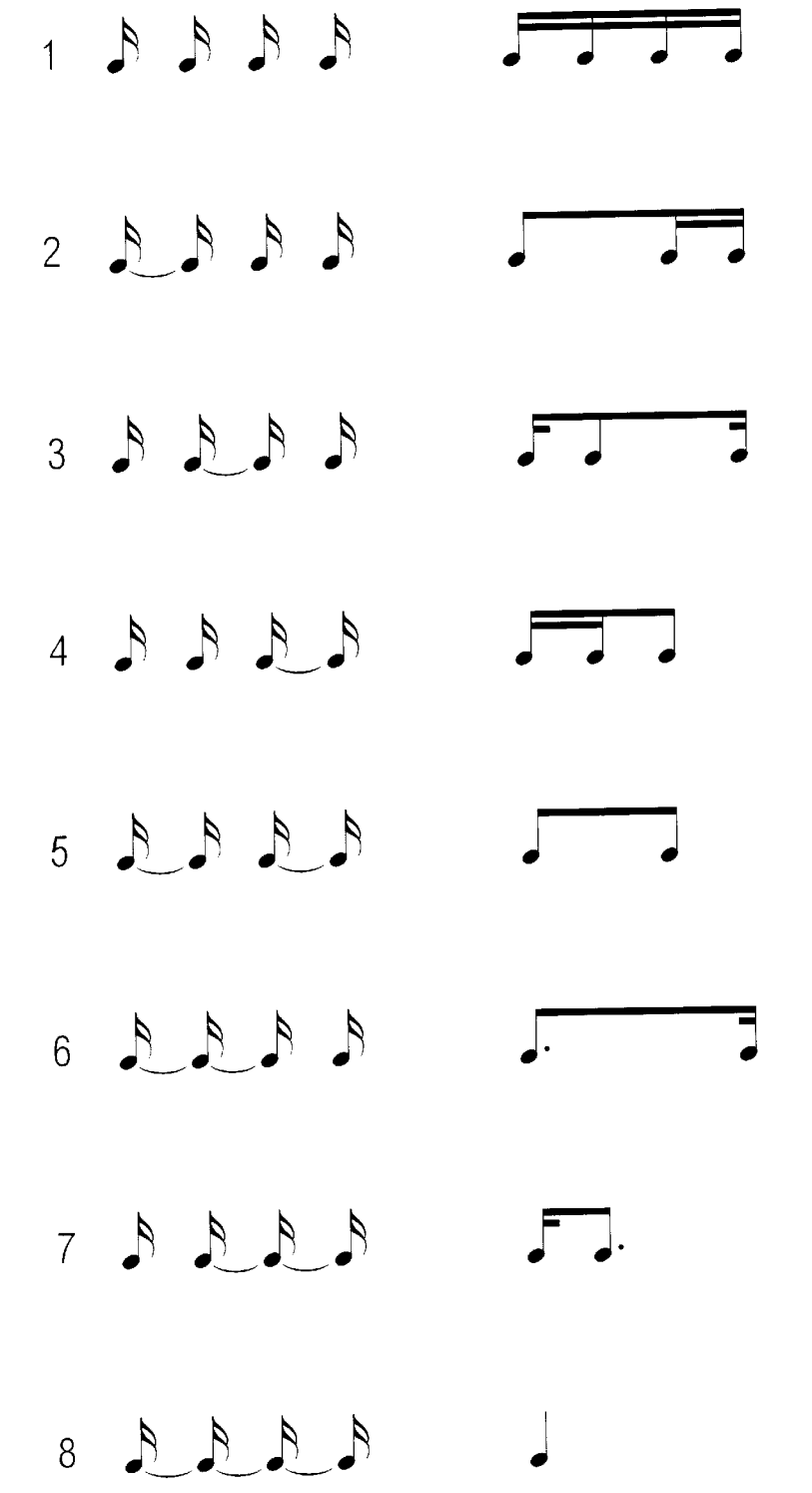
FIG. 17 is a diagram showing the eight possible results for the first four steps of the example random tie rhythm pattern in FIG. 16.

The possible randomly derived rhythm values for the first four steps of this example pattern are shown in FIG. 17. A total of 8 different rhythmic possibilities exist for the period of time equal to the four 16th notes, in which the 2nd through 4th indicate potential ties to previous 16th notes. Each of the 8 examples shows a possible arrangement of those ties, and the equivalent rhythmic notation.

Figure 18:
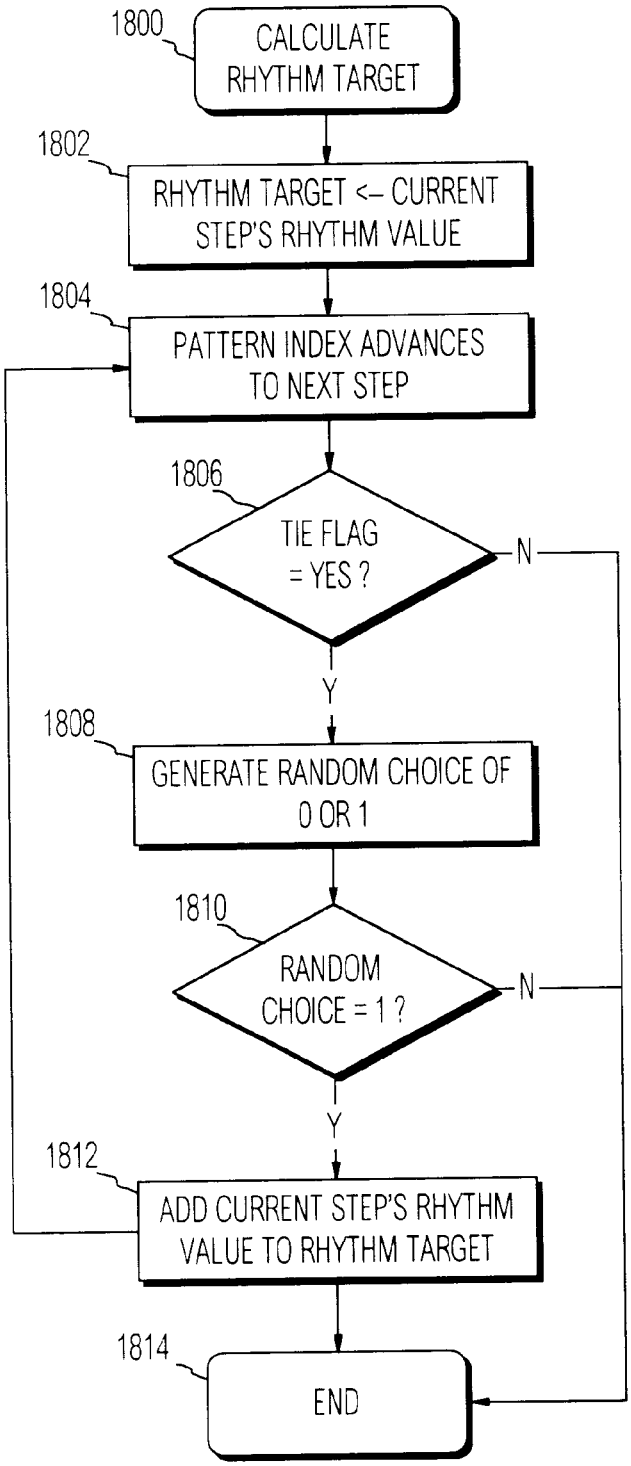
FIG. 18 is a flowchart showing the operation of a calculate new rhythm target routine.

The [Calculate Rhythm Target] routine by which a rhythm value is calculated is shown in FIG. 18. The pattern index indicating which step of the rhythm pattern to use next has been initialized to a starting location. A memory location rhythm target receives the rhythm value derived from the current step 1802, and the pattern index advances to the next step 1804. If the next step's tie flag is "yes" 1806, a random number of either "0" or "1" is generated 1808. If the value is "1" 1810, the value derived from the step's rhythm value is added to the rhythm target 1812, and the pattern index again advances to the next step 1804. This process is repeated until a step's tie flag is "no" 1806, or a "0" is generated as the random number 1810, after which the routine finishes 1814.

The random number generation can be weighted to favor the selection of the "0" more often than the "1," which results in less ties and a more complex rhythm, or the opposite, which results in more ties and a simpler rhythm. This can be achieved by any of the weighting methods previously described. If the random tie rhythm pattern has its associated current seed reset to the stored seed at predetermined intervals during processing, repeatable sequences of random choices can be achieved.

Although this example shows each step with a potential tie to a previous step, the invention could also be configured in the opposite manner, where each step has a flag indicating a potential tie to the next step, or even where the potential exists for a tie in either direction.

RANDOM POOL DRUM PATTERN

In another embodiment, a pattern has one or more steps, where each step contains data representing a pool of two or more possible sounds, or one or more possible sounds and a null value representing the absence of a sound. This shall be referred to throughout this description as a drum pattern, since it is particularly effective for the creation of drum effects. A drum pattern may also be used as an addressable series during the reading out of data as shall be described later. However, the use of the word drum is an arbitrary designation and for convenience only in that other types of sounds may be utilized. A current index is associated with the pattern indicating the next step to be used in processing. Each time a sound is to be generated, such as by the use of a rhythm pattern or other selection means, the next location of the drum pattern is selected and one or more items are selected from the pool at random. If the drum pattern has its associated current seed reset to the stored seed at predetermined intervals during processing, repeatable sequences of random choices can be achieved.

A single "n"-bit number can represent a pool of "n" different drum sounds, or "n"−1 different drum sounds and a null value, where the value of 1 for each bit represents the presence of the sound or null value. A null value so indicated shall also be referred to herein as a null-bit. The particular drum sounds corresponding to each of the "n" bits can be predetermined, or selected by the user. One example of a single step of such a pattern is shown in FIG. 19, using an 8-bit number to represent 7 different drum sounds and a null value. The value shown of 22 decimal (00010110 binary) has the 2nd, 3rd and 5th bits on (from right to left). In this example they represents a pool of three drum sounds, being kick, snare and low tom. The on-bit indexes and the pool size are also shown.

The drum pattern can operate in several different modes. If the mode is "poly," a step with more than one item in the pool and no null values will select all of the items in the pool. If a null value is present in the pool, it can indicate one of two methods of making a random selection for poly mode: (1) single choice—a single random choice is made from non-null values of the pool, so that there is a single item selected which is not the null value; alternately the null value could be included in the pool of choices, so that there is a chance of the null value also being selected, or (2) multiple choice—consecutive random choices are made between each of the remaining items in the pool and the null value, so that for each item there is a chance of the item or the null value being selected. Therefore, any number, from none to all of the pool items, may be selected. If the mode is "pool," a step with more than one item in the pool will make a random selection of only one of the items. If a null value is present in the pool, it can indicate one of two methods of making a random selection for pool mode: (1) pool choice—a random choice is made between all of the pool items including the null value, so that the result is the selection of any one of the pool items, including the possibility of the null value, or (2) null choice—a random choice is first made as to whether to generate a null value; if not, a random choice is then made from the remaining items of the pool (excluding the null value), resulting in either the null value or any one of the pool items being selected. The mode can either be a single value associated with the pattern that controls the operation of the whole pattern, or can be set individually for each step of the pattern.

It may also be specified that certain pool items may be excluded from the random choices to be performed. For example, it can be indicated that if a certain item is present in a pool, it shall always be either selected or ignored, with the random choice(s) made between the remaining items of the pool. This can allow certain items to be always selected while random choices are made around them, or alternately to suppress the selection of certain items while random choices are made around them.

FIG. 20 shows an additional example of a single step of a drum pattern. In this example, each step has an additional bit or value that indicates the mode for the step, rather than the entire pattern. There are 8 bits corresponding to 8 different drum sounds with no null value, although a null value could be indicated. For each of the 8 bits, there is a corresponding bit or flag indicating that it is to be always selected. These additional values can be part of the step of the pattern, so that each step may be set differently as to which bits will always be selected, or can be a single set of values associated with the pattern that affect all steps of the pattern. When this example step is processed, as shall be explained, the fourth bit hi-hat will always be selected, and the random choice(s) made among the remaining on-bits, in this case bits 2 and 3. Alternately, these additional flags may indicate that a bit is never to be selected.

Figure 21:
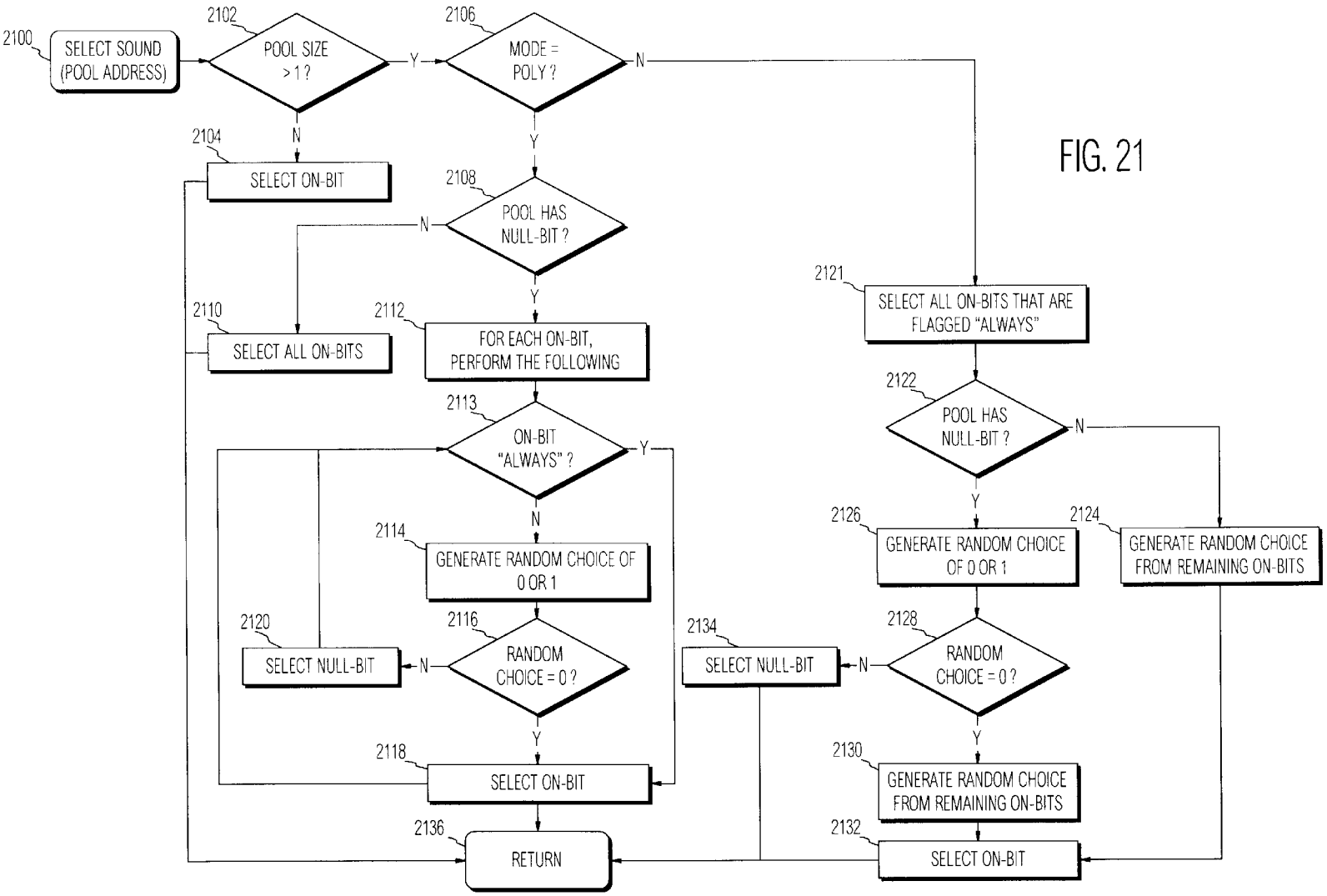
FIG. 21 is a flowchart showing the operation of a select sound routine.

FIG. 21 is a flowchart of a routine to select sounds from the steps of a drum pattern. The example assumes a pool where one of the bits is a null-bit, such as shown in FIG. 19. Alternately, there could be no null values in the pool, with all bits referring to drum sounds, and the portions of the routine dealing with the null-bit eliminated.

It is first checked whether the pool size is greater than "1" 2102. If the pool size is "1" (meaning only a single bit is on), then that on-bit is selected 2104, and the routine is finished 2136. If the pool size is greater than "1" 2102, the mode is then checked 2106. If the mode is "poly," then it is checked whether the pool contains a null-bit 2108. If the pool does not contain a null-bit, then all on-bits in the pool are selected 2110, and the routine finishes 2136.

If there is a null value contained in the pool 2108, then a loop can be performed for each on-bit in the pool 2112, comprising the steps 2113–2120. First, a flag is checked to see whether this on-bit should be played "always" 2113. If the on-bit is to be played "always," it is then selected 2118, and the loop continues with the next on-bit 2113. If the on-bit is not flagged to be played "always," a random choice of either "0" or "1" is generated 2114. If the choice is "0" 2116, then the current on-bit is selected 2118 and the loop continues with the next on-bit. If the choice is "1" 2116, then the null-bit is selected 2120, and the loop continues with the next on-bit. Therefore, for each on-bit in the pool, a chance exists for that on-bit or the null-bit to be selected, and the routine finishes 2136. This operation corresponds to the previously described multiple choice method. If the single choice method were to be used, at step 2112 all on-bits that are flagged "always" would be selected, and then a single random choice made between all of the remaining on-bits that are not flagged "always" (excluding the null-bit), after which the routine would be finished.

If the mode is not "poly" (meaning it is "pool") 2106, all on-bits that are flagged "always" are selected 2121, after which it is checked whether there is a null-bit in the pool 2122. If not, a random choice of one of the remaining on-bits is generated 2124. Remaining on-bits indicates all bits that are not flagged "always," and that are not the null-bit. The resulting on-bit is then selected 2132, and the routine finishes 2136.

If there is a null-bit in the pool 2122, then a random choice of either "0" or "1" is generated 2126. If the choice is "0" 2128, then a random choice is generated from the remaining on-bits in the pool 2130, the on-bit is selected 2132, and the routine finishes 2136. If the choice is "1" 2128, then the null-bit is selected 2134 and the routine finishes 2136. In this manner, a single choice of either a null-bit or an on-bit pool item will be accomplished, other than on-bits that have been flagged "always." The operations 2122 through 2134 correspond to the previously described null choice method. If the pool choice method were desired, then after 2121 a single choice would be made from all on-bits in the pool, including a null-bit if so included, and the routine would finish.

At this point, one or more bits have been selected. They are then mapped to corresponding values to use with the pattern's associated pool bit mapping table, such as the drum sounds discussed earlier. The selection of the null-bit indicates that no sound should be selected or produced. These selections can then be processed further by additional algorithms, or played in any conventional method, such as via MIDI data generation or digital audio playback, or they could be stored into a file for future playback.

The random selections can be weighted by any of the weighting methods previously discussed. For example, at step 2114 and 2126, the random choice between "0" and "1" may be weighted as previously described. In a similar fashion, the random choices from the pool items at step 2124 and step 2130 can also be weighted, as previously described. By varying the weighting, the selection of sounds can be shifted towards different areas of the pool, or can be shifted to increase or decrease the possibility of a null value being generated.

While this example assumes the random choice between a null value and other non-null values 2114 and 2126 has a separate weighting method, and the random choice between non-null values of a pool 2124 and 2130 also has a separate weighting method, a single weighting method could be used by both. Alternately, a separate weighting method could be used for each of the four steps. The operations corresponding to checking for on-bits that are flagged always, and selecting such on-bits can be skipped if such functionality is not desired or included in the pattern.

Figure 22:
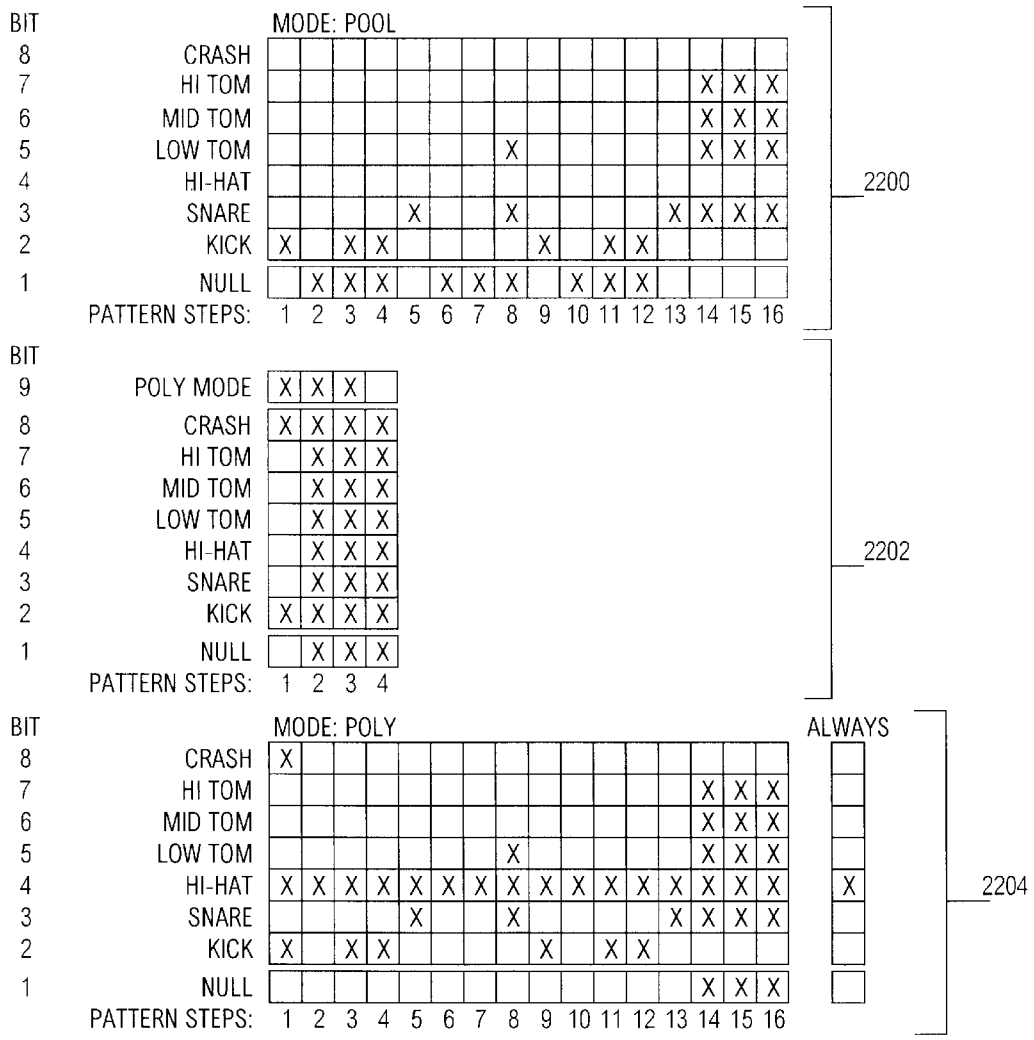
FIG. 22 is a diagram showing examples of drum patterns according to one embodiment.

Several examples of drum patterns utilizing the previously described methods are shown in FIG. 22, where X indicates a bit set to "1" (an on-bit), and a blank indicates a bit set to "0." It is assumed during this example that the steps of the pattern will be selected sequentially by a rhythm pattern such as 16th notes at a current tempo. Other arrangements or rhythmic values are possible, such as the rhythm patterns described in the earlier embodiments, or manual selection by a user-operated control.

A 16 step pattern is shown 2200 using the previous example of an 8-bit value representing 7 different drum sounds and a null value. The grid represents the settings for each of the 8 bits over the 16 steps of the pattern (columns 1 to 16). The example is using pool mode for the entire pattern, and the null choice method, so a step in which more than 1 bit is set will result in a single choice between the on-bits if the null-bit is not present, or a single choice between the remaining on-bits if the null-bit is not first selected as previously described.

Step 1 indicates that the kick will be selected always, since there are no other on-bits in the pool. Step 2 indicates a null value always (which will be perceived as a 16th note rest). Steps 3 and 4 indicate a random choice between a kick and a null value, so that the possibility exists of either selecting the kick or not, and so on. Step 8 indicates that first, a choice will be made as to whether to generate a null value. If so, nothing will be selected at that step. If not, a random choice will be made between the snare and the low tom. In this way, there are one of three possible outcomes at this step. When the weighting method of the null value choice favors the null value, a simple pattern will result, since notes will be selected less often. When the weighting favors the non-null values, a more complex pattern will result, since notes will be selected more often. Steps 14, 15 and 16 indicate a random choice between the snare and several of the toms. For example, if the weighting on the drum sound choices (upper 7 bits) favors the higher bits, toms will be selected more often. If the weighting favors the lower bits, snares will be selected more often. If the weighting favors the middle bits, the mid tom and low tom will be selected more often than the other sounds.

A 4 step pattern is shown 2202. This example uses the previously described method where each pattern step has an additional value indicating the mode of the step. X indicates poly mode, and blank indicates pool mode. This example uses the previously described multiple choice method for poly mode, and the pool choice method for pool mode.

Step 1 indicates that the kick and the crash will always be selected simultaneously, since the mode is poly, and there is no null value. Steps 2, and 3 are also in poly mode, and therefore indicate that a random choice will be made between each of the 7 drum sounds and the null value; therefore there could be from 0 to 7 drum sounds selected simultaneously on those steps. If the weighting method on the null value choice favors the null value, fewer sounds will be selected. If the weighting favors the non-null values, more sounds will be selected simultaneously. Finally, step 4 is in pool mode and using the pool choice method, so a single choice will be made between all 8 items including the null value, resulting in the selection of one of the drum sounds or the null value.

A 16 step pattern is shown 2204 in which the entire pattern is in poly mode. In this example, the single choice method previously described shall be explained, where the presence of the null value indicates a single choice to be made from the non-null values. Steps 1 to 13 do not contain any null values. Therefore all indicated pool items in those steps will be selected simultaneously as each step is accessed. Steps 14, 15 and 16 contain a null value, so a single random choice will be made from the non-null values. However, this example also shows the use of the "always" flag, which in this example refer to the operation of the entire pattern. Because the 4th bit hi-hat has its always flag set, at steps 14, 15, and 16 the hi-hat will always be selected, and a single random choice will be made between the remaining non-null values in the pool, resulting in either the snare or one of the three tom sounds shown. Alternately, the null-value could be included in the choice, so that there is also a possibility of selecting the null value. Weighting methods can be used to favor the selection of certain areas of the upper 7 bits, or the selection of the null-bit if it is included in the pool of choices, again influencing the types of sounds selected and the frequency of the null value being selected.

Figure 23:
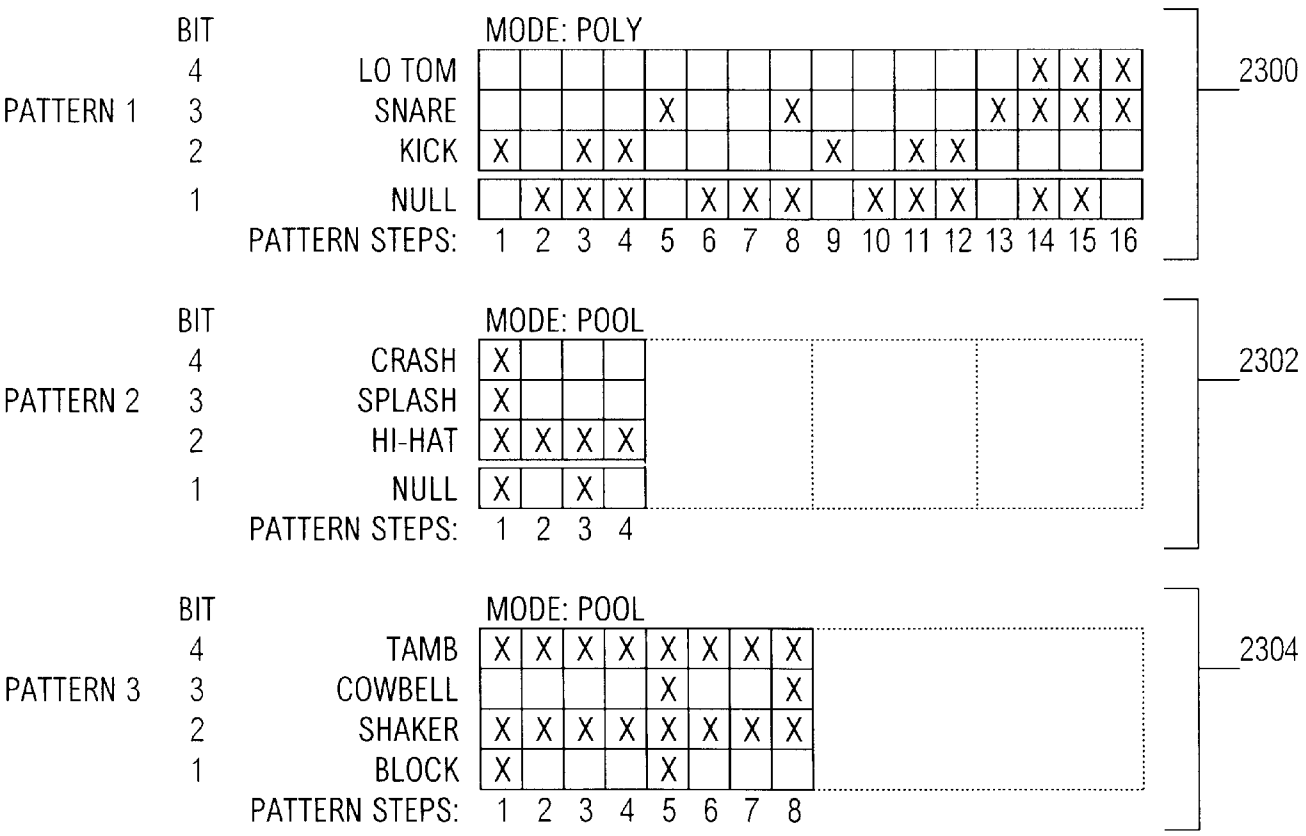
FIG. 23 is a diagram showing examples of drum patterns according to another embodiment.

In another embodiment, two or more of these patterns are played simultaneously, with separate weighting methods, and with the "n" bits of the pool representing different drum sounds in each pattern. FIG. 23 shows three example patterns that are being used simultaneously. In this example, each pattern uses only 4 bits. Pattern 1 represents drum sounds of a kick, snare, low tom and null value 2300. Pattern 2 represents cymbal sounds of a hi-hat, crash, splash, and null value 2302. Pattern 3 represents percussion sounds of a tambourine, cowbell, shaker, and block 2304. The patterns can be of different lengths and will loop concurrently, so for example, the dotted outlines of Pattern 2 indicated that it will have played 4 times during one repetition of Pattern 1. Although this example shows the three patterns having a length with a common multiple of 4, this is not necessary, and they can be of any length. Furthermore, the steps in each pattern can be selected by the same rhythm pattern or selection means, so that they are synchronized, or by different rhythm patterns and selection means, so that they may be utilized at different speeds or rhythms.

Although this example shows drum sounds being used, any sound could replace the drum sounds, or the drum sounds could be pitches of musical notes. The drum sounds could also be replaced by the addresses in memory of digital audio data. Furthermore, although this example shows a pattern step as always having at least one item in a pool, it could be configured that a pool of 0 items was considered a null value.

While the previous example used the on-bits pool method, the actual values pool method as previously described could also be used. For example, a pool could contain the actual drum sounds, or note numbers representing them, or digital audio data or the addresses in memory thereof, with or without the inclusion of null values, with the pool size being the number of items in the pool. An actual value or item would be selected from the pool rather than the selection of an on-bit that is then mapped to a table of corresponding drum sounds.

METHOD FOR RANDOMIZATION OF MUSICAL DATA

Another embodiment shall now be described. The Standard MIDI File 1.0 Specification provides a format where sequence data is presented as a time-stamped list of data, with an entry in the list being:

<delta time><event><data>

Delta time is based on the timing resolution of the sequence file, such as 24 ticks per quarter note, 96 ticks per quarter note, and so on. The delta time is the number of ticks from the previous event at which to generate the next event. An event is a MIDI message, such as note-on, controller, program change. Data is the pitch and velocity of a note-on message, the controller number and value, and so on. Events generally include a channel, which indicates one of many MIDI channels for which the event is intended. Various other proprietary and public domain methods of recording and storing MIDI data are well-known, often referred to as sequencers or sequencing software. These sequencers that record and playback MIDI data have many different timing resolutions, such as 24 ticks per quarter note, 96 ticks per quarter note, 480 ticks per quarter note and so on.

When playing back a MIDI file or other file of sequence data in real-time, more than one note within a given region may be deemed a pool of choices, from which one or more of the notes will be selected to be played at random. A starting seed, current seed, and stored seed may be utilized in memory in the same fashion as described for a random pool pattern. If the value of the current seed is stored at the beginning of processing a section of data, the current seed can be reset to the stored seed at specific locations so as to generate repeatable sequences of random choices.

A predetermined extraction area size is selected, which may be changed in real-time during processing if desired. The length of the extraction area may be expressed as a unit of musical time, such as a 16th note at the current resolution or a percentage thereof. Alternately, it may be expressed in absolute tick locations corresponding to a current resolution. It may start and end at locations corresponding to units of musical time, such as every beat, or may be offset with relation to those units, such as a certain number of ticks or time before or after the beat or other subdivision.

Figure 24:
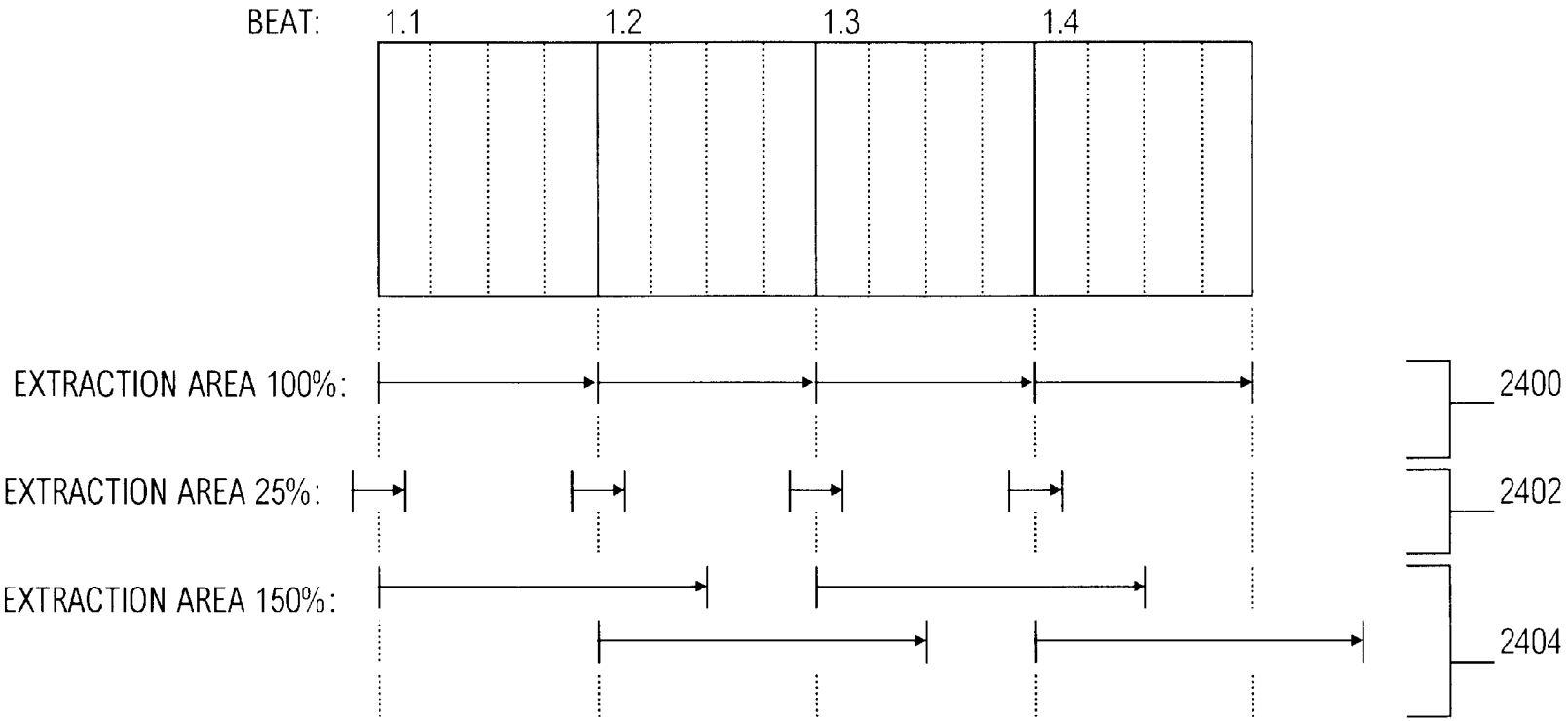
FIG. 24 is a diagram of extraction areas.

FIG. 24 is a diagram showing examples of several different extraction areas. In this example, four beats of musical time are illustrated as {1.1, 1.2, 1.3 and 1.4.} The dotted lines indicated subdivisions of a 16th note. The first example 2400 shows an extraction area that is equal to 100% of one beat, and that starts on each beat. As shown, multiple extraction areas can be contiguous, where the end of each area adjoins the beginning of the next area. The second example 2402 shows an extraction area that is equal to 25% of one beat starting a 32nd note before the location of the beat. As shown, multiple extraction areas may be non-contiguous, resulting in space between the extraction areas. The final example 2404 shows an extraction area equal to 150% of one beat, starting on the beat and extending halfway into the next beat. As shown, multiple extraction areas may overlap.

The data to be played back, or a portion thereof, is loaded into memory. As the data is played back, each extraction area is examined prior to actually being played to determine how many notes (note-ons) exist within the extraction area. If there are more than one, they will be deemed a pool of choices, and one or more of them can be selected at random to actually be played. Spaces between non-contiguous extraction areas can have all notes selected, or alternately may be ignored, so that none of the notes outside of the extraction areas are selected. One or more of the following methods can be used to play the selected notes:

(1) the selected notes can be "tagged" in memory with an indicator as to which are to be played;

(2) the selected notes can be copied to a buffer from which playback is actually performed, so that the buffer only contains the notes to be played;

(3) the entire upcoming portion of data can be copied into a buffer and the notes not selected deleted, so that the buffer only contains the notes to be played, and (4) the notes not selected to be played can be physically deleted from the actual stored data prior to playback.

Additionally, one or more data types within the file, such as a particular note-on number, or a particular MIDI Controller value can be designated as random choice indicators. If a random choice indicator is located within an upcoming extraction area, it may perform the same or similar type of functions as the null value described in the previous embodiments, with respect to the methods of performing random selections. The random choice indicator can indicate one or more of the following:

(1) a random choice between all of the notes within an area (single mode), so that only one of them will be selected;

(2) a random choice between all of the notes within an area and a null value (pool mode), so that a chance of none of the notes playing exists, and (3) a random choice between a null value and each of the notes within the area, so that each note within the area has a chance of being selected (poly mode), and the result could be from one to all of the notes in the area.

More than one random choice indicator can be used, so that any of the previously mentioned methods may be used selectively during different extraction areas. Extraction areas that do not contain a random choice indicator can be ignored for processing and played normally. If the random choice indicator is a note number, generation of notes with that value may be suppressed.

The random selections can be weighted to different areas of the pool by any of the methods previously described. In this case, the weighting domain (y-axis) can either be considered to be the range of pitches in the extraction area, from low to high or high to low, or can be the distribution over time of the notes in the extraction area as shall be described. In the case where random choice indicators are not included in the file or are not used, a simple percentage value can be varied in real-time, indicating a percentage of the total number of pool items to select at random.

Further provided is a means for identifying certain notes to be excluded from the pool of choices. For example, it may be specified that a certain note number or sound is not to be included, such as the pitch indicating a hi-hat for drum data. In this case, the hi-hat notes are considered to be flagged "always" as previously described. Notes selected in this manner will always be played, regardless of the determination of pools in the extraction areas.

The note-offs can be dealt with in several ways. In one method, the MIDI file is pre-processed by storing the data in a memory buffer, and processing the file so that rather than separate note-ons and note-offs existing, the note-ons and note-offs become a single note with a duration; alternately, the musical data may already be stored in such a format. When the note is played, the note-on is sent out, and a note-off will be sent out a certain period of time later determined by the duration. In this manner, when a note within an extraction area is not selected to be played, there will be no note-on or corresponding note-off put out for that note. In another method, the MIDI file is not preprocessed, but a buffer stores all note-ons that have been put out that have not yet received note-offs. When a note-off is to be sent out, if the corresponding note-on is in the buffer it is sent out and then that note-on is removed from the buffer. If the corresponding note-on is not in the buffer, the note-off is ignored and not sent out. In another method, the MIDI file is not preprocessed, and all note-offs are simply sent out as indicated in the file, whether or not the corresponding note-ons were actually selected for output.

Figure 25:
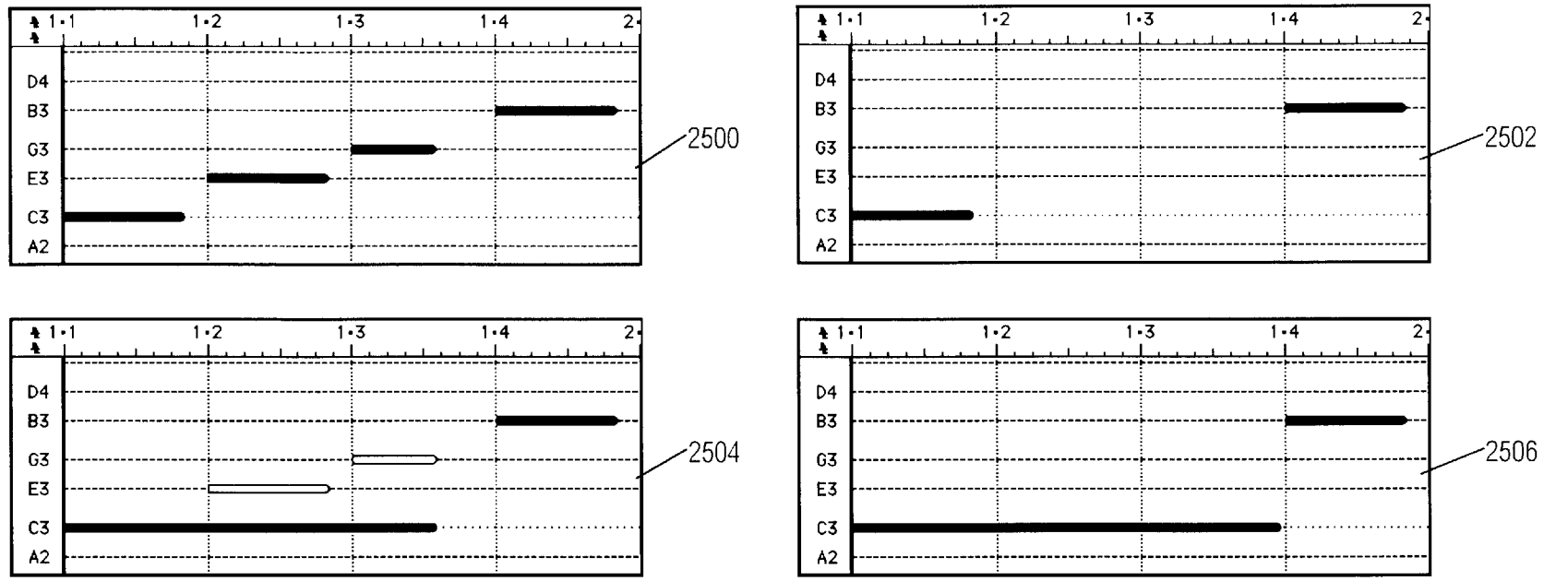
FIG. 25 is a diagram showing examples of MIDI note data and a method of duration control.

In another method, a note that is selected to be played may have its duration modified according to notes that are not selected for playback. FIG. 25 shows a section of a MIDI file displayed in "piano-roll" format 2500. The section of data is equal to 4 beats (one measure of 4/4 time), containing four quarter notes. Each quarter note's duration extends somewhat to the next quarter note. If the extraction area was as large as four beats, this entire example would form the pool of notes. If the first and fourth notes were randomly selected for playback, the second and third would be omitted, which would result in data being produced with the characteristics shown in 2502. If desired, the first note's duration can be extended until what would have been the end of the third note by monitoring the skipped notes, and extending the last played note until the end of the duration of the last skipped note. This would result in data being produced with the characteristics shown in 2504 (with the skipped notes shown as outlines). Alternately, no monitoring of the skipped notes can be done, and the previous selected note's duration simply extended until the next selected note is played, which would result in data being produced with the characteristics shown in 2506.

As the methods by which random choices can be made from a pool have been described in detail for earlier embodiments, the following examples explain in general the further operation of this embodiment on MIDI data.

Figure 26:
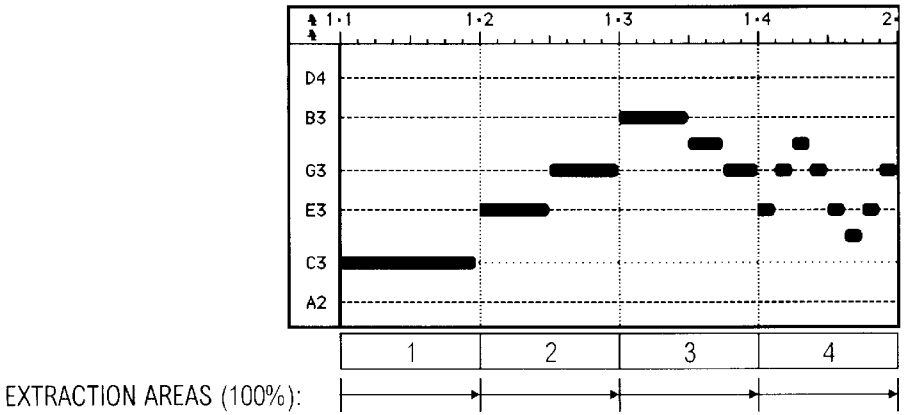
FIG. 26 is a diagram showing an example of MIDI note data divided into scanning regions.

FIG. 26 shows an example section of MIDI data corresponding to one bar. In this example, the extraction area has arbitrarily been determined to be a quarter note, so four extraction areas are shown. They have arbitrarily been chosen to start at each beat and extend until the next beat. In this example, no random choice indicator has been included in the data, so each area is treated as a pool of values from which to play one or more values. A percentage value that may be varied in real-time selects how many items from each pool will be selected. For example, area 4 contains 8 items, so if the percentage was 50%, 4 of them would be selected at random.

In this example, a weighting method is utilized with the weighting domain, or y-axis, being the distribution in time of notes over the extraction area. With extraction area 4 as an example again, by using any of the weighting methods previously described, the random selections may be weighted towards the notes earlier in the area, the notes later in the area, the notes in the middle of the area, and so on.

Figure 27:
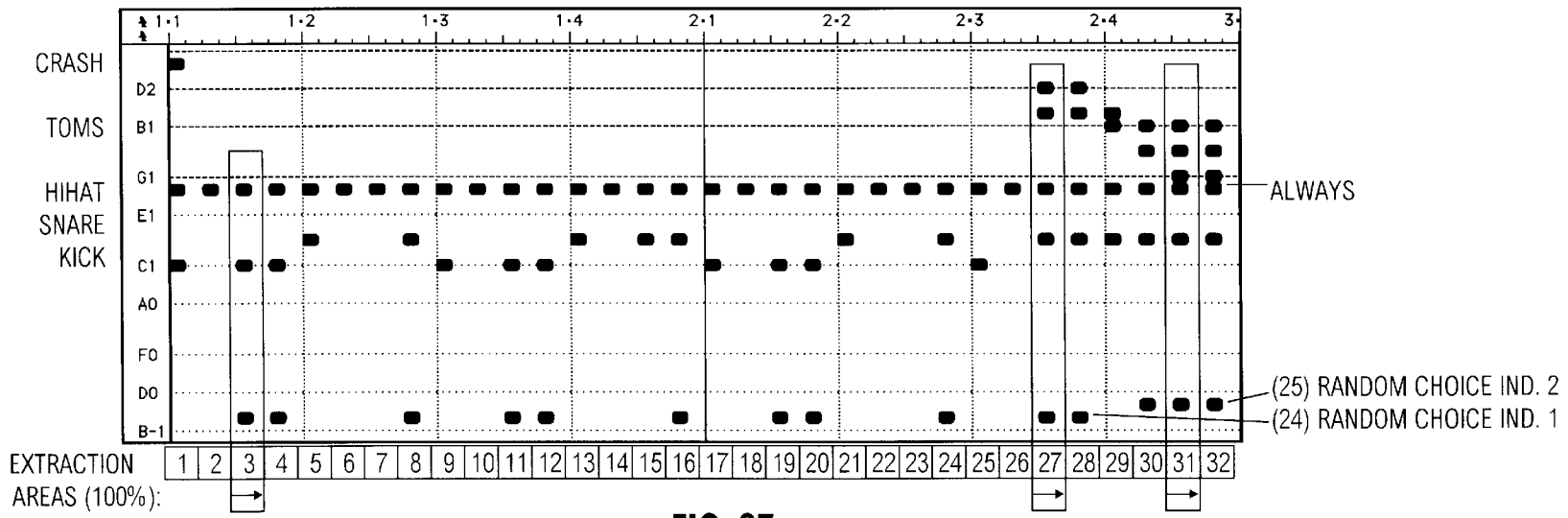
FIG. 27 is a diagram showing an example of MIDI drum data divided into scanning regions.

FIG. 27 shows an example section of MIDI data corresponding to 2 bars (8 beats) of drum notes. The extraction area has arbitrarily been determined to be a 16th note. Therefore 32 extraction areas are shown, each starting and ending slightly before the beginning of each 16th note subdivision. In this example, MIDI note number 24 (C0) has been designated as a pool random choice indicator; MIDI note number 25 (C♯0) has been designated as a poly mode random choice indicator. No data will be output from either of those two notes in this example.

In this example, the data indicating a hi-hat has been flagged as "always". This note will always be played, and is excluded from any of the random pool choices which will be described. Extraction areas that have no random choice indicators play normally, so for example, areas 1 and 2 play all of the notes in them. Area 3 (out-lined) contains a pool mode random choice indicator, so a random choice will be made between the kick and a null value, so that there is a chance of either the kick being selected or not (the hi-hat is played always and excluded from the choice). Area 27 (out-lined) also has a pool mode random choice indicator, so only one of the notes in the region (with the exception of the hi-hat) will be selected. It is shown that there are 4 possible outcomes: snare, hi tom, medium tom, or nothing. Area 31 (out-lined) contains a poly mode random choice indicator. In this case, consecutive random choices will be made between each of the notes in the area and a null value (with the exception of the hi-hat), so that any number, from one to all of the notes, will be selected.

The process is not limited to being performed during real-time playback. The processing of the extraction areas and the random selections made from them may be used to replace the stored musical data, or be stored elsewhere as a MIDI data file, without actually being played back. This allows the data to be processed and played back at a later time.

EXTRACTION OF PATTERNS AND NOTE SERIES FROM MUSICAL SOURCE DATA

Patterns and/or note series can be extracted from preexisting musical data. Such musical data can be a file stored in memory, representing an entire song, melody, or portion thereof, and may consist of a list of time-stamped events. The file may be a predetermined file, or one which the user has recorded into memory. Since the location in memory of various types of data in memory can be determined, specific regions of data can be extracted from the musical data and converted into patterns (e.g., velocity, pan, duration). Also, specific regions of note data can be extracted from the musical data and transferred to another location, thereby creating an initial note series, as described later. The resulting patterns and/or note series may then be utilized immediately, or can be stored in memory as one or more of a plurality of patterns and/or note series for use in later processing.

The extraction of the patterns and/or note series can be performed in real-time, e.g., at the tempo of the playback of the musical data, with or without output of the actual musical data, or can be performed in memory without output of musical data as fast as processing speed allows, with the results stored in other memory locations. Specific locations, such as the beginning of each beat or the beginning of a measure can be used to initiate the extraction of patterns from a new location of the memory, such as the beat or measure of data that is about to begin playback.

A predetermined extraction area size is selected, as previously described. A single extraction area may be used, within which groups of events are utilized to extract the steps of the patterns. Alternately, multiple extraction areas may be used, with each extraction area corresponding to a step of a pattern.

EXTRACTION OF PATTERNS USING A SINGLE EXTRACTION AREA

Examples of using a single extraction area shall be described first, which is typically used for the extraction of patterns in the specific value pattern category, although it may be also used in some cases to extract random pool patterns as will be shown. For the purposes of this discussion, an example Standard Midi File fragment 2 beats long is shown in FIG. 28, assuming a resolution of 96 ticks per quarter note. For clarity, only note-on, note-off, program change and controller information on one channel is shown, although there could be more than one channel and other event types present. Note-ons with a velocity of 0 indicate a note-off. The column labeled "accum delta" (accumulated delta time) is not actually present in the Standard Midi File; it is calculated by performing a running total of each event's delta time with the previous event's delta time. This can be done for the entire file at once, or in real-time during processing; the accum delta can be a continuously incrementing number, or can be reset to 0 at various locations if desired, such as the beginning of each beat.

In this example, a single extraction area has been arbitrarily decided to be 186 ticks in length, starting at the beginning of the example data and ending 186 ticks later. Those of skill in the art will realize that other arrangements are possible.

Event groups are shown surrounded by dotted lines, and indicate events that are within a predetermined distance from each other. In this example, the arbitrary value has been decided to be 8 ticks. Therefore, any events that are within 8 ticks of each other are considered to be part of the same event group, resulting in 10 event groups as shown. This allows groups of events that may be several ticks apart to be considered to have happened at the same time, for the purposes of pattern extraction. Alternately, the data may be quantized by well-known methods prior to processing according to a predetermined value, such as a 32nd note (at a resolution of 96 per quarter, 1/32nd=12), which results in all delta times being adjusted to the nearest number evenly divisible by 12. This will cause groups of events to be lined up, with delta times of 0, so that they can be considered to have happened at the same time.

Figure 29:
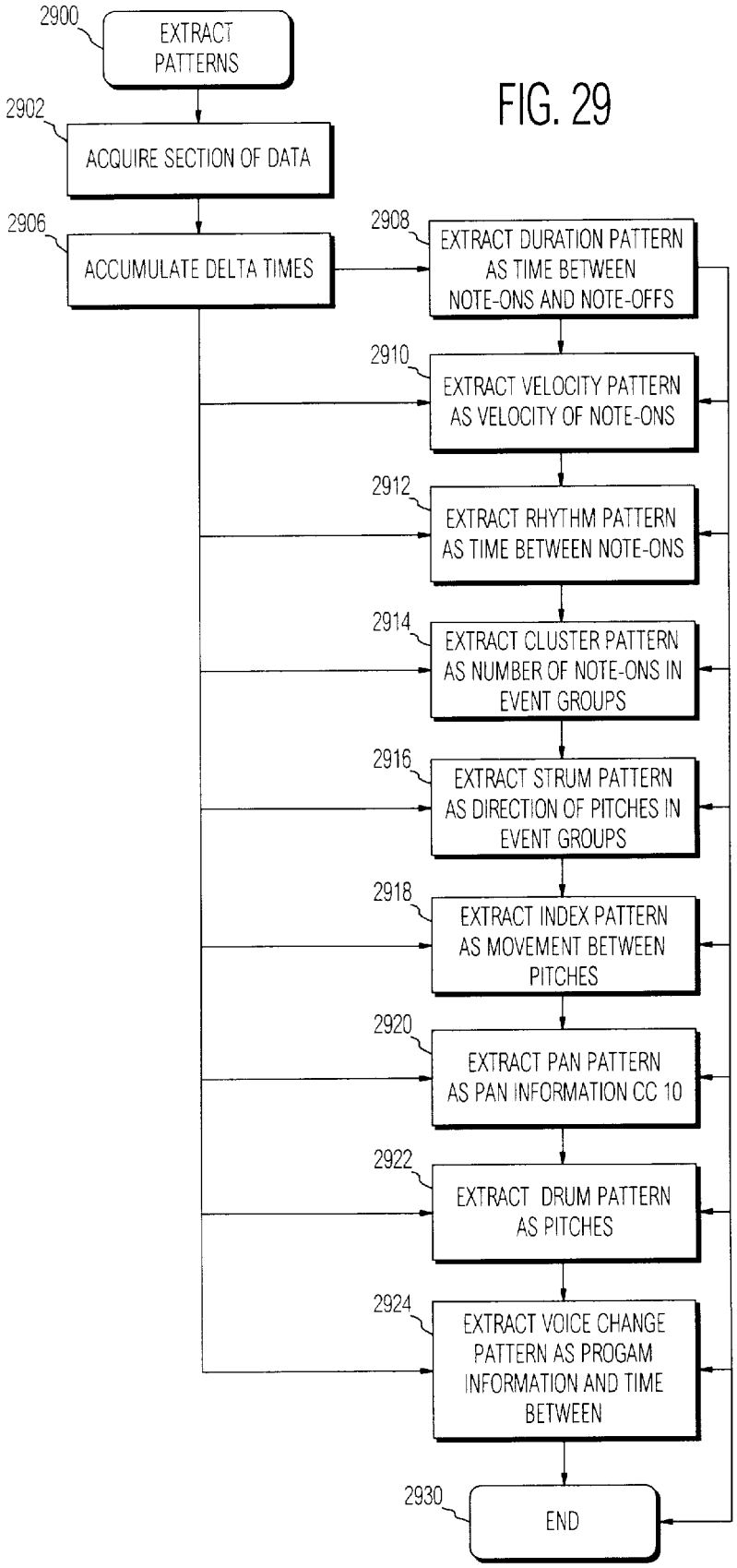
FIG. 29 is a flowchart of the process of extracting patterns from musical data using a single extraction area.

The process of extraction of patterns is shown in the flowchart of FIG. 29. Initially, the musical data of interest is acquired and placed in memory 2902, and the delta times between notes are accumulated 2906, by performing a running total of each event's delta time with the previous event's delta time. Then, one or more of the following steps may be performed.

First, a duration pattern can be extracted 2908 by calculating the amount of time between each note-on and its corresponding note-off within the extraction area. This is done by subtracting the note-off's accumulated delta time from the corresponding note-on's accumulated delta time, with a list being assembled of the values in the order of the note-ons. If constructing a specific value duration pattern, only one duration calculated from each event group containing note-ons may be added to the list if desired, such as the longest, shortest, or an average of all durations within the event group. If constructing a random pool duration pattern, all of the calculated durations within each event group can constitute a pool of choices, or be mapped to the bits of an n-bit number, with each event group corresponding to a pattern step. The values may be quantized, such as moving each value to the nearest tick evenly divisible by a certain value. The values may also be divided as necessary to place them within the timing resolution employed (e.g. 24 cpq). Duplicate values within each event group before or after quantization or division may be ignored.

Second, a velocity pattern can be extracted 2910 by assembling the velocities of the note-on events (velocities greater than 0) in the extraction area into a list in the order of the note-ons. If constructing a specific value velocity pattern, only one velocity from each event group containing note-ons may be added to the list if desired, such as the largest, smallest, or an average of all velocities within the event group. If constructing a random pool velocity pattern, all of the velocities within each event group can constitute a pool of choices, or be mapped to the bits of an n-bit number, with each event group corresponding to a pattern step. If the actual velocity values are being represented, this comprises an absolute velocity pattern. Utilizing the conventions employed herein, the constant −127 can be added to each of values to create a modify velocity pattern. Duplicate values within each event group may be ignored.

Third, a specific value rhythm pattern can be extracted 2912 by calculating the respective times between each note-on event. This is done by subtracting each note-on's accumulated delta time from the first note-on in the next applicable event group's accumulated delta time, and assembling the resulting values into a list in the order of the note-ons, with only one value from each event group being added to the list, such as the longest, shortest, or an average of all rhythms within the event group. The last note-on's rhythm may be calculated by using the end of the data or extraction area instead of a subsequent note-on. The values may be quantized or placed in a different timing resolution as previously described.

Fourth, a cluster pattern can be extracted 2914 by determining the number of note-on events present in each event group containing note-ons. If constructing a specific value cluster pattern, this may be done by assembling them into a list in the order of the event groups. If constructing a random pool cluster pattern, the number of note-ons within each event group can constitute a maximum value, where a pool of choices is constructed from 1 to the maximum, or mapped to the bits of an n-bit number, with each event group corresponding to a pattern step.

Fifth, a specific value strum pattern can be extracted 2916 by assembling lists of the note-ons occurring within each event group. If there is more than one note-on in such areas or segments, the pitches are analyzed to decide whether the order is generally ascending or descending, such as by comparing the pitch of the first note-on in the event group to the pitch of the last. Values representing the direction of the notes (up and/or down strokes) are assembled into a list to constitute a strum pattern. Additionally, the amount of time between the notes in each stroke may be extracted, averaged, and paired with the strum values as an associated strum time for each stroke in the pattern.

Sixth, an index pattern can be extracted 2918 by analyzing the movement between each note-on and a subsequent note-on. This is done by subtracting each note-on's pitch from the next note-on's pitch, and assembling them into a list in the order of the note-ons. If constructing a specific value index pattern, only one note-on from each event group containing note-ons may be utilized if desired, such as the first, last, highest, lowest and so on. If constructing a random pool index pattern, all of the resulting values within each event group can constitute a pool of choices, or be mapped to the bits of an n-bit number, with each event group corresponding to a pattern step. Lower to higher pitch movement results in a positive value and higher to lower pitch movement results in a negative value. The values may be optionally modified, such as by scaling them into a smaller range of numbers, or limiting them to minimum/maximum values. The last note-on in the extraction area can use the first note-on in the extraction area if desired or can be ignored. Duplicate values within each event group may be ignored.

Seventh, a specific value spatial location pattern can be extracted 2920 by directly collecting the spatial location data and assembling it into a sequential list. In a MIDI environment, this information is found in the MIDI controller 10 (pan) messages, and results in a specific value pan pattern. Although not specifically shown, assignable patterns as previously discussed may be extracted in the same fashion as the spatial location or pan pattern, by choosing the desired type of controller events and assembling them into a list, resulting in specific value assignable patterns. Specific value bend patterns may also be extracted in the same fashion by assembling pitch bend information into a list.

Eighth, a drum pattern can be extracted 2922 by directly collecting the pitches of the note-ons and assembling them into a list. If constructing a specific value drum pattern, only one note-on from each event group containing note-ons may be utilized if desired, such as the first, last, highest, lowest and so on. If constructing a random pool drum pattern, all of the values within each event group can constitute a pool of choices, or be mapped to the bits of an n-bit number, with each event group corresponding to a pattern step.

Finally, a specific value voice change pattern can be extracted 2924. One method of accomplishing this is to collect program changes with corresponding time references, such as a resolution to the time base of the system. For example, the program changes may be paired with the amount of ticks between each of the program change delta times divided as necessary to place them in the resolution of the time base. Alternately, note-ons between program changes can be counted and paired with the values.

Examples of extracted duration, velocity, rhythm, cluster, strum, index, pan, voice change and drum patterns using a single extraction area are shown in FIG. 30, FIG. 31, and FIG. 32. All examples use the example data from FIG. 28. For clarity, only certain event groups are shown, although events from other event groups may have been used in processing.

Referring to FIG. 30, an extracted specific value duration pattern is shown along with accompanying calculations, where the longest duration from each event group (in bold type) has been assembled into a list 3000. The list has been quantized by moving each value to the nearest tick evenly divisible by a certain value (e.g. 12), as shown. The values have been divided to place them within the timing resolution employed (e.g. 24 cpq). The resulting duration pattern is also shown in musical notation.

Extraction of a velocity pattern is shown 3002. The highest velocity value in each event group (in bold type) has been assembled into a list, resulting in a specific value velocity pattern. According to the conventions employed herein, this constitutes an absolute velocity pattern. Also shown is a modify velocity pattern created by adding the arbitrary value −127 to each value in the absolute velocity pattern. Below that is shown an extracted random pool velocity pattern constructed using all of the values within each event group, where each event group corresponds to a pattern step, according to the actual values pool method.

Extraction of a rhythm pattern is shown 3004. The largest value in each event group (in bold type) has been assembled into a list, resulting in a specific value rhythm pattern. The list has been quantized by moving each value to the nearest tick evenly divisible by a certain value, as shown. The values have been divided to place them within the timing resolution employed. The resulting rhythm pattern is also shown in musical notation.

Referring to FIG. 31, extraction of a cluster pattern is shown 3100. The number of note-ons within event groups containing note-ons has been assembled into a list, resulting in a specific value cluster pattern. Below is shown an extracted random pool cluster pattern, using the on-bits pool method, where the number of note-ons within each event group has been used to set the bits of a 4 bit number. In this example, the number of note-ons has been used to set all of the bits less than or equal to the number of note-ons. Those of skill in the art will realize that other arrangements are possible.

An extracted specific value strum pattern is shown, where only event groups containing more than one note-on have been used 3102. One method of choosing a strum direction is shown, where the pitch of the first note in each event group is compared with the last pitch (shown in bold type). If the last pitch is greater than first pitch, the direction is "up"; if not, the direction is "down." If they were equal, an arbitrary choice of either may be made.

Extraction of an index pattern is shown 3104. The first note-on in each event group containing note-ons is utilized to extract a specific value index pattern. Each of these note-ons (shown in bold type) is subtracted from the next such note-on, resulting in the value shown as distance to next. The last note-on is wrapping around to the first note-on to result in the value −7. These values are shown assembled into a list, and also after the steps of scaling them into a smaller range and limiting the minimum and maximum to −4 and 4 respectively. A random pool index pattern constructed according to the actual values pool method is also shown below, where duplicate values within each event group have been ignored, and no limiting or scaling has taken place.

Referring to FIG. 32, an extracted specific value pan pattern is shown, where all controller 10 events have been assembled into a list 3200. An extracted specific value voice change pattern is shown, where program changes have been assembled into a list along with the number of note-on events between each of them 3202.

Finally, extraction of a drum pattern is shown 3204. The lowest pitched note-on in each event group (shown in bold type) is used to extract a specific value drum pattern. A random pool drum pattern is shown below, constructed according to the actual values pool method, where all of the pitches within each event group from a pool of values in a corresponding pattern step.

EXTRACTION OF PATTERNS USING MULTIPLE EXTRACTION AREAS

Patterns may also be extracted using multiple extraction areas, where each extraction area corresponds to a step in a pattern. For example, a section of data may be divided into 16 extraction areas, and a 16 step pattern extracted from it. If an extraction area contains no relevant data to the type of pattern being extracted, (e.g. note-ons for a velocity pattern), it may be considered an empty extraction area. This can be an area that contains no data whatsoever, or no data that has been selected to be utilized. Empty extraction areas may be used to indicated default settings of a corresponding pattern step. Alternately, only extraction areas containing relevant data may be used to extract the pattern. Therefore, there will not necessarily be a one-to-one correspondence between the number of extraction areas and the number of pattern steps. For example, if a section of data contained 16 extraction areas and only 5 of them contained relevant data, a 5 step pattern could be extracted.

The flowchart of FIG. 29 can serve as a general guide for the process as previously described, with the main difference being that multiple extraction areas are used with each extraction area corresponding to a step of a resulting pattern, rather than event groups within a single extraction area being used to extract the pattern steps.

Figure 33:
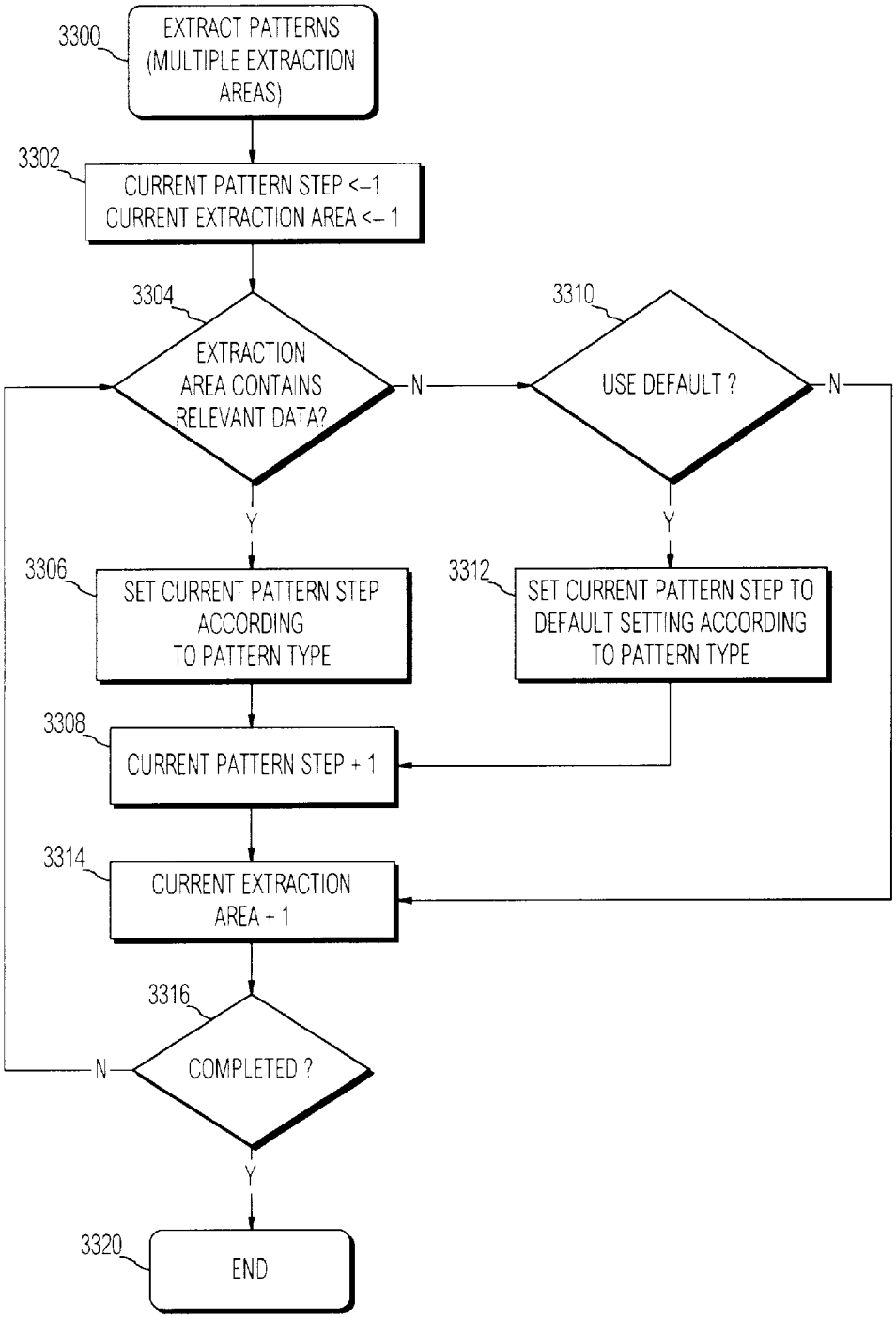
FIG. 33 is a flowchart of the process of extracting patterns from musical data using multiple extraction areas.

FIG. 33 is a flowchart showing the operation of a routine for extracting a pattern using multiple extraction areas, which could be utilized at each of the steps of FIG. 29 where pattern extraction occurs. A current pattern step index indicates the current step of the pattern being extracted, and a current extraction area index indicates the current extraction area of a section of data being processed. Both are stored in memory and initialized to the first locations 3302. A loop consisting of the steps 3304 through 3316 is then commenced. If the extraction area indicated by the current extraction area index contains data relevant to the type of pattern being extracted 3304, the step of the pattern being extracted indicated by the current pattern step index is set to whatever values are determined from the data contained in the extraction area, according to the pattern type. This particular operation is different for each pattern type, as previously explained. The current pattern step index is then incremented 3308, and the current extraction area index is incremented 3314. It is then checked whether processing is completed 3316. The answer may be "yes" if the end of the section of data to be processed has been reached, or a predetermined number of extraction areas have been processed, or some other operation has interrupted processing, in which case the routine is finished 3320. If not completed, processing loops back to 3304. If the extraction area does not contain relevant data, a processing option is checked 3310. If extraction areas that do not contain relevant data are to indicate a pattern step with a default setting, the current step of the pattern is set to the default setting according to pattern type 3312. The current pattern step and current extraction area indexes are then incremented 3308 and 3314, the completion test is made and processing conditionally loops back to 3308. If extraction areas that do not contain relevant data are not to indicate a default value 3310, then processing skips to 3314, where the current extraction area index is incremented before continuing with the rest of the procedure. In this manner, each extraction area is used to set the values in each pattern step; if default values are not used for extraction areas that do not contain relevant data, then the routine moves to the next extraction area without advancing to the next pattern step, and the resulting pattern will thereby be shorter than the number of extraction areas utilized.

Figure 34:
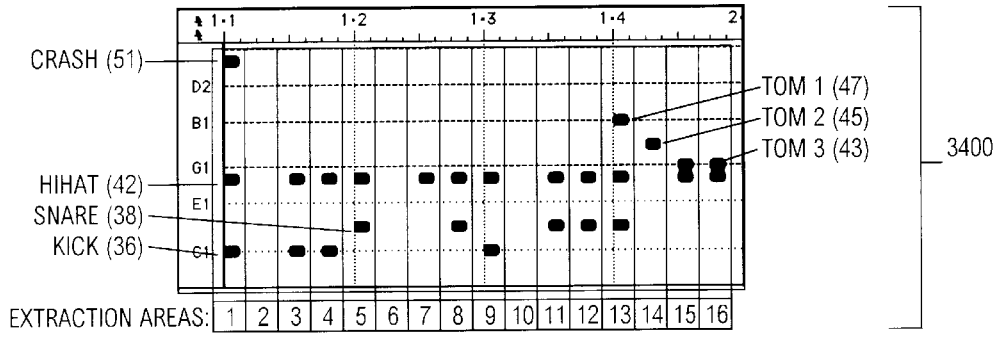
FIG. 34 shows examples of specific value patterns extracted from musical data.

FIG. 34 shows several examples of specific value patterns being extracted from a section of musical data, using multiple extraction areas. A graphical piano-roll representation of one measure (4 beats) of MIDI drum data is shown 3400, including the drum sound names and MIDI note numbers.

It has been arbitrarily decided to use an extraction area of a 16th note. As such, 16 extraction areas are shown, each starting and ending slightly before the beginning of each 16th note subdivision. This will result in 16 step patterns, assuming all areas contain relevant data or are utilizing default settings for a pattern step if not.

When extracting a specific value drum pattern (which can also be utilized as a note series during the reading out of data), arbitrary decisions have been made ahead of time. Although all notes within each extraction area could be utilized, it may be decided that only certain notes or ranges of notes should be utilized. Therefore, other sounds within extraction areas can be ignored. Furthermore, when more than one drum sound selected for utilization occurs in an extraction area, some method of extracting only one of them may be utilized, such as the lowest in pitch, the highest in pitch, the designation of one sound to have priority over others, a random choice, the location in the extraction area, and so on. In this first example, it has been decided to extract kick, snare, and tom sounds, and if there are more than one of those sounds in an extraction area, the highest in pitch shall be utilized; other arrangements are possible. An empty extraction area containing no relevant data shall be used to set the corresponding pattern step to a default value. In this example the null value is utilized, although a certain note could alternately be specified.

The resulting specific value drum pattern thereby extracted is shown 3402. Null values are shown as "–," with a corresponding value of 0. Since in this example the hi-hat and crash sounds have not been selected to be extracted, the only relevant data in extraction area 1 is the kick, which is indicated in step 1 of the resulting pattern. Extraction area 2 contains no relevant data whatsoever. This is used to set pattern step 2 to the null value. Similarly, extraction areas 3 through 12 result in the pattern steps 3 through 12 as illustrated. Extraction area 13 contains two relevant drum sounds, the snare and tom 1. Since this example chooses the higher pitched of the two, pattern step 13 is set to tom 1, and so on.

More than one drum pattern can be extracted from the same section of data, as illustrated in 3404. In this example, it has been arbitrarily decided that only notes corresponding to the hi-hat shall be extracted, which results in the specific value drum pattern shown.

The extraction of a specific value cluster pattern is shown 3406. In this case, the number of notes in each extraction area shall indicate a cluster size in a corresponding pattern step. All notes have been used, although a subset of certain notes or ranges of notes could be utilized. First, a 16 step cluster pattern has been extracted by allowing empty extraction areas such as areas 2 and 6 to set the corresponding pattern step to a default value of 1. Secondly, a 13 step pattern is show, which resulted from not utilizing any empty extraction areas. For example, when extraction area 2 is processed, no values are set in the pattern and the current pattern step index does not advance. Therefore, when extraction area 3 is processed, the resulting value of 2 is set in pattern step 2.

Specific value patterns other than drum or cluster patterns can be extracted from musical data using multiple extraction areas in a similar fashion. The velocities of notes within each extraction area can be used to extract a velocity pattern, and so on.

Random pool patterns as previously described can also be extracted from preexisting musical data, using multiple extraction areas. When using the on-bits pool method to extract a pattern, arbitrary decisions have been made prior to processing as to how many bits will be used to represent the pools in the extracted patterns, and the values or operational variables will be represented by each bit. Data present in the musical data not assigned to a bit may be selectively ignored in the final result. The pattern is extracted by processing each extraction area of the musical data, locating data assigned to be represented by bits (or calculating values from the data in the area that are assigned to be represented by bits), and setting the resulting bits in the step of the pattern that corresponds to the extraction area. The resulting number of on-bits in the pattern step becomes the pool size for each step. When using the actual values pool method to extract a pattern, arbitrary decisions have been made prior to processing as to the maximum number of items a step may contain, and whether certain data in the musical data will be ignored. The pattern is extracted by processing each extraction area in the musical data, locating data in the area that has been selected to be utilized (or calculating values from the data in the area which have been selected to be utilized), and transferring the resulting data to the step of the pattern that corresponds to the extraction area. The number of items thereby stored in each step becomes the pool size for each step. The items in each step (constituting a pool) are typically maintained in some sort of ascending or descending order within the pool, such as by pitch or velocity.

Additionally, in the case of random pool drum patterns, one or more data types within the file, such as a particular note-on number, or a particular MIDI Controller value can be designated as null value indicators. If a null value indicator is located within an upcoming extraction area, it may be utilized to set a null value or null-bit in the resulting pattern. More than one null-value indicator can be used, so that any of the previously mentioned modes of operation can be selectively indicated.

Figure 35:
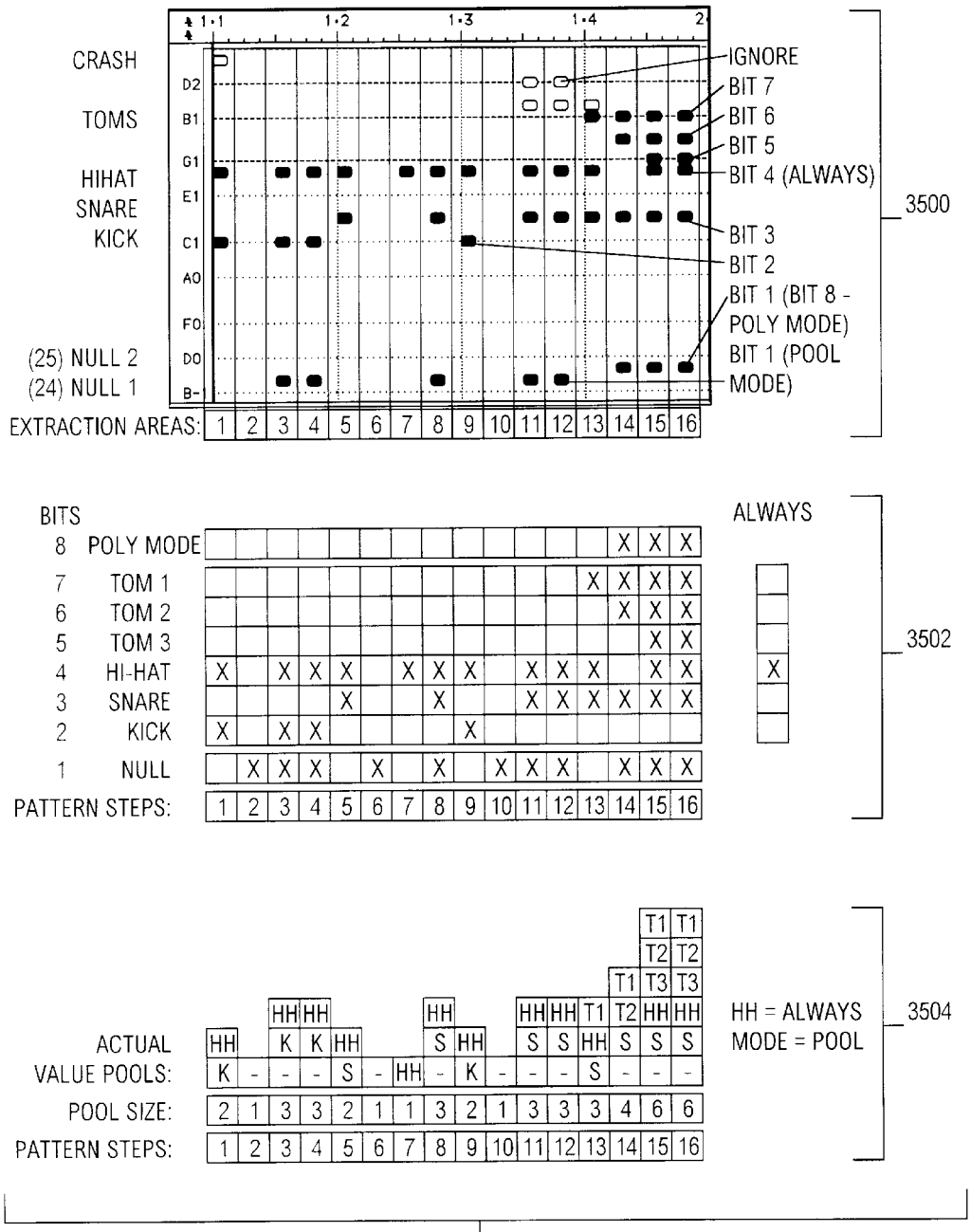
FIG. 35 shows examples of random pool patterns extracted from musical data.

An example of the extraction of random pool drum patterns is shown in FIG. 35. A graphical piano-roll representation of one measure (4 beats) of MIDI drum data is shown 3500. It has arbitrarily been decided to use an extraction area of a 16th note. As such, 16 extraction areas are shown 3500, each starting and ending slightly before the beginning of each 16th note subdivision. This will result in a 16 step drum pattern. These examples shall use an empty extraction area containing no relevant data to set the corresponding pattern step to the null value. Furthermore, the notes represented by C0 (24) and C♯0 (25) have been decided to be null value indicators. Using two different notes allows pool mode or poly mode to be selectively set in each step.

When using the on-bits pool method arbitrary decisions have been made in this example to use an 8-bit number, where bit 1 will be a null-bit representing a null value, bits 2 through 7 will represent the drum sounds shown, and bit 8 will be used to indicate poly mode processing. Those of skill in the art will realize that other arrangements are possible. Bit 4, chosen to represent the hi-hat, has been given the designation "always," so that it will always be played in the resulting pattern, as previously described. The two different null bits have the following function: a note of C0 (24) shall set the null-bit and a note of C♯0 (25) shall set the null-bit as well as set the poly mode bit. Notes present in the MIDI data that have not been assigned to a bit will be ignored in the final result, and are shown as white outlines. In this example an empty extraction area shall represent a pool mode null-bit; other variations are possible.

The pattern is extracted by processing each extraction area of the musical data, locating notes in the area that have been assigned to be represented by bits, and setting the resulting bits in the step of a drum pattern that corresponds to the extraction area. The extracted drum pattern is show in 3502, where X indicates a bit set to 1 (an on-bit), and a blank indicates a bit set to 0. For example, extraction area 1 is processed 3500. The crash sound has not been assigned to a bit, so it is ignored. The presence of the kick and hi-hat in the extraction area results in the setting of bits 2 and 4 respectively to the on position 3502. Extraction area 2 is empty. Therefore pattern step 2 has the null-bit set to the on position. Extraction area 3 contains a hi-hat, kick, and null value. These bits are likewise set to the on position in pattern step 3. Since the null value is a pool mode null value, the bit corresponding to poly mode is not turned on. Processing continues in a similar fashion. Extraction area 16 contains 5 drum sounds and a poly mode null value. Therefore, pattern step 16 has the 5 corresponding drum sound bits, the null-bit, and the poly mode bit all set to the on position. While this example uses a single bit or value to represent pool or poly mode, a larger value or additional bits can be used to indicate more than 2 modes of operation, such as inclusion of the previously described single mode. As shown, bit 4 has been flagged "always" and will result in bit 4 always being played when the pattern is used.

The previously described actual values pool method may alternately be used when extracting a random pool drum pattern from the data shown in 3500. The pattern is extracted by processing each extraction area in the musical data, locating notes in the area that have been selected to be utilized, and transferring the items to the step of a drum pattern that corresponds to the extraction area. The resulting drum pattern using this method is shown in 3504. Each pattern step therefore contains the actual items in the extraction area that have been selected to be utilized, and a pool size that indicates the number of items stored in the step. In this example, the items have been stored in each step in ascending order of pitch; other arrangements are possible. The values could be MIDI note numbers, digital audio data, or any other type of data; for clarity abbreviations are used to designate the various drum sounds in 3500; the null value is represented by "–." The hi-hat has been flagged as "always," and in this example, all null values indicate pool mode processing. Once again, the notes with white outlines in 3500 have been selected to be ignored, and not transferred to the resulting pattern. Therefore, example 3504 is functionally equivalent to example 3502.

Furthermore, multiple patterns can be extracted from the same section of MIDI data. In the example shown in 3500, the crash and hi-hat can be extracted along with the null values into a separate on-bit drum pattern or actual values drum pattern, the kick, snare, and toms extracted along with the null values into a different, separate on-bit drum pattern or actual values drum pattern, and so on. The patterns can then be used together, or interchangeably with other patterns extracted from other sections of data, in the manner shown in FIG. 23.

While these examples shows the use of drum data, any type of note data can be utilized, for creating patterns for sounds other than drums. While the example musical data here includes note numbers representing null values, there could also be no null values, and no null-bit in the resulting drum pattern, as previously explained.

Random pool patterns of any type may be extracted in this manner. For example, a random pool cluster pattern may be extracted, where the number of notes in each extraction area may be used to set the values for each pattern step. The total number of notes can be used to indicate the largest size, with all smaller sizes included in the pool. For example, if 5 notes were counted in an extraction area, that step of the pattern would have a pool consisting of the values 1 through 5 indicated. This may be done either by storing the values 1 through 5 as a pool, or by setting bits 1 through 5 of an n-bit number to the on position. A random pool velocity pattern may be extracted, where the velocities of the notes within each extraction area may be used to set the values for each pattern step. The actual velocity values can be stored in the step as a pool of values, or certain ranges of velocity can be mapped to the bits of an n-bit number. For example, the range of velocities from {0–127} can be divided into 16 ranges of 8 values (e.g. {0–7}, {8–15}, {16–23}, and so on). Velocities falling within those ranges can be mapped to the 16 bits of a 16-bit number. Duplicate values or bits within each extraction area may be optionally suppressed from inclusion in the corresponding pattern step. The resulting pattern can then be used as an absolute velocity pattern or a modify velocity pattern, as previously described. It will be apparent to those skilled in the art that other pattern types discussed herein may be extracted in a similar fashion.

Although all MIDI events are contained in a single channel in the previous examples, data containing more than one channel can be used, and the channel information could be selectively utilized or ignored as desired.

While throughout this description the specific value patterns and random pool patterns are utilized separately, it can be seen that a hybrid pattern could be constructed combining the two methods. For example, a pattern could have one or more steps corresponding to random pool pattern steps, and one or more steps corresponding to specific value pattern steps, arranged in any order desired. Alternately, a specific value pattern may have one or more steps "flagged" to indicate a random choice is to be made from a pool of values located elsewhere, and still remain within the scope of the invention.

One or more of the previously described patterns may be combined. For example, a rhythm pattern and a cluster pattern may be combined, so that each step of the pattern not only indicates a rhythmic value or pool of values, but also so that each step of the pattern indicates a cluster value or pool of cluster values.

(2) CREATION OF AN ADDRESSABLE SERIES

CONVERSION TABLES

Conversion tables are well known in electronic musical instruments, consisting of lookup tables storing a plurality of values that require substitution, and values to substitute in their place. The tables can cover all 128 notes of the available MIDI pitch range, or portions thereof. One novel apparatus and method for employing a conversion table is described in a U.S. Patent Application entitled Method for Dynamically Assembling a Conversion Table having Stephen Kay as an inventor and filed on Jan. 28, 1999, which claims benefit of U.S. Provisional Patent Application Ser. No. 60/072,920, filed on Jan. 28, 1998, both the disclosures of which are incorporated by reference herein. One means of utilizing conversion tables in the following descriptions shall now be explained, although others could be employed and remain within the scope of the invention.

There are twelve notes in an octave {C, C♯, D, D♯, E, F, F♯, G, G♯, A, A♯, and B }, which can be represented mathematically by the values {0, 1, 2, 3, 4, 5, 6, 7, 8, 9, 10, 11}, often referred to as pitch classes. Regardless of which octave a note is actually in, it can be reduced to one of these 12 values by modulo 12 division. For example, 62 (D4) and 86 (D6) both yield the value 2 (D) when divided by modulo 12. Standard integer division of a pitch number by 12 will reveal the octave; for example, (62/12)=5 (D4 is in the 5th octave relative to 0). In the key of C, the root is indicated by the pitch class 0. Notes in a key other than C may be transposed to that key by subtracting the root pitch class from every note. For example, if the root is known to be F (5), then subtracting 5 from every pitch will place them in the key of C.

A conversion table for these pitch classes may contain 12 locations, each location corresponding respectively to the pitch classes {0–11}. Each location stores a value for substitution, which may or may not be the same as the pitch class. For example, a conversion table corresponding to a CMaj7 chord or scale may take the form {0, 0, 2, 4, 4, 7, 7, 7, 9, 11, 11}, indicating that a C♯ (in the location corresponding to pitch class 1) will be substituted with a C(0). To convert the pitch of a note, the pitch is transposed to the key of C, and reduced to its octave and pitch class. The pitch class is replaced with the value in the location of the table corresponding to the pitch class and placed back in the correct octave and key.

The conversion table can be part of a predetermined collection of parameters loaded as a whole by the user, or can be individually selected from a plurality of conversion tables stored elsewhere in memory, where the selection means could be one or more of the following: the operation of a chord analysis routine on input notes, or on a certain range of input notes; the operation of a chord analysis routine on an area of a musical controller such as a keyboard or guitar; the operation of a chord analysis routine performed on sections of a background track of music; markers or data types at various locations in a background track of music; or user operations.

ADDRESSABLE SERIES

There are four types of addressable series in the present invention:

(a) a note series consisting of pitch or pitch and velocity information;

(b) a drum note series (also referred to as a drum pattern) consisting of pitch and null values, or pools of pitch or pitch and null values, with or without associated velocity information;

(c) a digital audio note series consisting of pitch, or pitch and velocity information, along with identifiers of corresponding digital audio locations; and (d) a pointer series, consisting of a series of links or pointers to address locations in memory containing pitch or pitch and velocity information.

With regard to the first three types, an initial note series is created, in one or more of the following ways:

EXTRACTION FROM MUSICAL DATA

A note series consisting of pitch or pitch and velocity data may be extracted from preexisting musical data, in the same fashion as previously described for the extraction of patterns. Such musical data can be a file stored in memory, representing an entire song, melody, or portion thereof, and may consist of a list of time-stamped events. The file may be a predetermined file, or one which the user has recorded into memory. Since the location in memory of various types of data in memory can be determined, specific regions of note data can be extracted from the musical data and transferred to another memory location such as a temporary buffer, thereby creating an initial note series. The note series may then be utilized immediately, or can be stored in memory as one or more of a plurality of predetermined note series for use in later processing.

The extraction of the note series can be in real-time related to tempo, with or without output of the actual sequence data, can be performed in memory without output as fast as processing speed allows, or can be a combination of the two. For example, when actual playback of the sequence data is started or reaches the beginning of the next extraction area, the next extraction area can be processed independently without playing it, and the note series thereby extracted, before the continuation of the actual playback of the sequence data.

Extraction areas have been explained previously; in this example, the extraction area has been arbitrarily decided to be 90 ticks in length, and to start at the beginning of each beat and therefore end 90 ticks later (6 ticks before the beginning of the next beat), with other arrangements being possible.

Figure 36:
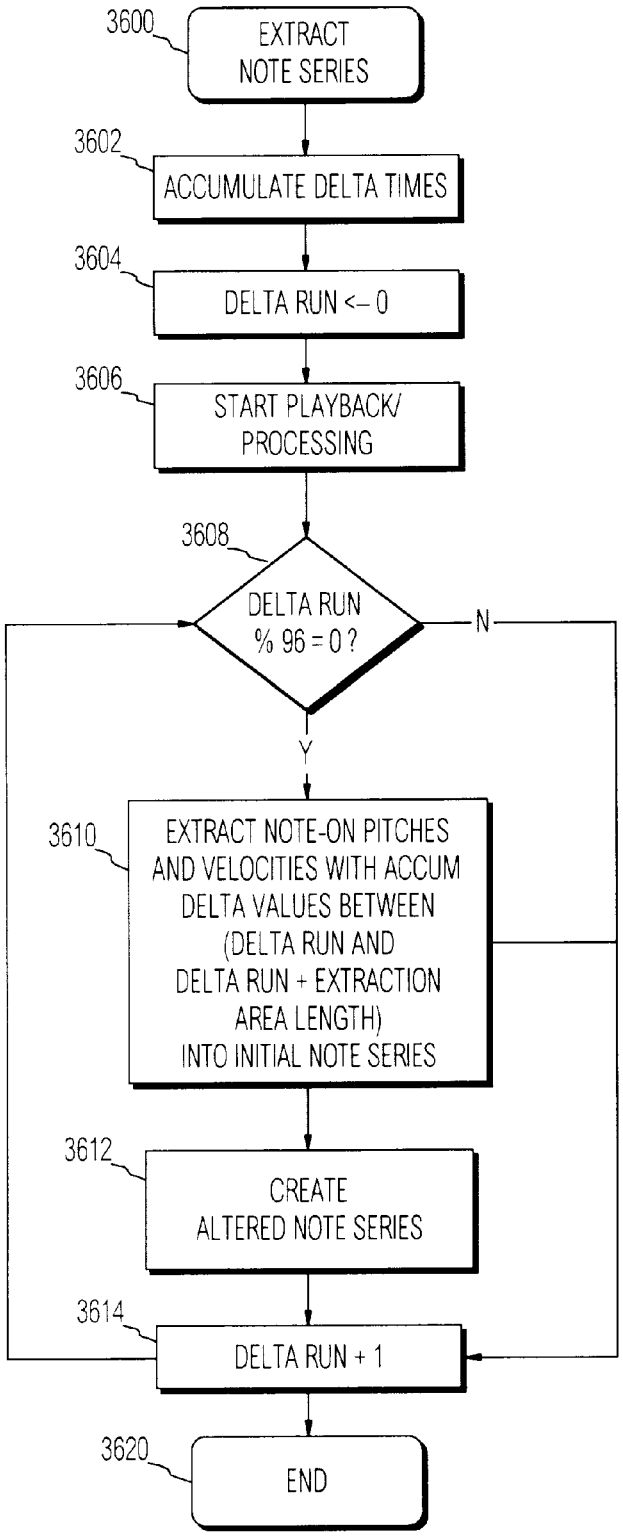
FIG. 36 is a flowchart of the process of extracting an initial note series from musical data.

FIG. 36 is a flowchart showing the extraction of note data from a musical source file in memory. First, an accumulated delta time is calculated for each event, by performing a running total of each event's delta time with the previous event's delta time 3602.

A running delta time "delta run" is initialized to zero in memory 3604. Then, playback or processing of the MIDI sequence is started. A loop consisting of the steps 3608 through 3614 is performed for every tick of processing according to the current timing resolution. Modulo division is then used to determine the beginning of a beat, where 96 is chosen to be the unit of ticks per quarter value in this example 3608. If the running delta time modulo 96 is not equal to zero, then it is not the beginning of a beat, delta run is incremented 3614, and the loop continues 3608. If delta run moduloed by the ticks per quarter 96 is 0, then it is assumed to be the beginning of a beat, and pitches and velocities of note-ons with accumulated delta times between delta run and (delta run+the extraction area length (90)) are extracted, in the order they are encountered in the musical data 3610. This is then transferred to a temporary buffer as an initial note series.

After the initial note series has been created, the creation of an altered note series (described later) can be immediately performed 3612, or can be bypassed and performed independently at other times. The routine ends when the playback or processing of data is finished, or according to user actions 3620.

Figure 37:
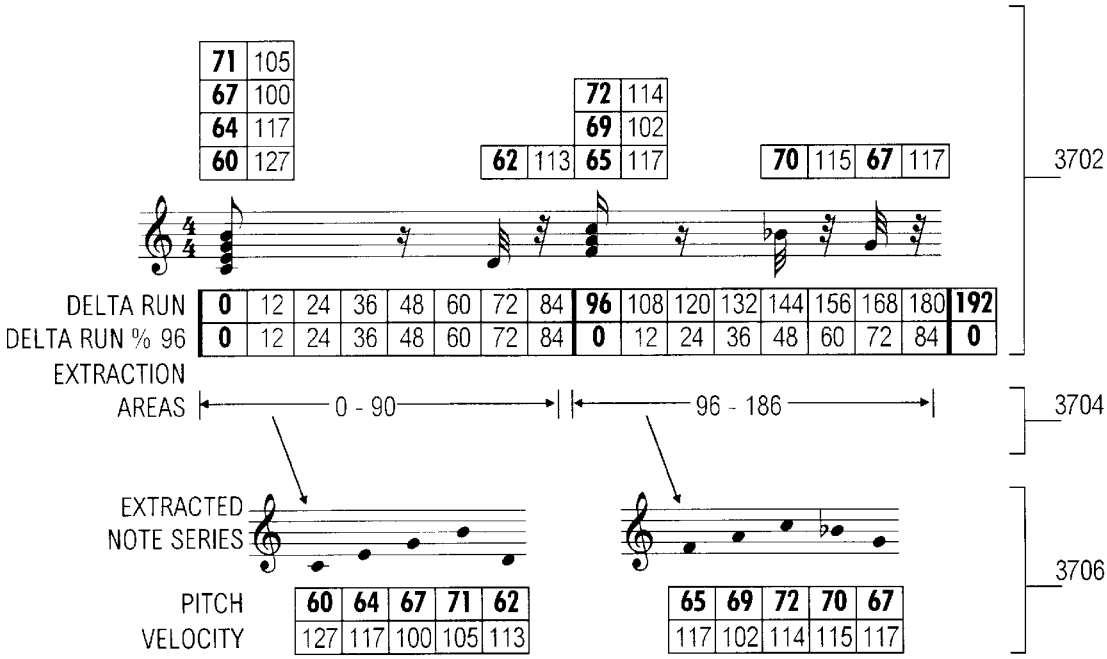
FIG. 37 is an example of the process shown in FIG. 36.

FIG. 37 illustrates an example of the previously described process, in which a note series is repeatedly extracted, once per beat. For the purposes of this discussion, an example Standard Midi File fragment 2 beats long is shown 3700, assuming a resolution of 96 ticks per quarter note. It may be noted that this is the same example data shown in FIG. 28. For clarity, all information other than note-ons and note-off events have been removed from this example, although other events could be present. Furthermore, although all events are contained in a single channel, data containing more than one channel can be used, and the channel information selectively utilized or ignored as desired. The column labeled "accum delta" (accumulated delta time) is not actually present in the Standard Midi File; it is calculated by performing a running total of each event's delta time with the previous event's delta time. The two extraction areas utilized during processing are shown.

The example Standard Midi File fragment is also shown in musical notation 3702. Above the notation is shown the pitches (in bold type) and the velocities of the note-on information. Underneath is shown the delta run value, and the delta run value after modulo division by 96, with the beginning of each beat in bold type.

The two extraction areas are shown 3704, utilizing the beginning of the beat plus the extraction area size. Finally, the resulting two initial note series that are extracted from the extraction areas are shown 3706, with the notes in the order they are met in the Standard Midi File. The first note series is extracted at beat 1 when delta run (0% 96) is equal to 0. The second note series is extracted at beat 2, when delta run (96% 96) is equal to 0. If this example contained more data, another note series would be extracted at beat 3, when delta run (192% 96) is equal to 0.

In this manner, once per beat or other time designation, the notes in a certain upcoming section of the musical data, either currently playing back or about to be played back, or currently being processed or about to be processed, can be extracted and designated the initial note series. When notes are transferred to a buffer storing the initial note series, the buffers may be cleared first so that new notes replace old notes. Alternately, the new notes could be added to the buffers without first clearing the old notes. After the initial note series has been created, an altered note series can be created immediately or created independently, as described later.

RETRIEVAL FROM MEMORY

An initial note series or drum pattern (drum note series) can be retrieved from a plurality of initial note series or drum patterns in memory. They may have been extracted from a source of musical data and stored in memory, as just explained, or created independently and stored in memory.

As an additional method, a predetermined note set can be retrieved from memory and transferred to another memory location, creating the initial note series. The note set can be arbitrary or correspond to a specific chord or scale type. For example, a chord designated CMin7 in the 5th octave can be stored as a note set consisting of the pitches specified absolutely as {60, 63, 67, 70}. Alternately, the pitches can be stored according to the pitch class of each note, where C through B correspond to 0 through 11 respectively. Values greater than 11 can be used to indicated the same 12 pitch classes in a higher octave. A chord designated as Maj7_9 might be stored as {0, 4, 7, 11, 14}. The retrieved set of notes can then have a certain multiple of 12 added to all of them to place them in a particular octave, and the pitch class corresponding to a key added to them to put them in a specific key. For example, to retrieve a DMaj7_9 in the 5th octave, each retrieved pitch in the note set of Maj7_9 would have 60 (5th octave relative to 0) and 2 (pitch class of D) added to it, resulting in {62, 66, 69, 73, 76} in the initial note series. The note sets may also contain velocity information associated with each pitch.

The note sets can also be drum patterns containing a null value as previously described. The null values can remain unaltered when performing the previously described mathematical operations on the pitches in the note set. For example, if a note set specified by pitch class was {0, 4, 7, 11, (null value), 14}, then placing the note set in the 5th octave by adding 60 would result in the note data: {60, 64, 67, 71, (null value), 74}.

The note sets can be retrieved on user demand, or at repeated specific intervals of time, such as every 2000 ms. In the case of the source data being a song or melody, the specific interval of time can be once per beat, or once per measure, or other musical timing related to the tempo and beat of the song. The choice of which note set to retrieve can be arbitrary or based on chord analysis of the source material. After the initial note series has been created, an altered note series can be created immediately or created independently, as described later.

REAL-TIME CREATION OF A NOTE SERIES

Real-time creation of an initial note series is accomplished by adding an incoming note (pitch, or pitch and velocity) to a temporary buffer when a MIDI note-on message is received, and removing the note when receiving a corresponding MIDI note-off message. In this manner, the temporary buffer contains all notes currently being sustained at a particular moment. The order that the received notes are kept in inside the buffer are not important, but may be maintained in any matter that is convenient.

The arrival of a first note-on or other predetermined event starts a time window, whereby after a certain number of milliseconds the current collection of notes in the buffer is transferred to another memory location, creating the initial note series. In this manner, collection has occurred for a certain time interval, and the series will be created from all notes currently sustaining at the end of the time window. After the completion of the time window, the next subsequent note-on or predetermined event would be considered the first note-on and again start the time window and subsequently end the collection of notes after the desired interval.

Figure 38:
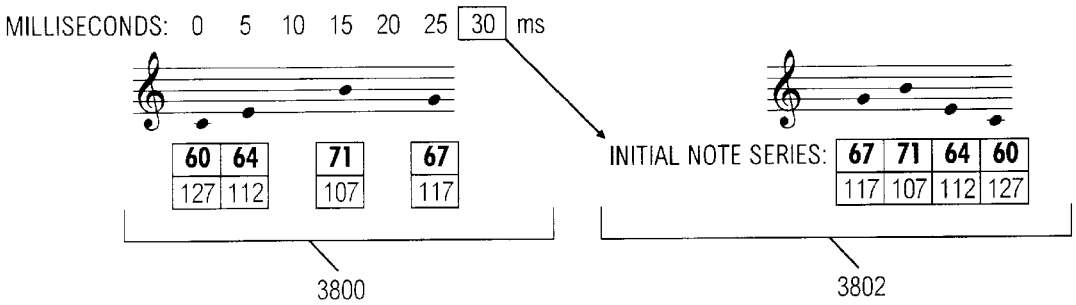
FIG. 38 is an example of the creation of an initial note series in real-time.

An example is shown in FIG. 38, where the arrival of four notes over time are shown in musical notation 3800, with pitches displayed in bold type and their associated velocities. The arrival of the first note starts a time window (in this example, an arbitrary value of 30 milliseconds with others being possible); the second, third and fourth notes are shown arriving respectively at 5, 15 and 25 ms after the first note. After 30 ms have passed from the receipt of the first note, the notes are transferred and become the initial note series of four pitches and velocities shown in 3802. The notes may be transferred in any order that is convenient.

As an alternative method or in conjunction with the time window, the note data can be transferred to another memory location and become the initial note series on user demand or at repeated specific intervals of time, such as every 2000 ms. In the case of the source data being a song or melody, the specific interval of time can be once per beat, or once per measure, or other musical timing related to the tempo and beat of the song. Optionally, if there are not a certain number of notes in the buffer, the transfer of the data can be selectively suppressed if desired. In the case of the musical data coming from an external device, a method of determining the beat is utilized, such as counting the number of clock ticks that have passed since the beginning of the song and performing modulo division based on the time resolution employed. Alternately, some other data may have been placed in the musical data indicating the location of the beats, such as a controller message.

As an additional alternate method or in conjunction with any of the previous methods, the note data can be transferred to another memory location and become the initial note series upon the receipt of a predetermined number of events, such as the receipt of a predetermined number of notes, or a predetermined number of sustaining notes being contained in the temporary buffer.

Figure 39:
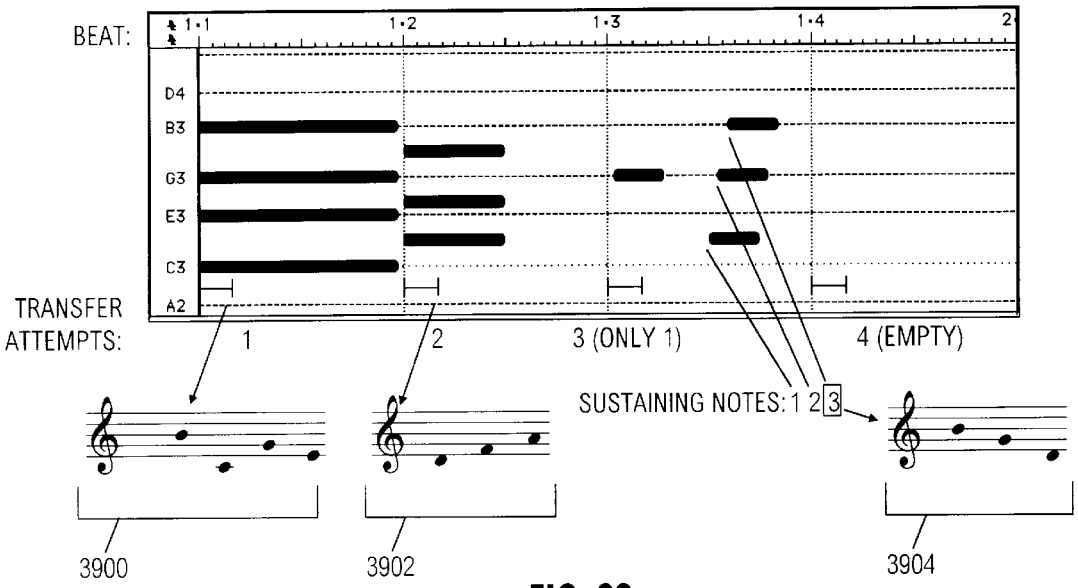
FIG. 39 is an example of the real-time collection of musical data from a song or melody.

An example of the real-time collection of musical data from a song or melody is shown in FIG. 39. A graphical example of a 4 beat section of musical data is shown in piano-roll format. The beats are labeled {1.1, 1.2, 1.3, and 1.4.} A location at which to repeatedly transfer the sustaining note data and create the initial note series has been arbitrarily decided to be a certain number of ticks or milliseconds after the occurrence of each beat, shown as "transfer attempt." It has been arbitrarily decided that no transfer will take place if the temporary buffer does not contain at least 3 notes when the transfer attempt is made. Furthermore, it has also been arbitrarily decided that if such a transfer does not take place, the arrival of the required number of sustaining notes before the next transfer attempt will immediately create the initial note series.

While the data is being played, the transfer attempts are repeatedly made. Shortly after beat 1.1, a successful transfer attempt 1 results in the four item initial note series shown in 3900, since four notes are currently sustaining. Transfer attempt 2 results in the three item series shown in 3902. When transfer attempt 3 is made, there is only one note currently sustaining in the temporary buffer, so the transfer is not made. Since the transfer was not made, if three notes are sustaining at any time before the next transfer attempt, the initial note series will be created. As shown in the center of beat 1.3, three notes arrive very close together. With the arrival of the third note, there are now three notes sustaining, and the notes are transferred, creating the initial note series shown in 3904. At transfer attempt 4, there are no notes sustaining so no transfer is made; furthermore no other notes arrive within beat 4 to cause the transfer.

While not shown for clarity, it can also be configured that the release of all sustaining notes allows the receipt of the required number of sustaining notes to create the initial note series, even after a successful transfer attempt has been completed. For example, in beat 2.1 a transfer attempt is successfully made, creating an initial note series of three notes. The notes are no longer sustaining approximately halfway through the beat. If three more notes arrived somewhere before the end of the beat, they could be allowed to create a new initial note series if desired. Alternately, the release of the sustaining notes can not be required, but another criteria may be used to cause a new transfer, such as the number of sustaining notes increasing or decreasing beyond the number that were present when the transfer attempt was made.

In one method of operation, the temporary buffer is not emptied after the initial note series has been created, so that new note-on messages may continue to add notes to the current collection in the buffer, and note-off messages may continue to remove notes from the current collection. Alternately, the buffer can be emptied after the initial note series has been created, and corresponding note-offs for the sustaining notes ignored. After the initial note series has been created, an altered note series can be created immediately or created independently, as described later.

In the case of song data being loaded into memory, it is not necessary to actually store the note-ons in a temporary buffer, and remove them when receiving corresponding note-offs. Since the entire file or portions of it are loaded into memory, it can be processed by any method of determining how many notes are sustaining at a given point in time, and the creation of the initial note series performed as described above.

REAL TIME CREATION OF A DIGITAL AUDIO NOTE SERIES

Pitch detection algorithms and amplitude detection algorithms are well-known in the industry, one example being a product known as the IVL Pitchrider. Audio from an input source is processed through an analog-to-digital-converter (ADC) and analyzed, and a pitch and velocity thereby determined, which can then be converted to MIDI note-ons and note-offs. Also existing are products such as an electric guitar with a specialized hex pickup, where the sound from each string is capable of being independently transmitted on a separate audio channel. By combining the two methods, when a chord is played on the guitar, the individual strings are received as audio data, and are each analyzed to determine the pitch and relative amplitude (corresponding to velocity).

A digital audio note series consists of pitch, or pitch and velocity information, along with identifiers of corresponding digital audio locations. It may be created in real-time from incoming audio data by recording digital audio data into buffers. The audio is then analyzed with a pitch detection algorithm to provide the pitch, and an amplitude detection algorithm to provide the velocity if desired. The pitch (or pitch and velocity) are then stored along with the identifier of the buffer that contains the digital audio data in a temporary buffer.

After a certain interval of time, or upon one or more predetermined events as previously described, the pitches or pitches and velocities stored in the temporary buffer are transferred to another memory location, along with the corresponding identifiers of the digital audio buffers with which they are associated, thereby becoming the initial digital audio note series. As previously described, when the information is transferred to another memory location the destination buffer may be cleared of old information and replaced with the new information, or may be added to the old information.

An example shall use the previously mentioned guitar with a hex pickup, so that the guitar is capable of transmitting each string separately on one of six audio channels. A predetermined number of digital audio locations (DALs) exist in memory, each containing a pointer to a buffer into which digital audio data is to be recorded, and locations to store an analyzed pitch and velocity. In this example there will be six DALs, one for each string of the guitar, although other arrangements are possible. The DALs are assumed to have identifiers of {1 to 6} by which they can be located in memory during processing (dal id). The 6 DALs can have a fixed correspondence to the 6 strings of the guitar, i.e. string 1 records into the buffer indicated by DAL 1, string 3 records into the buffer indicated by DAL 3, and so on. Alternately, the DALs can be allocated in the order in which audio input is received, i.e. the first string to play is recorded in to the buffer indicated by DAL 1, the second in DAL 2, and so on. While the present example uses the fixed correspondence method, the other could have been used.

When one or more strings are played on the guitar, the channels of audio data are received, converted via ADCs and recorded into the buffers associated with the DALs. Immediately upon receipt of the audio, the individual channels are analyzed to provide the pitch and the velocity, which is then stored in the DAL. An in use flag is set to "yes" for each DAL for which pitch and velocity analysis is successful. If unsuccessful or the DAL is empty (e.g. the corresponding string was not played), the flag is set to "no". Furthermore, when the audio on a particular channel ends, the in use flag may be set to "no." DALs with the in use flag set to "no" can be ignored later on during processing.

In the following example, a six note standard open E chord is played on the guitar, which causes the following notes to begin recording into the digital audio locations, and the following pitches and velocities to be analyzed from the audio:

| Audio | dal id | DAL pitch/DAL velocity |
|---|---|---|
| E2 | 1 | 40/117 |
| B2 | 2 | 47/127 |
| E3 | 3 | 52/127 |
| G#3 | 4 | 56/107 |
| B3 | 5 | 59/115 |
| E4 | 6 | 64/118 |

Figure 40:
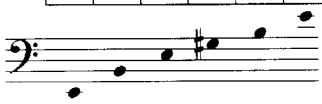
FIG. 40 is an example of a digital audio note-series.

After a certain interval of time, or upon one or more predetermined events as previously described, the pitches or pitches and velocities stored in any DALs that are in use are transferred to another memory location, along with the corresponding dal id with which they are associated. FIG. 40 shows the initial digital audio note series thereby created from the example above, and its corresponding musical notation. The additional location original pitch is a copy of the pitch, and shall be described during the creation of an altered note series. Should the additional step of creating an altered note series not be used, these locations could be omitted.

Although this example utilizes a 6 channel system along with a hex pickup, it could be configured that a single audio input such as a microphone or other device could be manually or dynamically switched between several discrete audio channels.

POINTER SERIES

The fourth type of addressable series, a pointer series, is created by utilizing a similar approach to the previously described method of extracting a note series from preexisting musical source data. The source of musical data can be a file stored in memory representing an entire song, melody, or portion thereof, consisting of a list of time-stamped events. The file can be a predetermined file or one that the user has recorded into memory. Since the address in memory of each note in the musical data in memory can be determined, specific regions of note data can be processed whereby the addresses of the note-ons can be repeatedly acquired and stored in an array of sequential memory locations, or a linked list of memory locations, thereby creating a pointer series. The creation of the pointer series can be performed in real-time related to tempo during playback of the musical data, with or without output of the actual musical data, or can be performed in memory without output as fast as processing speed allows, with the results stored in other memory locations.

Specific locations, such as the beginning of each beat or the beginning of a measure can be used to initiate processing of a specific section or sections of the memory and the creation of the pointer series, such as the beat or measure of data that is about to begin playback.

(3) CREATION OF AN ALTERED NOTE SERIES

Once the initial note series has been collected, retrieved, or extracted from the musical source data and placed in memory, various operations or manipulations can be performed on it to alter and expand it if desired. The altered note series may be created directly as a result of the completion of one of the previously described methods of creating an initial note series, or it may be created at any time by various user actions, thereby altering the initial note series on demand.

Figure 41:
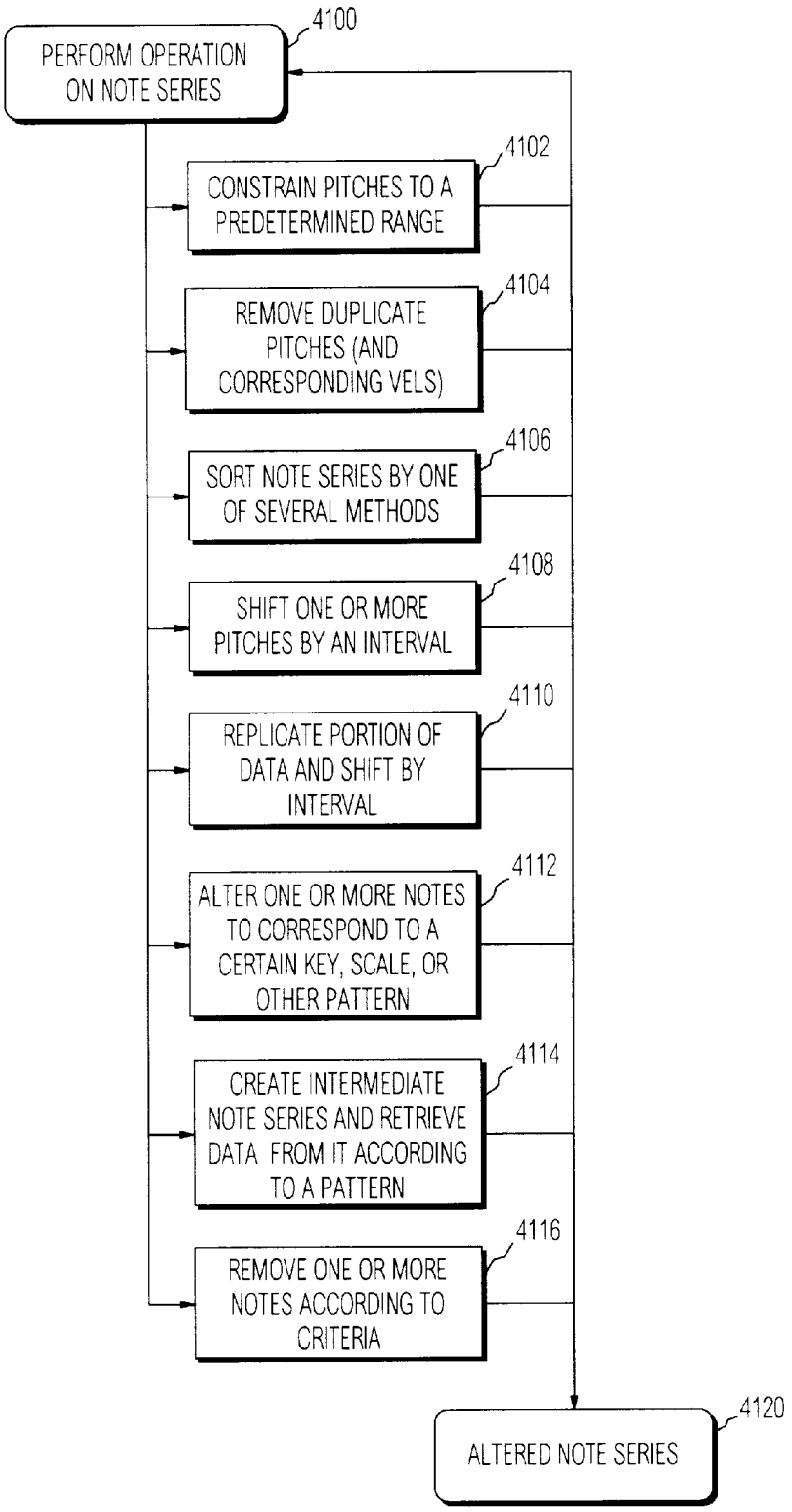
FIG. 41 is a flowchart of the process of creating an altered note series.

FIG. 41 is a flowchart of the process for creating an altered note series. Each of the following steps can be used as desired on part of or all of the note series in any desired combination. Therefore, the flowchart illustrates each step as returning to the starting point 4100, from where another step can be selected and performed, or completing the operation 4120. Furthermore, each step may, in the course of operation, be skipped or performed more than once at different locations in the sequence of steps, before the altered note series is completed 4120. Since each step may occur in any order or more than one time, note series in the following descriptions refer to the current state of the data in memory which may have already been modified by another step, not necessarily the original starting note series.

The pitches in the note series may span a great number of octaves. One or more pitches may be constrained to a predetermined range, such as a particular octave or any other user-defined range 4102. This can be done by testing each note in the note series, and if it is not within a specified range, transposing its pitch by an interval until it is within the required range.

Duplicate pitch values in the note series (and corresponding velocities and/or dal ids if applicable) may be selectively removed as desired 04. This can be done by comparing the pitch of each note in the note series with adjacent or non-adjacent pitches, and removing them if they are the same. The comparing and removal can be performed so that no notes with the same pitch remain, no adjacent notes having the same pitch remain, no notes with the same pitch remain in a predetermined area of the note series, or any combination thereof.

The notes in the note series will be in a particular order, which may be re-ordered by sorting all or selected portions of the notes according to pitch or velocity 4106. If desired, the pitch or velocity component of the note may remain with the other component when sorting by the other component. In the case of a digital audio note series, the digital audio location ID (dal id) component remains associated with the pitch component, as does the original pitch component. Furthermore, the order imposed may be ascending, descending, random, or some other selected method of re-ordering the notes.

The pitches in the note series may be shifted by an interval such as an octave, a fifth, etc. Some or all of the pitch values may be shifted, or every other, every third, or other method of selection of pitches as desired 4108.

The note series may be extended by replicating selected portions of it, and adding it to the end of the note series or inserting it in the note series 4110. Furthermore, the pitches in all or portions of the replicated data may be shifted by an interval such as an octave, a fifth, or other interval as desired.

Portions of the note series may be selectively replaced with other data. Pitches in the note series may be shifted to correspond to a certain key or scale, or other desired pattern 4112. Atonal pitches may be shifted to tonal pitches by analyzing the original note series and selecting a conversion table corresponding to chord type, where the conversion table stores a plurality of values that require substitution, and values to substitute in their place.

The initial or current state of the note series may be stored as an intermediate note series in a series of sequential memory locations from 1 to "n," from which a new note series may be constructed by retrieving selected portions of the intermediate note series 4114. This may further be accomplished by retrieving notes according to an index pattern of absolute memory location addresses, such as {1, 3, 2, 4}, wherein the first note would be retrieved, then the 3rd note, then the 2nd note and so on. Alternately, this may further be accomplished by choosing a starting location in the intermediate note series such as the first note, and moving through the intermediate note series and retrieving the notes at various locations by using an index pattern specifying movement from current location, such as {1, 3, −1, 2}, where the starting note would be retrieved (for example, the note at index 1), then the next note forward from the starting note 2 (1+1), then the note 3 steps forward 5 (2+3), then the note 1 step backwards 4 (5−1) and so on. Choice of the pattern value to use next is done by starting at the first pattern step and using each subsequent step until reaching the end of the pattern and returning to the first step; other methods are possible.

One or more notes can be removed from the note series based on predetermined criteria 4116. The criteria may include removing notes of a certain pitch class with regards to a current chord and key, or notes with predetermined pitches or velocities.

If the initial note series is a drum pattern containing null values as previously described, the above steps can be performed in a like fashion with the exception that when the pitches are shifted, altered, or transposed the null values remain null values, and are not changed to new values. If the initial note series is a digital audio note series, when the pitches are shifted, altered, or transposed, the original pitch component is not altered. Therefore, each step of the resulting note series may have a transposed pitch component that is different than the original pitch component. These differences are used later on in the reading out of the data.

Figure 42:
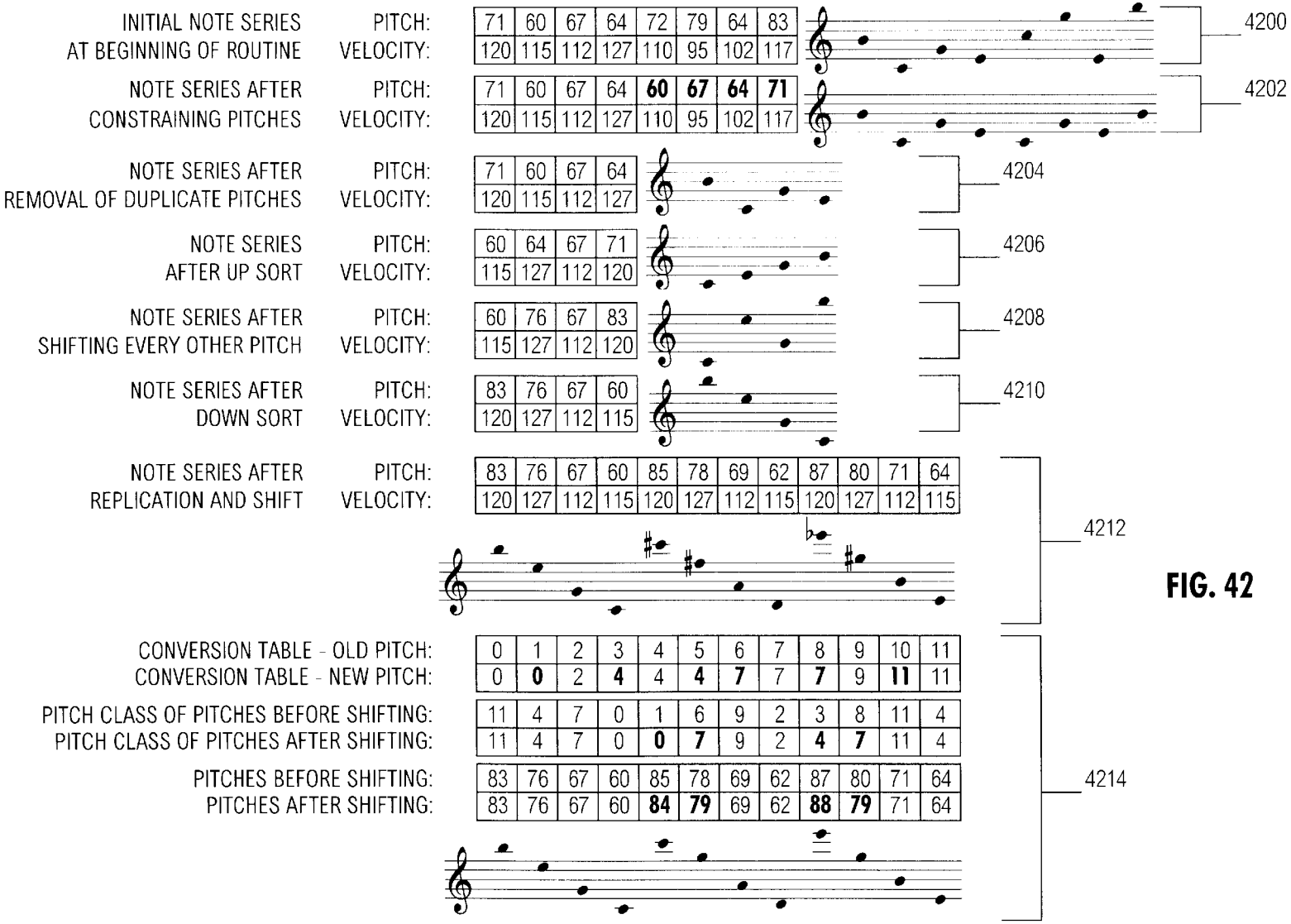
FIGS. 42 and 43 are examples of altered note series generated by the process shown in FIG. 41.
Figure 43:
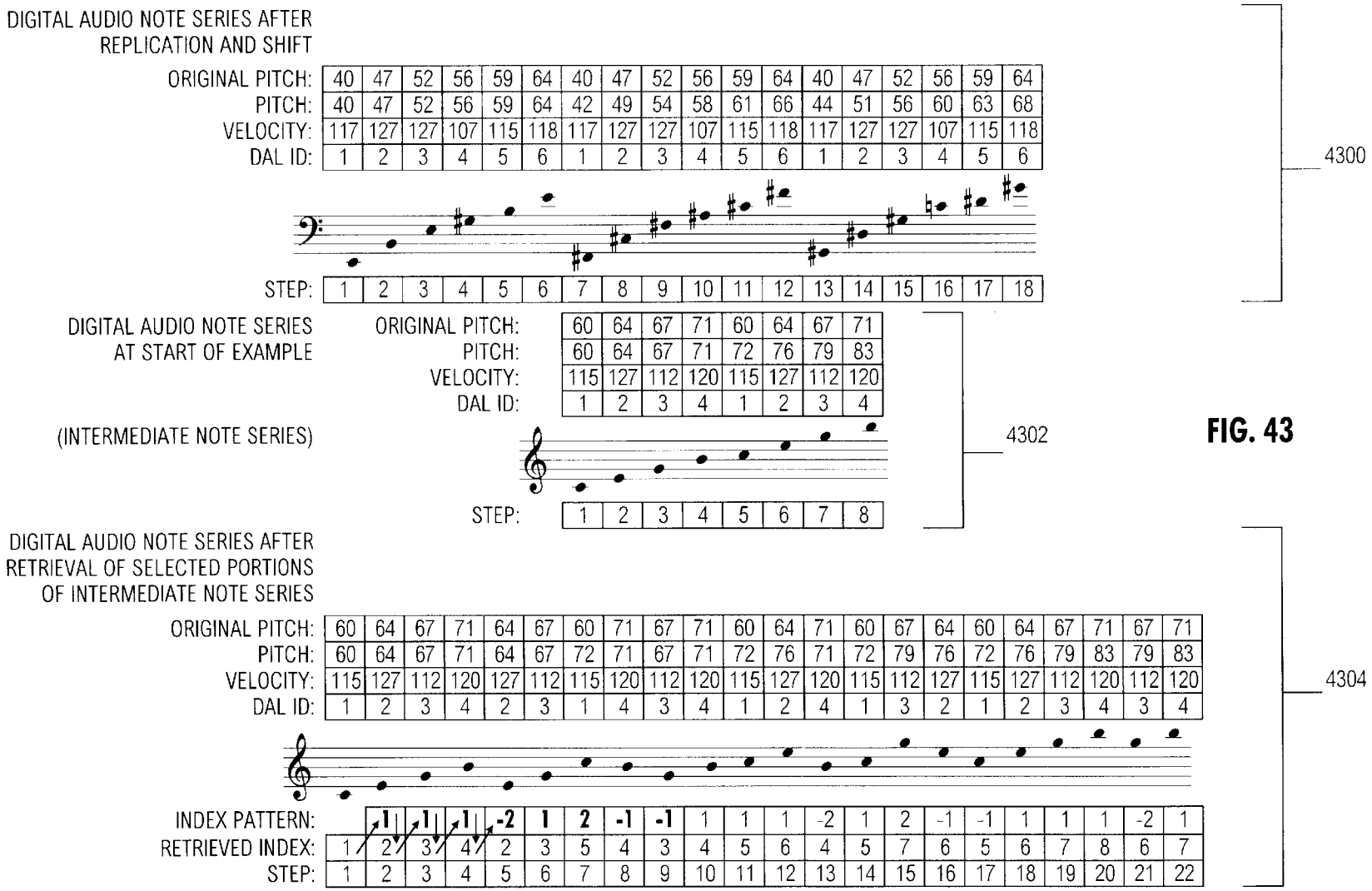

FIG. 42 and FIG. 43 illustrate examples of altered note series created with the process of FIG. 41. Referring to FIG. 42, the various steps will be shown operating on the data one after the other and continually modifying the note series. As described previously, steps may be omitted or performed more than once, in other orders than the one illustrated here. An 8 step initial note series comprised of a series of pitches and velocities stored in consecutive memory locations is shown first 4200. The note series after the step of constraining the data to a particular range is shown next 4202. In this case, the range is the same octave as the first note. As can be seen, the last 4 notes are now duplicate pitches of the first four notes and are shown in bold type. The 4 step note series with duplicate pitches and their corresponding velocities removed is illustrated next 4204. In this case, all the duplicates are removed, but one or more of them could have been left in the note series.

The next section shows the note series after the further step of sorting according to pitch where the velocities have remained paired with the original pitch 4206. In this case, the ordering of the pitches is in an upwards direction; other orders are possible. Following is the note series after the further step of shifting selected pitches by an interval 4208. In this case, every other pitch has been shifted upwards by the interval of an octave; other orders and intervals are possible. Next is the note series after the further step of an additional sorting according to pitch where the velocities have remained paired with the original pitch 4210. In this case the ordering of the pitches is in an downwards direction, other orders are possible.

The note series after the further step of replicating the data two additional times, and shifting the pitches in each replication by an interval is illustrated next 4212. In this case, the interval for the first replication is 2, and the interval for the second replication is 4, although, other intervals are possible including the use of a pattern of values where each successive value indicates an amount by which to shift the next replication. Furthermore, although all of the data was replicated twice, resulting in a 12 step note series, other values are possible including replication of only a portion of the notes in the series. Finally, the note series is shown after the further step of shifting pitches according to a conversion table storing a pitch class of 0 to 11 corresponding to the 12 notes of an octave, and the same or different pitch class 4214. Each pitch is first reduced to its pitch class by modulo 12division, and used as an index into the conversion table, where either the same or different pitch class is stored, from which the pitch class is retrieved and placed back in the same octave as the original pitch. Altered pitches are shown in bold type. While the use of a 12 step conversion table is shown here with modulo 12 division, the conversion table could alternately be 128 by 128 values, one for each MIDI note number, or any portion thereof, utilizing different values for division or no division as desired.

Referring to FIG. 43, an example of an 18 step altered note series created from an initial digital audio note series is shown, after the further step of replicating the data and shifting the pitches in each replication by an interval 4300. The initial note series was the 6 step digital audio note series shown in FIG. 40. In this example it has been replicated two additional times, with the first replication shifted by an interval of 2, and the second replication shifted by an interval of 4. As illustrated, the dal ids (identifiers of the associated digital audio buffer) remain associated with the pitches as they are replicated and shifted, as do the original pitches. Furthermore, the original pitches are not shifted or transposed, as shown.

The step of storing an intermediate note series and creating a new notes series by retrieving portions of it with an index pattern is shown next. An example 8 step digital audio note series that has been created by several of the steps previously described is shown 4302. This is stored in memory as the intermediate note series. The resulting 22 step note series 4304 is created by starting at the beginning of the intermediate note series, and retrieving notes at subsequent locations by moving through the intermediate note series with an index pattern. The actual length of the index pattern is 8 items and is shown in bold type. The first value is used, then the next value and so on until the end of the pattern, after which the index pattern is applied by starting at beginning again. Other methods of movement such as backwards, using the next value +1, etc. are possible. As shown, the dal id remains associated with the note as it is retrieved, as do the original pitch.

The index pattern indicates the number of memory locations to move forwards or backwards from the current location in the intermediate note series and from which to retrieve the next note. The retrieved index shows the locations of the intermediate note series that are retrieved for each step of the resulting note series. For example, step 1 starts with index 1 of the intermediate note series. At step 2, the first value of the index pattern 1 is added to the last retrieved index 1 to yield index 2 (1+1). At step 5, the next value of the index pattern −2 is added to the last retrieved index 4 to yield index 2 (4+−2). In this case, the range of the intermediate note series is used as the determining factor in when to stop retrieving data, in that if the index moves beyond the first note or last note the step would be completed. Other means such as an absolute number of notes may also be applied. Furthermore, although in this case single notes are being retrieved, more than one note could be retrieved from the present location and other adjacent or nonadjacent locations. While this example utilizes a note series that was already altered by several previous steps, an initial note series can also be altered in this manner without performing any of the other steps.

Although not shown, the step of removing notes based on criteria could also be applied to the preceding examples. For example, it could be specified that every note with a pitch class of 4 (E) is to be removed. Using the example in 4304, the notes at steps 2, 5, 12, 16, and 18 would be removed, leaving a 17 step note series.

Although the previous examples use pitch and velocity in creating the note series, the note series can be created using pitch values alone. As can be seen, different and diverse musical phrases in memory can be created from pitches and velocities, or pitch values alone; furthermore, by varying the index pattern and other applicable parameters, different musical phrases can be created from the same input notes. Note that at this point the note series in these examples consists simply of note numbers and velocities, with or without dal ids—there is no rhythmic information associated with it.

The resulting altered note series can be placed in memory for the reading out of data as described next, or stored as a predetermined note series in one of a plurality of memory locations for later use in the reading out of data.

(4) READING OUT DATA

A musical effect is generated by reading out data stored in memory, using various independent patterns that control when and how often the data is read out, which locations the data is read out from, how much data is read out each time, and other attributes. The data stored in memory can be a note series or other types of predetermined data stored in memory, in which case the values stored in the memory locations are read out. The data in memory can be a pointer series, in which case the values at the memory addresses pointed to by the pointer series are read out. In the case of a digital audio note series, the values read out are used to modify and playback the digital audio data stored in other memory locations. Furthermore, the data is not restricted to the examples given here but could encompass other types of data in memory, such as individual samples of digital audio data.

When the data is read out, it may be issued immediately, or may be scheduled to be issued at some time in the future. A system clock is used for reference, such as a value in memory that starts at 0 when the process is begun, and increments repeatedly every 1 millisecond. Alternately, it could be a number of clocks or ticks counted at a base resolution related to tempo, such as 96 clocks per quarter note. The current value of this clock shall be referred to as now time. While throughout this discussion the 1 millisecond clock method is utilized, the other method could alternately have been employed.

Data is produced at scheduled times by placing events in a task list in memory (list of tasks to perform) along with an absolute time at which to perform each task, maintained in the order of the soonest to the farthest away in time. Each time the system clock increments the list is checked to see if the first event's time is now equal to (or less than) the system clock, and if so, all events with the same time or less than the system clock are issued and removed from the list.

Various processes can be scheduled in this manner, so that a call to a specific procedure or routine can be set to occur at some point in the future (e.g. now time+"n," where "n" indicates a number of milliseconds or clock ticks). When this happens, the procedure is called and passed a pointer to a memory location containing the data with which to perform the procedure. For example, to issue a note-on at a certain time in the future, a pointer to a procedure that issues note-ons is stored in the list, along with a pointer to the note-on data to send out. One well-known example is the programming language "Max" and its publicly available developer's kit, marketed by Opcode Systems Inc. In the following flowchart diagrams, a step in which an operation is scheduled in the future in this manner is shown as a square box with a black stripe down the left side.

The process of reading out data can be performed using one of two different modes: (a) clock event advance mode, and (b) direct indexing mode. Before describing these two modes in detail, some other aspects of the process shall be described.

PARAMETER MEMORY—PHASES

A phase is a discrete, self-contained exercise of the method, including all of the parameters and patterns used in the reading out of data. One or more such phases may be utilized and each phase may be unique. In other words, in the case of two or more phases, the second phase could have a different rhythm pattern and/or a different cluster pattern than the first phase, and so on. At any given time, one of the phases is the current phase, meaning that its parameters control the current performance in reading out data.

Figure 44:
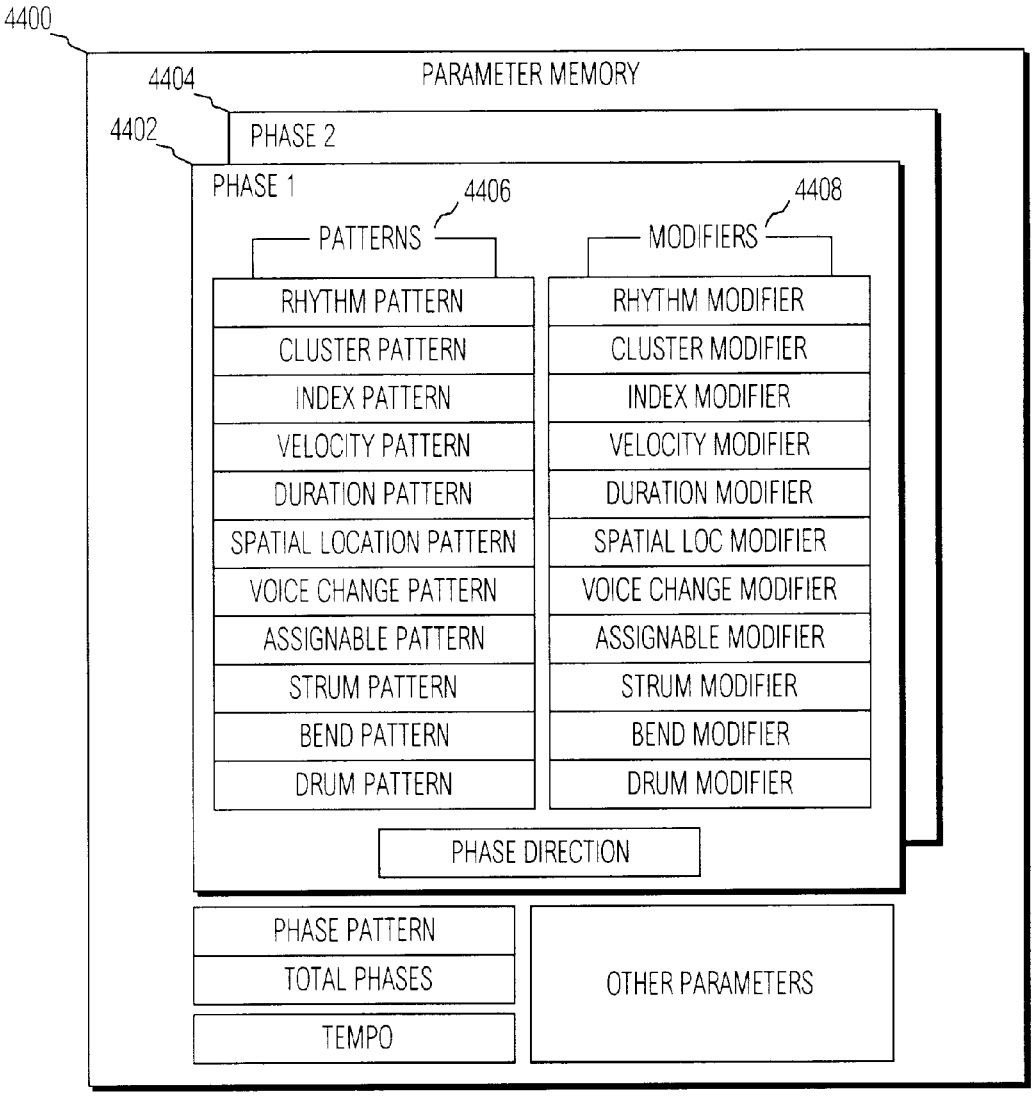
FIG. 44 is a diagram of parameter memory locations.

Referring to FIG. 44, within an overall parameter memory 4400 are shown two phase parameter memory locations 4402 and 4404. Each of them contain the same memory locations corresponding to a number of patterns and other parameters. Although this example uses two phases, there could be only one, or more than two. It would also be possible for the phase pattern to indicate the order in which to read from stored memory (ROM, RAM or other storage medium) the appropriate patterns and other parameters from a plurality of such patterns and parameters and load them into a single phase location in memory in real-time, or even to simply indicate a series of stored memory locations to point to. The exact location of the phases and whether they are in RAM or other storage is not important.

Within each phase's parameter memory locations are a group of patterns 4406, and associated pattern modifiers 4408. These patterns may be specific value patterns or random pool patterns as previously described. One or more patterns may come from either category. The various pattern types and pattern modifiers have been previously described in detail, and shall be further explained as necessary at the appropriate points in the following description. A phase direction indicates a general direction of movement in each phase, by influencing the way the index pattern is used, described later. In the present embodiment, each phase may have a phase direction of either "up" or "down." If the current phase direction is up, addition is performed with the value of the index pattern, and if the current phase direction is down, subtraction is performed.

Within the parameter memory are several locations outside of the phase parameter memory locations that relate to the use of phases. A phase pattern may be used to control which phase's memory locations are currently being used during processing. An example of derived values from a phase pattern may take the form {1, 1, 2} indicating that phase 1 will be run twice in succession, then phase 2's memory locations will be used once, then phase 1 again twice, and so on. Each step of the phase pattern may contain additional data indicating one or more parameters to change and new values to change them to. When the phase is changed, the indicated parameters can be changed to the new values, thereby controlling other portions of the process. The additional data may also indicate that procedure calls are to be made to other portions of the process, or that random seeds are to be reset to stored, repeatable values. A number of phases to complete can be specified (total phases), whereby generation of the effect can be terminated after completing the required number of phases.

The current phase can be set by the user and/or is determined by the phase pattern. As shall be explained later, stored in other memory locations are indexes into the phase pattern, and pointers to the memory locations of the 2 phases that are switched during processing. A phase change is deemed to occur by one or more of several methods, such as whether a note series index is within a certain range, or a certain number of notes have been generated, or a certain number of clock events has occurred, or a certain period of time has passed, or upon user demand.

When a phase change occurs, the various pattern indexes stored in other memory locations (which maintain the next value of each pattern to use) may be optionally and individually reset to starting values, so that each phase's patterns may seem to start at a certain repeatable point. Alternately, the reset may be omitted so that the patterns continue from the present step although the pattern may have changed. Furthermore, any parameters specified by the phase pattern step may then be changed, any random seeds specified by the pattern step may be reset, and any procedure calls indicated by the pattern step may be made, thereby controlling other portions of the process.

A tempo parameter also exists which is a value in beats per minute (bpm) specifying the overall tempo rate of the effect. Other memory locations and parameters that are used in the processing but not specifically disclosed here shall be described at the applicable point in the following descriptions.

All of the various parameters can be part of a predetermined collection of parameters loaded as a whole by the user from a plurality of predetermined collections of parameters, or each parameter may be individually set and/or modified by the user.

ENVELOPES

The use of envelopes in electronic musical instruments is well known. In general, an envelope is an independent process that indicates a shape of a function or calculation over time. It has a number of segments, and each segment has a level value and a time value. The level specifies a new value to move to, and the time specifies how long it will take to get there from the previous level. In other words, once started, an envelope will continuously calculate a value representing its present position on a pathway defined by the levels and times. Other well known modifications or variations of envelopes allow them to run forwards or backwards over specified portions, or loop between various points in the envelope, so that when reaching a predetermined point the process may skip back to another predetermined point and continue doing so indefinitely, or specify one or more segments as sustain level segments, where processing will pause until restarted by predetermined actions, among others.

The level is a value within an arbitrary range that may relate directly to a specific parameter to be changed, or may be a general range that is scaled into other desired ranges. In the present example, the range for a level value is {0–100}, with other ranges being possible. The time is a value within an arbitrary range representing an amount of time between one level and another. The range may be in absolute values such as {1–2000 milliseconds}, or may be an abstract range that is scaled into units of time. In the present example, the range for a time value is also {0–100}, which is then scaled into a range of absolute millisecond values.

Figure 45:
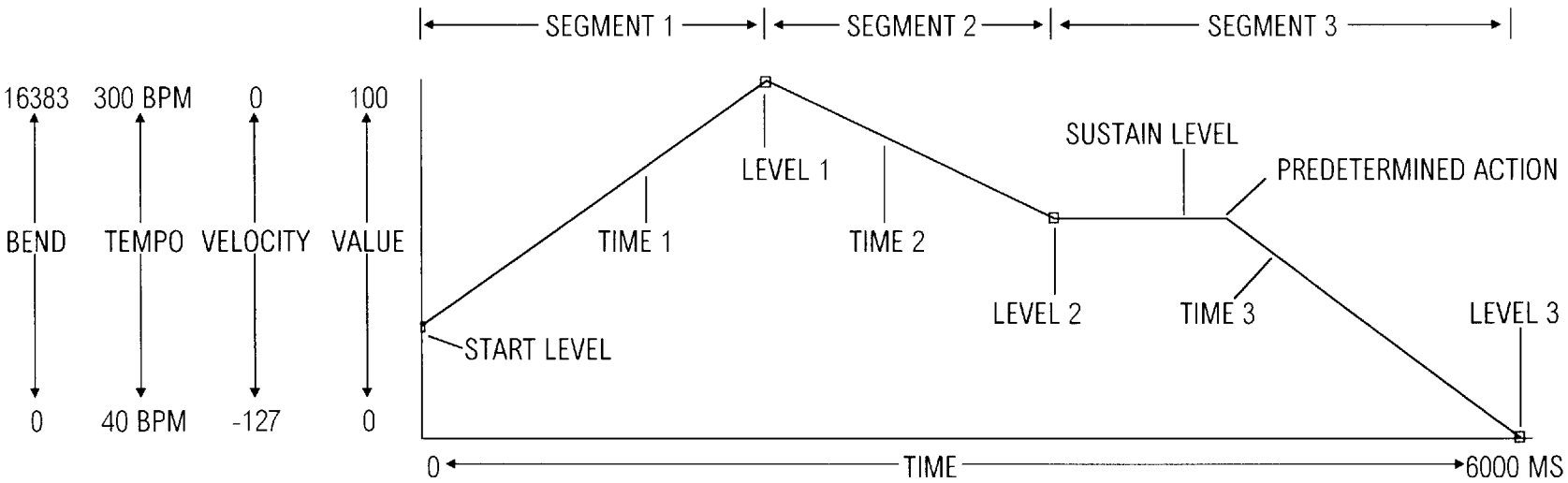
FIG. 45 is a diagram of a three segment envelope.

A three segment envelope utilized in the present embodiment is shown in FIG. 45. The x-axis is an overall time range for the entire envelope. In this example it is 6000 ms. The y-axis is an envelope value that is calculated by the movement from one level to another level. As shown, there is a start level and for each of the three segments, a time and level are shown.

Once the envelope has been started, it continuously moves from one specified level to the next specified level, recalculating the envelope value according to the specified times between each level. The current envelope value at any given moment may be utilized to perform a calculation, or influence other processing in some manner. Further shown in this example is that segment 3 has been designated as a sustain level segment. This means that the envelope will stop upon reaching level 2, and not continue to level 3 until a predetermined action has indicated it should do so, such as the release of keyboard keys or buttons by a user, or other such action. Segment 3 is therefore referred to as a release segment. While 3 segment envelopes are presently utilized, the envelopes could contain any number of segments such as 4, 7 or 11 segments, thereby providing greater control, and still remain within the scope of the invention.

In the present embodiment, a velocity envelope may be utilized during calculation of the velocity in the reading out of data. In this example, this is done by scaling the envelope value of {0–100} into an offset of {−127–0}, with other ranges possible. This offset may be utilized to impart an overall increase or decrease in velocity levels during note generation, thereby providing the musical effect of a crescendo and/or decrescendo (or combinations of the two), whereby a gradual raising and lowering of the volume of a musical phrase over time may occur.

A tempo envelope may be utilized, which modifies the tempo of the clock event generator, thereby producing clock events that may have an increasing or decreasing amount of time between them. In this example, this is done by scaling the envelope value of {0–100} into a tempo of {40–300 bpm}, with other ranges possible. This produces the musical effect of a ritard and/or accelerando (or combinations of the two), whereby the tempo of a musical phrase speeds up or slows down over time.

A bend envelope may be utilized, which continuously sends out MIDI pitch bend data. In this example, this is done by scaling the envelope value of {0–100} into a double precision MIDI pitch bend value of {0–16383}, with other ranges possible. This produces the musical effect of a gradual increase or decrease in pitch over time. Other envelopes are possible that send any type of MIDI data continuously in a similar fashion, with different ranges of values. A spatial location envelope could send MIDI pan (controller 10) values, by scaling the envelope value {0–100} into a pan value from {0–127}, and so on.

A more detailed explanation of the operation of envelopes according to the present embodiment shall now be given. As previously described, an overall time range exists for the entire envelope, which may be a predetermined or user selected value, or may be changed or scaled in real-time according to other calculations that shall be described later. Assuming there are three segments, if an arbitrary time range is decided to be 6000 ms, then each segment will occupy 2000 ms. Therefore, the segment time value of {0–100} may be scaled into the range {0–2000 ms}, which shall be referred to as the "segment time ms." For example, if segment 2 had a time of 45, then the segment time ms for segment 2 would be (2000/100)*45=900 ms.

A step rate and step size are calculated by determining the number of steps within a segment. The number of steps is determined by subtracting the previous level from the current segment's level. For segment 1, a separate start level has been provided since there is no previous segment. The step rate determines how often the envelope value will be calculated and updated to a new value. It has arbitrarily been decided that a minimum step rate will be 20 ms in this example, so that calculations will not be performed more often than that. The step size determines the amount by which the envelope value will be incremented or decremented at each calculation. It has arbitrarily been decided that a minimum step size is 1. Therefore, when the step size and step rate are calculated, if the step rate is greater than the minimum rate, the step size will be 1. If the step rate is less than the minimum rate, it will be limited to the minimum rate, and the step size will therefore be greater than 1. One may employ the following C code fragment to calculate the step size and step rate:

```
number of steps = current level - previous level;
step rate = segment time ms/number of steps;
if (step rate < 20 ms){
  step rate = 20 ms;
  step size = number of steps/(segment time ms/20);
}else{
  if (number of steps > 0)
      step size = 1.0;
  else
      step size = −1.0;
}
```

By way of example, if level "a" is 30 and level "b" is 100, the number of steps between level a and level b is 70. If the segment time ms for a segment is 2000 ms, the step rate is calculated by dividing the segment time ms by the number of steps (2000/70)=28.57 ms. This step rate is greater than the minimum step rate of 20 ms; therefore, since the number of steps is a positive number, the step size is 1.0, and the step rate is 28.57 ms. A calculation will be performed every 28.57 ms, and the envelope value will be incremented by 1 each time.

If the segment time ms were 1000 ms, then (1000/70)=14.286 ms. Since this is less than 20 ms, the step rate will be set at 20 ms, and the step size becomes (70/(1000/50))=1.4. Therefore, a calculation will be performed every 20 ms, and the envelope value incremented by 1.4 each time.

An envelope is started by one or more of the triggering means to be explained shortly. This sets the envelope value to the start value, and then schedules a call to a recursive procedure at a time in the future equal to (now time+segment 1 step rate). When the system time reaches the specified time, the envelope value is modified by the segment 1 step size, and another procedure call is again scheduled at a time in the future equal to (now time+segment 1 step rate). In this manner, the function repeatedly schedules itself to be called, and at each repetition recalculates the envelope value. Once the envelope value reaches the segment 1 level, the next call is scheduled in the future at (now time+segment 2 step rate), after which the envelope value will be modified by the segment 2 step size, and so on, until the end of the envelope is reached, at which point no further procedure calls are scheduled in the future and the processing of the envelope stops. If a certain segment has been specified as a sustain level segment, when the envelope value reaches the level prior to the start of that segment, no further procedure calls are scheduled and the envelope stops. A predetermined action may then restart the processing from the present level, with the step size and step rate of the sustain level segment. The envelope value may be stored in memory and referenced by other operations, scaled into other ranges and used to vary parameters in real time, and/or scaled into other ranges and sent out as various types of MIDI data.

The step rate and step size for each segment may be precalculated according to the settings of the time and level for each segment and stored in memory, or calculated in real-time. The various levels and times may be changed in real-time and a recalculation of the step rate and step size performed without stopping the envelope.

READING OUT OF DATA—CLOCK EVENT ADVANCE MODE

During clock event advance of the musical effect, clock events are counted to determine when to read out some data, based on a rhythm target value calculated from the current phase's rhythm pattern. Automatic advance clock events are provided by an internal or external clock that produces clock events automatically at intervals. The intervals may be regular intervals based on the current tempo (e.g., utilizing a MIDI clock corresponding to 24 pulses per quarter note), or may be produced by utilizing a function generator such as an envelope generator to produce clock events that have an irregular nature, such as increasing or decreasing the amount of time between the clock events over a period of time. Alternately or in conjunction with automatic advance clock events, manual advance clock events may be utilized, where a user action such as pressing a key or button has been predetermined to generate one or more clock events, which are then counted in the same fashion.

An initialization sequence that independently sets starting values for various indexes and other variables may be performed at any time independently of starting or stopping the effect. The initialization sequence can be performed by user actions such as each new key depression on a keyboard or button depression on an interface, or analyzing the number of keys or buttons currently being held down by the user, and initializing only for the first key or button depression after all other keys or buttons have been released. Upon user demand, the counting of the clock events can be suspended or the generation of the clock events suppressed, stopping the effect and freezing it at its present position. Furthermore, the counting or generation of clock events may be resumed at any time either with or without initializing again if desired. These operations, along with several envelope functions previously described, are controlled through the use of various triggering means.

TRIGGERING MEANS

Several different types of trigger actions may be utilized to control the process of the reading out of data. These trigger actions are used to determine a corresponding trigger event type:

key down trigger:
- input note-ons or key/button presses from a keyboard or other musical instrument are used to determine key down trigger events.

key up trigger:
- input note-offs or key/button releases from a keyboard or other musical instrument are used to determine key up trigger events.

external trigger:
- a user controlled device such as a foot switch, front panel button, sensor mechanism etc. is used to determine external triggers events.

location trigger:
- specific locations in a pre-recorded background piece of music are used to determine location trigger events, which can either be embedded in the music as a specific type of predetermined data which is recognized as such, or by calculating a location on the fly, such as a predetermined number of clock ticks, beats or measures.

phase trigger:
- a phase change as previously described may send a phase trigger event.

When the trigger action is key up trigger or key down trigger, three different trigger methods are provided:

time window:
- time windows are used to determine the trigger events.

note count:
- the arrival of a certain number of note-ons and/or note-offs, or key/button presses and/or releases are used to determine the trigger events.

threshold:
- the velocity with which the notes are received (or level of other MIDI data) are used to determine the trigger events.

When the trigger action is key down trigger, three different key down conditions are provided:

any: all key down trigger events will be utilized.

first note: a key down trigger event will only be utilized if there is only one note sustaining (meaning that subsequent key down trigger events caused by adding or removing additional sustaining notes will be ignored).

after stop: a key down trigger event will only be utilized if it is the first one since the effect was started (meaning that all subsequent key down trigger events will be ignored until the effect is stopped and started again).

The present embodiment provides for several separate trigger modes, indicating ways in which the processing of the reading out of data can be controlled by the preceding actions. Each of the trigger modes can be set to utilize one or more of the preceding trigger event types, and one or more of the key down conditions (assuming the key down trigger event is selected for use).

envelope trigger mode:
- an envelope function may be started by a trigger event.

release trigger mode:
- an envelope function may be allowed to continue from the sustain level into the release segment, or forced into the release segment, by a trigger event.

initialize trigger mode:
indexes and other variables may be initialized to predetermined starting values by a trigger event.
clock on trigger mode:
the counting of clock events may be allowed to begin by a trigger event, starting or resuming the effect.
clock off trigger mode:
the counting of clock events may be suppressed by a trigger event, stopping or pausing the effect.

Several flags used in the following description exist in memory, which are initialized to "no" in a general initialization routine:

on window running: indicates a note-on time window is in progress.
off window running: indicates a note-off time window is in progress.

Two temporary buffers and three associated counters are used in the following description, with all locations initialized to 0:

note-ons buffer:
a predetermined number of storage locations in memory containing data space for a pitch, velocity, and time stamp.
note-offs buffer:
a predetermined number of storage locations in memory containing data space for a pitch and time stamp.
stored note-ons:
the number of note-ons currently stored in the note-on buffer.
stored note-offs:
the number of note-offs currently stored in the note-off buffer.
sustaining notes:
the number of notes which are currently sustaining.

The use of separate note-on and note-off buffers is only for ease of performance and explanation. A single buffer with additional locations could easily accomplish the same purpose, with a slightly different implementation, and remain within the scope of the invention.

Figure 46:
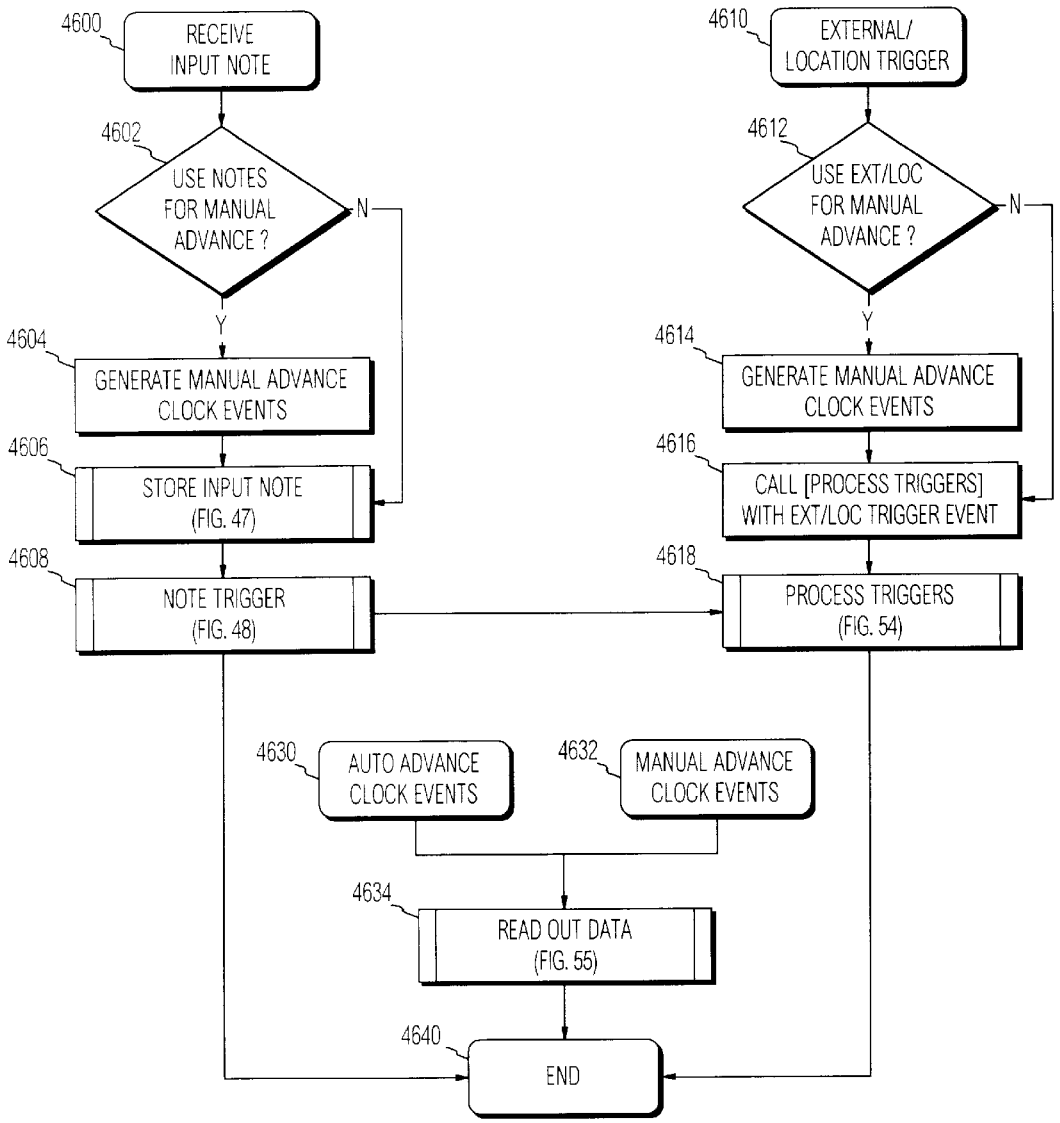
FIG. 46 is a flowchart of the process of controlling triggering means.

FIG. 46 is a flowchart showing the [Receive Input Note] routine where one means of controlling the various trigger modes is demonstrated, along with means for generating manual advance clock events. When an input note arrives 4600, a parameter memory setting is checked to see whether notes are being used for manual advance 4602. If so, one or more manual advance clock events may be generated 4604, which may eventually be utilized by the [Read Out Data] routine 4632 and 4634, as shall be described later.

The notes to be utilized for manual advance may be a subset of all available input notes, such as a certain range of input notes (e.g. one octave, two octaves, or contiguous or non-contiguous portions thereof). For example, it might be specified that all input notes with pitches between 60 and 71 are to be used for manual advance. Furthermore, within the desired notes to be utilized, it may be specified that only note-ons, only note-offs, or both noteons and note-offs may indicate clock events. For each such note-on and/or note-off, one or more manual advance clock events may be generated simultaneously as desired. Furthermore, the number of clock events generated for each note-on and/or note-off may be derived from the current step of a rhythm pattern, so that each such note-on and/or note-off will advance the reading out of data by one step of the rhythm pattern, as shall be described shortly. If notes are not being used for manual advance 4602 or continuing from step 4604, the [Store Input Note] routine is entered 4606.

Figure 47:
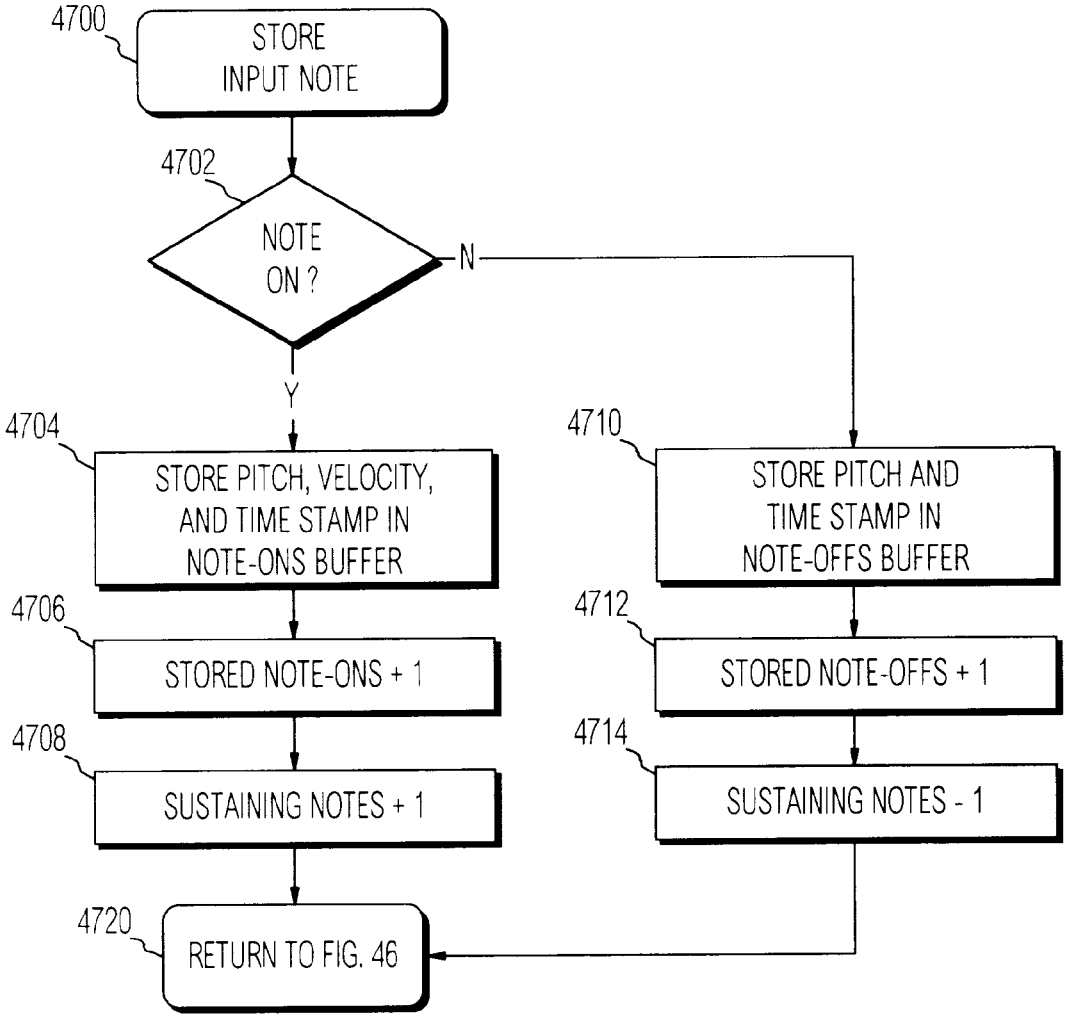
FIG. 47 is a flowchart showing a store input note routine.

The [Store Input Note] routine shown in FIG. 47 stores note-ons and note-offs in two separate buffers, maintains the count of items in the buffers, and maintains the count of sustaining notes. If the input note is a note-on 4702, the pitch, velocity, and a time stamp indicating when the note-on was received (now time) is stored in the note-ons buffer 4704. Stored note-ons is incremented by one 4706, sustaining notes is incremented by one 4708, and the routine returns 4720.

If the input note is a note-off 4702, the pitch and a time stamp indicating when the note-off was received (now time) is stored in the note-offs buffer 4710. Stored note-offs is incremented by one 4712, sustaining notes is decremented by one 4714, and the routine returns 4720. In this manner, the sustaining notes value contains the number of notes for which note-offs have not yet been received. Returning to the [Receive Input Note] routine of FIG. 46, the [Note Trigger] routine is then entered 4608.

Figure 48:
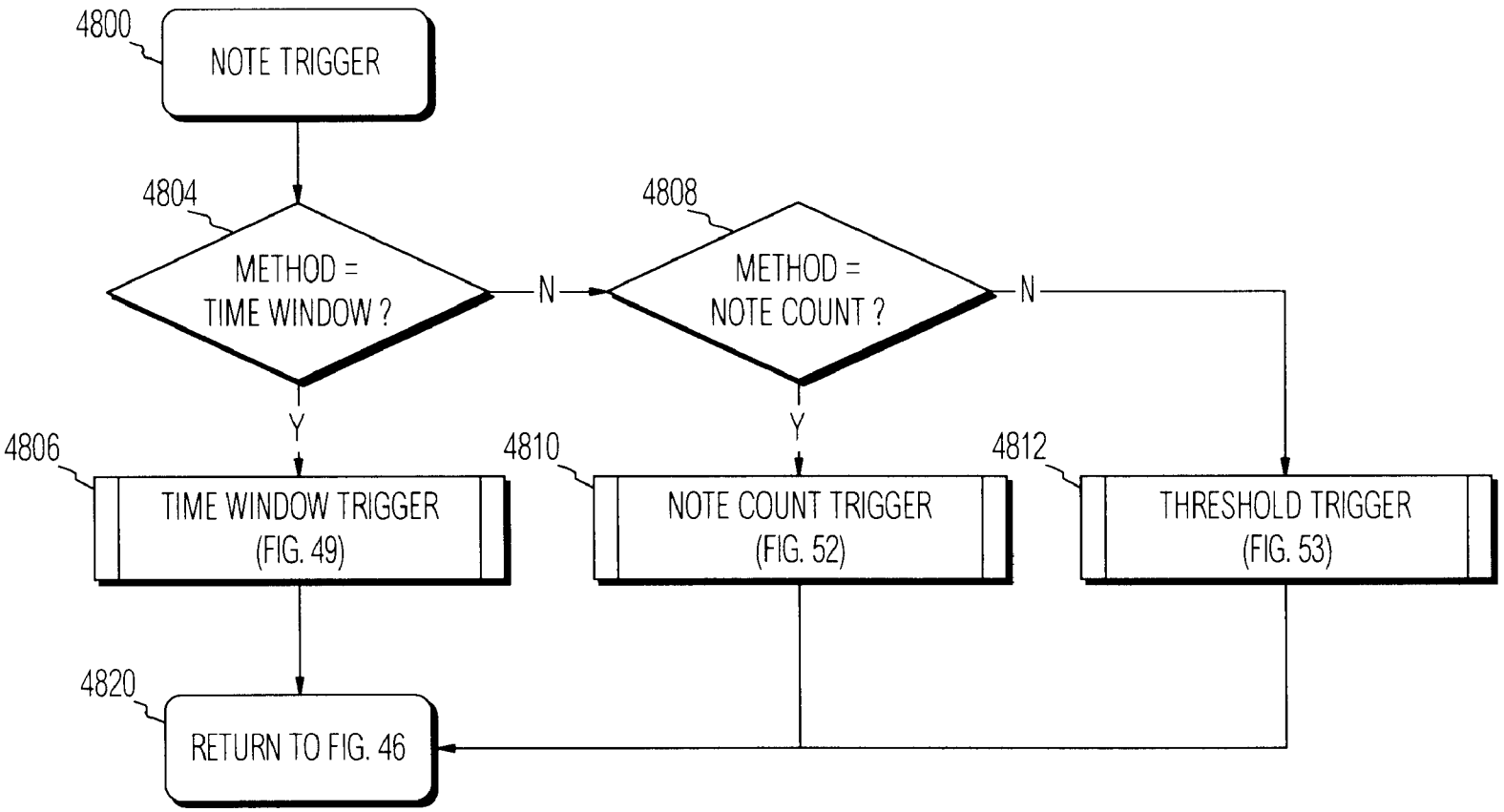
FIG. 48 is a flowchart showing a note trigger routine.

The [Note Trigger] routine shown in FIG. 48 allows incoming input notes to potentially trigger any of the trigger modes previously described, using several different triggering methods. If the trigger method is "time window" 4804, the [Time Window Trigger] routine is entered 4806.

Figure 49:
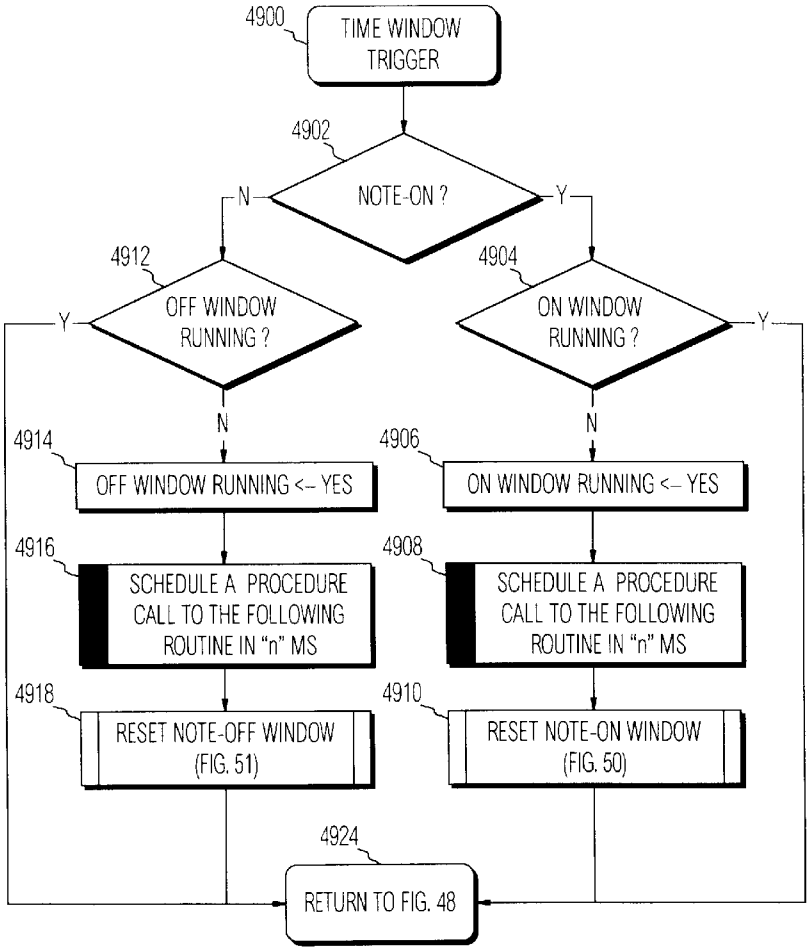
FIG. 49 is a flowchart showing a time window trigger.

The [Time Window Trigger] routine shown in FIG. 49 uses two separate time windows for note-ons and note-offs. If the routine has been called by a note-on 4902, the on window running flag is checked 4904. If the flag is "yes," indicating that the window is already running, the routine returns 4924. If the flag is "no," then the flag is set to "yes" to indicate the window is now running 4906. A procedure call to the [Reset Note-On Window] routine is then scheduled for a predetermined "n" milliseconds (e.g. 30 ms) in the future 4908 and 4910, and the routine is finished 4924.

Figure 50:
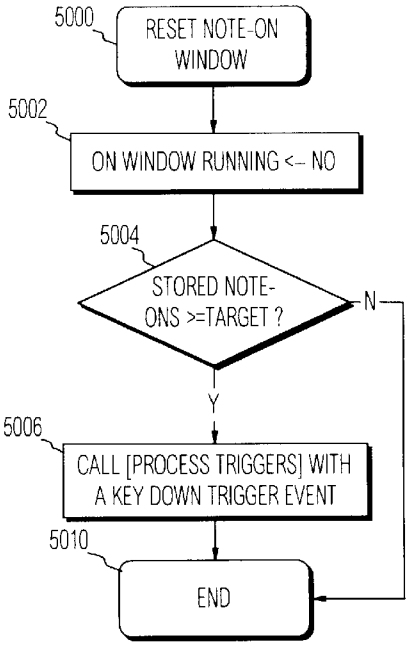
FIG. 50 is a flowchart showing a reset note-on window routine.

The [Reset Note-On Window] routine shown in FIG. 50 resets the flag allowing the note-on window to be run again, and then sends a key down trigger if a certain number of note-ons have been stored at that time. The on window running flag is first reset to "no" 5002, allowing the window to again be run. If the current number of stored note-ons is greater than or equal to a predetermined target value 5004, a call is made to the [Process Triggers] routine (not yet described) with a key down trigger event 5006. If stored note-ons is not greater than or equal to the target value, no trigger is sent, and the routine is finished 5010.

Returning to the [Time Window Trigger] routine of FIG. 49, if the routine has not been called by a note-on but by a note-off 4902, the same sequence of events as described occurs for the note-off window, except using the off window running flag, and scheduling a procedure call to the [Reset Note-Off Window] routine 4918.

Figure 51:
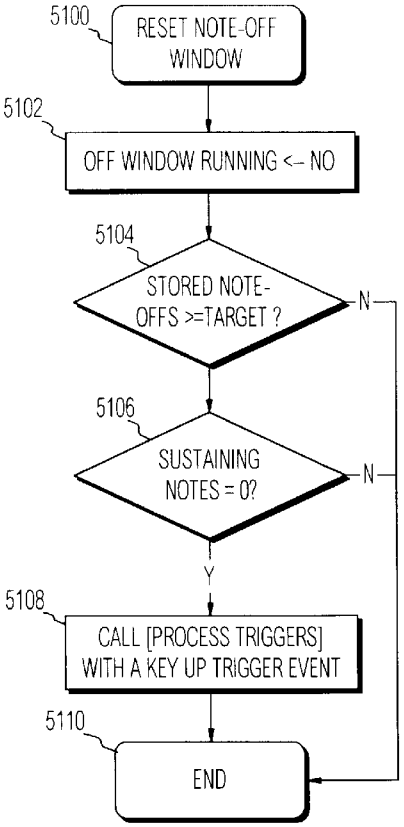
FIG. 51 is a flowchart showing a reset note-off window routine.

The [Reset Note-Off Window] routine shown in FIG. 51 resets the flag allowing the note-off window to be run again, and then sends a key up trigger if a certain number of note-offs have been stored by this time, allowing the further refinement of not setting the trigger flag if any notes are currently sustaining. The off window running flag is reset to "no" 5102, allowing the window to again be run. If the current number of stored note-offs is greater than or equal to a predetermined target value 5104, the sustaining notes value is checked 5106. If it is "0", then no notes are being held down, and a call is made to the [Process Triggers] routine with a key up trigger event 5108. If stored note-ons is not greater than or equal to the target value 5104, or sustaining notes does not equal "0" 5106, no trigger is sent and the routine is finished 5110.

In this manner, the arrival of notes can be grouped together and used to determine trigger events, either for key down activity (note-ons) or key up activity (note-offs). Note that the target value for the number of note-ons or note-offs can be any value from 1 up.

Returning to the [Note Trigger] routine of FIG. 48, if the trigger method is not "time window" 4804, it is checked whether the trigger method is "note count" 4808. If so, the [Note Count Trigger] routine is entered 4810.

Figure 52:
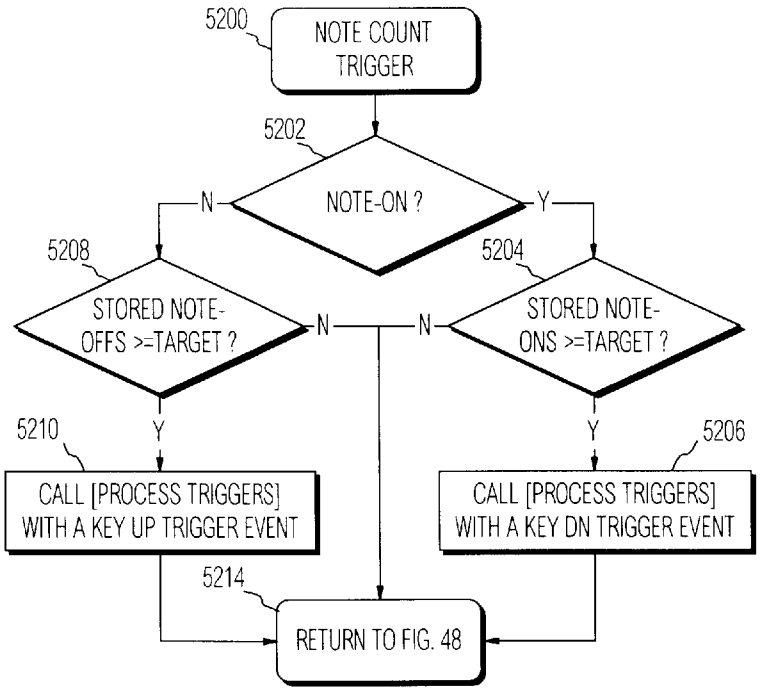
FIG. 52 is a flowchart showing a note count trigger routine.

The [Note Count Trigger] routine shown in FIG. 52 checks whether a certain number of note-ons or note-offs has been received, and allows the trigger modes to potentially be triggered if so. If the input note is a note-on 5202, it is checked whether the stored note-ons is greater than or equal to a predetermined target value 5204. If so, a call is made to the [Process Triggers] routine with a key down trigger event 5206 and the routine returns 5214. Otherwise, the routine returns with no trigger being sent. If the input note is a note-off 5202, it is checked whether the stored note-offs is greater than or equal to a predetermined target value 5208. If so, a call is made to the [Process Triggers] routine with a key up trigger event 5210 and the routine returns 5214. Otherwise, the routine returns with no trigger being sent. In this manner, the count of notes can be used to determine trigger events, either for key down activity (note-ons) or key up activity (note-offs). Note that the target value for the number of note-ons or note-offs can be any value from 1 up.

Returning to the [Note Trigger] routine of FIG. 48, if the trigger method does not equal "note count" 4808, then the method is "threshold trigger," and the [Threshold Trigger] routine is entered 4812, after which the routine returns 4820.

Figure 53:
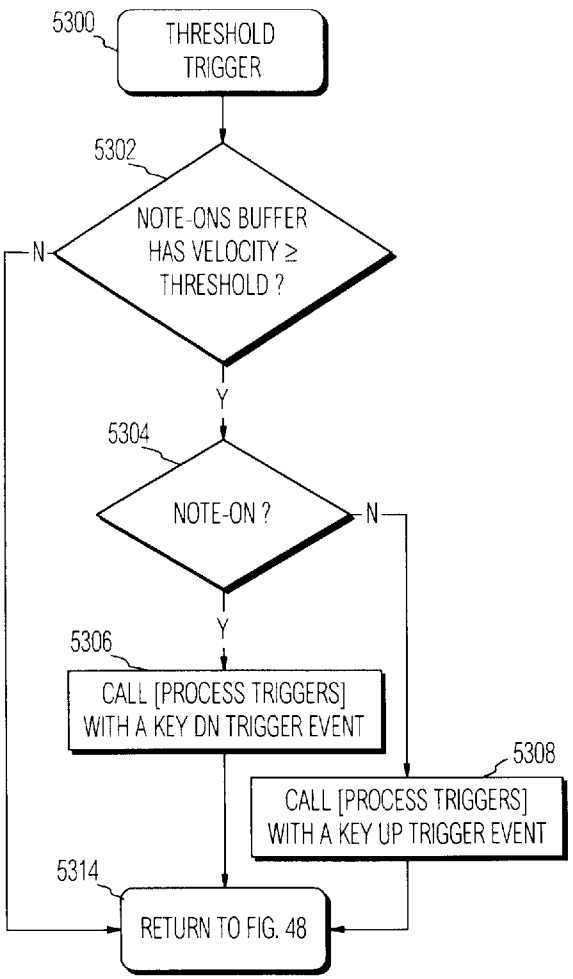
FIG. 53 is a flowchart showing a threshold trigger routine.

The [Threshold Trigger] routine shown in FIG. 53 checks whether the velocity of note-ons received so far exceeds a predetermined threshold, and allows the trigger modes to potentially be triggered if so. It is first checked if any of the note-ons currently stored in the note-ons buffer has a velocity greater than or equal to a predetermined threshold 5302. If so, it is then checked whether a note-on called the routine 5304. If so, a call is made to the [Process Triggers] routine with a key down trigger event 5306, and the routine returns 5314. If a note-off called the routine 5304, a call is made to the [Process Triggers] routine with a key up trigger event 5308 and the routine returns 5314. If a velocity was not found that was greater than or equal to the threshold 5302, the routine returns without any triggers being sent 5314. In this manner, the velocity of notes can be used to determine trigger events, either for key down activity (note-ons) or key up activity (note-offs).

The step of testing the velocities of the note-ons in the note-ons buffer can comprise finding a velocity greater than or equal to a threshold, or less than or equal to a threshold, or performing an average on all the velocities stored and using the average value for the test. Furthermore, the threshold can be a range of minimum/maximum velocity levels that the test velocity must be within or outside of. Furthermore, other types of MIDI data could be tested against thresholds in a similar fashion, such as aftertouch data, or controllers such as mod wheels and ribbons. In this case, the MIDI value itself would simply be tested against the threshold at step 5302 rather than utilizing notes in a buffer, the test at step 5304 would be skipped, and an external trigger event type would be sent to the [Process Triggers] routine.

Returning to the [Receive Input Note] routine of FIG. 46, the [Process Triggers] routine may have been called 4618 by one or more of the previously described trigger events. This routine can also be called eventually as the result of the arrival of an external or location trigger 4610. In the case of external triggers received from buttons, pedals, or other user operated controls, such triggers can be initiated by either the up or down position of a 2-stage control, the high or low value of a continuous controller, any position arbitrarily designated in between, or any combination of all of these. In the case of a location trigger, any predetermined data value inserted at various positions in the pre-recorded backing track can be used to initiate a call to this routine. Furthermore, by counting system clocks, processing clocks, or MIDI clocks received while playing the backing track, positions such as the start of each measure can be determined in real-time without the addition of predetermined data, and can also be used to call this routine.

When an external or location trigger is determined 4610, a parameter memory setting is checked to see whether these triggers are being used for manual advance 4612. If so, one or more manual advance clock events may be generated 4614, which may eventually be utilized by the [Read Out Data] routine 4632 and 4634. For each external or location trigger to be utilized, one or more manual advance clock events may be generated simultaneously as desired. Furthermore, the number of clock events generated for each external or location trigger may be derived from the current step of a rhythm pattern, so that each such trigger will advance the reading out of data by one step of the rhythm pattern. While this example groups the external and location triggers together, it can be seen that they could have separate tests applied, and generate manual advance clock events separately. If external or location triggers are not being used for manual advance 4612 or continuing from step 4614, a call is made to the [Process Triggers] routine with an ext/loc trigger event 4616.

Figure 54:
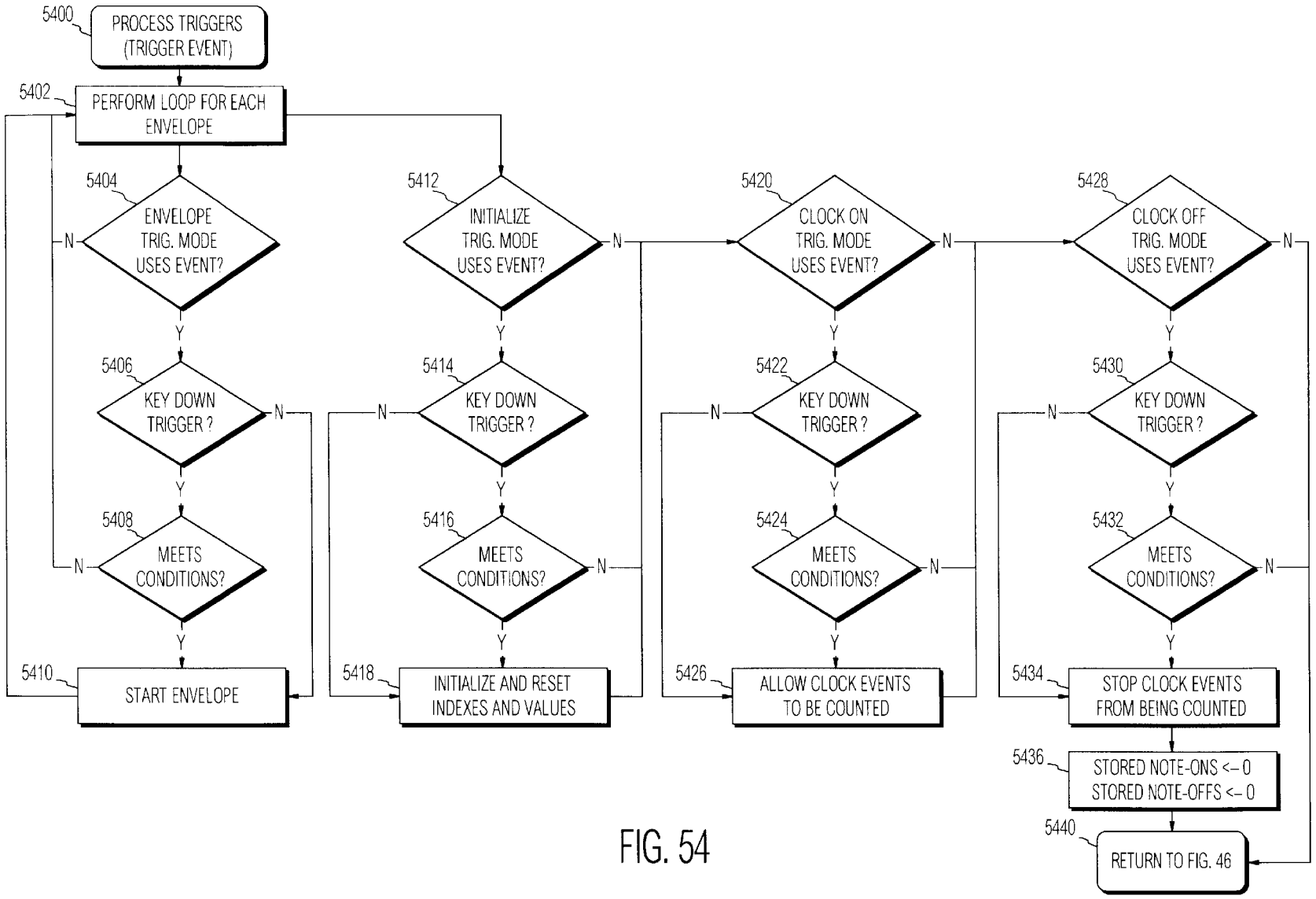
FIG. 54 is a flowchart showing a process triggers routine.

Referring to FIG. 54, the [Process Triggers] routine may potentially be called by any of the methods previously described, with one of the trigger event types 5400. A loop is performed for each envelope utilized (three in the present example) consisting of the steps 5402 through 5410. It is first checked if the envelope has been set to utilize the trigger event type 5404. If not, execution loops back to 5402. If so, it is checked whether the trigger event type is a key down trigger 5406. If so, it is tested whether conditions are currently met to allow the key down trigger event to be utilized 5408. As previously described, there are three different key down conditions that can be selected for use. If the key down condition is "any", then all key down trigger events are used and the envelope is started 5410. If the key down condition is "first note", the current value of sustaining notes is checked to see how many notes are sustaining. If only one note is sustaining, the envelope is started 5410. Otherwise, the condition is not met and execution loops back to 5402. If the key down condition is "after stop", then a flag in memory that is set each time the effect is stopped is checked. If this is the first key down trigger event since the flag was set, the envelope is started 5410 and the flag in memory set to indicate that no more key down events are to be used until it is reset by the effect being stopped. Otherwise, the condition is not met and execution loops back to 5402. If the trigger event type is not a key down trigger event 5406, the envelope is also started 5410 before execution loops back to 5402. In this manner, various actions can individually and selectively start one or more of the envelopes being utilized.

While not specifically shown on this diagram, the release trigger mode for each envelope may also be controlled by the addition of another set of tests similar in form to steps 5402–5410, with the result that the envelope enters the release segment of operation as previously described.

After the loop has been completed for all envelopes 5402, it is then checked whether the initialize trigger mode has been set to utilize the trigger event type 5412. If so, it is checked whether the trigger event type is a key down trigger 5414. If so, it is tested whether conditions are currently met to allow the key down trigger event to be utilized 5416. As previously described for the envelopes, the same three key down conditions are evaluated, and if the conditions are met, the various indexes and desired values are selectively initialized and reset to starting values 5418. If the event trigger type is not a key down trigger event 5414, the indexes and values are also initialized and reset 5418. In this manner, various actions can selectively reset indexes and other values to predetermined starting values, achieving the effect of restarting the reading out of data from the beginning, or other repeatable location.

If the initialize trigger mode does not utilize the trigger event type 5412, or the conditions are not met 5416, or continuing from step 5418, it is then checked whether the clock on trigger mode has been set to utilize the trigger event type 5420. In a similar fashion as previously described, if the event type is a key down trigger 5422 and conditions are met 5424 or the event type is not a key down trigger, a flag in memory is set indicating that clock events are to be allowed to be counted 5426. In this manner, various actions can selectively start or resume the read out of data.

If the clock on trigger mode does not utilize the trigger event type 5420, or the conditions are not met 5424, or continuing from step 5426, it is then checked whether the clock off trigger mode has been set to utilize the trigger event type 5428. In a similar fashion as previously described, if the event type is a key down trigger 5430 and conditions are met 5432 or the event type is not a key down trigger, a flag in memory is set indicating that clock events are no longer allowed to be counted 5434. In this manner, various actions can selectively stop or pause the read out of data.

If the clock off trigger mode does not utilize the trigger event type 5428, or the conditions are not met 5432, or continuing from step 5434, the note-ons buffer and note-offs buffer may be optionally emptied, and stored note-ons and stored note-offs reset to "0" 5436, after which the routine returns 5440. It could also be arranged that the reset of the buffers was selectively accomplished by other means, so that more note-ons and note-offs could be added to those already stored, and this routine called again.

When utilizing random pool patterns during the process of reading out data, a series of steps such as 5420 through 5426 may be utilized to choose a new starting seed and/or reset the starting seed to a stored seed, and remain within the scope of the invention. In this case, one or more additional trigger modes would exist for the choosing and/or resetting of the seeds, which may be set to utilize any of the various trigger event types to call the [Initialize Seeds] routine of FIG. 4 and/or the [Repeat Random Sequence] routine of FIG. 6.

In the [Store Input Note] routine of FIG. 47, the steps of storing the note-ons 4704 and storing the note-offs 4710 could be skipped, but rather just a count of stored note-ons and note-offs incremented 4706 and 4712. Furthermore, a single buffer could be maintained, by adding an incoming note to a buffer when a note-on message is received, and removing the note when receiving a corresponding note-off message. In this manner, the buffer contains all notes currently being sustained at a particular moment, and the sustaining notes count is not needed. The [Time Window Trigger] and [Note Count Trigger] routines may then be used to determine key down trigger events by checking the number of sustaining notes. The [Threshold Trigger] routine could simply analyze the last received velocity, and not check the velocities of notes in a buffer. The time stamp stored in steps 4704 and 4710 was not utilized in the present embodiment, but will be utilized in a later embodiment.

Returning to the [Receive Input Note] routine of FIG. 46, manual advance clock events 4632 that may have been generated at steps 4604 and/or 4614 are received by the [Read Out Data] routine 4634. Automatic advance clock events 4630 are provided by an internal or generator that produces clock events automatically at intervals; the previously described tempo envelope may be used to modify the tempo of an internal clock event generator, thereby increasing and/or decreasing the amount of time between the clock events over a period of time.

Figure 55:
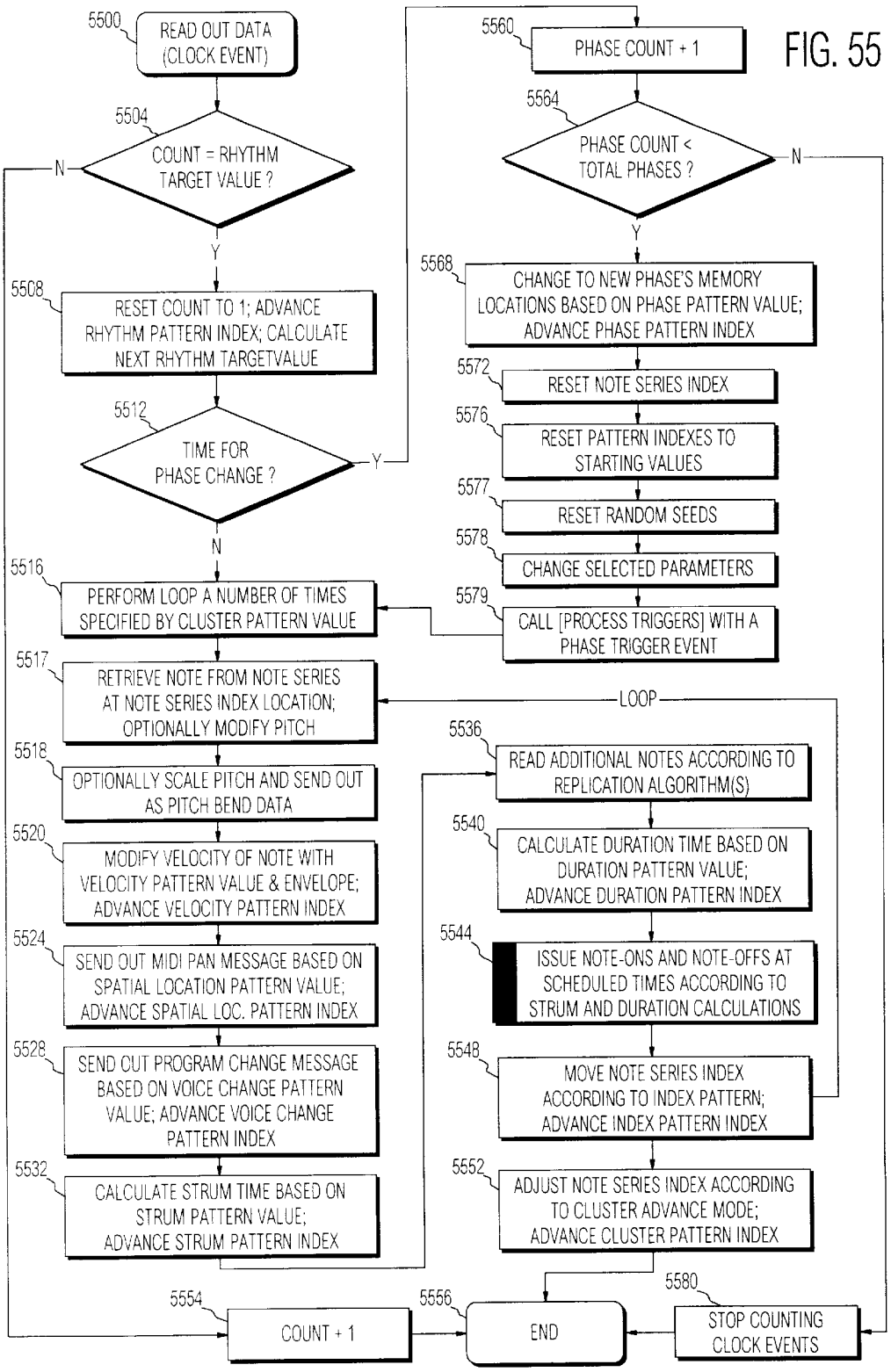
FIG. 55 is a flowchart of the process of reading out data from a note series using clock events.

FIG. 55 is a flowchart of the [Read Out Data] routine, which shows the process of reading data out with clock event advance. For the purposes of the following discussion, all patterns and other referenced parameters are considered to be those designated as the current phase. Since specific value patterns and/or random pool patterns may be utilized, the terms "current value" or "current pair of values" refers to the value(s) derived from the location indicated by the pattern's associated pattern index, not necessarily the actual values in the pattern.

Prior to this, an initialization sequence has set the note series index (which is a pointer into an addressable series indicating the next value to use) and all pattern indexes to predetermined starting values. An initial rhythm target value has been calculated by using the current value of the rhythm pattern. In this example, that value is a number of clock events at a base resolution of 24 cpq. Those of skill in the art will recognize that, other arrangements are possible. The rhythm pattern's associated rhythm modifier may be used to modify the current value derived from the pattern step; in this case it is used as a multiplier. For example, if the current value of the rhythm pattern is 6 (a 16th note at 24 cpq) and the rhythm modifier is 2, then the rhythm target value is (6*2)=12, indicating an eighth note. A memory location clock event counter (that is used to count clock events as they occur) has been set to the rhythm target value (so that the first clock event will generate a note as shall be seen).

A user action has been performed (such as the previously described triggering means) that indicates that clock events are now to be counted, by setting a flag in memory indicating that counting is to begin or resume. The [Read Out Data] routine is then called for every clock event received 5500. If the clock event count is not yet equal to the target value 5504, the clock event count is incremented 5554 and the routine is finished 5556. If the clock event count is equal to the rhythm target value, then the clock event count is reset to "1" 5508, the rhythm pattern index is advanced to a new location, and a new rhythm target value is calculated as described above for the next time the routine is called.

A decision is then made as to whether it is time for a phase change 5512. This can be caused by one or more of the following methods:

(a) since the note series index will be constantly changing to point to different memory locations (described below), if it moves outside of a predetermined range it can set a flag indicating a phase change;

(b) notes being generated can be counted, with the occurrence of a certain number of notes setting a flag indicating a phase change;

(c) clock events can be counted, with the occurrence of a certain number of clock events setting a flag indicating a phase change, such as a number corresponding to a measure of a musical time signature at a current resolution;

(d) the passing of a certain period of time can set a flag indicating a phase change, such as 5000 milliseconds from the last phase change;

(e) if music sequence or song data is being played simultaneously, phase changes can be flagged to occur at specific locations, such as the beginning of each beat or the beginning of a measure; and/or (f) user actions may specify directly a certain phase to change to, thereby setting a flag indicating a phase change, or set the flag directly, so that the next value of a phase pattern will be used.

If it is not time for a phase change, the current value derived from the current step of the cluster pattern is used to set the number of times to perform a loop 5516. The value may be optionally modified by the cluster pattern's associated cluster modifier, such as compressing or expanding the value. The loop consists of the steps 5517 through 5548, with each repetition generating one or more notes and other MIDI data. If a cluster pattern is not being used, this step 5516 can be skipped and the loop would execute one time.

At the beginning of the loop, a note is retrieved from a note series in memory at the location specified by the note series index 5517. The pitch of the note can optionally be altered in one or more of the following ways, which have been previously described in more detail during the creation of the note series. These operations may be performed here selectively as an alternative or in addition to those operations:

(a) constrain the pitch to a predetermined range;

(b) disregard a duplicate pitch value when compared to a previous pitch or pitches;

(c) shift the pitch of the note by an interval;

(d) substitute a new pitch for the pitch, by substituting tonal values for atonal values, or substituting according to a conversion table, which may be arbitrarily chosen or chosen as a result of chord analysis of the note series; and (e) disregard a pitch value based on predetermined criteria.

In the case of (b) or (e), the note series index may be advanced to a different location and another choice made.

Next, the pitch of the note can be optionally scaled into a certain range and sent out as pitch bend data 5518. One may employ the following formula, where pitch is the current pitch of the note and pitch min and pitch max are the lowest and highest pitches, respectively, in the note series:

$$\text{bend}=((\text{pitch}-\text{pitch min})*127)/(\text{pitch max}-\text{pitch min}).$$

The resulting bend value is sent out as a MIDI pitch bend message, transforming the pitches of the notes into full-range pitch bend messages. This is typically done once per cluster but may also be done for each repetition of the loop. If processing was being performed more than one time simultaneously, the reading out operation could end here with only pitch bend data being sent out, while another simultaneously running reading out operation could be reading notes out of a different note series in memory. The combined effect would be one of note generation from one note series and pitch bend generation from a different note series being achieved simultaneously. Other ranges and values can be used, and the generated data could be sent out as other types of MIDI messages other than pitch bend.

Next, the velocity of the note can be modified by the current value of the velocity pattern 5520. Such modification can be an addition or subtraction of an amount, or a direct replacement of the value, after which the velocity pattern index is moved to another location. The velocity pattern's associated velocity modifier may be used to modify the current value derived from the pattern step; in this case it indicates a percentage. For example, if the current value is −10 and the velocity modifier is 200%, then the actual value to be used is (−10*2.0)=−20. The retrieval of the value and movement of the index is typically done once per cluster but may also be done for each repetition of the loop. The velocity may be further optionally modified or replaced by the current envelope value of a velocity envelope, such envelope having been triggered by the triggering means as previously described. In this example, this is done by scaling the envelope value of {0–100} into an offset of {−127–0} and adding it to the velocity already calculated, with other ranges possible.

The current value of the spatial location pattern can be retrieved and sent out as a MIDI pan message, after which the spatial location pattern index is moved to another location 5524. The value may be optionally modified by the spatial location pattern's associated spatial location modifier, such as compressing or expanding the values. The retrieval of the value and movement of the index is typically done once per cluster but may also be done for each repetition of the loop. While this example shows MIDI pan data being used, other types of data can be used, including data required to move a sound in a multi-dimensional field. Although not specifically shown on the flowchart, any data being defined by an assignable pattern as previously described may be sent out in a similar fashion as the spatial location pattern, and the assignable pattern index moved to a new location.

Next, a decision can be made as to whether it is time to perform a voice change 5528. This may be done by comparing the second value of the current pair of values in the voice change pattern (a number of clock events to count) with a counter in memory. If the correct number of clock events has been reached, the first value in the current pair of voice change pattern values is sent out as a MIDI program change message, thereby changing the instrument which is playing the notes. The voice change pattern index is then moved to another location and the counter is reset; the retrieval of the values and movement of the index is typically done once per cluster but may also be done for each repetition of the loop.

A strum time may be calculated for each note in the cluster 5532 (if the current cluster size is greater than 1). This is an amount of time to delay the issuance of the notes with respect to each other, in a specific order based on a direction specified by the current value of the strum pattern, and a predetermined time in milliseconds. The strum pattern index is then moved to another location; the retrieval of the values and movement of the index is done once per cluster at the beginning. The following formulae may be used to calculate the strum time, where cluster value is the current cluster pattern size, with a counter "i" being initialized to 0 and incrementing each time through the loop currently being performed; strum ms is the predetermined time between each note:

strum pattern direction up:

$$\text{strum time}=i*\text{strum ms}$$

strum pattern direction down:

$$\text{strum time}=((\text{cluster size size}-1)-i)*\text{strum ms}$$

For example, if the predetermined time between notes is 10 ms, the result of this process is that when the strum pattern direction is up, the cluster of notes will eventually be issued in the order they exist in the note series with the first note being generated immediately and the others having 10 ms between them as will be described shortly; when the strum direction is down, the notes will be put out in the reverse order they exist in the note series, the last note being generated immediately and 10 ms between the others in reverse order.

The predetermined time between notes could also be a part of the pattern, so that each stroke of the pattern can have a different amount of time delay between the notes as they are issued. Furthermore, rather than using a strum pattern value, a toggle in memory that flip-flops between 0 and 1 each time it is accessed may be utilized, indicating an alternation of up and down strums.

Additional notes can be retrieved from the note series using various replication algorithms, such as doubling or inversion 5536. Inversion takes the current value of the note series index and creates an additional index which is inverted with respect to the size of the note series or a portion thereof. One may employ the following formula:

additional inverted index=size of note series or portion−note series index.

Doubling adds one or more offset amounts to the note series index to calculate additional indexes from which to retrieve notes, taking into account the size of the note series and discarding or wrapping around indexes that are out of range.

A duration time may then be calculated from the current value of the duration pattern, after which the duration pattern index is moved to another location 5540. The retrieval of the value and movement of the index is typically done once per cluster but may also be done for each repetition of the loop. This duration time is an amount of time in milliseconds in the future (from the present time) at which to issue a note-off for a corresponding note-on, thereby controlling the length of the note. Here, the duration pattern value is a number of clocks related to 24 cpq (with other divisions being possible). The duration pattern's associated duration modifier may then be used to modify the value in the same fashion as explained for the rhythm pattern. The resulting duration time may be calculated according to the following formula:

duration time=(duration pattern value*(60000/tempo))/cpq

For example, at a tempo of 120 bpm with a duration pattern value of 12 (8th note), the formula yields a duration time of 250 ms. Alternately, if absolute millisecond values are utilized for the duration pattern, the values may be used directly. If a duration pattern is not desired to be used, a fixed duration value may be substituted instead, such as the length of time corresponding to an 8th note at the current tempo, or a predetermined value such as 50 ms.

The currently retrieved notes are scheduled to be issued in time-sequential order by placing pointers to the MIDI note-on and note-off events (and procedures that issue them) inside a task list as previously described 5544. The note-on events are scheduled by placing them in the list at (now time+strum time). Therefore, according to the previous example, the first note-on will be generated immediately, the second one 10 ms later, and so on. If no strumming is being used, all note-ons are scheduled at now time, which causes them to be sent out immediately.

A corresponding note-off event for each note-on event is scheduled by placing it in the list at (now time+strum time+duration time). Therefore, according to the previous example where a duration time of 250 ms was calculated, the note-off corresponding to the first note-on will be issued 250 ms after the first note-on, the note-off corresponding to the second note-off 260 ms later, and so on.

Next, the note series index is moved to a new location based on the current value of the index pattern, after which the index pattern index is moved to a new location 5548. The movement of the indexes is typically done for each repetition of the loop, but may also be done once per cluster. The movement of the note series index is accomplished by a mathematical procedure specified by the index pattern value, and the phase direction. If the current phase direction is up, addition is performed with the value of the index pattern; if the current phase direction is down, subtraction is performed. For example, if the current value of the note series index is 3 (indicating the 3rd location in the note series), the current value of the index pattern is 3 and the phase direction is up, then the note series index becomes (3+3)=6 for the next repetition of the routine; if the current value of the index pattern is −1, the note series index becomes (3+−1)=2. The loop 5517–5548 may then repeat as determined by the cluster pattern value. If an index pattern is not being used, this step 5548 can be replaced by the addition of a constant value such as 1 when the phase direction is up, and the subtraction of a constant value such as 1 when the phase direction is down.

Once the loop has been performed the number of times specified, the note series index can be further adjusted by the cluster pattern size 5552 depending on the cluster advance mode as has been previously described, after which the cluster pattern index is moved to a new location. If a cluster pattern is not being used, this step can be skipped. This completes the clock event advance read out of data 5556 until the next time the count of clock events equals the current rhythm target value 5504.

If it is time for a phase change based on any of the previously described methods of determining this 5512, a counter originally set at "0" during an initialization routine is incremented for each phase change 5560. If the count reaches the total specified number of phases 5564, the counting of clock events is stopped 5580 by setting a flag in memory indicating suspension of counting. This routine will then no longer be called, thus terminating the effect. However, if the count of phases is less than the total specified number, the phase is changed 5568. One way of accomplishing this is to provide a master pointer that points to the address in memory of different phase parameters stored as structures. The master pointer was initialized to point to the address in memory of a phase location based on a predetermined starting value, which may have been based on a value derived from the first step of the phase pattern. Upon a phase change, the master pointer is changed to point to a potentially different phase's memory location based on a value derived from the next step of the phase pattern, after which the phase pattern index is moved to a new location. For example, if the pointer is currently pointing at phase 1, and the next derived value of the phase pattern is 2, then after the operation the pointer would be pointing at phase 2, indicating the use of phase 2 patterns and parameters in subsequent processing.

While this example shows the use of a phase pattern, a user may directly specify a new phase to change to, in which case step 5512 will occur, and at step 5568 the phase pattern can be ignored, and the user specified value employed. Alternately, the use of a phase pattern may be omitted if desired, with all phase changes occurring due to user actions.

The note series index is then optionally reset to a predetermined starting value for the current phase 5572. Optionally, various current pattern indexes may be selectively and independently reset to starting values 5576, so that certain patterns may start from a repeatable location. Optionally, if utilizing random pool patterns, various random seeds may be selectively and independently reset to their stored values 5577, so that repeatable random number sequences are generated. Optionally, if the phase pattern contains data indicating various parameters should be changed, the indicated parameters may then be changed to new values 5578. Finally, a phase trigger event may be optionally sent to the [Process Triggers] routine 5579, thereby controlling such functions as the starting of envelope functions. The process now proceeds to step 5516 and the subsequent loop using the parameters of a potentially different phase. If only one phase is being used, or the same phase is being used repeatedly, no actual movement of the pointer takes place, but the phase change may be used to reset the various indexes and change parameters as shown.

While this example reads out pitches and velocities from a note series while issuing other MIDI data, a pointer series could also have been used. Furthermore, any type of data in memory may be read out in a similar fashion. Instead of issuing MIDI Data with the loop comprising the steps 5517 through 5548, the cluster pattern value derived at step 5516 may be used to perform a loop reading out other types of data, such as individual samples of digital audio data, with the index pattern and note series index indicating the next location of the data to read out. For example, 1 second of digital audio data recorded at the CD standard rate of 44.1 k contains 44,100 individual samples of data. Each of those individual samples could be addressed as independent memory locations according to the reading out of data methods described herein, and the data read out and reissued as digital audio.

While this example shows each pattern using its own pattern index, patterns may use the index of another pattern, so that one or more patterns are locked at the same position in processing. This is particularly useful if the rhythm pattern being utilized is a random tie rhythm pattern. As the randomly chosen ties cause the rhythm pattern to skip indexes as previously described, other patterns using the rhythm pattern index instead of their own index will track the position of the rhythm pattern and therefore maintain a logical correspondence.

The retrieval of the note from the note series at step 5517 may be replaced by a random choice, utilizing a pseudo random number generator. In this case, the number of steps in the note series is considered the pool size according to the conventions employed herein, and a weighting method may be utilized to favor areas of the pool over other areas. For example, a weighting curve may be utilized whereby the beginning, end, or other portion of the note series has indexes selected more often.

EXAMPLES OF READING OUT OF DATA FROM A NOTE SERIES—CLOCK EVENT ADVANCE

FIG. 56 shows an example of reading out of data according to the previously described process. The example begins with the contents of a note series in memory 5600 (8 notes consisting of pitch and velocity at sequential index locations (steps) {1–8}). Two phases consisting of a variety of patterns 5602 are shown below the note series. These are not necessarily representations of the exact patterns, since specific value patterns or random pool patterns could be utilized. Instead, these are the values that will be derived from the patterns during processing. For purposes of clarity, the values derived from the cluster patterns in this example are {1} in both phases so that only one note at a time is generated. Also, duration patterns, strum patterns, and program patterns are not included in this example although they could have been utilized. Furthermore, it is assumed that a phase pattern of {1, 2} is being used, and that the phase direction of phase 1 is "up," and the phase direction of phase 2 is "down."

A sequence of 21 rhythm events (when the count of clock events meets the current rhythm target value) are shown below 5604, along with the values of the various indexes in memory for each rhythm event. The current rhythm pattern value, the current index pattern value, the value of the note series index after it is modified by the index pattern value, the retrieved pitch from the note series, current velocity pattern value, the resulting velocity read-out from the note series after it is modified by the velocity pattern value, the pan data generated, and musical notation representing the rhythm and pitch of the resulting notes as they are generated are shown. A phase change is indicated in bold type.

Since the value derived from the rhythm pattern for phase 1 is simply {6} (16th note at 24 cpq), then rhythm events in phase 1 will be generated as straight 16th notes. When a phase change occurs at rhythm event 14, the rhythm pattern in phase 2 is used, with derived values of {12, 6, 3, 3}, which generates an 8th note, a 16th note, and two 32nd notes in a repetitive loop.

At rhythm event 1, the pitch and velocity in the note series at note series index 1 is retrieved (60, 115), the velocity 115 has the first phase 1 velocity pattern value 0 added to it, and the first spatial location pattern value 0 is sent out as pan data. The pitch 60 (C4) is generated, with a velocity of 115, after which all pattern indexes have advanced by 1 (or loop back to the beginning if such advancement puts them out of range of the pattern they are indexing). At rhythm event 2, the current index pattern value 1 is added to the note series index, and the pitch and velocity at note series index 2 of the note series is retrieved (64, 127), the velocity 127 has the second velocity pattern value −20 added to it, the second spatial location pattern value 32 is sent out, and the note 64 (E4) is generated with a velocity of 107.

The processing continues in like fashion, with the note series index being modified by the index pattern, indicating the index of the note series to retrieve, until rhythm event 13 has finished execution. The note series index 7 will now have the next index pattern value 2 added to it, and it becomes 9. At rhythm event 14, this is used to determine a phase change, since the note series index is now greater than note series items (8). The note series index is reset to 8, the current phase pointer is set to point to the address of memory locations for phase 2, and processing continues using the pattern values from phase 2. In this example, the pattern indexes are all reset to the starting points of the patterns regardless of their current position.

Continuing from rhythm event 14, the pitch and velocity at note series index 8 is retrieved (83, 120), the velocity 120 has the first phase 2 velocity pattern value 0 added to it, and the first spatial location pattern value 0 is sent out. The pitch 83 (B5) is generated, with a velocity of 120, after which the pattern indexes have advanced by 1. Furthermore, since the rhythm pattern in phase 2 is different, this note will have the rhythm of an 8th note (first value 12 in phase 2's rhythm pattern values), as shown by the musical notation. At rhythm event 15, the current index pattern value 3 is subtracted from the note series index (since phase 2 is operating in the down direction). The pitch and velocity at note series index 5 is retrieved (72, 115), the velocity 115 has the second velocity pattern value −10 added to it, and the second pan value 127 is sent out. The note 72 (C5) is generated with a velocity of 105 and the rhythm of a 16th note (second value in phase 2's rhythm pattern values), and so on.

Figure 57:
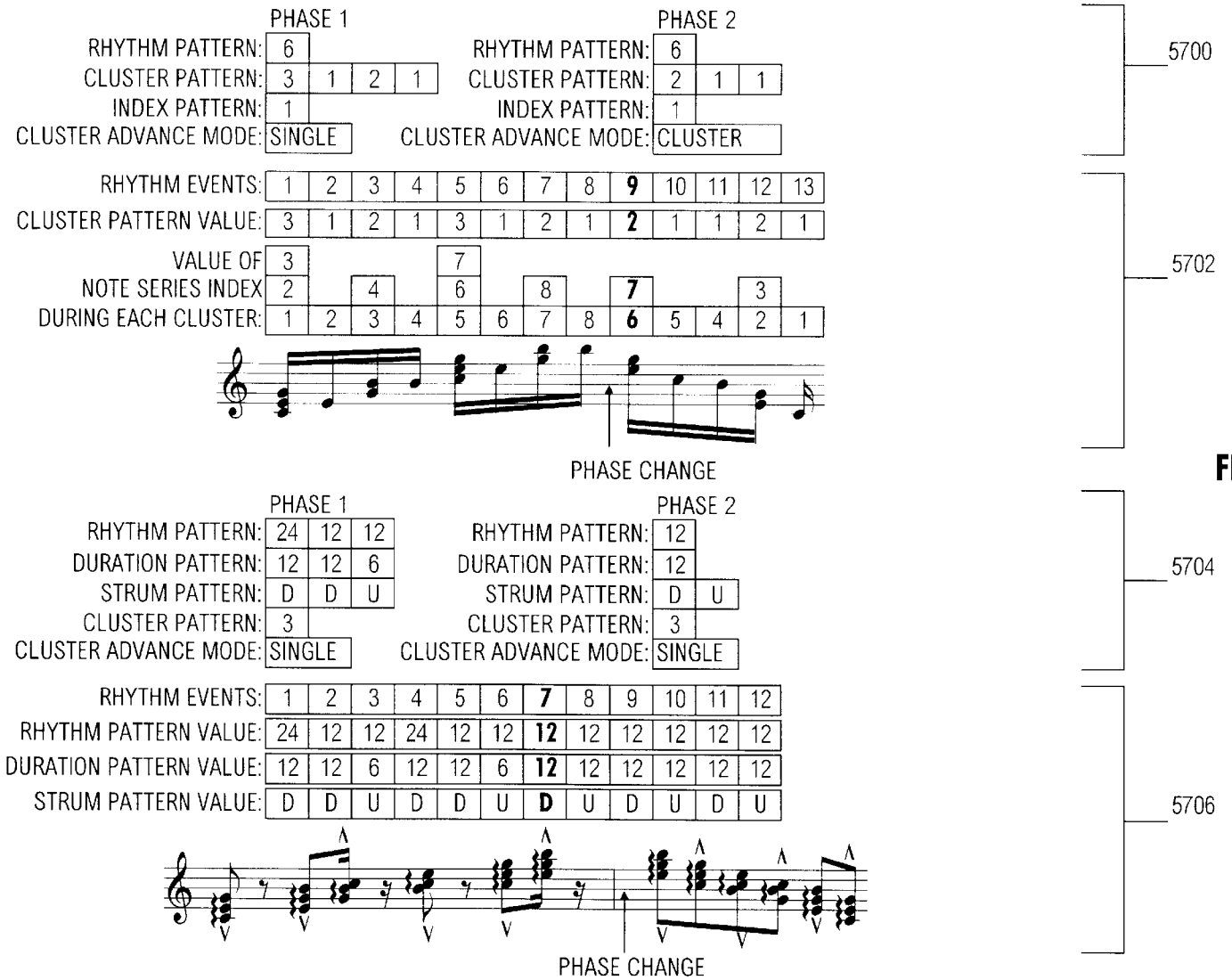

FIG. 57 shows two additional examples of the reading out of data process using the same note series. Once again, it is assumed that a phase pattern of {1, 2} is being used, and that the direction of phase 1 is "up," and the direction of phase 2 is "down."

Two phases (1 and 2) of various values derived from patterns including cluster patterns are shown in the FIG. 5700. For clarity, the rhythm pattern in both phases will generate straight 16th notes, and the index pattern in both phases will produce the value {1} (the note series index will simply increment or decrement depending on the direction of the phase). Again, other patterns such as velocity, pan, duration, program and strum are not shown. This example will show the additional functionality of utilizing the previously described cluster advance mode to create additional movement through the note series. The cluster advance mode for phase 1 is "single" and for phase 2 is "cluster."

A sequence of 13 rhythm events 5702, the corresponding cluster pattern values, the note series indexes used to retrieve the pitches and velocities from the note series, and the resulting generated notes are shown below. Since the cluster advance mode for phase 1 is "single" and the direction is "up," the actual net advance of the note series index after each cluster is only 1 even though it increments with each note due to the index pattern of 1. However, in phase 2, the cluster advance mode is "cluster" and the direction is "down."As a result, the actual note series index is decremented each time a note in a cluster is produced due to the index pattern of 1 and is not adjusted at the end of the cluster. Thus, at rhythm event 9, indexes 7 and 6 are chosen, after which at rhythm event 10 index 5 is chosen since there was a net advance of 2, and the index was not reset as in single mode.

A further example illustrates the operation of strum patterns and duration patterns. Two phases containing values derived from such patterns are shown 5704. Phase 1 contains duration pattern values of {12, 12, 6} corresponding to {8th-8th-16th} (at 24 cpq) while phase 2 has a duration pattern value {12} indicating straight 8th notes. Phase 1 has strum pattern values indicating {down, down, up}. Phase 2 has strum pattern values indicating {down, up}.

A sequence of 12 rhythm events 5706, including the rhythm pattern, duration pattern, and strum pattern values for each rhythm event are shown below. In the music notation, the "V" and "inverted V" indicate the direction of the strums.

At rhythm event 1 the rhythm target value is 24, the duration pattern value is 12, and the strum pattern value is "D." This results in a quarter note chord generated with an 8th note duration (yielding an 8th note rest) arpeggiated slightly in a downward direction (with the notes in the cluster issued sequentially in reverse order with a predetermined time delay between them). At rhythm event 2 the rhythm target value is 12, the duration pattern value is 12, and the strum pattern value is "D," resulting in an 8th note chord generated with an 8th note duration arpeggiated slightly in a downward direction. At rhythm event 3 the rhythm pattern value is 12, the duration pattern value is 6, and the strum pattern value is "U," resulting in an 8th note chord with a 16th note duration (yielding a 16th note rest) arpeggiated slightly in an upwards direction.

EXAMPLES OF READING OUT OF DATA FROM A DRUM PATTERN—CLOCK EVENT ADVANCE

As previously defined, a drum pattern is a note series of any length consisting of pitches and null values, or pools of pitches or pitches and null values, where a null value represents the absence of a pitch. In the following discussion, the pitches are note numbers corresponding to pre-defined drum and percussion maps. Further, in the examples discussed here, the note numbers are in the range 24 to 96, and correspond to the General Midi Specification drum maps; other ranges and maps are possible.

The reading out of data in FIG. 55 is performed as described, with the difference that any time a null value is retrieved from the note series in step 5517, the steps 5518–5548 are skipped without the issuance of any MIDI Data. The procedure immediately continues with the next repetition of the loop (if additional repetitions remain to be completed), or is finished at 5556 until the next rhythm event occurs.

Since both specific value drum patterns or random pool drum patterns may be employed, "drum pattern values," "drum pattern," and "values" in the following description shall all refer to values that are derived from a drum pattern, not necessarily the actual values stored in the drum pattern.

One example of values derived from a drum pattern is the following:

{36, 0, 0, 0, 38, 0 36, 0, 36, 0, 0, 0, 38, 0, 38, 38}.

Figure 58:
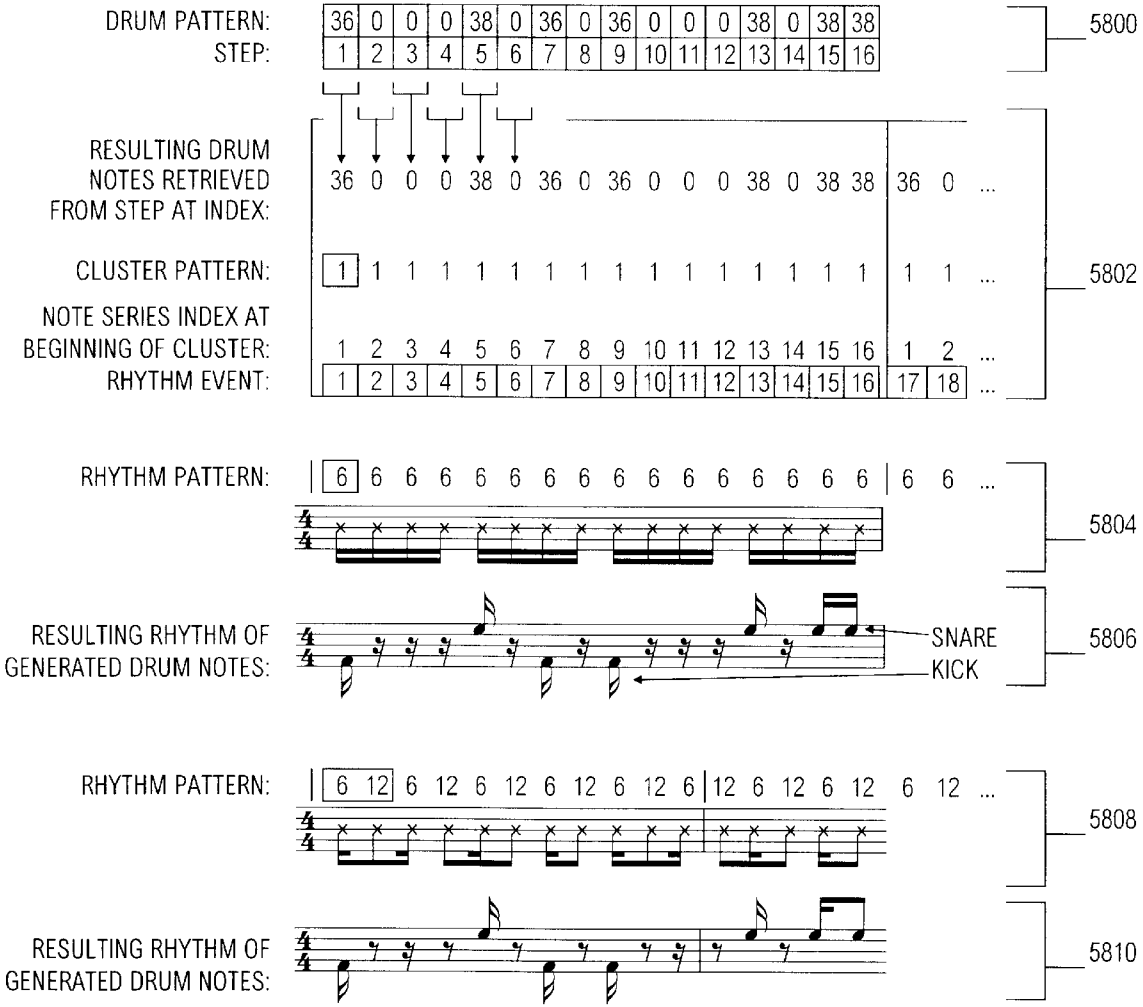
FIGS. 58, 59, 60 and 61 are examples of the process of FIG. 55 applied to a drum pattern.

36 indicates a kick drum, 38 indicates a snare drum, and 0 indicates no sound (a null value). FIG. 58 shows examples of two different rhythm patterns being utilized to read out these example values. The index pattern (not shown) will produce the value {1} (the note series index will simply increment, and wrap around back to the beginning upon reaching the end of the note series.) For clarity, velocity patterns, duration patterns, pan patterns, phase changes etc. are omitted.

The values derived from a 16 step drum pattern are shown 5800. The application of a cluster pattern value of {1} and the index pattern described above will simply advance the note series index forward through the drum pattern, as shown by "note series index at beginning of cluster" 5802. Each drum pattern value will be retrieved in succession at each rhythm event.

The rhythm caused by a rhythm pattern value of {6} (16th note at 24 cpq) is shown 5804. Therefore, when reading data out of the drum pattern with this rhythm pattern causing the rhythm events, the drum notes shown in musical notation will be produced 5806. As seen, each time the null value 0 is retrieved from the note series, no data is issued, resulting in the absence of a sound (perceived as a rest).

In the second example, the rhythm caused by a rhythm pattern of {6, 12} (16th note, 8th note) is shown 5808. When reading data out of the drum pattern with this rhythm pattern, the drum notes shown in musical notation will be produced 5810. As can be seen, the resulting drum beat has a different rhythm than 5806, extending partially into a second measure. In this manner, the same drum beat can be read out of memory with a different rhythm pattern, resulting in a different drum beat.

Figure 59:
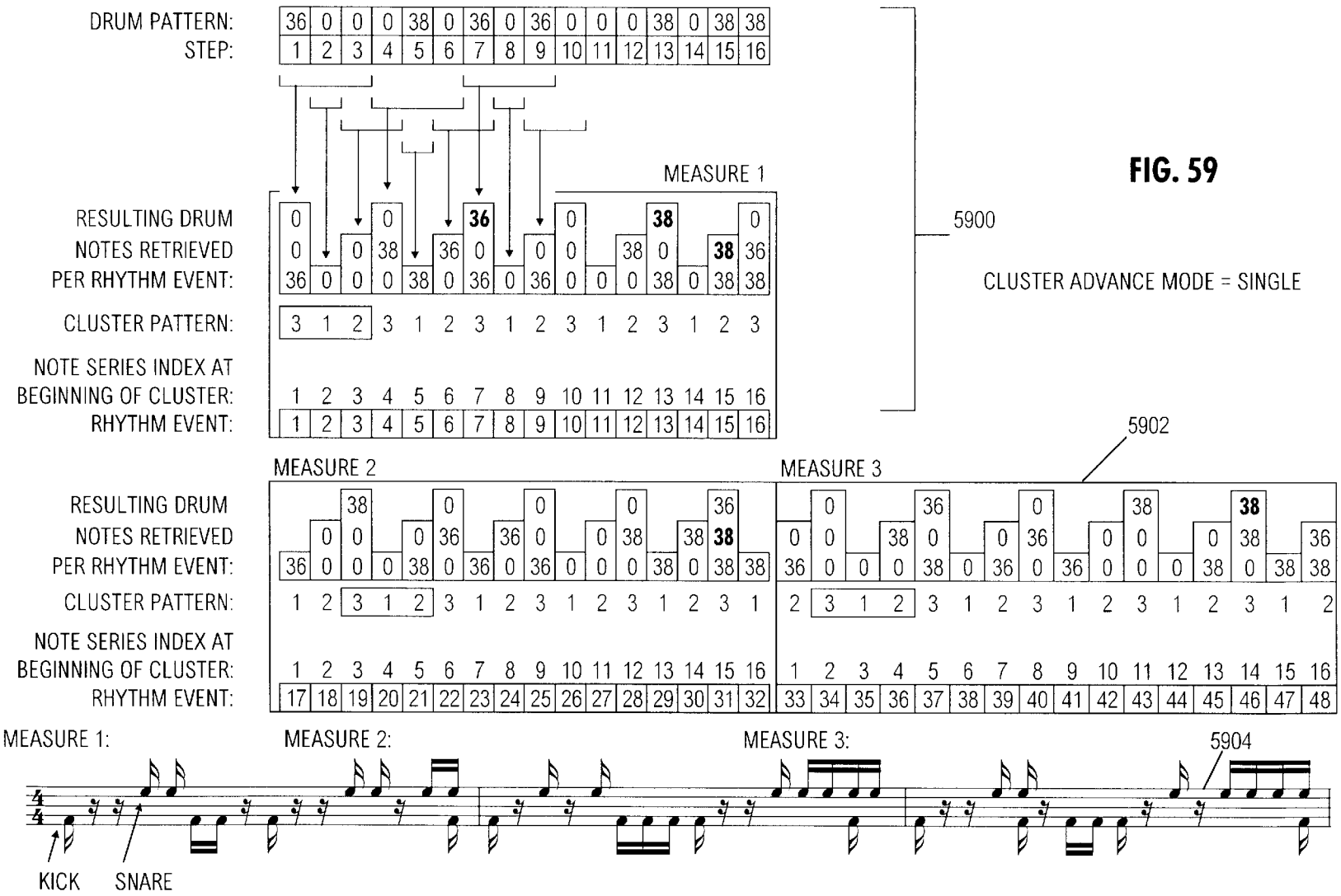

FIG. 59 is an example of the effect of reading data out of the same drum pattern with cluster pattern values of {3, 1, 2}, a cluster advance mode of "single" and a rhythm pattern value of {6} (16th note). The index pattern (not shown) will again produce the value {1}. Any time the note series index goes outside of the range {1–16} (the drum pattern steps) it will be wrapped around by modulo division; for example, the value 17 becomes 1, 18 becomes 2, and so on. As shown in 5900, for each rhythm event, a number of indexes equal to the cluster pattern value are retrieved from the drum pattern. Since the cluster advance mode is "single," the note series index at the beginning of each cluster only has a net advance of 1 from the previous cluster, as previously described. Therefore, at rhythm event 1, 3 items are retrieved from indexes {1, 2, 3} since the index pattern value of {1} is added with each retrieval. At rhythm event 2, the note series index is set so that there was only a net advance of 1, and 1 item is retrieved from index {2}. At rhythm event 3, 2 items are retrieved from indexes {3, 4} and so on. Duplicate pitches are shown in bold face and ultimately discarded. Null values produce no output. This example further shows that applying the values from this cluster pattern (which has 3 steps and is therefore not an even multiple of the 16 step drum pattern) results in a cyclical output 3 measures in length 5900–5902, where each measure has a different beat, as shown by the music notation 5904.

Figure 60:
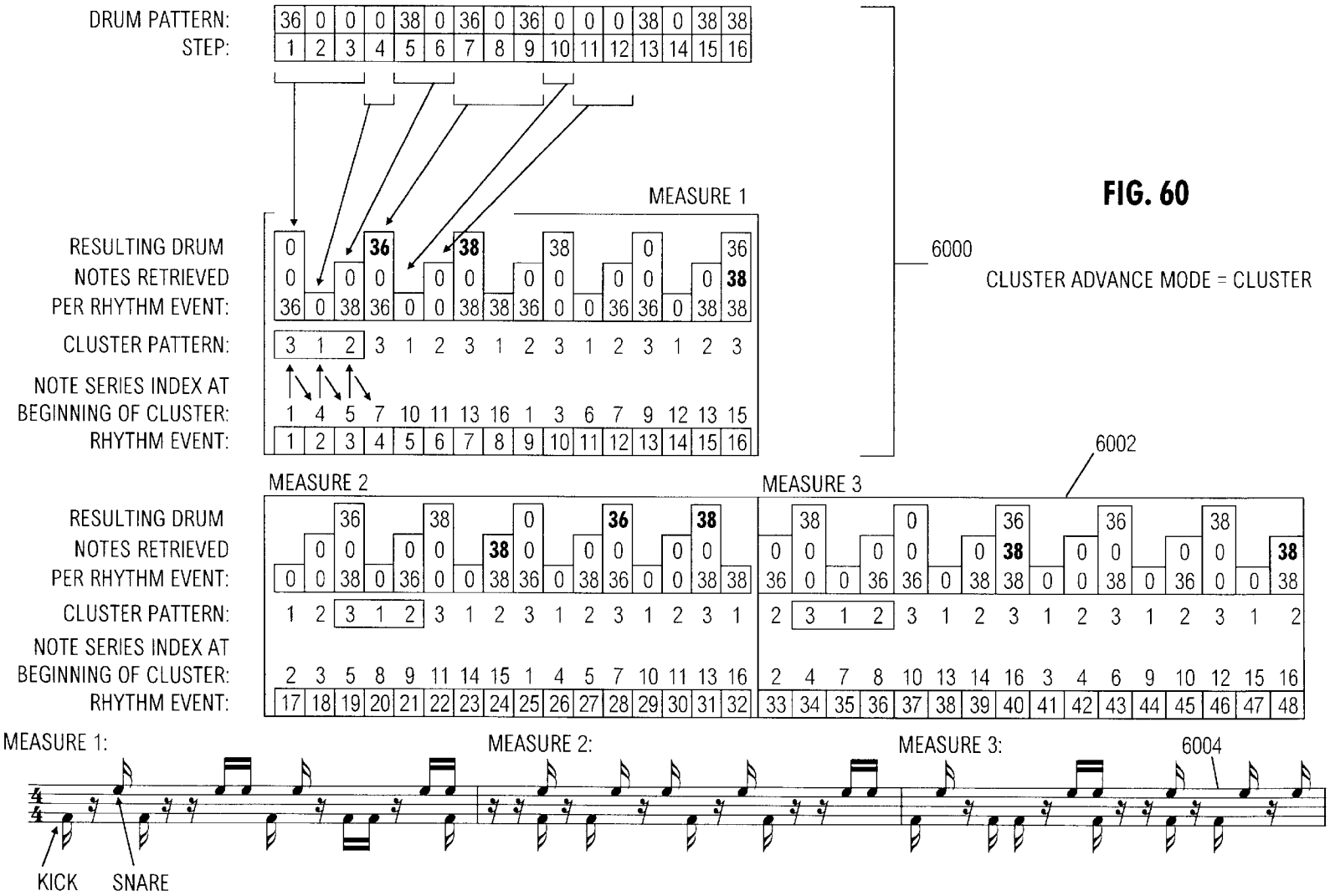

FIG. 60 is an example of the same cluster pattern values {3, 1, 2}, but the cluster advance mode is set to "cluster." Therefore, the note series index at the beginning of each cluster has a net advance of the previous cluster size 6000. For example, at rhythm event 1, the first 3 items of the drum pattern are retrieved from indexes {1, 2, 3} since the index pattern value of {1} is added with each retrieval. At rhythm event 2, the note series index has not been reset but continues from its present location, and 1 item is retrieved from index {4}. At rhythm event 3, 2 items are retrieved from indexes {5, 6}, and so on. Once again, the application of the values from this cluster pattern results in a cyclical output 3 measures in length 6000–6002, where each measure has a different beat, as shown by the music notation 6004. As can be seen, this is a different resulting beat than the previous example.

Figure 61:
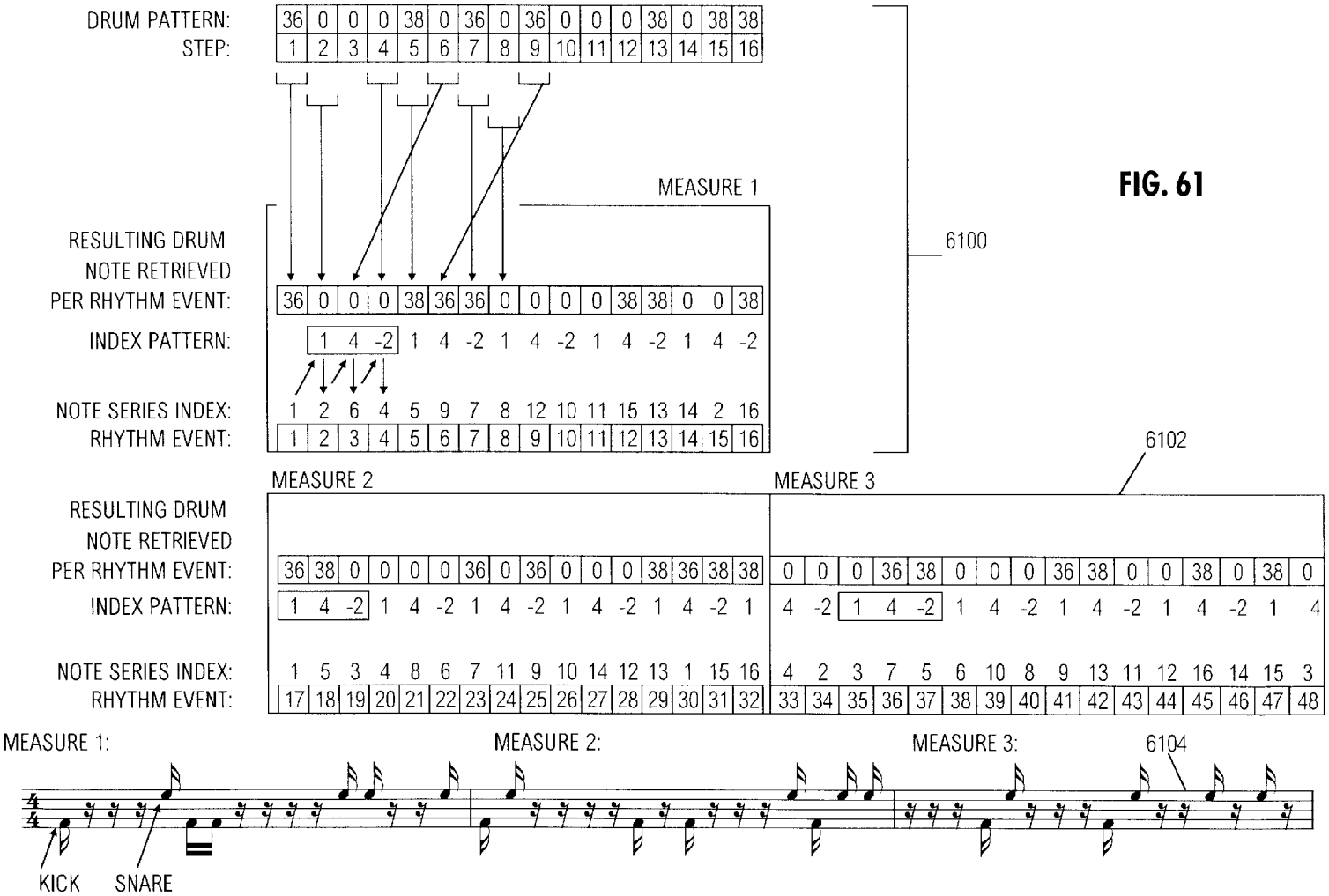

FIG. 61 is an example utilizing index pattern values of {1, 4, −2} to read data out of the drum pattern. In this example, the cluster pattern value is assumed to be {1}, so that single notes are retrieved at each rhythm event 6100. After each rhythm event, the next value derived from the index pattern is added to the note series index as previously described. As shown, this results in a movement through the drum pattern of forward by 1, forward by 4, backwards by 2, and so on. As shown, the application of the values from this index pattern results in a cyclical output 3 measures in length 6100–6102, where each measure has a different beat, as shown by the music notation 6104. As can be seen, this is a different resulting beat than the previous examples.

Although the previous examples show the note series index being wrapped around if it goes outside the range of the drum pattern, other methods are possible such as inverting the value (e.g. note series index=drum pattern size−note series index) or limiting the note series index to a value within the range. Furthermore, although shown separately for clarity, the index patterns and cluster patterns may be used together to further alter the read out of the data.

When multiple drum patterns are used together in the manner of FIG. 23, each drum pattern maintains a separate note series index, and separate pattern indexes, so that each pattern can be indexed in an independent manner, and data read out of different locations as desired.

SCALING THE LENGTH OF AN ENVELOPE ACCORDING TO A PORTION OF READ OUT DATA

The previously explained envelopes may have their time reference scaled to the length of a certain portion of the reading out procedure. This may be done by processing the portion desired according to the previously described process, but rather than using regularly received automatic and/or manual advance clock events, clock events are generated as fast as processing allows while suppressing the output of any data.

Figure 62:
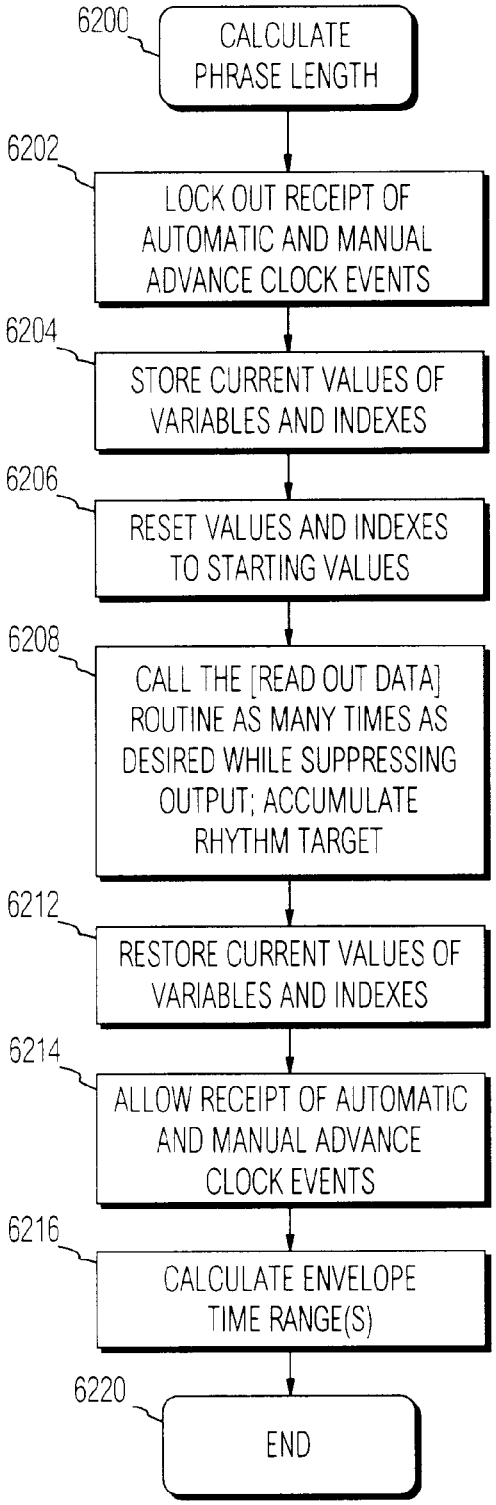
FIG. 62 is a flowchart of the process of scaling an envelope's time range to a portion of read out data.

FIG. 62 is a flowchart showing the operation of a [Calculate Phrase Length] routine which may be used to scale the time reference of the envelopes to the length of a portion of musical effect to be generated. This routine may be called at any time during other processing to update the envelopes. First, the receipt of regular automatic and/or manual advance clock events is "locked out," so that the [Read Out Data] routine (FIG. 55) will not be called by such receipt during this process 6202. The current values of all related variables and indexes used during the reading out of data are then stored in temporary memory locations 6204, which has the effect of saving the current state of the variables and indexes at the present point in the processing sequence. Next, all of the variables and indexes are reset to their predetermined starting values 6206. The previously described [Read Out Data] routine is then called as fast as processing speed allows while suppressing the output of data 6208. The value of the rhythm target that is calculated each time the rhythm pattern advances is accumulated in a temporary memory location. Since the [Read Out Data] routine is actually reading out the data with the same pattern indexes and other variables as described, phase changes terminations and all other aspects of the process will occur as described, and a certain portion of the data can be read out. However, no data is actually output during this time. Typically, this is sufficient to accumulate a rhythm target for a certain amount of read out data within a few milliseconds.

After the desired portion has been read out without output, the current values of the variables and indexes are restored 6212 from the values that were stored previously at step 6204. This has the effect of restoring the previous state of the variables and indexes at the point in the processing sequence prior to this procedure being called. The receipt of regular automatic and/or manual advance clock events is then restored 6214, after which the read out of data may continue as previously described. The accumulated rhythm target value may then be utilized to calculate a new time range for any envelopes which may be basing their time range on this method 6216, and the routine is finished 6220.

To calculate a new time range for an envelope, one may employ the following formula, utilizing the current tempo, and current timing resolution in clocks per quarter note (cpq):

$$\text{time range}=((60000/\text{tempo})/\text{cpq})*\text{accumulated rhythm target.}$$

By way of example, assume the reading out process at step 6208 runs for 2 total phases, and during that time the accumulated rhythm target (number of clock events that would have been utilized) is 192. If the tempo is 120 bpm and the timing resolution 24 cpq, the time range is (((60,000/120)/24)*192)=4000 ms (rounded to nearest whole integer). An accumulated rhythm target of 144 at a tempo of 100 bpm would yield a time range of (((60,000/100)/24)*144)=3600 ms. After calculating a new time range, the step rate and step size for each segment of the envelopes may be recalculated as previously described. In this manner, the length of an envelope function may be scaled in real-time to correspond to a musical phrase length which may change in real-time.

DIRECT INDEXING

When reading out data using the direct indexing mode, user actions are used to determine which memory locations to read data out of (in place of an index pattern) and when such reading out will occur (in place of a rhythm pattern). The other types of patterns as previously described can be used in a similar fashion once the data has been retrieved. Furthermore, the actual duration of a key or button being held can be used in place of a duration pattern; the actual velocity with which a key or button is pressed can be used in place of a velocity pattern.

Locations in the addressable series from which to read out data are chosen by one or more of several methods:

(a) MIDI controllers, such as a ribbon, mod wheel, joystick and so on configured for this purpose; the value passed to the routine is the current value of the controller;

(b) MIDI notes from a keyboard or other controller configured for this purpose within a certain range of pitches, the value being passed to the routine is the MIDI note number and the current velocity; and (c) interface buttons and keys. These can be numbered in a series of {1 to "n"} ("n" being an integer representing the number of such buttons or keys). The value passed to the routine is the number of the button, which may optionally be velocity-sensitive, in which case, the velocity is also passed to the routine, with a velocity of 0 being sent on the release of the button. If the buttons are not velocity sensitive, a default velocity such as 127 for button press and 0 for release can be used.

A direct index call is a single operation of the direct indexing routine, utilizing the value from one of the previous methods. A direct index chord is a group of direct index calls with different values occurring simultaneously or at nearly the same time. A direct index chord may be created from two or more direct index calls, such as by multiple key presses grouped together using a process such as the time window method previously described, or by buttons or keys on the control panel of an electronic musical instrument configured to send a group of direct index calls. This will cause several different indexes from the addressable series to be chosen and output as MIDI notes simultaneously, creating a chord, in which case a flag in memory will be set indicating that a direct index chord has occurred. This flag may then be utilized during selection of values in the following routine.

Figure 63:
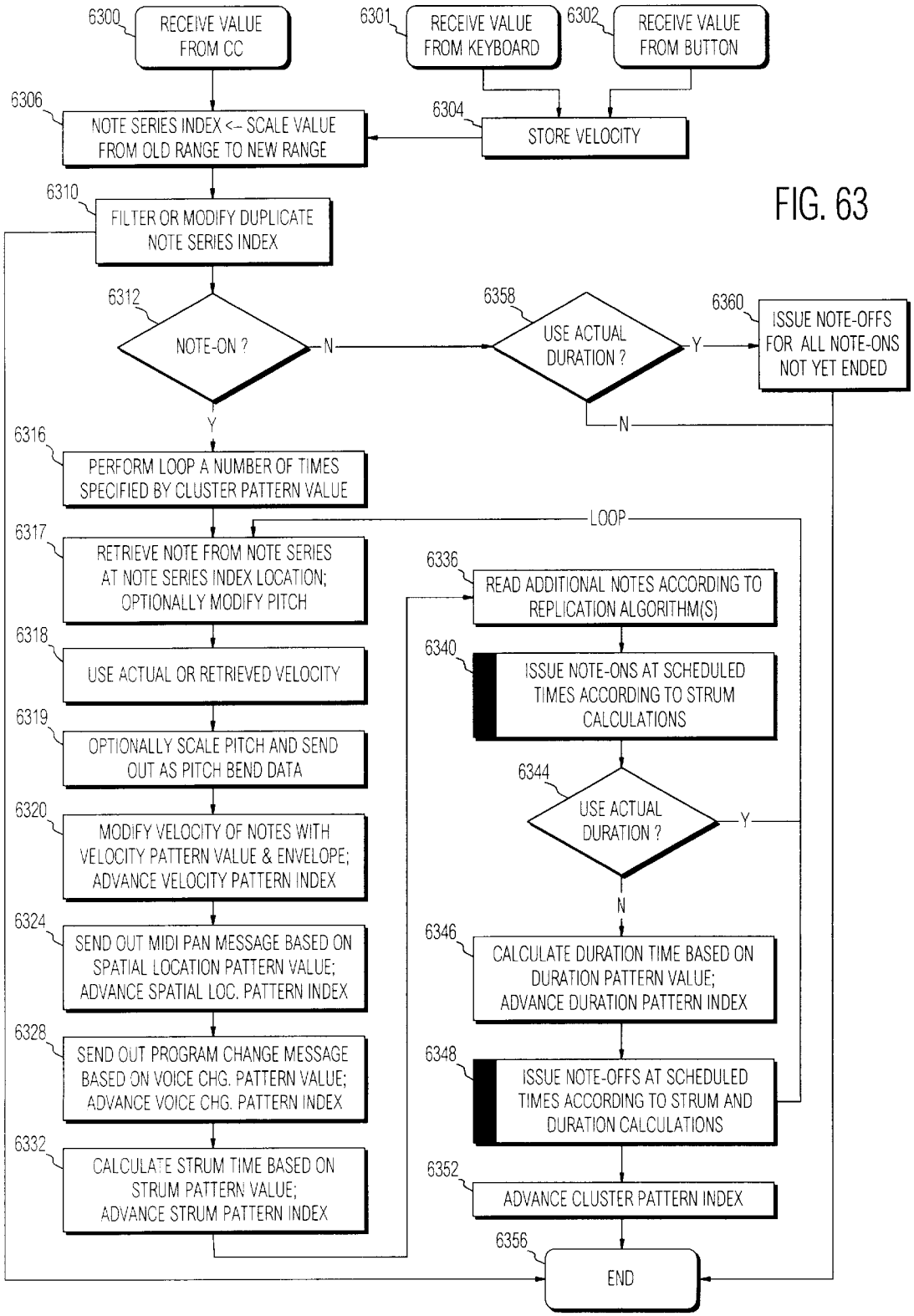
FIG. 63 is a flowchart of the process of reading out data from a note series using direct indexing.

FIG. 63 is a flowchart of the direct index routine. Since many of the steps in this routine are the same as or similar to FIG. 55 (reading data out with clock event advance), the following description will not go into detail for steps already described. Furthermore, the definitions and initialization previously described also apply here. For clarity, the following discussion does not show the phase changing steps 5512 and 5560–5579 of FIG. 55, and all patterns and values are shown as if there was only a single phase being utilized. However, these steps can be added to the following routine and multiple phases utilized in the same fashion.

The process of direct indexing in FIG. 63 begins with an input call from a continuous controller 6300, a keyboard 6301, and/or a button 6302. If a keyboard key 6301 or a button 6302 is the source of the call, the velocity of the key or button press is stored 6304. For any of the inputs, the note series index is calculated by linearly scaling the value from an original (old) range to a value within a new range. For a continuous controller, the old range is typically 0 to 127 (old bottom and old top). Keyboards will have a predetermined range of valid note numbers ranging from the lowest pitch to the highest pitch. Finally, interface keys or buttons may be considered to have an old range of {1 to the number of buttons.} For any of the input devices, the new range (new bottom and new top) is {1 to the number of steps in the note series.}

The following formula may be used to calculate the note series index, where "value" is the continuous controller value, keyboard pitch or button number:

note series index=((value−old bottom)*(new top−new bottom)/(old top−old bottom))+new bottom.

Instead of using the entire length of the note series as the basis for the new range, any portion of the range may be utilized (e.g. {1 to (length/2)}, {3 to (length −2)}, and so on).

Next, the note series index may optionally be filtered or adjusted by comparing it with the last note series index calculated by a previous running of this routine 6310. In the case of a continuous controller, it is advantageous to filter out repetitions of the same value, so if the value was the same, the routine would terminate 6356. In the case of a key or button press, it may be desirable to adjust an index to an adjacent index if the index is the same as the previous one. This can be accomplished by using a flip-flop in memory, and adding or subtracting a value such as 1 or 2 from the note series index while remaining within the range of the note series, and toggling the flip-flop with each adjustment so that repeated adjustments go back and forth between addition and subtraction. Furthermore, if a source note-on or button push results in an adjusted note series index, and in turn the generation of an adjusted pitch note-on, the source note-off or button release will generate the same adjusted pitch as a note-off corresponding to the note-on.

After filtering or adjustment of the note series index, it is determined whether or not the routine was called by a note-on 6312. In the case of a continuous controller, all values are considered to be note-ons with an arbitrary default velocity value such as 127. In the case of a keyboard or user interface button, the depression of the key or button is considered to be a note-on, and the release is a note-off. If the routine was called by a note-on, the current value of the cluster pattern is used to determine the number of times to perform a loop 6316. The loop consists of the steps 6317 through 6348, with each repetition generating one or more notes and other MIDI data. If a cluster pattern is not being used, this step 6316 can be skipped and the loop would execute one time.

At the beginning of the loop, a note is retrieved from a note series in memory at the location specified by the note series index 6317. The note may be optionally modified as previously described.

Next, the actual velocity or a stored velocity is selected 6318. This can be determined by settings in memory. In the case of a continuous controller calling the routine, the actual velocity would be a default value such as 127 with other values possible. In the case of a keyboard key or button press calling the routine, the actual velocity will be the velocity with which the key or button was pressed, and was stored previously 6304. If not using actual velocity, then the velocity stored in the note series can be used.

In the subsequent steps, previously described operations are performed. The pitch of the note can be optionally scaled into a certain range and sent out as pitch bend data 6319. The velocity of the note can be modified by the current value of the velocity pattern and velocity envelope, for each note or once per cluster or direct index chord 6320. The current value of the spatial location pattern is sent out as pan data, for each note or once per cluster or direct index chord 6324. A decision is made as to whether it is time to send out a program change message, for each note or once per cluster or direct index chord 6328. A strum time is calculated, once per cluster or direct index chord 6332, and additional notes can be retrieved from the note series using various replication algorithms 6336. The currently retrieved notes are then issued at scheduled times as note-on messages 6340.

At this point, if actual durations are being used 6344, the loop ends and another part of the routine will handle the note-offs. Otherwise, if actual durations are not being used, the duration pattern will be utilized. In such a case, it will be necessary to calculate duration times based on a duration pattern value 6346 (or constant value if not utilizing a duration pattern) and schedule the issuance of note-offs corresponding to the issued note-ons 6348, before continuing the loop. If required, the loop executes again.

Once the loop has been performed the number of times specified, if a cluster pattern is being used, the cluster pattern index is advanced 6352, either once per direct index chord or per every execution of the routine. At this point, the routine ends 6356, until the next time a user action calls the routine.

If the initial calling of the routine is a note-off message 6312, then this information may be used to control the duration of the generated notes. If actual duration is not selected 6358, then steps 6346 and 6348 have already scheduled the issuance of the note-offs and the routine terminates 6356. If actual duration is selected 6358, note-off messages are sent out immediately for any note-ons not having previously scheduled or issued note-offs 6360, thereby imposing the actual duration on the generated notes, and the routine then terminates 6356.

EXAMPLES OF DIRECT INDEXING

Figure 64:
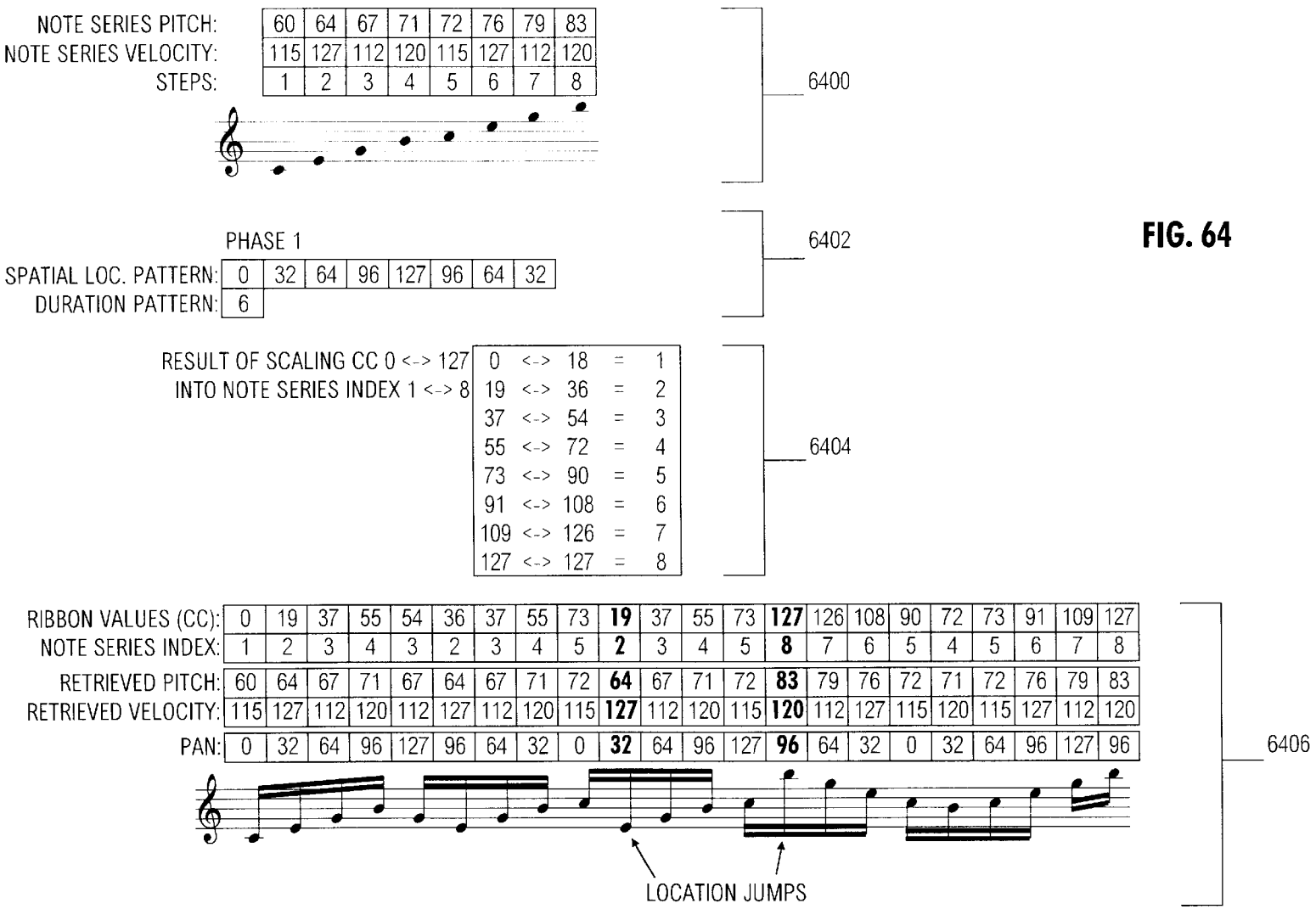

FIG. 64 illustrates an example of direct indexing using a MIDI continuous controller such as a ribbon controller that allows placing the finger at any starting point and moving upwards or downwards from there, thereby generating a range of values (e.g. {0–127}). The example shows the contents of an 8 step note series 6400 (consisting of pitch and velocity at sequential index locations {1–8}). Spatial location and duration pattern values for a single phase are also shown 6402. For purposes of clarity, other various patterns are not shown. Scaling of the controller output into a note series index {1–8} is accomplished by the algorithm in chart form 6404 although it should be recognized that other algorithms could be used.

A series of values generated by the ribbon controller is illustrated by the tables and musical notation in the lower portion of the FIG. 6406. The numbers in bold type signify a discontinuity in the input to the controller caused by lifting the finger and starting in a new place (a location jump).

When using a continuous controller, duplicate note series indexes can be filtered out and not cause any output as previously described. Thus, although the controller provides multiple sequential values between 0 and 18, no additional output occurs until the controller output enters a new input range 6404 (e.g. {19–36} or {27–54}). The resulting scaled note series index 6406 retrieves pitches and velocities from the note series, and pan data is selected by advancing through the pan pattern as each successive note is generated. Since the duration pattern value is {6}, each note is generated with a duration of a 16th note, but the rhythm of the resulting notes is determined by the movement of the continuous controller. Although the musical notation shows the pitches and durations of the phrase, no rhythm is implied.

FIG. 65 is a diagram showing another example direct indexing using a number of user interface buttons, in this example assumed to be 12 buttons numbered {1–12}. The example shows the contents of a 12 step note series 6500 (consisting of pitch and velocity at sequential index locations {1–12}). Various pattern memory locations for a single phase are shown 6502. For purposes of clarity, various other patterns are not shown. Since the number of buttons (12) and the number of notes in the note series (12) are the same, in this example there is a direct correlation between which button is pressed and which index is chosen. In other words, scaling the button numbers into the note series produces the same value as before, although there could be more or fewer buttons than steps in the note series. As described before, the buttons may be configured so that they produce a velocity value relating to how hard they have been pressed, and send a velocity value of 0 when released. In the following example, however, the velocities are ignored because actual velocities and actual durations are not being used.

Next is shown a rhythmic pattern played on a series of buttons 6504, and the resulting musical phrase generated by the button presses 6506. The pitches and velocities at the note series indexes are retrieved, the velocity is modified by the next velocity pattern value, and pan data is sent from the spatial location pattern as each successive note is generated. Since actual durations are not being used, the duration pattern value of {12} produces notes all having the duration of an 8th note, even though the rhythm of the button presses contained quarter notes.

FIG. 66 is an example of achieving direct indexing with the notes from a MIDI keyboard. In this example, the range of notes used is {60–84} (25 notes covering a 2 octave range). A 12 step note series is shown 6600 (consisting of pitch and velocity at sequential memory locations {1–12}). A spatial location pattern for a single phase is shown 6602. For purposes of clarity, various other patterns are not shown. Actual durations and actual velocities are used instead of patterns. An arbitrary scaling algorithm in chart form 6604 shows the mapping of the keyboard output into the note series index. As seen, several adjacent notes will produce the same note series index since the range of notes is greater than the range of indexes.

A series of input notes played on the MIDI keyboard 6606 are shown in chart form and musical notation, with the rhythm, duration, and velocities they were played with. The resulting musical phrase generated in response is shown below 6608. Since actual durations and velocities are used, the rhythm, durations, and velocities carry through from the input. Pan data is generated from the spatial location pattern as each note issues. The note series index in bold type (the seventh note) signifies a duplicate index adjusted. Because the input note number 72 would result in a scaled index of 5, the same as the previous index, the index is adjusted to an adjacent index (e.g. 4).

While the previous examples showed the use of a single phase, multiple phases could have been used as previously described.

READING OUT OF DATA FROM A DIGITAL AUDIO NOTE SERIES

Pitch-shifting algorithms are well-known in the industry, whereby the pitch of a sound that has been digitally recorded into memory can be changed to a different pitch. One example of a product incorporating pitch-shifting algorithms is the Digitech Studio Vocalist. Furthermore, devices that allow digital audio data in memory to be played back by more than one playback voice at different pitches and amplitudes simultaneously are well know as "samplers," with the Fairlight CMI Series III being one example.

An example system utilizing an electric guitar with a hex pickup has already been described in the creation of a digital audio note series, whereby a number of discrete channels of digital audio data are recorded into separate DALs. When utilizing this type of note series, the system also provides for a number of playback voices, which can be the same as the number of DALs, or a higher number. The digital audio in each DAL buffer is capable of being played back by one or more playback voices at the same time, at different pitches and amplitudes.

The digital audio notes series consists of pitches, velocities, original pitches and dal ids as previously described. As the data in the digital audio note series is read out, the values retrieved are used to initiate playback and modification of the digital audio with one or more of the playback voices.

The example shown in the top portion of FIG. 43 shall be utilized in the following discussion, which shows an 18 step digital audio note series 4300. When the reading out of the data is performed, the original pitch, pitch, velocity and dal id are retrieved at the index specified according to the processing. Rather than sending the pitch and velocity as MIDI information to a tone generator, the digital audio data in the buffer indicated by the dal id is played back using one of the playback voices, but the retrieved pitch is used to playback the audio at a different pitch.

For example, at index (step) 8, the dal id is 2. The original pitch of that input note that was analyzed and stored was 47. The pitch of the note series at index 8 is 49. Therefore when the digital audio data in the buffer corresponding to dal id 2 is played, it may be shifted up by 2 semitones (49–47). If a velocity pattern is being used during the processing as previously described, the resulting modified or replaced velocity value may then be optionally used to modify the amplitude or playback volume of the digital audio, so that it was louder or softer as a result than the original recording. For example, a velocity value of 127 could indicated playback at 100% original volume, and a value of 0 indicating playback at 0% original volume, with values in between being scaled accordingly.

Therefore, during the read out of data using the clock advance mode of FIG. 55, at step 5544 instead of issuing note-ons and note-offs, the playback of digital audio in the buffer indicated by the retrieved dal id is commenced, with the duration calculation being used to determine when to stop playback and end the note. During the read out of data using direct indexing mode of FIG. 63, at step 6340 the playback of digital audio in the buffer indicated by the retrieved dal id is commenced, with step 6348 or 6360 determining when to end playback. The difference between the retrieved pitch and the original pitch indicates an amount of pitch-shift to apply to the digital audio data, with the velocity optionally controlling the volume during playback.

Alternately, the step of creating an altered digital audio note series could consist of duplicating the recorded digital audio data of the input notes, and pitch-shifting it ahead of time rather than in real-time. In this case, there would be a higher number of DALs available, and when a pitch was replicated during the creation of the altered note series, the DAL would be duplicated, and the pitch then shifted to the specified pitch. Therefore, for the example shown in FIG. 43, the altered note series 4300 would contain 18 DALs, with dal ids {1–18} constituting the original 6 DALs plus two replications, with the replicated locations containing pitch-shifted data. Therefore, the original pitches would not be needed, and the read out of the data would not need to perform any pitch-shifting. The digital audio data in the locations would simply be played at the pitches they were stored with; however the velocity may still control the volume of the playback.

AUTOMATIC PITCH-BENDING EFFECTS

DETAILED DESCRIPTION OF A PREFERRED EMBODIMENT

Automatic pitch-bending effects may be independently generated during the process of the reading out of data or generating a repeated effect, corresponding with the notes as they are generated. This is achieved by sending out MIDI pitch bend messages of different values at precalculated times, imposing an overall bend shape on a note while it is sustaining.

Figure 67:
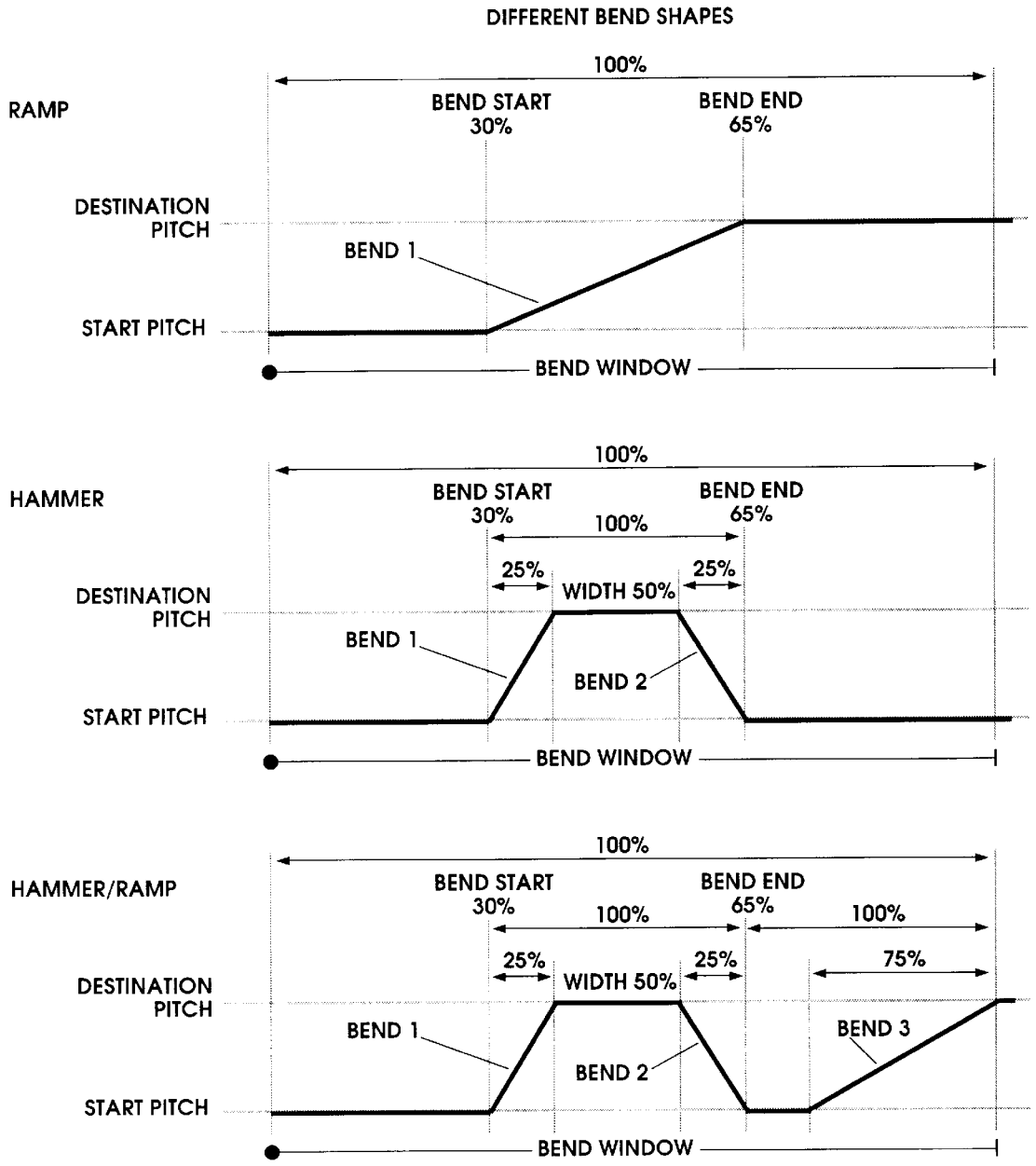
FIG. 67 is a diagram showing three different bend shapes.

A number of different bend shapes are provided, as illustrated in FIG. 67. The ramp shape is a single bend from a start pitch to a destination pitch. The hammer shape is a series of two bends from the start pitch to the destination pitch and back to the start pitch. The hammer/ramp shape is a series of three bends combining the hammer with a ramp at the end. Other shapes are possible, such as shapes containing four or more separate bends.

An overall bend window is utilized as illustrated, which is the length of the bend over time. Parameters are provided that determine where in the bend window the bends will be generated. The bend start and bend end are percentages of the overall bend window indicating where the bend will start and end. For the hammer and hammer/ramp shapes, an additional width parameter is specified, which is a percentage of the portion centered between the start and end points. The diagram shows a width setting of 50%. Therefore it is centered between the bend start and bend end, with 25% left on either side. For the hammer/ramp shape, the width parameter also affects where the third bend will start in the remaining portion after the end point. In the present example, the following formula may be employed:

$$\%\text{ of remaining portion}=(100-(\text{width}/2)).$$

Figure 68:
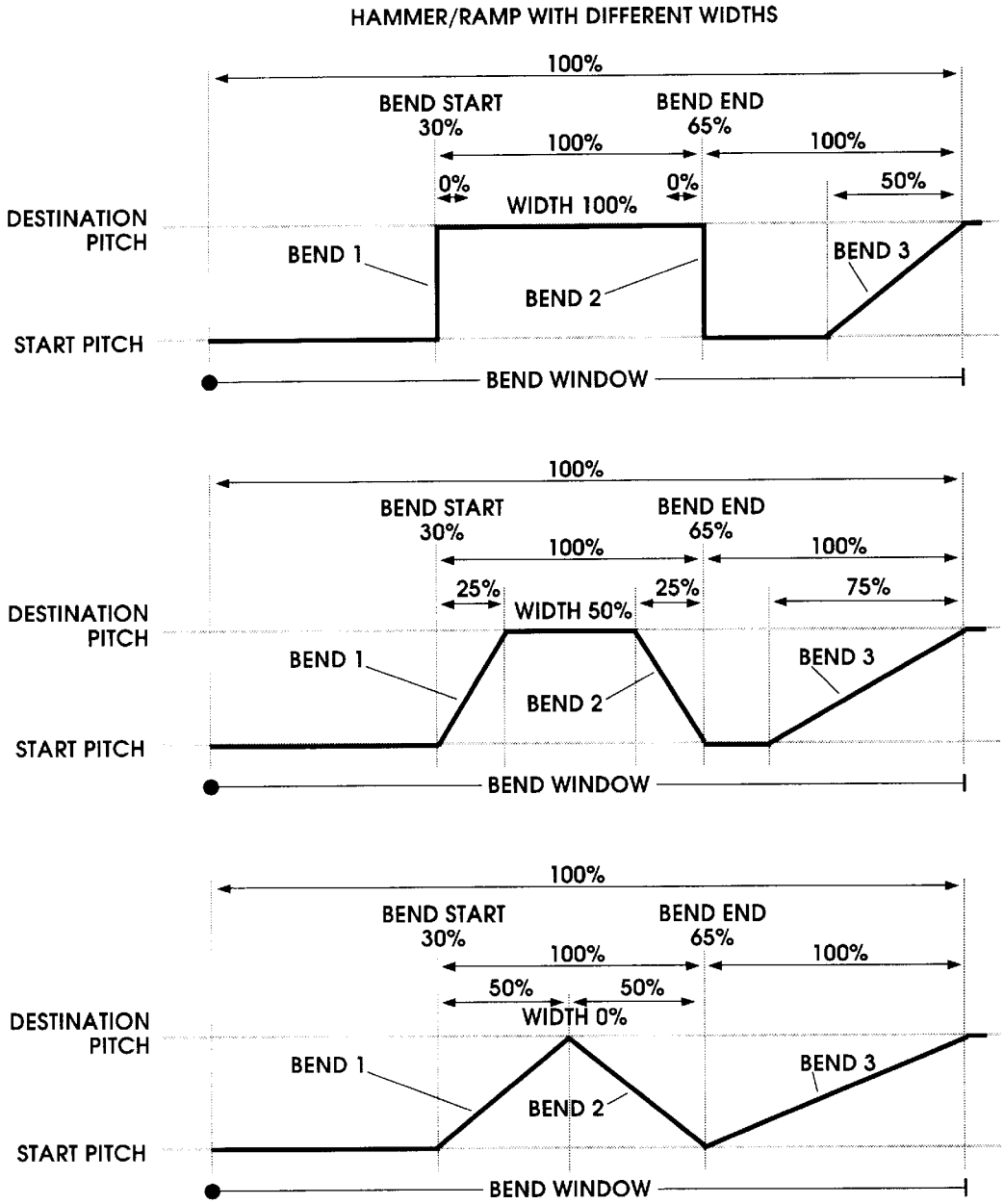
FIG. 68 is a diagram showing the effect of three different width settings on a hammer/ramp bend shape.

FIG. 68 illustrates 3 different settings of the width parameter and the resulting effect on a hammer/ramp bend shape. The first example shows that when the width is 100%, the length of the third bend is 50% of the remaining portion after the bend end (100–(100/2)). The second example shows that when the width is 50%, the length of the third bend is 75% of the remaining portion (100–(50/2)). The third example shows that when the width is 0%, the length of the third bend is 100% of the remaining portion (100–(0/2)). Other methods are possible, including a separate parameter controlling the length of the third bend.

Two modes of operation may be used to determine the actual bend window length. If the length mode is note duration, the duration of the note about to be generated is utilized; if the length mode is actual time, a fixed amount of time such as a value in milliseconds is utilized. FIG. 69 illustrates the difference between the two length modes. In a bend using note duration, the percentages apply to a bend window that changes based on the note's duration. In a bend using absolute time, the lengths of the bend windows stays the same regardless of the actual duration of the note.

The amount to bend the pitch may be a predetermined value, such as a fixed amount or a value derived from the next step of a bend pattern. Alternately, the amount to bend the pitch can be calculated based on previously generated notes and/or notes which will be generated in the future. In the case of reading out data, the pitches of one or more previously generated notes can be stored. From these values, the required bend amount and shape can be calculated, and pitch bend data issued so that the note appears to bend to a previous pitch. Bending to the pitch two steps previous (previous+1), three steps previous (previous+2) and so on can be achieved if desired, by storing the requisite number of pitches desired. The pitches of notes to be generated in the future can be determined by looking ahead in the reading out process, such as by running a second simultaneous reading out process that is ahead of the present process by one or more instances of reading out data (without output of data), and storing the pitches of the notes that would have been generated. From these values, the required bend amount and shape can be calculated, and pitch bend data issued so that the note appears to bend to a next pitch not yet generated. Bending to the pitch two steps ahead (next note+1), three steps ahead (next note+2) and so on can be achieved if desired, by running the second reading out process more than one step ahead of the present process.

As an alternate to utilizing one of the bend shapes described above, a bend envelope may be utilized to describe a shape, with the y-axis envelope value being scaled to the desired bend amount, and the x-axis time range being scaled to the length of the bend window.

To initiate the generation of the automatic pitch bend effect, an additional step is required in the previously described reading out of data. During the process of reading out data in clock advance mode of FIG. 55, an additional step may be inserted into the process between steps 5540 and 5544. During the process of reading out data in direct indexing mode of FIG. 63, an additional step may be inserted into the process between steps 6336 and 6340.

Figure 70:
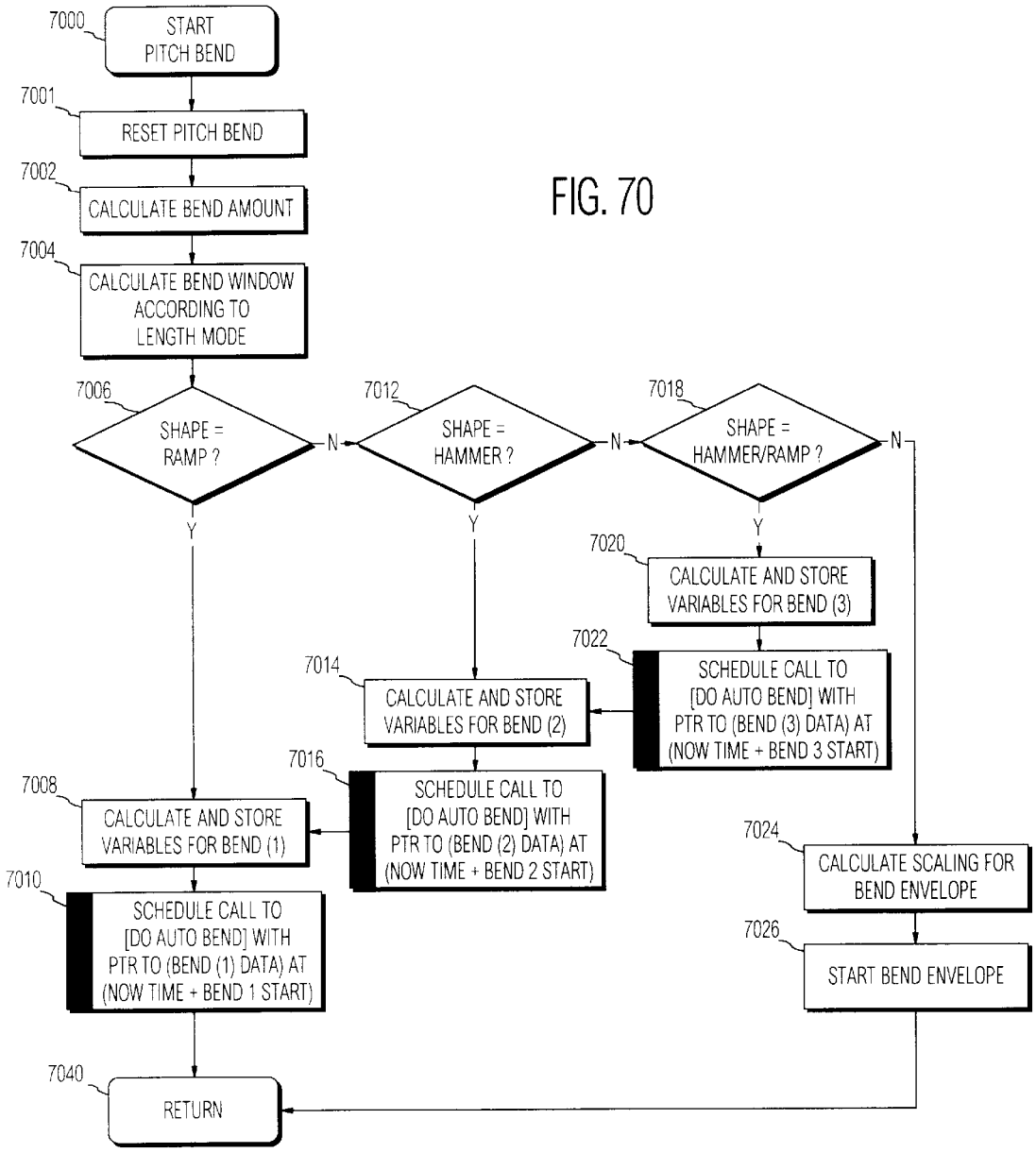
FIG. 70 is a flowchart showing the process of generating an automatic pitch-bending effect.

The additional step is the [Start Pitch Bend] routine shown in FIG. 70. When a note is about to be generated, the various variables related to the automatic pitch bend effect are calculated and stored in separate data locations for each bend. A call to a recursive procedure is scheduled at a point in the future equal to the calculated start of each of the bends making up the bend shape. When each of them are ultimately called, they send out a first calculated pitch bend value and then schedule another call to the same routine at a point in the future, initiating a chain of pitch bend data output corresponding to the desired bend shape.

Double precision (14 bit) MIDI pitch bend values are utilized in this example and hereafter, ranging from {0–16383}, with 8192 being deemed a center position at which the pitch is at its normal value. Standard values (7 bit) from {0–127} could alternately be used. The bend range on the MIDI device is assumed to be set to an octave, so that a pitch bend value of 0 bends the pitch down one octave. A value of 8192 returns the pitch to its normal pitch, and a value of 16383 bends the pitch up one octave.

First, an initial bend reset value (e.g. 8192) may be sent out 7001, which resets the pitch bend of the destination device to a default or center position. Next, a bend amount is calculated 7002, being a number of semitones to bend in either direction. Positive values bend the pitch upwards; negative values bend the pitch downwards. The calculation of the bend amount may be done in several different ways. If it is a fixed amount (e.g. 6) it can be retrieved from parameter memory. If a bend pattern is utilized, it can be derived from the next step of the bend pattern and the bend pattern index advanced to a new location. In the case of a fixed or derived semitone value, the bend amount may be adjusted to compensate for atonal bends by using a conversion table based on a current chord or scale. One may employ the following pseudo-code as an example of the procedure:

bent note=current note+bend amount bent note=[Convert] bent note adjusted bend amount=bent note−current note By way of example, if the current note to be generated is 71 (B3) and the bend amount is 7, the bent note will be (71+7)=78 (F♯4). If the current chord is a CMaj7 utilizing a conversion table of {0, 0, 2, 4, 4, 7, 7, 7, 9, 11, 11}, the bent note is reduced to its pitch class and octave, the pitch class (6) is modified by the conversion table to 7 and placed back in the correct octave, yielding 79 (G4). The adjusted bend amount is therefore 79−71=8 semitones.

If the bend is to be calculated based on bending to a previous or next note, the bend amount may be determined by utilizing the current pitch about to be generated, and one of the two following formulae:

bend to previous pitch: (bend amount=current pitch−previous pitch)

bend to next pitch: (bend amount=next pitch−current pitch)

For example, if bending to the next pitch 64 from a current pitch 60, the bend amount is (64−60)=4 semitones.

The resulting bend amount arrived at by any of these methods may be limited to a maximum range of values (e.g.+12 to −12), or may have modulo division performed to keep it within a range (e.g. modulo 12).

The bend amount may be optionally inverted (e.g. 7 becomes −7, −12 becomes 12) as desired according to a mathematical procedure, such as every other bend produced is inverted, or every third one, or a pattern of bend inversions such as {yes, no, no, no}. In the case of using a conversion table, the inversion would be applied before the calculation above. In the case of bending to a next or previous note, the inversion may indicate utilizing the opposing operation. For example, bend to the (next note+1), then bend to the (previous note+1), and so on.

Once the bend amount is determined, the overall length of the bend window is calculated 7004, depending on the length mode. If the length mode is absolute time, a value is retrieved from parameter memory or derived from the next step of a bend pattern representing a time in milliseconds (e.g. 100 ms). If the length mode is note duration, the bend window is calculated according to the duration of the note about to be generated. The duration time calculated in FIG. 55 5540 or FIG. 63 6346 may be utilized, or calculated in the same fashion. If using an absolute time, it may be checked if the absolute time is greater than the calculated duration time (meaning the bend may not finish before the note ends). The bend window may be limited to the duration time in this case.

After the bend window length is determined, the bend shape is checked. If the bend shape is "ramp" 7006, then a single bend must be calculated 7008, using the parameter memory values of bend start and bend end, and the bend window. One may employ the following formulae to calculate the bend start and bend length (in milliseconds):

bend length ms=(bend window*(bend end−bend start))

bend start ms=(bend window*bend start)

By way of example, a bend window length of 500 ms will be utilized. If the bend start is 60%, and the bend end is 100%, then the length of the bend will be (500*((100−40)/100))=200 ms. The bend start ms will be (500*(60/100))=300 ms.

A bend target value is calculated, being the total amount to bend in double precision MIDI pitch bend values. With an overall range of 8192 for an octave, a semitone bend requires the value (8192/12)=682.6666. If an example bend amount is +4 semitones, then the bend target will be (4*682.6666)=2730.6664.

A bend rate parameter determines how often a pitch bend message will be sent. Utilizing an arbitrary value of 20 in this example, every 20 ms a bend message will be sent. Since the bend length has been calculated to be 200 ms, (200/20)=10 bend messages will be sent in the required time. To achieve the bend target in 10 messages, each of the messages must cumulatively bend the pitch by (2730.6664/10)=273.06664, rounded to 273. If the bend length ms is less than the bend rate, it may be adjusted to equal the bend rate. If the bend length ms is 0, then a single bend message corresponding to the entire bend target may be sent.

Figure 71:
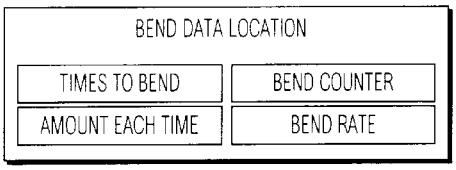
FIG. 71 is a diagram of a bend data location.

The values after calculation 7008 are stored in a bend data location in memory. The data location can be pre-allocated, or allocated during processing using standard memory allocation techniques. FIG. 71 shows the structure of a bend data location in memory. The times to bend is stored (e.g. 10), the bend amount each time is stored (e.g. 273), and the bend rate is stored (e.g. 20 ms). A bend counter is initialized to 0.

Returning to FIG. 70, the [Do Auto Bend] routine is scheduled to occur at a point in the future of (now time+bend start ms) 7010, which is 300 ms from the current time. A pointer to the bend data location with the stored calculations is passed.

Figure 72:
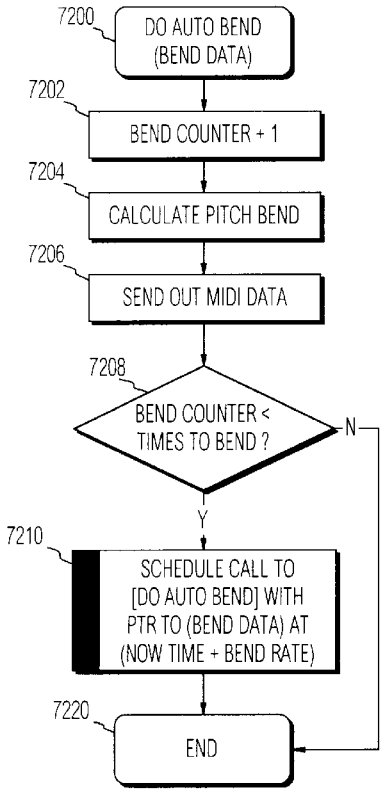
FIG. 72 is a flowchart of a routine used in the process of generating an automatic pitch-bending effect.

When the [Do Auto Bend] routine shown in FIG. 72 is eventually called (in 300 ms), it receives the pointer to the bend data location 7200. First, the bend counter is incremented by one 7202. Next, the actual amount of pitch bend to be send out is calculated 7204 by multiplying the current value of the bend counter by the amount each time value. This is then added to an offset of 8192 (to bend from the center of the range), with other offsets (or no offset) being possible. In this example, the calculation yields (1*273)+8192=8465. The calculated value is then sent out as a double precision MIDI pitch bend message 7206. If the bend counter is still less than the times to bend 7208, another call to this same procedure is scheduled at a point in the future equal to (now time+bend rate) 7210 and the routine ends 7220. Therefore, in 20 ms this routine will be called again. At that time, the value of the bend counter will be incremented to 2, so the actual pitch bend value sent out will be (2*273)+8192=8738, the counter will increment, and the routine will be called again in 20 ms. At that time, the actual pitch bend value sent out will be (3*273)+8192=9011, and so on. Once the counter is incremented to 10 (indicating the 10th bend has been sent out), the test will fail at step 7210 and the routine will stop calling itself, thereby ending the bend. The bend data location may then be reallocated according to whatever memory management scheme is utilized.

Returning to the [Start Pitch Bend] routine of FIG. 70, if the bend shape is "hammer" 7012, a second bend is calculated and stored 7014, and a call to the [Do Auto Bend] routine scheduled at the calculated time 7016, before the first bend is calculated and scheduled at steps 7008–7010. If the shape of the bend is "hammer/ramp" 7018, a third bend is calculated and stored 7020, and a call to the [Do Auto Bend] routine scheduled 7022, before performing steps 7014–7016 and 7008–7010. The order in which the bends are calculated, stored and scheduled is not important, and only shown in reverse order for the clarity of the flowchart.

In the case of the hammer and hammer/ramp shapes, the first and second bends are calculated using the width parameter. One may employ the following formulae to calculate the length of both bend 1 and 2, and the start of each bend:

width percentage=(bend end−bend start)*(bend width/100)

bend percentage=((bend end−bend start)−width percentage)/2 bend length ms=(bend window*bend percentage)

bend 1 start ms=(bend window*bend start)

bend 2 start ms=(bend window*(bend end−bend percentage))

By way of example, a bend window length of 500 ms will be utilized. If the bend start is 60%, the bend end is 100%, and the width is 50%, then the width percentage is (100−60)*(50/100)=20%. The bend percentage is ((100−60)−20)/2=10%, and the bend length ms for both bends is (500*(10/100))=50 ms. Bend 1 start ms is (500*(60/100))=300 ms. Bend 2 start is (500*((100−10)/100))=450 ms.

In the case of the hammer/ramp shape, the third bend is also calculated using the width parameter. One may employ the following formulae:

end percentage=(100−bend end)

bend percentage=(100−(bend width/2))

bend length ms=((bend window*end percentage)*bend percentage)

bend 3 start ms=(bend window−bend length ms)

By way of example, a bend window length of 500 ms will be utilized. If the bend start is 40%, the bend end is 80%, and the width is 50%, the end percentage is (100−80)=20%. The bend percentage is (100−(50/2))=75%. The bend length ms is ((500*(20/100))*(75/100))=75 ms. The bend 3 start is (500−75)=425 ms.

Each of the bends allocates its own bend data location, stores the applicable values inside, and schedules a call to the [Do Auto Bend] routine at the correct start time, producing one or more resulting bends. In the case of the second bend, it will be bending back to the center pitch from the end of the first bend. Therefore, when the bend amount each time value is stored, it is first inverted so the bend will proceed in the opposite direction. Then, in the [Do Auto Bend] routine, when the actual pitch bend value to send out is calculated, an additional offset of the calculated bend target (total size to bend) is added to the value. For example, if the bend amount was +4 semitones, the bend target is (4*682.6666)=2730.6664. Therefore, when the second bend starts, the actual value will be calculated as (bend counter*amount each time)+8192+2731. This has the effect of starting the pitch of the second bend from where the first bend finished; other methods are possible.

As an additional option, stepped bends may be created in a similar fashion, where instead of a smooth linear ramp between two points, the number of semitones between the two points is used, with the result that the bend is quantized as if stepping by semitones to reach the desired destination value. In this case, the bend rate value is calculated by dividing the bend window by the number of semitones. For example, if the bend window is 500 ms, then the bend rate is (500/4)=125 ms. The times to bend is 4, and the amount to bend each time is a semitone, or 682.6666. The bends are scheduled to occur in exactly the same fashion, with the result that a series of 4 semitone bends would be sent out, separated by 125 ms each.

Referring to FIG. 70, if the bend shape is not a hammer/ramp 7018, it is assumed a bend envelope is being utilized to describe the shape, and calculations are made to scale the envelope value and time range of the envelope to the bend amount and the bend window respectively 7024. For example, if the bend amount is +4 semitones, the envelope value (x-axis) may be scaled from its arbitrary range of {0–100} into double precision pitch bend values in the range (8192 to (8192+2731). If the bend window is 500 ms, the y-axis may be scaled so that the total of all three segment's highest possible arbitrary value (100*3)=300 is scaled into a range of (0–500 ms). Other scaling methods are possible. The envelope is then started 7026 and the routine is finished 7040.

Bends in progress may be stopped at any time by searching through the task list in memory of scheduled tasks to perform, and removing any pending scheduled calls to the [Do Auto Bend] routine, or by stopping any bend envelopes which are operating. This may also be done as an optional step at the beginning of the [Start Pitch Bend] routine, so that a new automatic pitch bend effect that is about to be generated may terminate any bending operations still in progress from earlier operations of the routine.

Although many of the various parameters described above are percentages of the overall bend window, they could alternately be absolute values referring to time. While the automatic pitch bend effects are generated in the previous examples by sending out MIDI pitch bend data, it is also possible to directly control pitch-bending parameters of a tone generator through the preceding process and remain within the scope of the invention.

Figure 73:
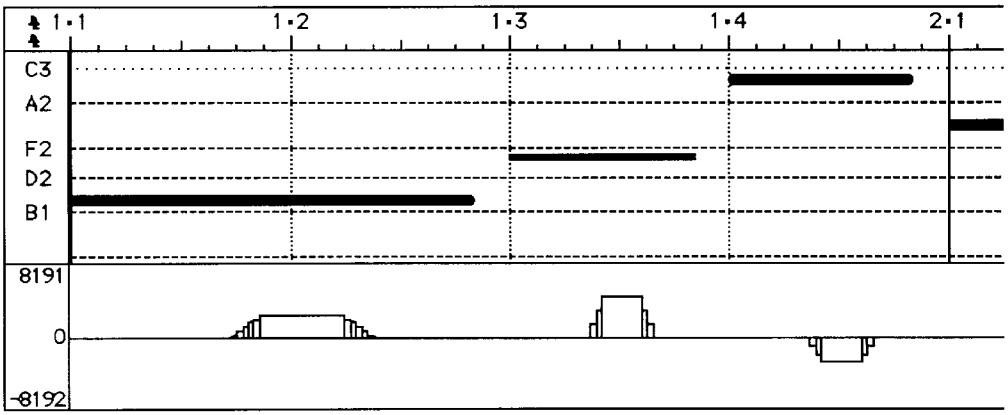
FIG. 73 is a diagram of an automatic pitch-bending effect generated using MIDI data.

FIG. 73 shows an example section of MIDI data in piano-roll format, along with the resulting pitch bend data generated by bending each note to the next pitch, utilizing a bend window equal to the duration of the note. Therefore, the shorter notes have shorter overall bend lengths, with fewer instances of bend data sent out. The hammer bend shape has been utilized, with a width of 50%, so that each note bends to the next pitch and back. For example, the first note is a C2 (36) and the second note is an E2 (40). A pitch bend of +4 semitones has been generated during the first note. The third note is a B2 (37) and the fourth note is a G2 (41); a pitch bend of −4 semitones has been generated during the third note.

The preceding method may also be utilized during the processing of musical data in memory. Sections of preexisting MIDI data such as the preceding example may be analyzed, and automatic pitch bend data generated over the duration of each note, utilizing either the note duration or an absolute time as a bend window. The processing/playback can be in real-time related to tempo, with or without output of the actual sequence data, or can be performed in memory without output as fast as processing speed allows, with the results stored in other memory locations. The duration of a note can be determined before playing it by searching forward to find the corresponding note-off; alternately, the data may be preprocessed to store durations with each note. As the data is played back or processed, each note as it is played or processed may be stored and become a previous note to bend to, or the data may be scanned ahead so that the next note from a current position is determined and becomes a next note to bend to. Alternately, a bend of a fixed amount may be applied, modified by conversion tables if so desired.

DETAILED DESCRIPTION OF ANOTHER EMBODIMENT

In another embodiment of generating an automatic pitch bending effect, the bending is automatically performed in real-time while the user plays notes on a keyboard or other control device. The system of FIG. 2 may be simplified by removing modules 230, 235, 240, 245, 255 and 260. Each time an input note is received, the calculations are performed and the necessary bends scheduled at the calculated time(s) in the future. The overall bend window length may be specified as a certain duration at a current tempo (e.g. quarter or eighth note), or a specified number of milliseconds (e.g. 500 ms).

The bend can be chosen to start on key down or key release. Note-offs may be delayed for a period of time, so that when starting a bend with the release of a key, the note will continue for some time after release so the bend can be performed. The amount of time to delay the issuance of the note-offs may be specified as a certain duration at a current tempo, or a specified number of milliseconds.

The previous note that the user has played may be stored in memory, and when the user plays the next note, a bend size be calculated by utilizing the current pitch and the previous pitch. The bend can be performed either to or from the previous pitch. In the case of bending to the previous pitch, the currently played pitch is sent out and the bend data is generated so that it appears to bend to the previous pitch. In the case of bending from the previous pitch, the previous pitch is sent out, and bend data is generated whereby it appears to bend to the current pitch.

A flowchart of the process of real-time automatic pitch bending is shown in FIG. 74, utilizing a bend to a previous note. If an input note is a note-on 7402, an initial bend reset value (e.g. 8192) may be sent out 7403, which resets the pitch bend of the destination device to a default or center position. If desired, any bends that are presently in progress may be terminated. Then it is checked whether a parameter memory location indicates the bend should be performed "to" or "from" 7404. If bending to the previous pitch 7406, a start pitch value in memory receives the current pitch value, and an end pitch value in memory receives the value stored in a previous pitch location. If bending from the previous pitch 7408, the start pitch receives the previous pitch, and the end pitch receives the current pitch. In the case where no previous note has yet been played, a default value may be chosen, such as a pitch one octave above or below the current pitch. A note-on is then sent out with the start pitch 7410.

If a parameter memory location indicates that the bend is to be initiated by a key down action 7412, the bend amount is calculated by subtracting the start pitch from the end pitch 7414. For example, if the start pitch is 60, and the end pitch is 64, the bend amount is +4 semitones (64–60). The resulting bend amount may be limited to a maximum range of values (e.g. +12 to −12), or may have modulo division performed to keep it within a range (e.g. modulo 12). The bend window length is calculated by retrieving a predetermined value from parameter memory, or a value derived from the next step of a bend pattern. The value may be an absolute time in milliseconds, or a value calculated according to a duration at the current tempo. All other calculations necessary to schedule one or more bends based on the bend shape are carried out according to the previous embodiment, and one or more bends are scheduled to start. Alternately, a bend envelope may be utilized and the scaling calculations performed on its axes. If key up actions are not being utilized to start bends 7412, step 7414 will be skipped, and no bends will be started. The current pitch is then stored in memory as the previous pitch 7416, where it may be utilized at steps 7406 and 7408 with the next input note-on.

Since a note-on may have been received and a different note-on sent out, an altered notes buffer in memory is utilized to store pairs of pitches, in this case representing the current pitch, and the pitch that was actually sent out. In this manner, note-offs when they arrive may find the current pitch value, and then utilize the stored sent value for the note-off. The current pitch and sent pitch (which may be different) are stored as a pair in the altered notes buffer 7418, after which the routine is finished 7440.

If the input note is a note-off 7402, the current pitch is located in the altered notes buffer 7420. If located 7422, the pair of pitches is first removed from the altered notes buffer 7424. A parameter memory location is then checked to see if a bend is to be initiated by a key up action 7426. If not, a note-off is sent out 7428 with the sent pitch located previously in the altered notes buffer, no bend is started, and the routine ends 7440. If key up actions are being used to start the bend 7426, a note-off is scheduled to be output at a point in the future equal to (now time+"n") 7430. The value "n" is calculated by retrieving a predetermined value from parameter memory, or a value derived from the next step of a duration pattern. The value may be an absolute time in milliseconds, or a value calculated according to a duration at the current tempo. This causes the note to continue playing for some period of time after the receipt of the note-off, so that the bends may be performed while the note is sustaining. One or more bends are then calculated and scheduled 7432 (or a bend envelope started), utilizing the values for start pitch and end pitch previously stored by the note-on, and the routine ends 7440. If the pitch is not located in the altered notes buffer 7422, it is ignored 7440.

The preceding example utilized the method of bending to/from a previous pitch. A fixed bend amount, or a bend amount derived from the next step of a bend pattern may also be utilized. The bend amount may be modified to avoid atonal bends by the conversion table method previously described. At step 7406, the start pitch receives the current pitch, and the end pitch receives the (current pitch+bend amount). At step 7408, the start pitch receives the (current pitch+bend amount) and the end pitch receives the current pitch. Step 7416 is skipped, and step 7412 proceeds to step 7418 when key down actions are not being utilized. All other steps operate in the manner previously described.

The velocity of the notes may trigger the bending effect. At step 7402, the velocity of a note-on can be tested against a threshold or range. If it does not pass the test, the routine may immediately terminate 7440. For example, it could be configured that only a note-on with a velocity greater than 120 will pass the test and thereby initiate a bend.

DETAILED DESCRIPTION OF ANOTHER EMBODIMENT

In another embodiment of generating an automatic pitch-bending effect, notes played on a keyboard controller in one area may be used to precisely control bending effects on notes that are played in another area of the keyboard. The system of FIG. 2 may be simplified by removing modules 230, 235, 240, 245, 255 and 260.

A sliding control area two octaves wide is determined that can be either above or below the notes the user is playing, or both. Therefore, the notes can be played with either the right or left hand, and the control area used with the other hand. When a note is played and held, the sliding control areas are updated based on the current note. Subsequently, as long as the note is held, notes played in the control areas do not make any sound. Instead, they are utilized to bend the pitch of the held note(s).

Figure 75:
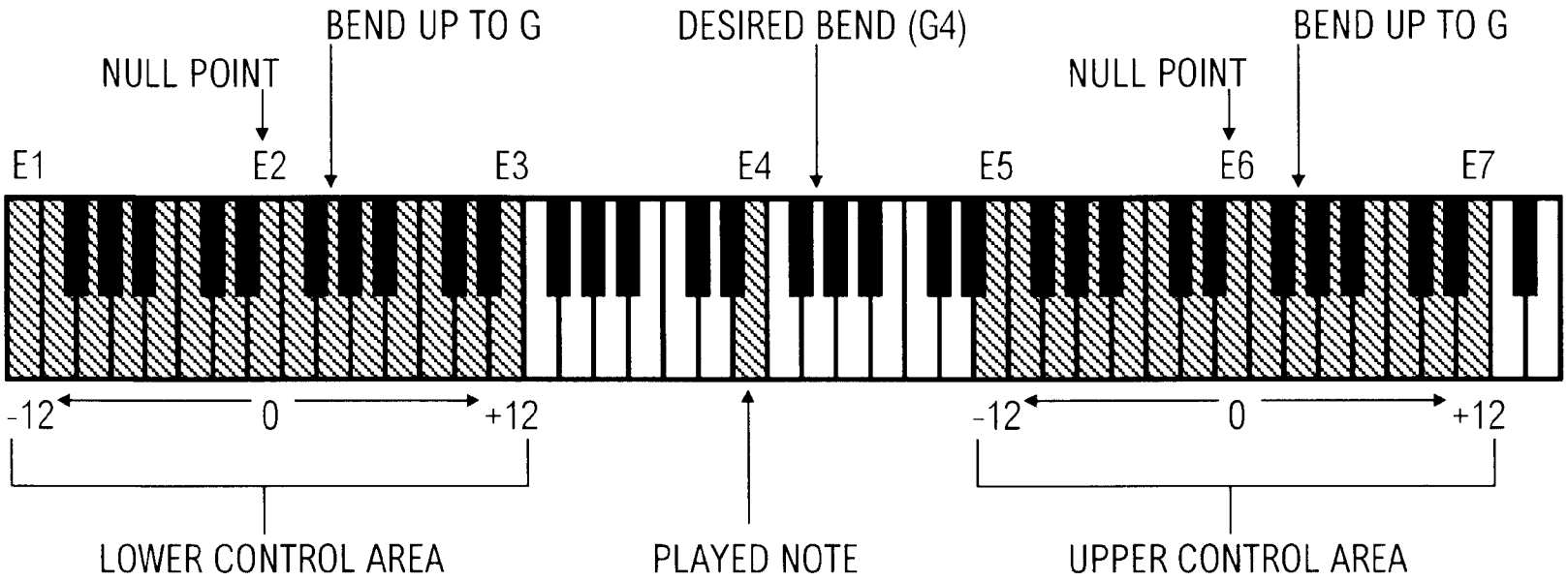
FIG. 75 is a diagram showing the relationship of the sliding control areas to a played note.

FIG. 75 is a diagram showing the operation of the sliding control areas. The lower control area is based on the lowest note the user presses, starts one octave below the lowest note and extends two octaves farther down. The upper control area is based on the highest note the user presses, starts one octave above the highest note and extends two octaves farther up. These ranges are arbitrary and could be farther apart on a larger keyboard if desired. In this example, a single note (E4) has been played; the lower control area therefore extends from {E1–E3}, and the upper control area extends from {E5–E7}. While this example uses a single note for clarity, more than one note can be held, and the upper and lower areas adjusted independently.

The center of each control area is a null point, or key that causes no bend to be produced. The null point of the lower control area will be the note two octaves below the lowest note held (e.g. E4). The null point of the upper control area will be the note two octaves above the highest note held (e.g. E6). The pitch to which the held note is bent is calculated from the null point in either control area. From the null point, the pitch bends go up or down 12 semitones, corresponding to the octaves of keys above and below the null points. Since the relationship of the held note to the control area is a musical relationship, the user can bend to a desired note by indicating the desired note two octaves higher or lower than the note that is being held. For example, if the held note is an E4 as shown in the example, to bend up 3 semitones to a G4 above, the user plays a G three keys above either one of the null points with the other hand (G2 or G6).

A bend time parameter in memory determines how long over a period of milliseconds the bend will take to go from its current value to the new pitch indicated by the control area. A bend rate parameter determines the time between pitch bend messages during the overall bend. The resulting bend can be an instantaneous change of pitch from the original note to the bent note, simulating the stringed instrument technique know as the hammer-on, can be a slower bend that simulates the bending of many ethnic instruments, or a long bend that can be a novel effect.

The release of a certain number of keys in the control area may be optionally utilized to cause a bend back to the original pitch. If the release of every key is to be utilized, as soon as the note in the control area is released the pitch bends back to the original note. If the release of two keys is utilized, two notes can be played consecutively in the control area to bend the pitch to two different pitches before the release of the second control note returns the pitch to the original pitch, and so on.

Figure 76:
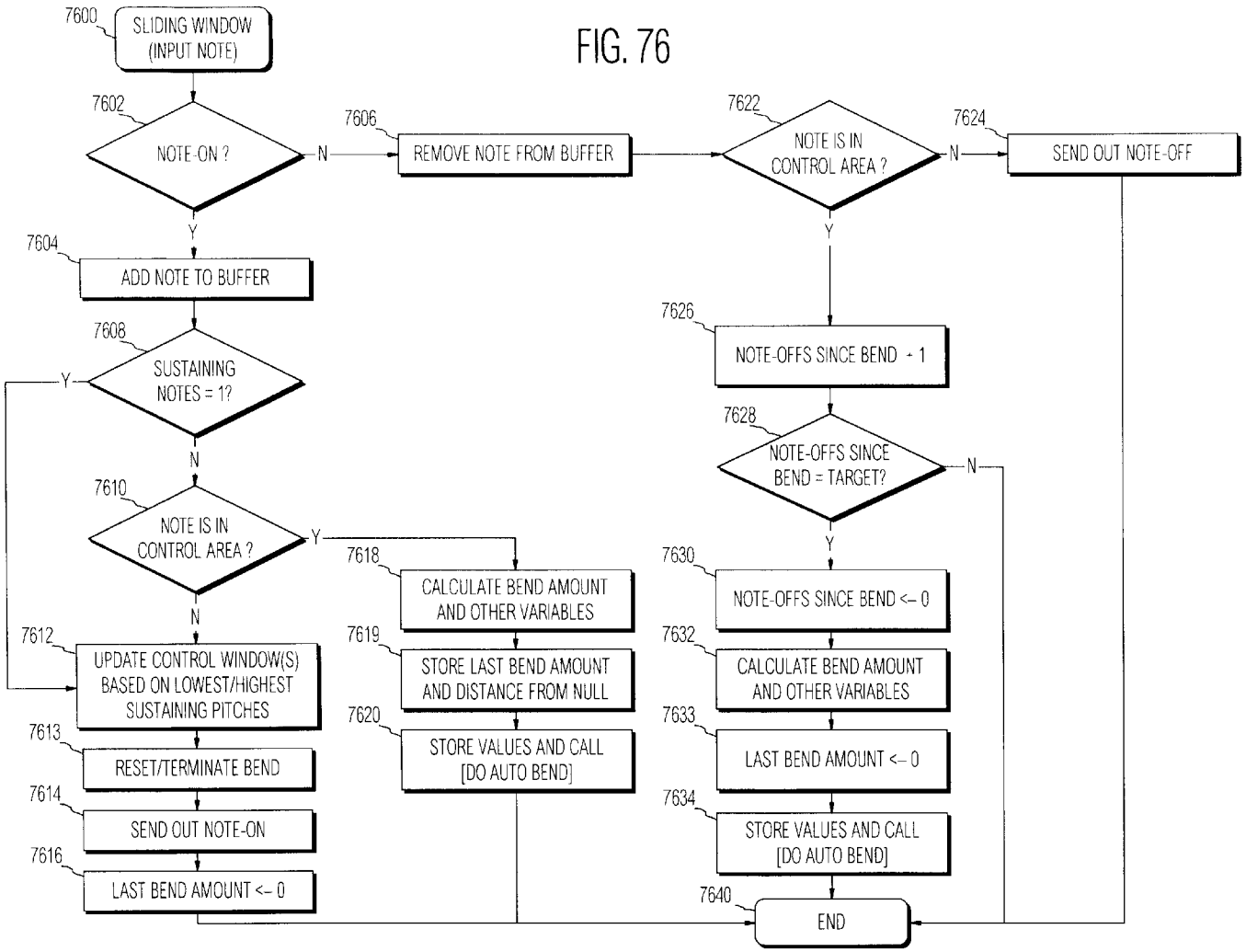
FIG. 76 is a flowchart showing the process of generating an automatic pitch-bending effect according to another embodiment.

FIG. 76 is a flowchart illustrating the operation of the sliding control area bending process. A buffer is utilized in memory to store notes that are sustaining. When a note-on is received 7602, it is added to the buffer 7604. When a note-off is received, the buffer is searched and the corresponding note-on is removed 7606. The number of items in the buffer is therefore the number of notes currently sustaining. After the note-on is added to the buffer, it is checked whether the number of notes sustaining is equal to "1" (meaning this is the first note to arrive since the buffer was last emptied) 7608. If so, execution passes to step 7612, and the sliding control areas are updated. Both the lower and upper control areas may be utilized, or only one or the other. For the lower control area, the lowest pitch in the buffer is found, and values are set in memory indicating a certain range of notes. In this example, the lower control area's bottom pitch is 3 octaves below the lowest pitch in the buffer, and the lower control area's top pitch is 1 octave below the lowest pitch in the buffer, with other ranges being possible. The lower control area's null point is set to indicate the pitch 2 octaves below the lowest note. For the upper control area, the highest pitch in the buffer is found, and values are set in memory indicating a certain range of notes. In this example, the upper control area's bottom pitch is 1 octave above the highest pitch in the buffer, and the upper control area's top pitch is 3 octaves above the highest pitch in the buffer, with other ranges being possible. The upper control area's null point is set to indicate the pitch 2 octaves above the highest note.

If sustaining notes is greater than "1" 7608, it is checked whether the pitch of the note is within either of the two sliding control area ranges 7610. If not, the sliding control areas are also updated at step 7612. An initial bend reset value (e.g. 8192) may be sent out 7613, which resets the pitch bend of the destination device to a default or center position. If desired, any bends that are presently in progress may be terminated. The note-on is then sent out 7614, a value in memory that stores the last sent bend amount is reset to "0" 7616, and the routine is finished 7640.

If the note is inside one of the sliding control areas 7610, then all of the variables for a bend are calculated 7618. The bend amount in semitones is calculated according to the distance of the pitch in the control area from the null point, and the stored last bend amount. One may employ the following formula:

distance from null=(control pitch−null pitch)

bend amount=(distance from null−last bend amount)

By way of example, if the null pitch is E6 (88), the pitch of the note played in the control area is G6 (91), and the last bend amount 0, the distance from null is (91−88)=3, and the bend amount is (3−0)=+3 semitones. The bend amount is then stored as the last bend amount, and the distance from null value is also stored 7619. Continuing with this example, if an A6 (93) is then played in the control area, the distance from null will be (93−88)=5, and the bend amount will be (5−3)=+2 semitones. This will have the effect of issuing a bend that continues from the previous bend position to the new pitch.

A bend target value is calculated, being the total amount to bend in double precision MIDI pitch bend values. With an overall range of 8192 for an octave, the bend target for +3 semitones will be (8192/12)*3=2048. The bend time is a predetermined time in milliseconds specifying the length of the bend; an example value of 100 ms will be utilized. The bend rate parameter determines how often a pitch bend message will be sent. Utilizing an arbitrary value of 5 in this example, every 5 ms a bend message will be sent. Using the example bend time of 100 ms, (100/5)=20 bend messages will be sent in the required time. To achieve the bend target in 20 messages, each of the messages must cumulatively bend the pitch by (2048/20)=102.4, rounded to 102. If the bend time is less than the bend rate, it may be adjusted to equal the bend rate. If the bend time is 0, then a single bend message corresponding to the entire bend target may be sent.

The calculations are stored in a bend data location as previously described, and a call is made to the [Do Auto Bend] routine, which is passed a pointer to the bend data location 7620. This starts a recursive chain of pitch bend values being sent out until the required number have been completed, thereby bending to the pitch specified by the note in the control area. Alternately, a bend envelope may be utilized and scaling calculations performed on its axes, where the x-axis time range is scaled to the bend time, and the y-axis envelope value is scaled to the bend target.

Referring back to step 7602, if a note-off calls this routine, the corresponding note-on is first removed from the buffer 7606. It is then checked whether the pitch is within one of the sliding control areas 7622. If not, the note-off is sent out 7624, and the routine finished 7640. If the note-off is in one of the control areas 7622, it may optionally be utilized to determine a bend back to the original pitch. Therefore, the steps 7626 through 7634 are optional and may be omitted. A value in memory used to count the note-offs received since the initiation of a bend has been initialized elsewhere to "0." The note-offs since bend value is incremented by one 7626. It is then checked whether the value is equal to a predetermined target 7628. If not, the routine is finished 7640 with no bend back to the original pitch performed. If the note-offs since bend is equal to the target 7628, then the value 7630 is reset to "0", and a bend is calculated back to the original pitch 7632.

The bend amount is calculated by inverting the distance from the null value that was calculated and stored earlier. Since this value is always the current distance from center pitch, inverting it will allow a bend from the present position back to the null or center pitch. The other variables are calculated as previously described, and the last bend amount value 7633 is reset to "0". The calculated values are then stored in a bend data location, and a call is made to the [Do Auto Bend] routine, which is passed a pointer to the bend data location 7634. This starts a recursive chain of pitch bend values being sent out until the required number have been completed, thereby bending to the pitch back to the original pitch. Alternately, a bend envelope may be utilized and scaling calculations performed on its axes, where the x-axis time range is scaled to the bend time, and the y-axis envelope value is scaled to the bend target. The routine is then finished 7640.

While this example shows the use of MIDI information, the sliding control area could also be used to control pitch bending characteristics of an internal tone generation system directly, and remain within the scope of the invention. Furthermore, the use of the sliding control areas is not limited to producing pitch bend, but may be utilized to control other actions. For example, sliding control windows may be utilized to control any level or parameter of a tone generator in a logical and accurate fashion. For example, the values across the keys of the sliding window could represent filter frequency offsets for a resonant filter, or amounts of vibrato to apply, or any other tone control parameter or MIDI message, and still remain within the scope of the invention.

(5) GENERATING A REPEATED EFFECT

After the data has been read out, it may be optionally repeated. Alternately or in conjunction, the input musical source data may be repeated directly, or collected musical data may be stored and repeated.

A system for the generation of musical effects has been described in FIG. 2. When utilized to generate a repeated effect, the input data for the repeat generator 260 may come from the data read out by the read out data module 255, or input notes from the input device 200 or song data playback means 215. If only notes from the input device 200 or song data playback means 215 are utilized, the addressable series module 230 and clock event generator 245 need not be utilized.

Figure 77:
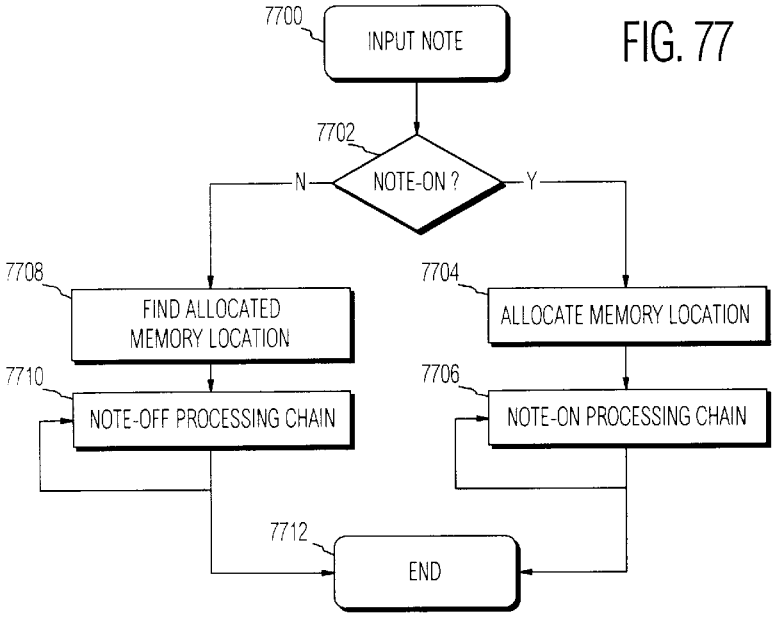
FIG. 77 is a diagram of an overview of the process of generating a repeated effect.

FIG. 77 is a simplified overview of the process of generating a repeated effect. When a note-on is received 7702, it reserves a memory location to be used for processing and stores some initial values such as pitch, velocity, and starting processing values 7704. This then starts a recursive note-on processing chain of procedure calls to a processing routine, each one scheduling the next one to occur a certain time in the future and producing note-ons 7706. When a note-off is received, the memory location corresponding to the note-on for that pitch is located 7708, and a separate recursive note-off processing chain of procedure calls to a processing routine is started, each one scheduling the next one to occur a certain time in the future and producing note-offs 7710. The memory location has separate areas for note-on and note-off processing, so that each chain of procedure calls can maintain its own current indexes into various patterns and other such counters. In this manner, each note-on and note-off maintain their own separate yet related variables as they repeat and reschedule themselves for further processing in the future, while maintaining access to some shared parameters in the parent memory location. The process ends 7712 when a certain number of repetitions has occurred, or through other termination means described later.

In the description which follows, a separate pathway shall be generally shown for note-ons and note-offs. This is for ease of operation and explanation. For example, the two steps 7706 and 7710 could be combined into a single processing chain where multiple tests are made at many steps to determine whether the procedure is called by a note-on or note-off, and the routines which are note-on or note-off specific could be combined and changed accordingly to process both note-ons and note-offs.

Various patterns as previously described are used during the process. In general, each repetition accesses a rhythm pattern. As each repeated note is generated, the next value in the rhythm pattern is accessed and used to determine how far in the future to schedule the generation of the next repeated note. A velocity pattern can be used, which provides accents to the repeated notes. As each repeated note is generated, the next value in the velocity pattern is accessed and used to modify the velocity of the repeated note, optionally in conjunction with a fixed velocity offset, so that the repeated notes can overall increase or decrease in volume while maintaining a pattern of accents. A transposition pattern can be used, which allows the pitch of each repeated note to be transposed by a different value than the previous note, in either direction. The resulting transposed pitches can be further modified by a transposition table based on a selected chord or scale type, thereby shifting atonal pitches to tonal pitches. Furthermore, if a note after being shifted has the same pitch as a previous repeated note, it can be selectively discarded and the next value of the transposition pattern used. A cluster pattern can be used, which allows multiple repeated notes or repeated groups of notes to be generated at the same time from an original note or group of notes. A strum pattern can be used, which allows the repeated notes within a cluster to be issued with time delays between them. A spatial location pattern can be used, which allows each repeated note to be moved about in a stereo or multi-dimensional space. An assignable pattern can be used, which allows each repeated note to modify some tonal characteristic of the tone module that is used to create the sounds, such as resonance, filter frequency and so on. A voice change pattern can be used, which allows each repeated note, or some number of repeated notes to change the instrumental sound of the tone module that is used to create the sounds, for example from a trumpet to a violin. A bend pattern can be used, which allows each repeated note to generate a different automatic pitch-bending effect if desired. The durations of the repeated notes can be the same as the original notes, or can use a duration pattern, which allows each repeated note to have a different duration. Furthermore, the durations of the resulting repeated notes can be controlled in several different ways so that in addition to providing new useful musical effects, the problem of large numbers of voices in a destination tone module being used up is eliminated.

A range of notes within which to remain when transposing pitches can be used in several different ways to cause further variations. When notes go outside the range due to transposition, the generation of the repeated notes may be terminated, or the pitches wrapped around, or rebounded, or a phase change may be determined as will be explained later on. A phase change may also be triggered at various times by one of several methods, whereby completely different groups of patterns and parameters are selected with which to continue processing. A phase pattern may be used to determine the order of the various phases as processing continues.

The repeated effect can be selectively started immediately upon the receipt of input notes, or by any of the triggering means previously described including input notes within a time window, input notes within predetermined velocity ranges, or by other actions such as user operated pedals, buttons and switches, and/or by locations in a backing track of prerecorded music. The repeated effect can be selectively terminated by the same type of actions, in addition to the completion of a number of repetitions, the completion of a number of phases, the transposition of pitches outside a predetermined range, and/or the start of a new repeated effect. Envelopes may also be triggered as previously described, and utilized in the processing of the repeated effect.

Before the description of several embodiments, some memory locations, parameters, patterns and modes of operation utilized throughout the following descriptions will be provided.

PHASES AND PATTERNS

Figure 78:
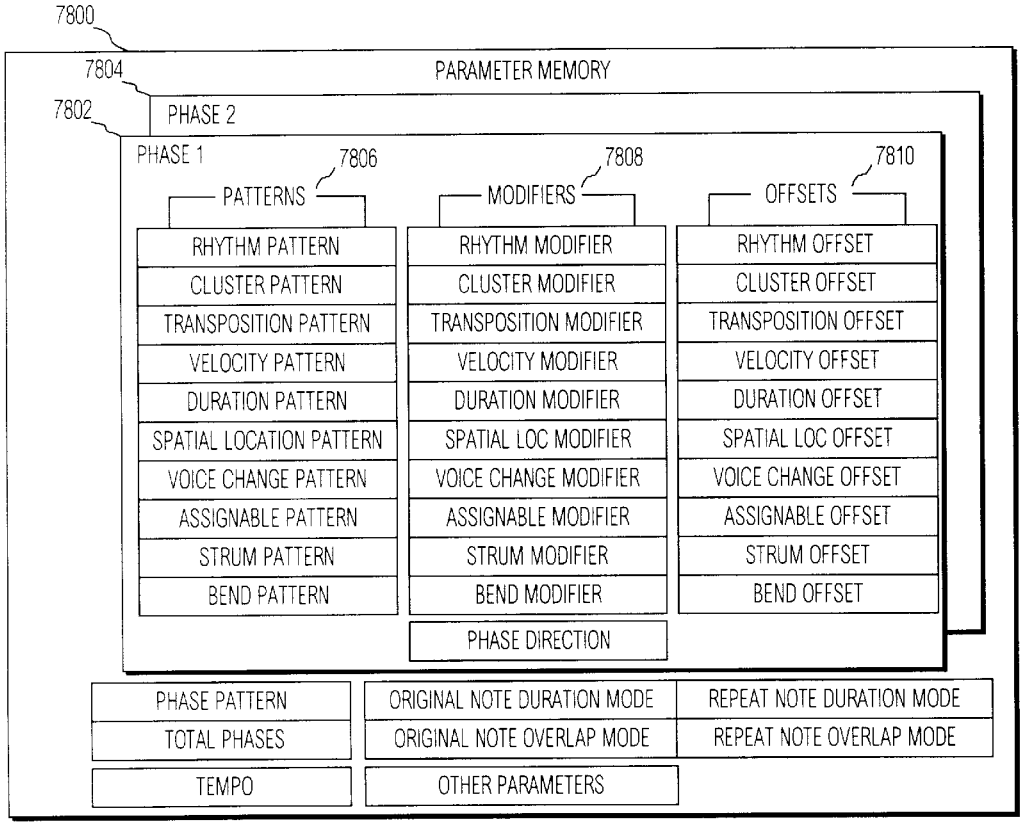
FIG. 78 is a diagram of parameter memory locations.

Phases have been previously described. As such, only the differences related to the generation of a repeated effect will be described here in detail. Referring to FIG. 78, within an overall parameter memory 7800 are shown two phase parameter memory locations 7802 and 7804. In the case of generating a repeated effect, a phase change is deemed to occur by one or more of several methods, such as whether a transposed note's pitch is within a certain range, or a certain number of repetitions have been generated, or a certain period of time has occurred, or upon user demand. As previously described, this causes a potentially different phase's patterns and parameters to be utilized during the continuation of processing.

Within each phase's parameter memory locations are a group of patterns 7806. Patterns and the various types have been previously described in detail. Only the differences between those descriptions and the way that patterns are used in generating a repeated effect shall now be described.

A rhythm pattern controls when and how often data will be produced, with each derived value indicating a time at which a next event should be produced, in this case a time in the future at which the next repeated notes will be generated.

A cluster pattern controls how many notes will actually be generated simultaneously for each repeated note. A example of derived values from a cluster pattern may take the form {3, 1, 2} which means that a single original note would first generate a repeat of 3 simultaneous notes, then a repeat of 1 note, then a repeat of 2 notes and so on.

A transposition pattern is used to either modify or replace a pitch for a note about to be generated, with each derived value indicating either an absolute pitch value or an amount by which to transpose a retrieved or actual pitch value. An example of derived values from an absolute transposition pattern may take the form {60, 64, 67}. This indicates that a first note would be generated with a pitch of 60 (C4), the second note with a pitch of 64 (E4), the third with a pitch of 67 (G4), then back to the beginning of the pattern for the next note. An example of derived values from a modify transposition pattern is {1, 3, −2}. This indicates that the pitch of the first note to be generated would be transposed by 1 semitone up, the pitch of the second note by 3 semitones up, the pitch of the third note by 2 semitones down, and so on. This modification can be done with an absolute reference to the original pitch, meaning that the original pitch is always transposed to yield the resulting pitch. Using the example derived values of {1, 3, −2} and an original pitch of 60, the resulting pitches would be 61 (60+1), 63 (60+3), 58 (60+−2), 61 (60+1) and so on. Alternately, the modification can be done with a cumulative reference, meaning that after each pitch is transposed, the new value is used and transposed for the following note. Using the same example derived values with the cumulative reference would result in the pitches 61 (60+1), 64 (61+3), 62 (64+−2), 63 (62+1), 66 (63+3), 64 (66+−2) and so on. A value of "0" can be used to indicate no transposition from a previous pitch, resulting in repeated pitches. Although the modify transposition pattern method and cumulative reference is employed throughout these explanations, the absolute transposition pattern method could also have been utilized, or the absolute reference.

A velocity pattern, duration pattern, spatial location pattern, voice change pattern, assignable pattern, bend pattern, and strum pattern are all as previously described.

Each of the patterns described may have an associated pattern modifier parameter 7808, as previously described. Furthermore, each of the patterns may have an associated pattern offset parameter 7810, which is used to further modify values calculated at various points in the processing, as shall be described later. Any of the patterns could be modified to include an additional parameter for each step directing that the particular operation be performed a number of times before moving on to the next value.

As described previously, patterns may represent musical characteristics and processing instructions. Pattern types that may be considered to have data items representing a musical characteristic include rhythm, velocity, duration, spatial location, voice change, bend, assignable, and drum patterns. Patterns that may be considered to have data items representing processing instructions include index, cluster, strum, and phase patterns. A transposition pattern may be considered to belong to either group, depending on whether it represents absolute pitch values or transposition values.

When the repeated effect is being generated using data that has been read out of memory as previously described, the patterns may be the same set of patterns utilized during the read out of data, or a different set of patterns. In other words, if generating a repeated effect from notes that are generated by the reading out of data, there could be a separate rhythm pattern for the reading out of data and a separate rhythm pattern for the generation of repeated notes within each phase, a separate velocity pattern and so on.

DURATION AND OVERLAP MODES

There are several different modes for controlling the duration of notes utilized in the process of generating a repeated effect, in several different combinations.

A duration mode indicates one of two modes of operation for controlling the durations of repeated notes. When the duration mode is "pattern," the notes are generated with durations specified by a duration pattern, and the original durations are ignored. When the duration mode is "as played," the notes are repeated with the durations they were originally performed or generated with.

An overlap mode indicates one of two modes of operation further modifying the durations. When the overlap mode is "yes," the durations of notes are allowed to overlap new notes being generated. When the overlap mode is "no", the durations of notes are not allowed to overlap new notes being generated.

Furthermore, these modes may be individually selected for each of two types of notes: (a) original notes, referring to the original notes supplied as input notes; (b) repeat notes, referring to the notes are generated as repetitions of the original notes. Therefore, there is a repeat note duration mode and repeat note overlap mode, and an original note duration mode and original note overlap mode, as shown in FIG. 78.

Figure 79:
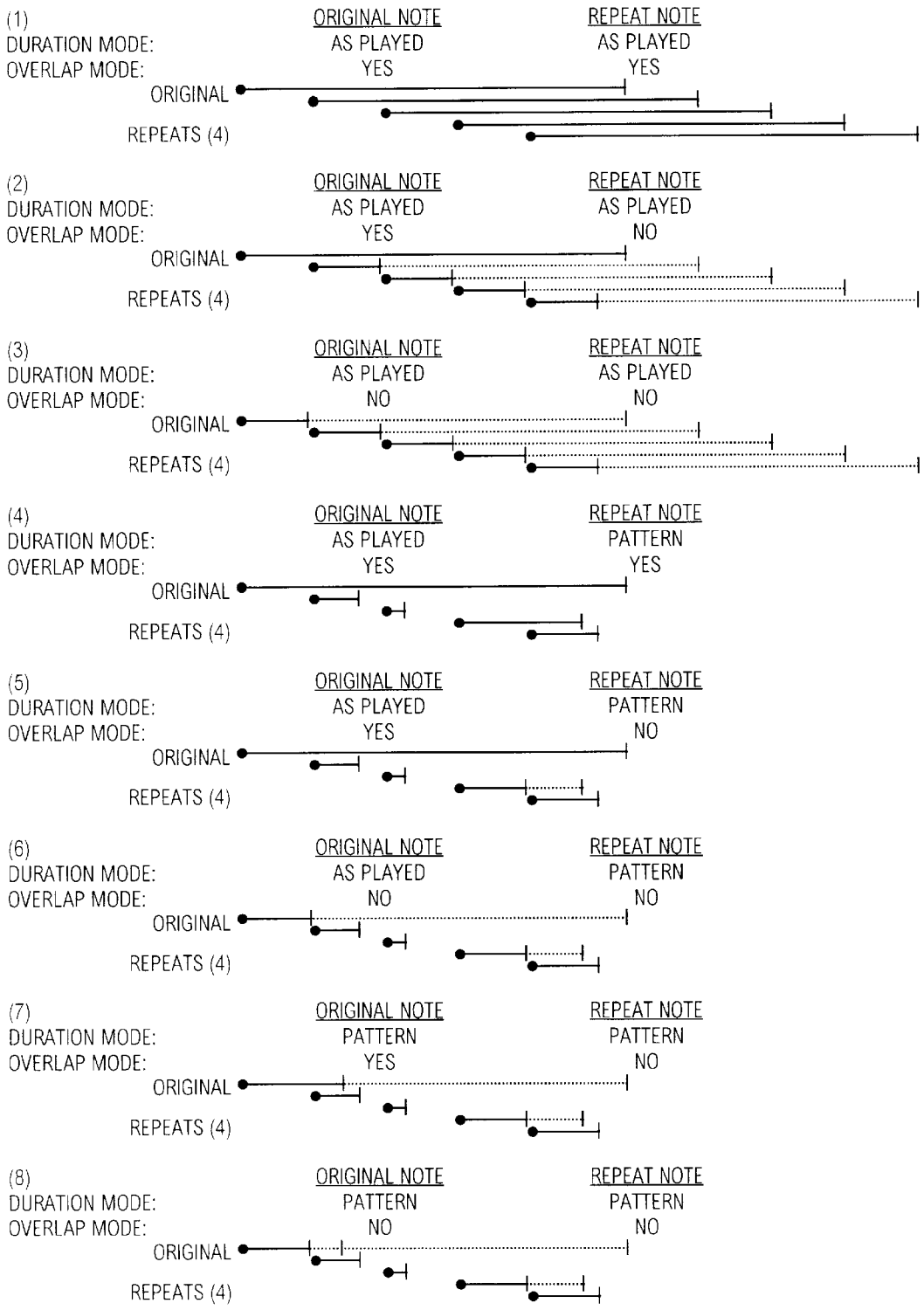
FIG. 79 is a diagram illustrating the effect of eight different duration effects.

FIG. 79 is a graphical representation of eight different combinations of these modes which shall be referred to as duration effects. Those of skill in the art will realize that other combinations can also be achieved. Each of the eight sections shows an original note, and 4 repeated notes. A solid black line indicates a duration that is produced; a dotted line shows a duration that might have been normally produced, but was changed according to the processing. The means by which these different effects are achieved shall be described in detail at the appropriate places in the following descriptions.

(1) When a note-on is received, it starts the note-on processing chain, thereby causing repeated note-ons to be generated at various scheduled times in the future. When a note-off is received, it starts the note-off processing chain, thereby causing repeated note-offs to be generated in the same fashion. The result is that each repeated note thereby has the same duration as the original note that started the effect generation, since both the note-on and the note-off of the original note start their own processing chain.

However, one aspect of the invention that shall be described herein is that if the notes and the repeated notes overlap each other, a means is provided so that repeated notes of the same pitch as previous repeated notes already sustaining first terminate the sustaining notes, thereby preventing the overlapping of repeated notes with the same pitch, and greatly cutting down on the number of voices in a tone generator required to generate the effect.

(2) The original note is echoed to output exactly as played. The repeated notes are the same as the original note, but they are not allowed to overlap. If the original input note is shorter than the time between the repeats, then the repeats will be the same as the played notes; if the original note is longer as shown, the repeats will terminate other sustaining repeats.

(3) The same as (2) above, except that the first repeat will terminate the original note if it is still sustaining, so that no overlapping notes are allowed.

(4) The original note is echoed to output exactly as played; the repeated notes have durations calculated with the duration pattern, and therefore have no relation to the original note's duration. However, as in duration effect (1), if the repeated notes overlap each other, a means is provided so that repeated notes of the same pitch as previous repeated notes already sustaining first terminate the sustaining notes, thereby preventing the overlapping of repeated notes with the same pitch, and greatly cutting down on the number of voices in a tone generator required to generate the effect.

(5) The same as (4) above, but the repeated notes are not allowed to overlap. If the calculated duration is shorter than the time between repeats, it is kept; if it is longer, the duration time is limited to the repeat time.

(6) The same as (5), except that the first repeat will terminate the original note if it is still sustaining, so that no overlapping notes are allowed.

(7) The original note has a duration calculated from a duration pattern; the original duration is not used. The repeated notes have durations calculated with the duration pattern, and therefore have no relation to the original note's duration, and are not allowed to overlap, as in (5).

(8) The same as (7) above, except that if the calculated duration for the original note is shorter than the time between repeats, it is kept. If it is longer, the duration time is limited to the repeat time.

Other parameters in memory (FIG. 78 7800) which are not specifically discussed here but control or influence the operation of the invention shall be described at the appropriate places in the following descriptions. All of the various parameters can be part of a predetermined collection of parameters loaded as a whole by the user, or each parameter may be individually set and/or modified by the user.

NOTE LOCATIONS

When a note-on is received, it reserves a memory location to be used for processing and stores some initial values such as pitch, velocity, and starting processing values; this memory location shall be referred to as a note location.

Figure 80:
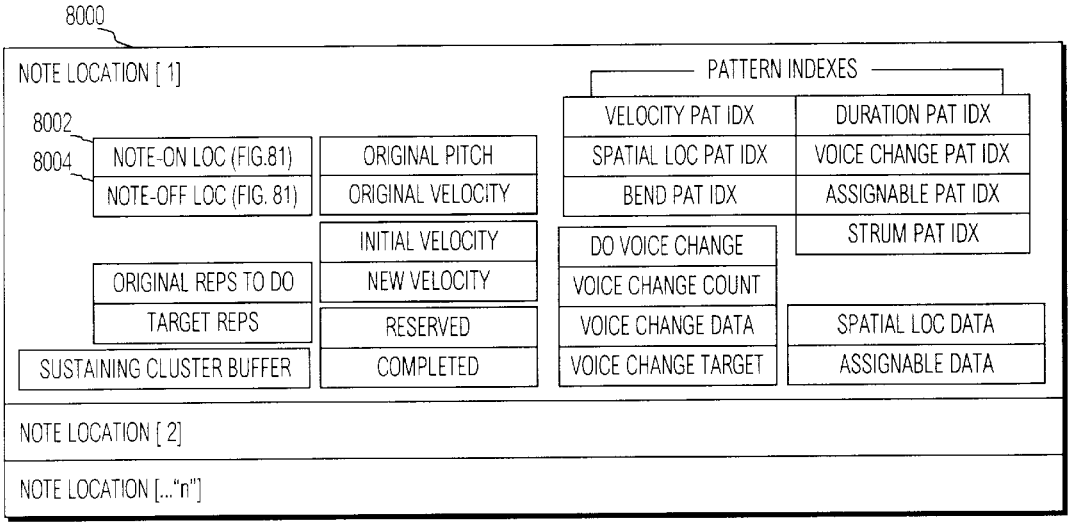
FIG. 80 is a diagram of a note location.

Referring to FIG. 80, a number of note locations (1 to "n") exist in memory 8000, which are used to store the relevant data necessary to reproduce a repeated note. These may be preallocated, or allocated during processing using standard memory allocation techniques. Each of them contain the same data locations, which are shown in detail for the first location. Each location contains two identical sub-locations referred to as note-on location 8002 and note-off location 8004, which store data used to modify and generate the note-ons and note-offs as the procedure repeats; they shall be explained in detail shortly. The other parameters and memory locations within the note location are as follows. The original pitch and original velocity store the pitch and velocity with which an input note is received. Initial velocity stores a precalculated value at which to generate the first repeats; new velocity stores a newly calculated velocity during processing. Original reps to do stores a predetermined initial number of repetitions to perform; target reps stores a predetermined count at which to perform phase changes. A reserved flag indicates whether this memory location is in use and is initialized to "no," and a completed flag indicates when a note-off has been received for a corresponding note-on stored in this location. A do voice change flag, voice change count counter, and voice change target value are used to determine when to change an instrumental voice during processing a voice change data area contains precalculated data to change the instrumental voice. A spatial location data area contains precalculated data to control the spatial location of the note. An assignable data area contains other miscellaneous precalculated data used to control a tonal characteristic of the note.

A sustaining cluster buffer is a predetermined number of storage locations containing data space for a pitch, comprising a list of all currently sustaining repeated notes for that note location only. The remaining locations are pattern indexes indicated by the abbreviation pat idx, which are used during processing to index the next location of a particular pattern to be used, as previously described. These pattern indexes are only used during note-on processing and therefore do not need duplicate locations in the note-on/note-off locations described below.

Figure 81:
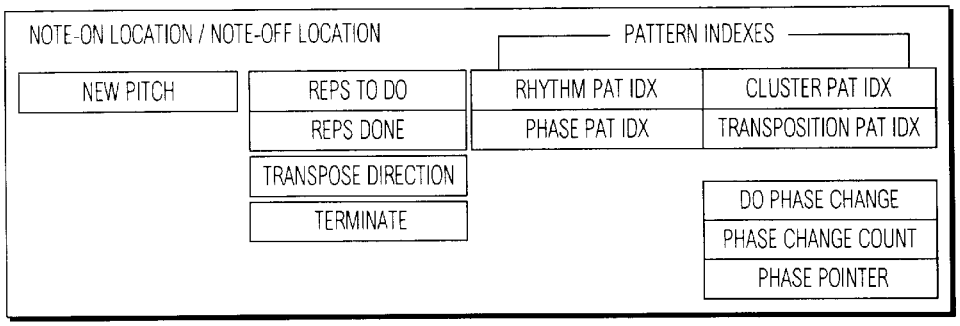
FIG. 81 is a diagram of a note-on/note-off location.

The note-on location 8002 and note-off location 8004 are shown in detail in FIG. 81. The parameters and memory locations are: new pitch stores a newly calculated pitch, reps to do stores an initial number of repetitions of notes to perform, reps done stores the number of repetitions actually completed. A transpose direction is used during calculation of the new pitch. A terminated flag is set when the procedures require termination. A do phase change flag and phase change count counter are used to determine when to change phases; a phase pointer points to the memory locations of the current phase that is being used during processing. The remaining locations are pattern indexes ending in the abbreviation pat idx, which are used during processing to index the next location of a particular pattern to be used.

In this manner, the note-on location and note-off location each have their own variables and parameters for processing, yet coexist within a parent note location containing data and parameters that may be accessed and shared by either the note-on or note-off as processing progresses.

In the present embodiment, the note locations are in sequential locations of memory as an array. When a note location is in use and has its reserved flag set to "yes," it is added to a list of pointers that constitutes an "in use list." When it is returned to use and has its reserved flag set to "no," it is removed from the list. This list can then be used to find note locations in use, rather then searching the entire group of memory locations. It is also possible to store the note locations as a linked list using techniques well known in the industry, where each location has a pointer to a previous location. The locations in use are then assembled into a separate in use list as they are used, and returned to a master list of available locations when not in use.

Several other buffers in memory are used to store data in various ways, which are not specifically shown on the diagrams:

altered notes buffer:
- a predetermined number of storage locations containing data space for a pitch and an altered pitch, comprising a list of pitches and altered pitches after transposition.

replicated notes buffer:
- a predetermined number of storage locations containing data space for a pitch and a replicated pitch, comprising a list of pitches and replicated pitches after transposition.

sustained notes buffer:
- a predetermined number of storage locations containing data space for a pitch, comprising a list of currently sustaining input (original) notes.

sustained repeats buffer:
- a predetermined number of storage locations containing data space for a pitch, comprising a list of all currently sustaining repeated notes.

DETAILED DESCRIPTION OF A PREFERRED EMBODIMENT OF GENERATING A REPEATED EFFECT

Input notes may come from one or more of the following locations:

(a) notes that were generated by the process of reading out of data;

(b) notes received directly as input source material, such as notes played in real-time on a MIDI keyboard or other MIDI device, or notes being provided in real-time by the output of an internal or external MIDI file playback device, such as a sequencer; and/or (c) notes collected in real-time, or notes extracted from musical source material, or notes retrieved from predetermined note sets, all previously described; where instead of creating an initial note series, the collected notes are then processed according to the following descriptions.

Figure 82:
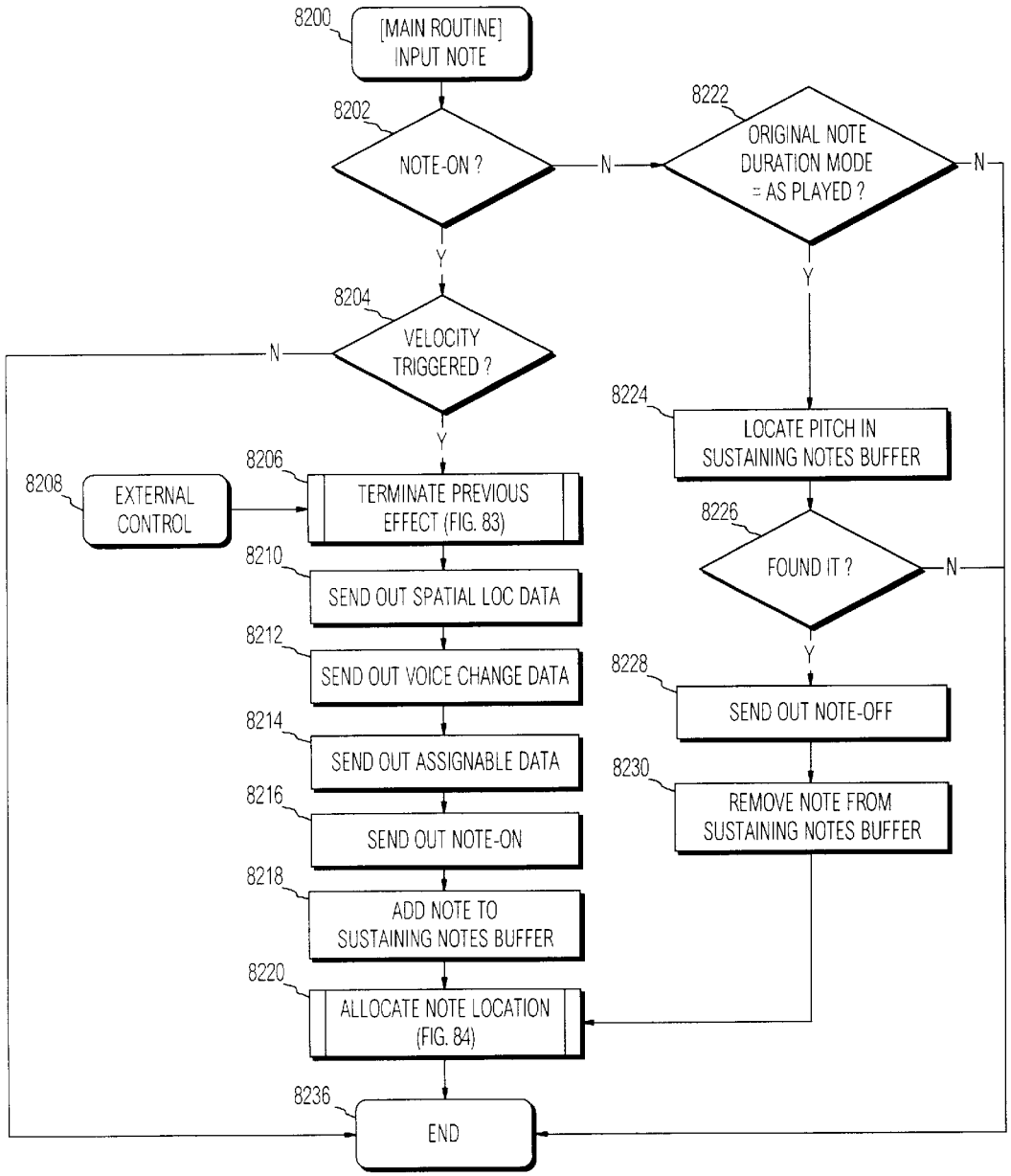
FIG. 82 is a flowchart showing the process of generating a repeated effect according to a first embodiment.

For every input note that is received, the [Main Routine] of FIG. 82 is called. In general, this routine adds an input note-on to a buffer of sustaining notes, and removes it from the buffer when a note-off is received, the removal dependent on a duration mode. The receipt of the note-on may terminate a previously repeating effect, sends out the note-on, and causes additional spatial location, voice change and other data to be sent out. If the velocity of the note-on is not within a predetermined range, portions of the routine can optionally be bypassed. Therefore, the velocity can optionally be used to trigger the start of the repeated effect, or the effect can start for each note-on. The receipt of the note-off sends out the note-off, in addition to passing it to the processing chain, dependent on a duration mode.

If an input note is a note-on 8202, the velocity is then optionally tested to see if it should trigger the start of the effect 8204. This could be testing whether the velocity is greater than a predetermined threshold, or less than a threshold, or within or outside of a predetermined range such as a minimum and/or maximum value. If the test is negative, the routine is finished with no repeated notes being generated 8236. If the test is positive (or if this step was being skipped), the [Terminate Previous Effect] routine is entered 8206. As shown, this routine may also be called by the operation of a predetermined external control 8208, such as a pedal, button, switch or other controller operated by a user, or sent at predetermined locations marked inside of or calculated from a pre-recorded background track of music. This may also be controlled as an additional trigger mode according to the previously described triggering means.

Figure 83:
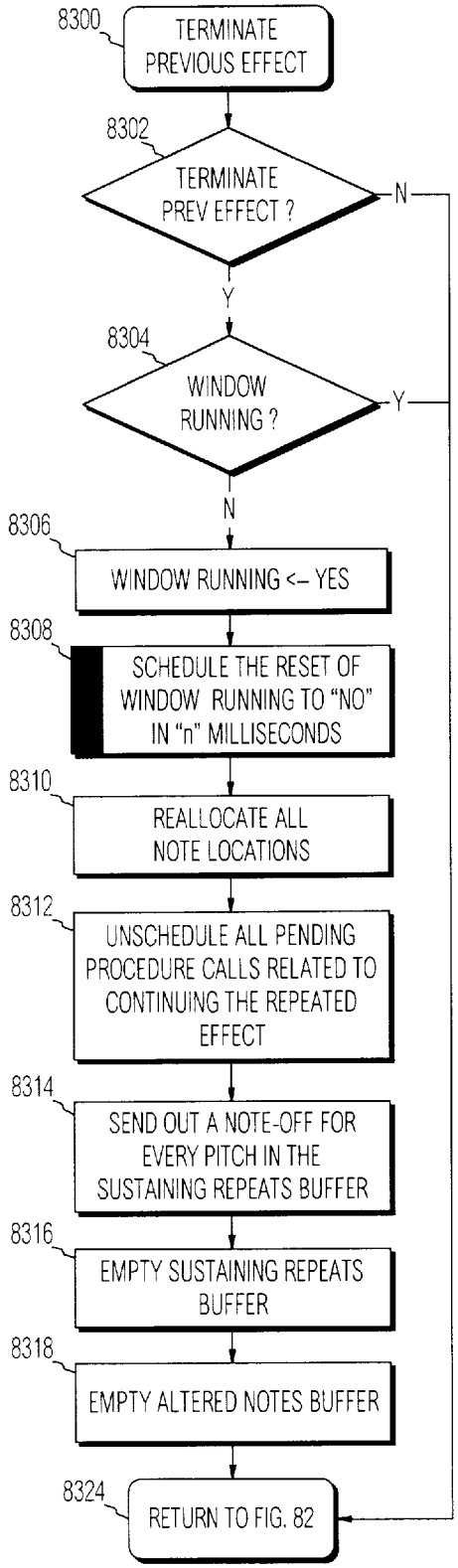
FIG. 83 is a flowchart showing the operation of a terminate previous effect routine.

The [Terminate Previous Effect] routine shown in FIG. 83 allows newly arriving input notes to optionally terminate a repeating effect that was started by prior input notes; a time window is utilized so that several note-ons arriving nearly simultaneously will only terminate the effect and reset the memory locations once.

A terminate previous effect parameter exists in memory as part of the collection of parameters specifying the overall repeated effect. If the parameter does not indicate that a previous effect is to be terminated 8302, the routine returns to the [Main Routine] with no termination 8324. If termination of previous effect is selected, then a window running flag in memory is checked 8304. If the flag is "yes," then the time window is already running, no termination will be allowed until a certain time period has elapsed, and the routine finishes 8324. If the time window is not running, first the window running flag is set to "yes," indicating the time window has started 8306. A procedure call is scheduled for "n" milliseconds in the future ("n" being a predetermined time for the length of the window, such as 30 ms) whereby the window running flag will be returned to "no," again allowing the window to be run 8308. Then, all note locations which have been allocated in a previous running of the procedure (which shall be described shortly) are reallocated and made available for use 8310. This is done by removing them all from the in use list, and setting all of their reserved flags to "no," indicating they are again available. Any of the various procedure calls which have been scheduled to process repeated notes (which shall be described shortly) are then unscheduled so that they will not occur 8312. This is done by removing them from the task list. A note-off is then sent out for every pitch currently in the sustaining repeats buffer 8314, the sustaining repeats buffer is emptied 8316, the altered notes buffer is emptied 8318, and the routine returns to the [Main Routine] 8324.

Returning to the [Main Routine] of FIG. 82, initial spatial location data may then be sent out 8210, thereby influencing the spatial location of the note-on that is later sent out. In this example that means sending an initial MIDI pan value by using the value derived from the default starting index of a spatial location pattern. Initial voice change data may then be sent out 8212, being in this example a MIDI program change value derived from the default starting index of a voice change pattern. Initial assignable data may then be sent out 8214, being in this example a MIDI controller 17 value derived from the default starting index of an assignable pattern.

The note-on is then sent out 8216, and the pitch is added to the sustaining notes buffer 8218. The [Allocate Note Location] routine is then called with the note-on 8220, which eventually may start a note-on processing chain resulting in a repeated effect, after which the routine is finished 8236.

If the input note is a note-off 8202, then the original note duration mode is checked 8222. If it is not "as played," then the routine ends with no further processing taking place 8236. This is because the note-off will be generated by the further processing of the invention, and will contribute to achieving duration effects (7) and (8) of FIG. 79 (for the original note). If it is "as played," the pitch is located in the sustaining notes buffer 8224 where a previous note-on may have stored it. If located 8226, the note-off is sent out 8228, which contributes to achieving duration effects (1) through (6) of FIG. 79 (for the original note), and duration effects (1) through (3) (for the repeated notes). The pitch is then removed from the sustaining notes buffer 8230. The [Allocate Note Location] routine is then called with the note-off 8220, which eventually may start a note-off processing chain. The sustaining notes buffer therefore holds a collection of pitches for all note-ons that have not yet received a corresponding note-off. If the pitch is not found in the sustaining note buffer 8226, then it has been supplied by a later working of the procedure as will be described, or was never issued, such as by the velocity test at step 8204, and the note-off is ignored 8236.

Figure 84:
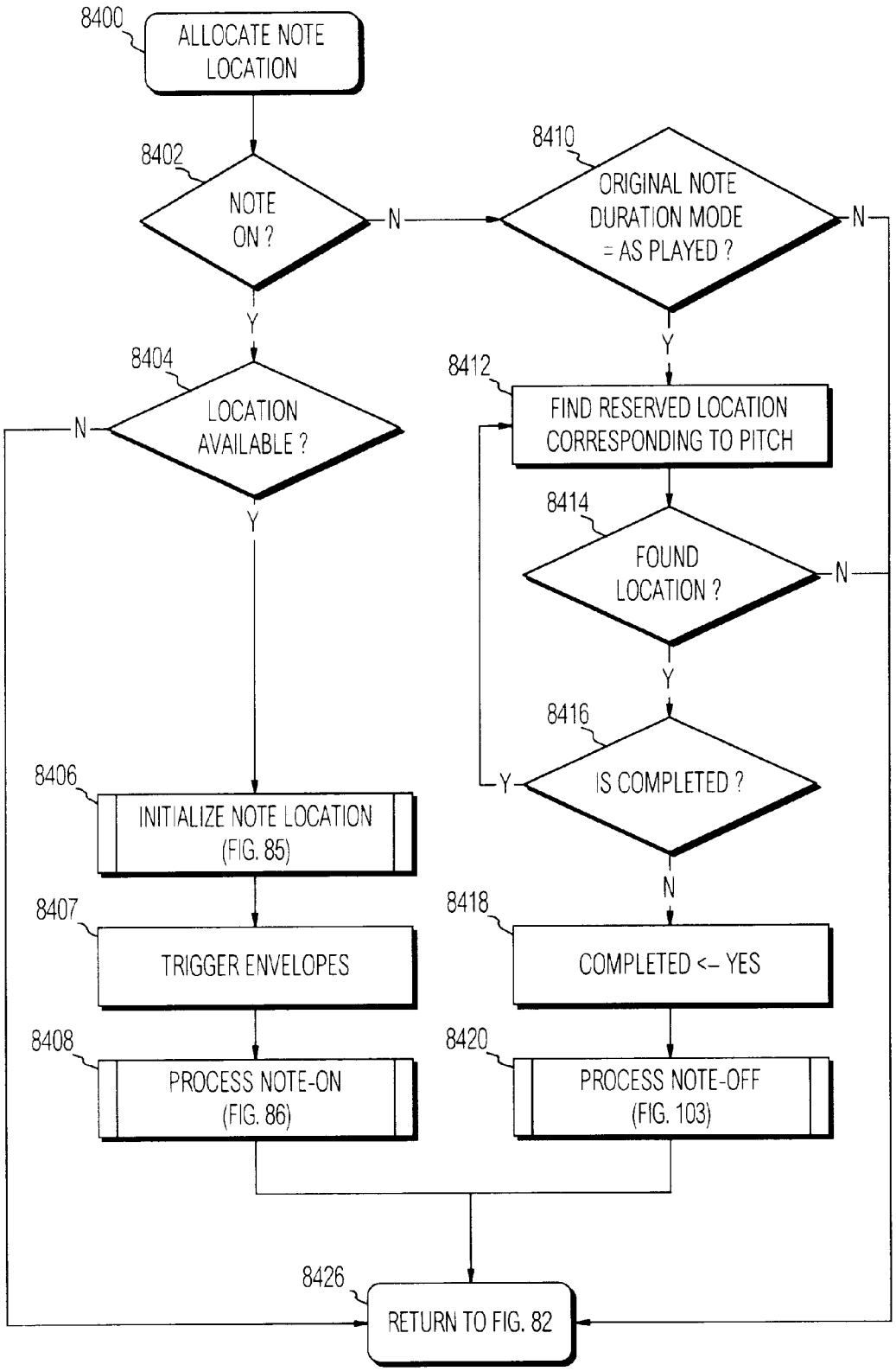
FIG. 84 is a flowchart showing the operation of an allocate note location routine.

The [Allocate Note Location] routine shown in FIG. 84 allocates a note location in memory for a note-on and starts a note-on processing chain, or matches a note location already in use with a note-off, which then may start its own note-off processing chain.

If the input note is a note-on 8402, it is checked to see whether a note location is available 8404. This can be done by looping through all note locations in memory and checking whether each one's reserved flag is set to "no." If a location is not available (meaning all are currently in use), then the routine finishes 8426. When the first available location is found the [Initialize Note Location] routine is then called 8406, being passed the address of the available note location.

Figure 85:
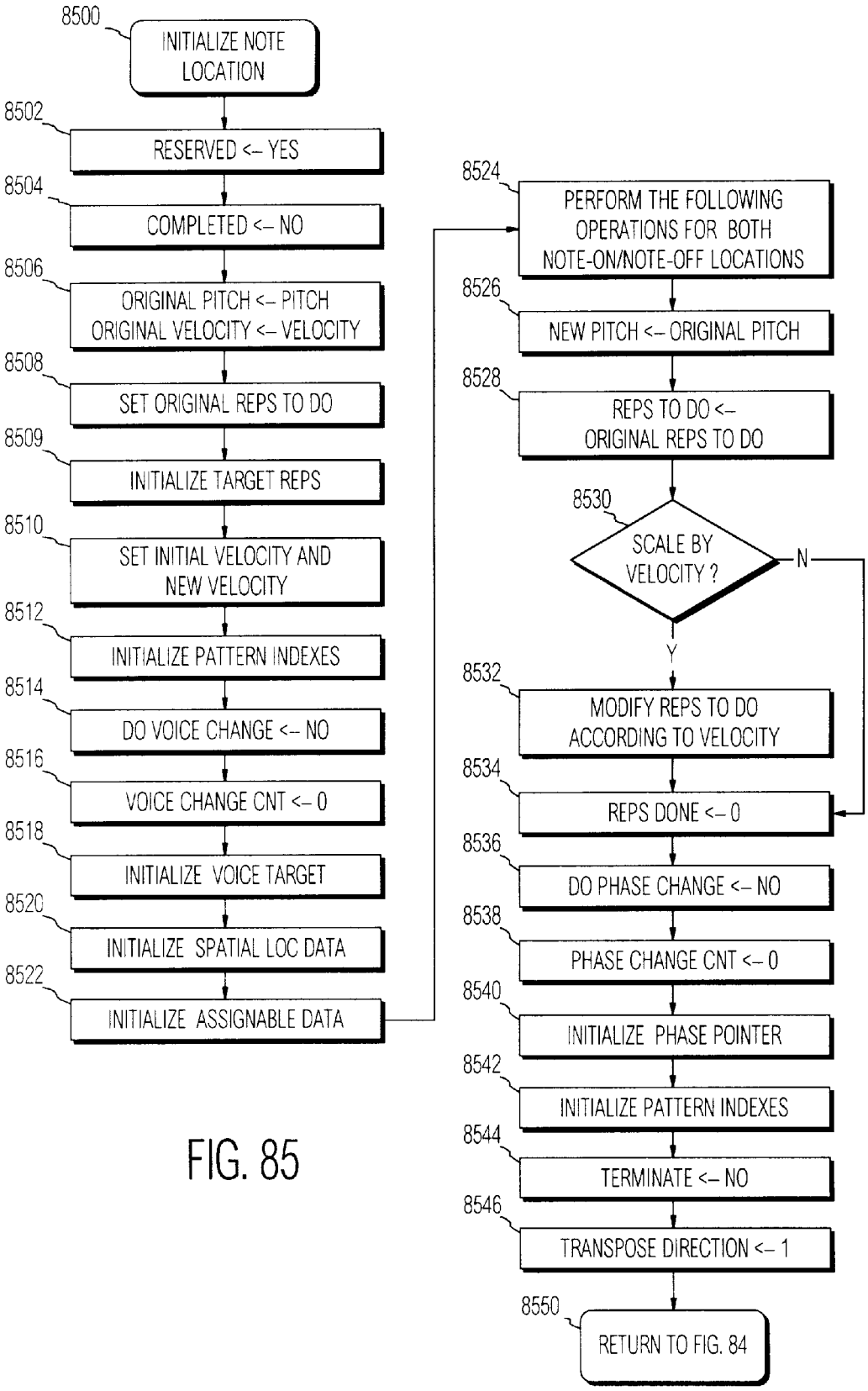
FIG. 85 is a flowchart showing the operation of an initialize note location routine.

The [Initialize Note Location] routine shown in FIG. 85 initializes various parameters to predetermined starting values in the chosen note location. The reserved flag indicating the note location is in use is set to "yes" 8502. The completed flag indicating that a note-off has been received matching the original note-on is set to "no" 8504. The pitch and velocity of the note-on are stored as the original pitch and original velocity 8506. The original reps to do value (number of repetitions to complete) is set to a predetermined or user selected value 8508. The target reps value (count at which to perform optional phase changes) is initialized to a predetermined or user selected value 8509. The initial velocity, which is used to calculate the velocities of the repeated notes, is set by copying the original velocity 8510, or optionally by specifying either a predetermined absolute value, or by adding or subtracting a predetermined offset from the original velocity. The new velocity, which may be repeatedly modified as the effect repeats and will be used to determine the velocity of the repeated notes, is set to the initial velocity. The various pattern indexes in FIG. 80 are then initialized to predetermined values indicating a starting position in the applicable pattern 8512. The do voice change flag that indicates a change in an instrumental voice later on is set to "no" 8514, and the voice change count is set to "0" 8516. An initial voice target (number of repetitions to generate before changing voices) is calculated and stored 8518. This is done by using the stored voice change pattern index to choose the voice pattern data at the step indicated by the index and derive the target value, after which the index is advanced to another location. The spatial location data area is initialized 8520. This is done by using the stored spatial location pattern index to access the spatial location pattern data at the step indicated by the index and derive one or more values, after which the index is advanced to another location. The assignable data area is initialized 8522. This is done by using the stored assignable pattern index to access the assignable pattern data at the step indicated by the index, after which the index is advanced to another location.

Memory locations within each of the note-on/note-off locations are then initialized 8524. The new pitch is set to the stored original pitch 8526. This value may be repeatedly modified as the effect repeats and will be the actual pitch of the repeated note(s). The reps to do value is set to the original reps to do value 8528. If an optional predetermined setting indicates that the reps to do value should be scaled by the velocity of the input note-on 8530, then the reps to do value is modified accordingly 8532. For example, it might be specified that the original reps to do value be used if the velocity was 127, only 1 repetition to be performed with the velocity is 64 or less, and scaled linearly for values between 65 and 127. This amount of scaling may also be performed according to other MIDI controllers, or a user operated control specifying a scaling amount, rather than velocity. This allows a predetermined number of repetitions to be determined, yet gives the user the flexibility to modify it at will. Reps done (the number of actual repetitions completed) is set to "0" at 8534.

The do phase change flag indicating it is time for a phase change is set to "no" 8536, and the phase change count is set to "0" 8538. The phase pointer, which is a pointer to the address of one of the phase parameter memory locations in FIG. 78 is initialized to point to the phase indicated by the first value of the phase pattern 8540. The various pattern indexes in FIG. 81 are then initialized to predetermined values indicating a starting position in the applicable pattern 8542. The terminate flag that indicates it is time to terminate the repeating operations is set to "no" 8544. The transpose direction 8546 is set to "1," and the routine then returns to the [Allocate Note Location] routine 8550.

Returning to the [Allocate Note Location] of FIG. 84, if various envelopes are being utilized, they may be selectively started 8407. In this example, they include a tempo envelope that is used to modify the calculations of the next repeat time, a velocity envelope that is used to modify the velocity of notes as they are generated, and a bend envelope that continuously sends out MIDI pitch bend data. The [Process Note-On] routine is called next 8408, which may start a note-on processing chain to be described shortly. The routine is then finished 8426.

If the input note is a note-off 8402, the original note duration mode is checked 8410. If it is not "as played," then a duration pattern is being used, and the routine is finished 8426. This is because later workings of the process has taken care of or will take care of supplying the note-off for the corresponding note-on, and this note-off is ignored. This will contribute to achieving duration effects (7) and (8) of FIG. 79 (for the original note). If the original note duration mode is "as played", then the note locations that are in use (have their reserved flags set to "yes") are searched for a note location containing an original pitch equal to the pitch of the input note-off 8412. If such a location is not found 8414, it is assumed that either the note-off has been handled by another part of the process and should be ignored, or that a note-on corresponding to that note-off was never received into this routine, and the routine is finished 8426. However, if a note location containing the correct original pitch is found 8414, it is then checked to see whether the location's completed flag is "yes" 8416. If so, this location has already been found by a previous note-off, and execution loops back to 8412 where the search may either be continued or terminate if no further matches are found. If the completed flag is "no" 8416, then the correct note location has been found, and the completed flag is set to "yes" 8418. The [Process Note-Off] routine will then be called, which will start a separate note-off processing chain that shall be described shortly, and the routine is finished 8426. This contributes to achieving duration effects (1) through (6) of FIG. 79 (for the original note), and duration effects (1) through (3) (for the repeated notes).

In this manner, any note-on that allocates a note location and starts a note-on processing chain may be located and matched by a corresponding note-off, which then may start its own note-off processing chain.

NOTE-ON PROCESSING CHAIN

The note-on processing chain starts with the [Process Note-On] routine, which is either called directly (e.g. from within the [Allocate Note Location] routine just described in FIG. 84 8408), or by scheduled procedure calls as shown below. It is passed a pointer to the address in memory of a note-on location, and those parameters and variables are used during processing. The memory locations of the parent note location can also be accessed. Therefore, during the following discussion, the parameter and variable names are either referring to the memory locations in the current parent note location, or to the note-on variables in the note-on location of the parent note location. For example, when a step indicates an operation such as "reps done+1," this means that the reps done value in the note-on location is being incremented, and not the corresponding same location in the note-off location. Furthermore, all memory locations that are in a phase parameter memory location (FIG. 78) are assumed to be referring to the locations in the current phase which is pointed to by the note-on location's phase pointer.

Figure 86:
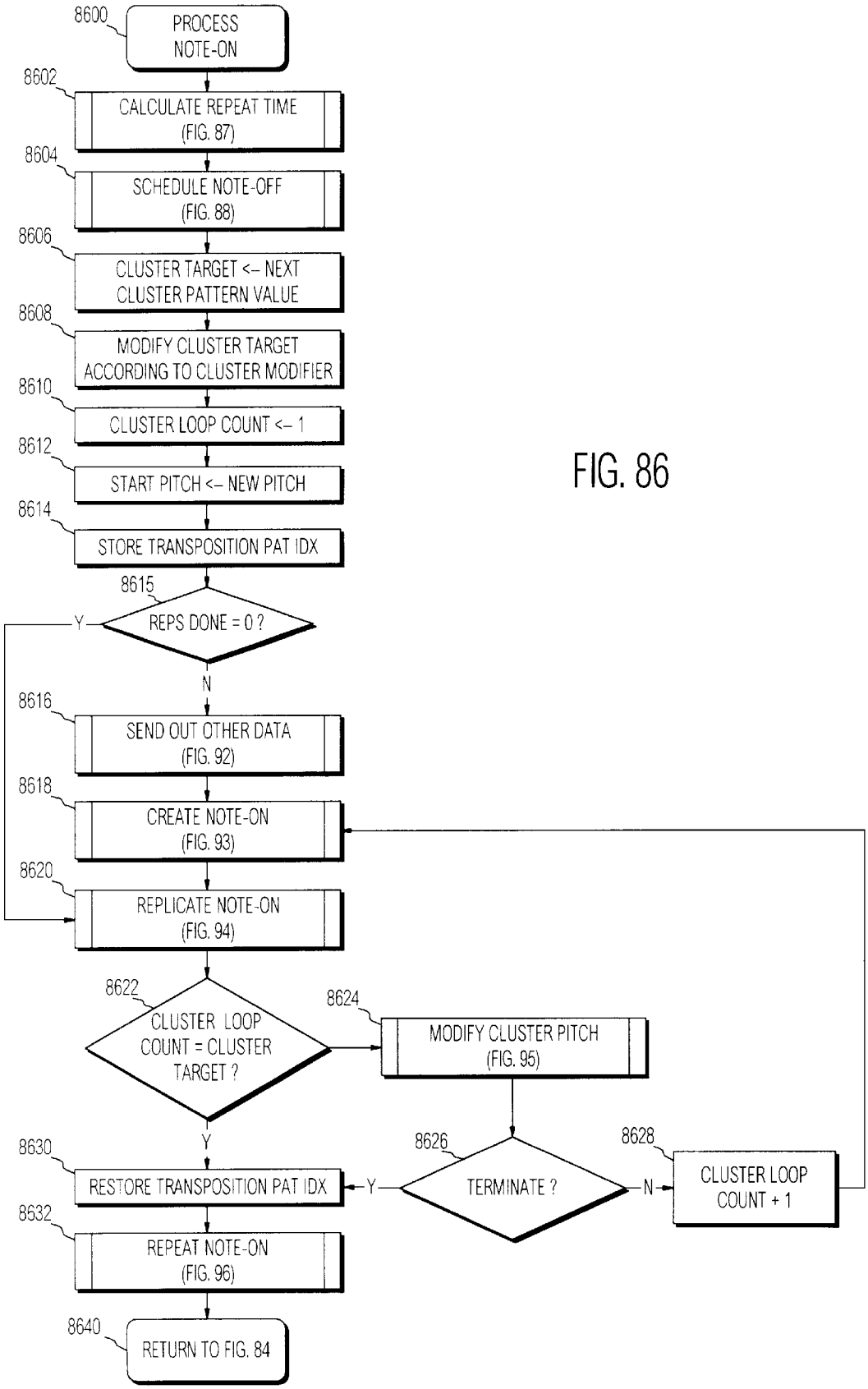
FIG. 86 is a flowchart showing the operation of a process note-on routine.
Figure 87:
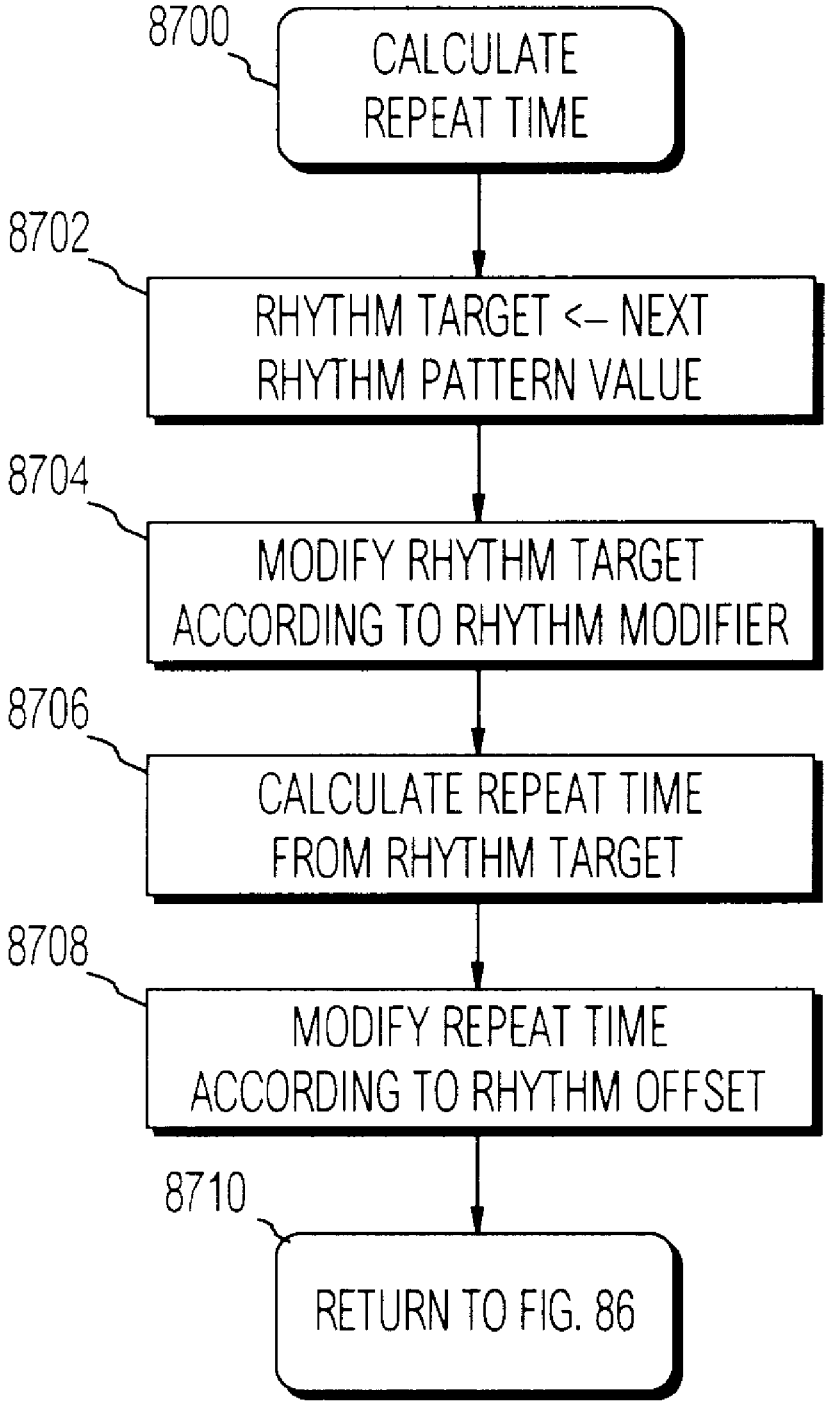
FIG. 87 is a flowchart showing the operation of a calculate repeat time routine.

The [Process Note-On] routine is shown in FIG. 86. First, the [Calculate Repeat Time] routine is entered 8602, which is shown in FIG. 87. This routine calculates a repeat time (time at which to schedule a repeated note in the future) using a rhythm pattern value, a rhythm pattern modifier, and a rhythm pattern offset. The calculation may be optionally modified by a tempo envelope.

A rhythm target location in memory receives the next value derived from the rhythm pattern 8702. This is done by using the stored rhythm pattern index to derive a rhythm pattern value from the step indicated by the index, after which the index is advanced to another location. The rhythm pattern's associated rhythm modifier may then optionally be used to modify the rhythm target 8704. For example, if the rhythm target is 6 (16th note at 24 cpq) and the rhythm modifier is 2, then the rhythm target becomes (6*2)=12, indicating an eighth note. A memory location repeat time receives a value calculated from the rhythm target 8706, according to the current tempo chosen for the repeated effect. The tempo may be a fixed value, or may be derived from the current envelope value of a tempo envelope as previously described. One may employ the following formula, where cpq is 24 clocks per quarter in this example:

repeat time=(rhythm target*(60000/tempo))/cpq

For example, at a tempo of 120 bpm with a rhythm target of 12 (8th note), the formula yields a repeat time of 250 ms.

The value of repeat time may then be optionally further modified by the rhythm pattern's associated rhythm offset, to cause an overall increase or decrease over time 8708. In this example, this is done by taking a predetermined or user determined rhythm offset, which may be positive or negative, multiplying it by the number of reps done, and adding it again to the repeat time; other methods are possible. One may employ the following formula:

repeat time=repeat time+(rhythm offset*reps done)

Since reps done is incremented later on as shall be described, the rhythm offset will start at 0 and become progressively larger with each completed repetition, causing an overall increase or decrease in repeat time. The routine then returns 8710.

Figure 88:
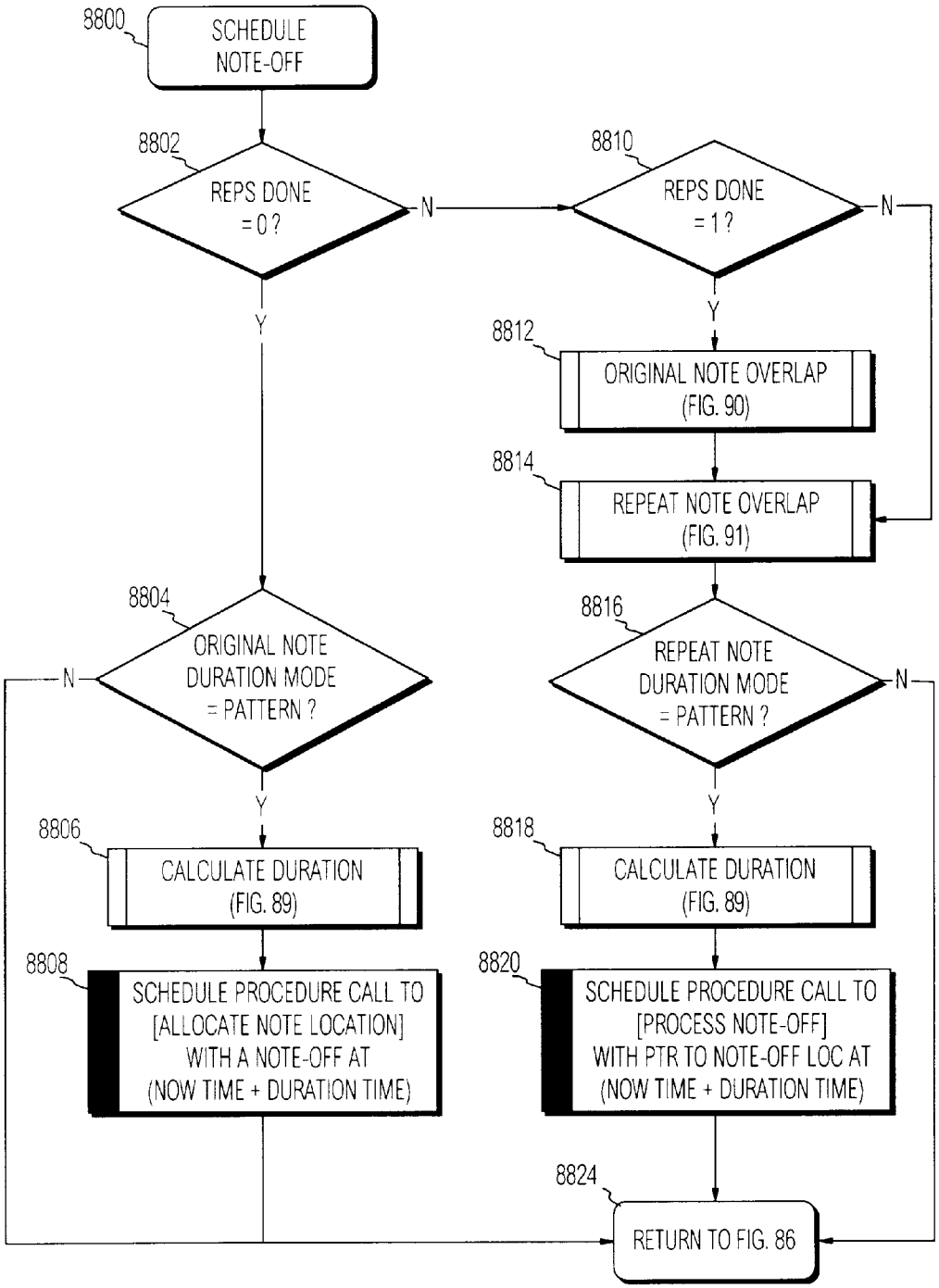
FIG. 88 is a flowchart showing the operation of a schedule note-off routine.

Returning to the [Process Note-On] routine of FIG. 86, the [Schedule Note-Off] routine is entered 8604. Referring to FIG. 88, the [Schedule Note-Off] routine checks several duration mode and overlap mode options, and allows note-offs to be sent out in certain cases (even though this is the note-on processing chain), thereby achieving various duration effects. These note-offs will not be put out immediately. They will be scheduled to be put out at some time in the future, to correspond with note-ons that will be put out instantly later on in this procedure.

If reps done equals "0" 8802, then the original input note is still being processed (since no repetitions have yet occurred). It must then be determined whether or not to use the actual duration of the original note, or a duration pattern. If the original note duration mode is not "pattern" (but is "as played") 8804, the original duration will be used. This means that no note-offs need to be generated here, because the original note-off will be utilized when it is received, and the routine returns 8824. This contributes to achieving duration effects (1) through (6) of FIG. 79 (for the original note). If the original note duration mode is "pattern" 8804, then a duration pattern is being used, the duration with which the note is actually played (the original note-off) will be ignored, and the duration for the original note must be calculated in the [Calculate Duration] routine 8806.

Figure 89:
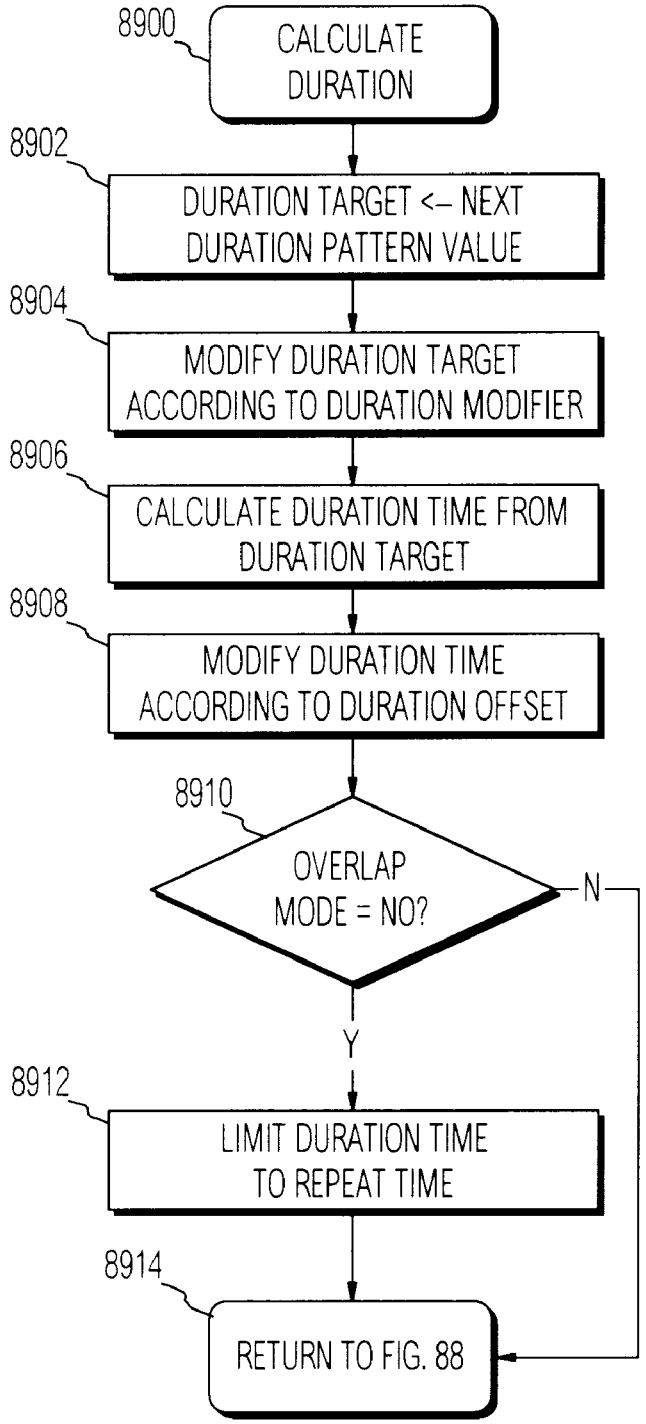
FIG. 89 is a flowchart showing the operation of a calculate duration routine.

The [Calculate Duration] routine shown in FIG. 89 calculates a duration for a note using a duration pattern value, a duration modifier, and a duration offset. The duration time may be limited to the current repeat time, so notes do not overlap notes which will come later, thereby achieving various duration effects.

A memory location duration target receives the next value derived from the duration pattern 8902. This is done by using the stored duration pattern index to derive a duration pattern value from the step indicated by the index, after which the index is advanced to another location. The duration pattern's associated duration modifier may then optionally be used to modify the duration target 8904 in a similar fashion to that already explained for the rhythm pattern. A memory location duration time receives a value calculated from the duration target 8906, according to the current tempo (or tempo envelope value) chosen for the repeated effect. One may employ the same formula as used to calculate the repeat time. The value of duration time may then be optionally further modified by the duration pattern's associated duration offset 8908, to cause an overall increase or decrease over time, in the same fashion as already described for the rhythm pattern.

The overlap mode is then checked 8910. Since this routine was called as a result of checking the original note duration mode, we are checking the original note overlap mode. If "no," then the duration time is limited to the repeat time 8912, so that it will not overlap the next note(s) which will be generated in the future. If the mode is "yes," then overlaps are allowed, the duration time is not modified any further, and the routine returns to the [Schedule Note-Off] routine 8914. In this manner, duration effects (7) and (8) of FIG. 79 are achieved (for the original note).

Returning to the [Schedule Note-Off] routine of FIG. 88, a procedure call to [Allocate Note Location] is scheduled for (now time+duration time) 8808. The scheduled call will be passed a pointer to a note-off stored in memory that has the current value of new pitch (in the note-on location, which was initialized to the original pitch as previously described). When this call eventually occurs at the specified time in the future, it will enter the previously described [Allocate Note Location] routine as a note-off. This will eventually start the note-off processing chain yet to be described, and thereby generate the same number of corresponding note-offs to the note-ons that will soon be generated. This is because the setting of the original note duration mode is "pattern", and therefore the original note's note-off will be ignored. In other words, the note-off processing chain is being scheduled here to start at some point in the future according to a duration pattern value, rather than waiting for the actual note-off of the original note.

If reps done was not "0" 8802, then it is checked to see if reps done equals "1" 8810. (The value of reps done is incremented later on in this discussion, after each successful scheduling of the next repetition of the note-on.) If so, this is the first repetition of the effect since the original note was received, and a note-off for the original note may need to be sent out in the [Original Note Overlap] routine 8812, in order to achieve the desired duration effects.

Figure 90:
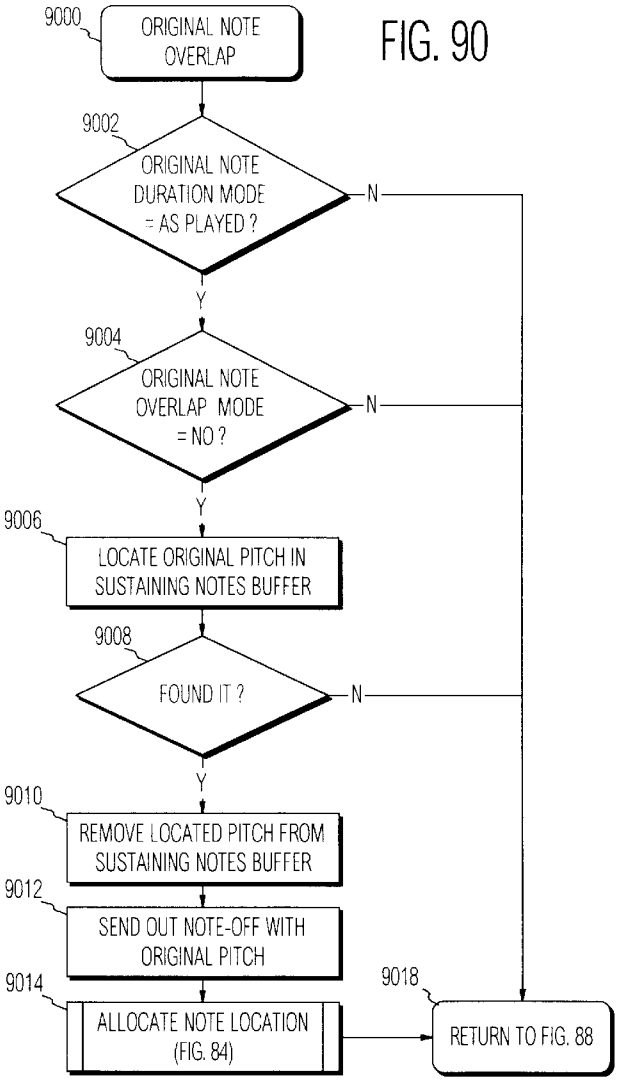
FIG. 90 is a flowchart showing the operation of an original note overlap routine.

The [Original Note Overlap] routine shown in FIG. 90 sends out a note-off for an original input note if it is still sustaining, based on various duration and overlap modes. If the original note duration mode is "as played" 9002, then the potential exists that the original note is still sustaining. The original note overlap mode is then checked 9004. If "no," then repetitions are not allowed to overlap the original note and it must be ended. It is then checked to see if the original note is still sustaining 9006. This is done by searching through the sustaining notes buffer for the pitch stored in the note location as original pitch. If it is found 9008, then the located pitch is removed from the sustaining notes buffer 9010, a note-off is sent out for the original pitch 9012, and the [Allocate Note Location] routine is called directly with a note-off of original pitch 9014. This will provide a note-off that will start the note-off processing chain for the original note as if it had actually been received. Since the original note is no longer in the sustaining notes buffer, it will be ignored when it is subsequently actually received. In this manner, duration effects (3) and (6) of FIG. 79 are achieved (for the original note).

If the original note duration mode is not "as played" 9002, or the original note overlap mode is not "no" 9004, or the original note is not sustaining 9008, it is not necessary to send out any note-off for the original note, and the routine returns 9018. This contributes to achieving duration effects (1), (2), (4), and (5) of FIG. 79 (for the original note).

Returning to the [Schedule Note-Off] routine of FIG. 88, execution proceeds to the [Repeat Note Overlap] routine 8814. If reps done is greater than "1" at step 8810, then there is no need to check for overlapping original notes, since the routine just described will have been called by a previous repetition, and execution also proceeds to 8814.

Figure 91:
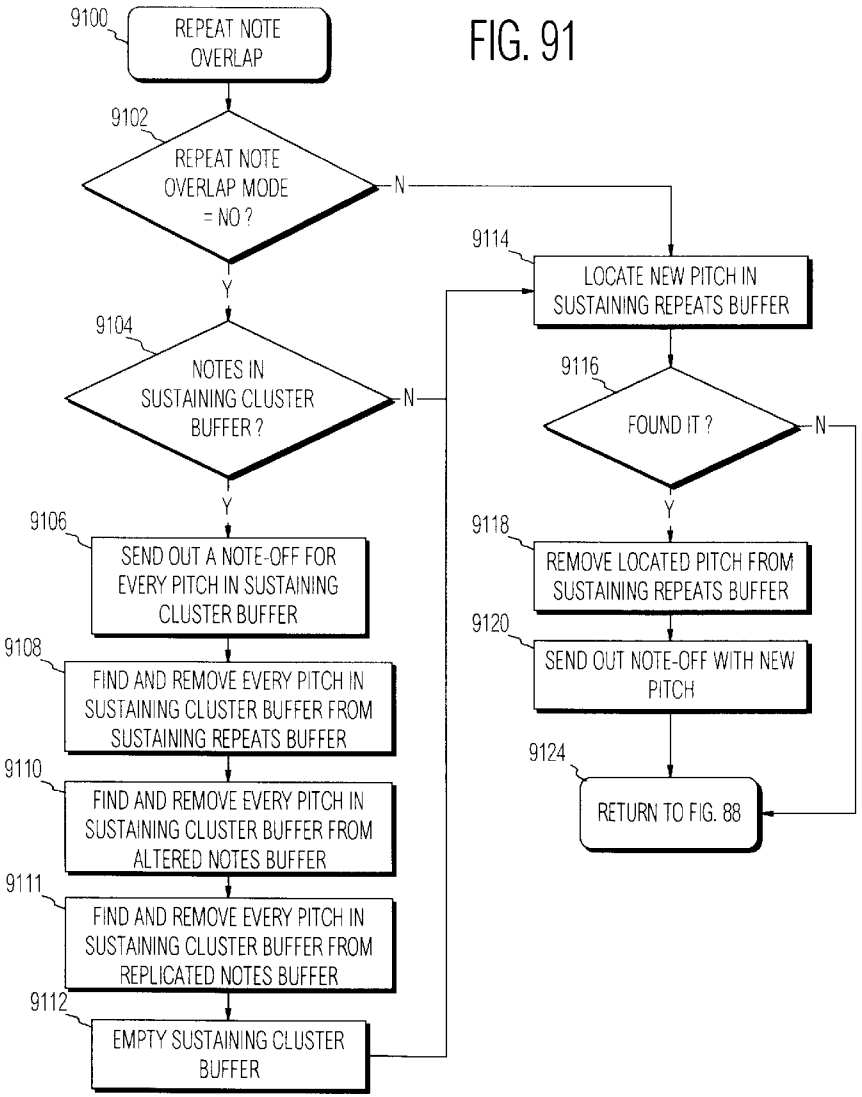
FIG. 91 is a flowchart showing the operation of a repeat note overlap routine.

The [Repeat Note Overlap] routine shown in FIG. 91 sends out one or more note-offs for repeated notes if they are still sustaining, based on various duration and overlap modes, in order to achieve the desired duration effects. The various buffers mentioned here may have notes from previous repetitions stored in them. If the repeat note overlap mode is "no" 9102, then each repeated note-on must shut off any sustaining previously repeated notes, regardless of the durations they were intended to be played with. This is done by sending out a note-off for every pitch currently contained in the sustaining cluster buffer 9104–9106. In this manner, duration effects (2), (3), (5), (6), (7), and (8) of FIG. 79 are achieved (for repeated notes). These same pitches must then be removed from other buffers which may contain them, so they are found and removed from the sustaining repeats buffer 9108. They are found and removed from the altered notes buffer 9110 and the replicated notes buffer 9111, based on the second value of the stored pairs (stored altered/replicated pitch), after which the sustaining cluster buffer is reset to empty 9112.

If the repeat note overlap mode is not "no" 9102, or there are no notes from previous repetitions in the sustaining cluster buffer 9104, or continuing from step 9112, then a note-off will be sent out for a sustaining previously repeated note only if it has the same pitch as the current note-on about to be generated. This is done by searching the sustaining repeats buffer for the pitch currently stored as new pitch 9114. If found 9116, the located pitch is removed from the sustaining repeats buffer 9118, a note-off is sent out for new pitch 9120, and the routine returns 9124. In this manner, the previously described benefits of the invention for duration effects (1) and (4) of FIG. 79 are achieved (for repeated notes). If new pitch is not located in the sustaining repeats buffer 9116, then there is no need to send any note-offs and the routine also returns 9124.

Returning to the [Schedule Note-Off] routine of FIG. 88, if the repeat note duration mode is not "pattern" 8816, then actual durations are being used and will be handled by other portions of the process, and the routine returns 8824. This contributes to achieving duration effects (1), (2) and (3) of FIG. 79 (for repeated notes). If the mode is "pattern," then once again the [Calculate Duration] routine is called 8818. This is performed exactly the same way as previously described, with the single exception that when the step of checking the overlap mode is taken, the repeat note overlap mode is checked (rather than the original note overlap mode). This contributes to achieving duration effects (4) through (8) of FIG. 79 (for repeated notes).

A procedure call to the [Process Note-Off] routine is then scheduled for (now time+duration time) 8820, after which the routine returns 8824. The scheduled call will be passed a pointer to the note-off location corresponding to the note-on location that is currently being explained. However, note that this is a different procedure call than the one that was scheduled in step 08, because repeats and not original notes are being processed at this time. When this call eventually occurs at the specified time in the future, it will enter the not-as-yet described [Process Note-Off] routine with the values passed in the note-off location, thereby eventually generating the same number of corresponding note-offs to the note-ons that will soon be generated. The resulting repeated notes will therefore have the durations specified by the duration pattern. In other words, to achieve duration effects (4) through (8) of FIG. 79, in this case the note-on processing chain also schedules the output of note-offs in addition to note-ons for the repeated notes.

Returning to the [Process Note-On] routine of FIG. 86, a memory location cluster target receives the next derived value from the cluster pattern 8606. This is done by using the stored cluster pattern index to derive a cluster pattern value from the step indicated by the index, after which the index is advanced to another location. The value of cluster target may then be optionally modified by the cluster pattern's associated cluster modifier 8608. In this example, this is a percentage so that the values retrieved from the pattern may be compressed or expanded in real-time. For example, if the cluster target was {3} and the cluster modifier 200%, the cluster target would then become (3*2.0)={6}. Although not shown, the cluster pattern's associated cluster offset may optionally be used to further modify the cluster target value, in a similar fashion to that described for the rhythm pattern.

A cluster loop count variable in memory is initialized to "1" 8610, which shall be used to count repetitions of a loop consisting of the steps 8618 through 8628, which shall be performed the number of times specified by the cluster target. This may cause the generation of one or more note-ons at this time. A start pitch location in memory receives the current value of new pitch stored in the note-on location 8612, and the current value of the transposition pattern index is stored in a temporary memory location 8614.

If reps done is equal to "0" 8615, then the original note-on is being processed, and the original note-on and other data has already been output in the [Main Routine] of FIG. 82. Therefore, the next two steps 8616 and 8618 are bypassed and execution passes to 8620. In this manner, step 8616 will only be performed once per cluster (since it is outside of the loop), and not at all in the case of an original note (since the other data has already been sent out). Furthermore, in the case of an original note, unless the cluster size is greater than 1 (which will cause the loop to be run more than one time), step 8618 will not get called. In this manner, what would normally be the first note of a cluster is skipped here, since it has already been sent out. However, if reps done is not equal to "0" 8615, then repeating notes are being processed, and the [Send Out Other Data] routine is entered 8616.

Figure 92:
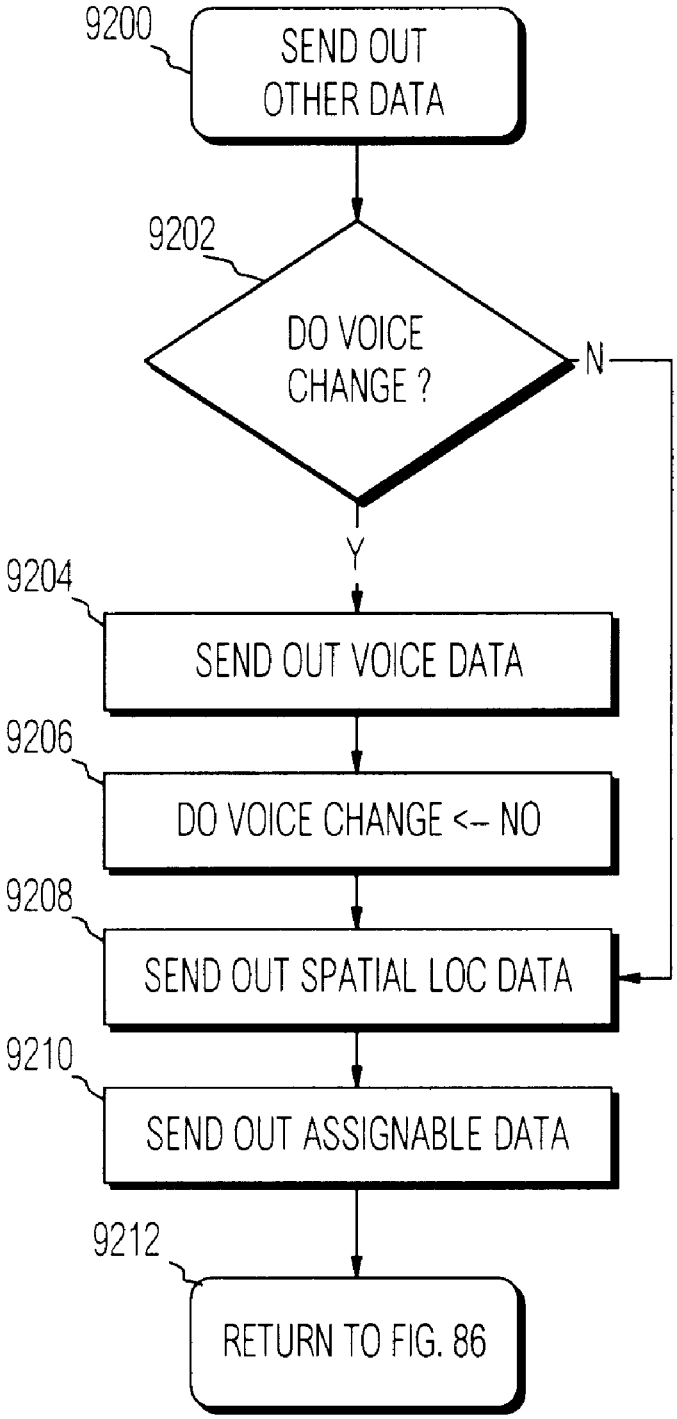
FIG. 92 is a flowchart showing the operation of a send out other data routine.

The [Send Out Other Data] routine shown in FIG. 92 handles sending out the spatial location data, the voice change data, and the assignable data, which is pre-calculated later on in this description and stored for output on the next repetition of this procedure. Therefore, the data to be output here will have been either calculated on the previous working of this routine, or initialized before the first call.

If the do voice change flag is "yes" 9202, then the later workings of the process have set this flag to indicate that the pre-calculated voice data should be output here 9204, which in this example is a MIDI program change. The do voice change flag is then reset to "no" 9206. If the do voice change flag is "no," steps 9204 and 9206 are skipped and no voice data sent out. Precalculated spatial location data is then sent out 9208, which in this example is a MIDI pan value. Instead of using a special flag indicating the sending of data as in the voice change step, it is simply checked to see whether the data is different then previously sent out data. If not, no data is sent out. This method could also be used for the voice change data, and the two methods are shown as interchangeable. Precalculated assignable data is then sent out 9210, which in this example is a MIDI controller 17 value. Again, if the value is not different from a previously sent value, no data is sent out. The routine then returns 9212 to the [Process Note-On] routine of FIG. 86, where execution then proceeds to the [Create Note-Ons] routine 8618.

Figure 93:
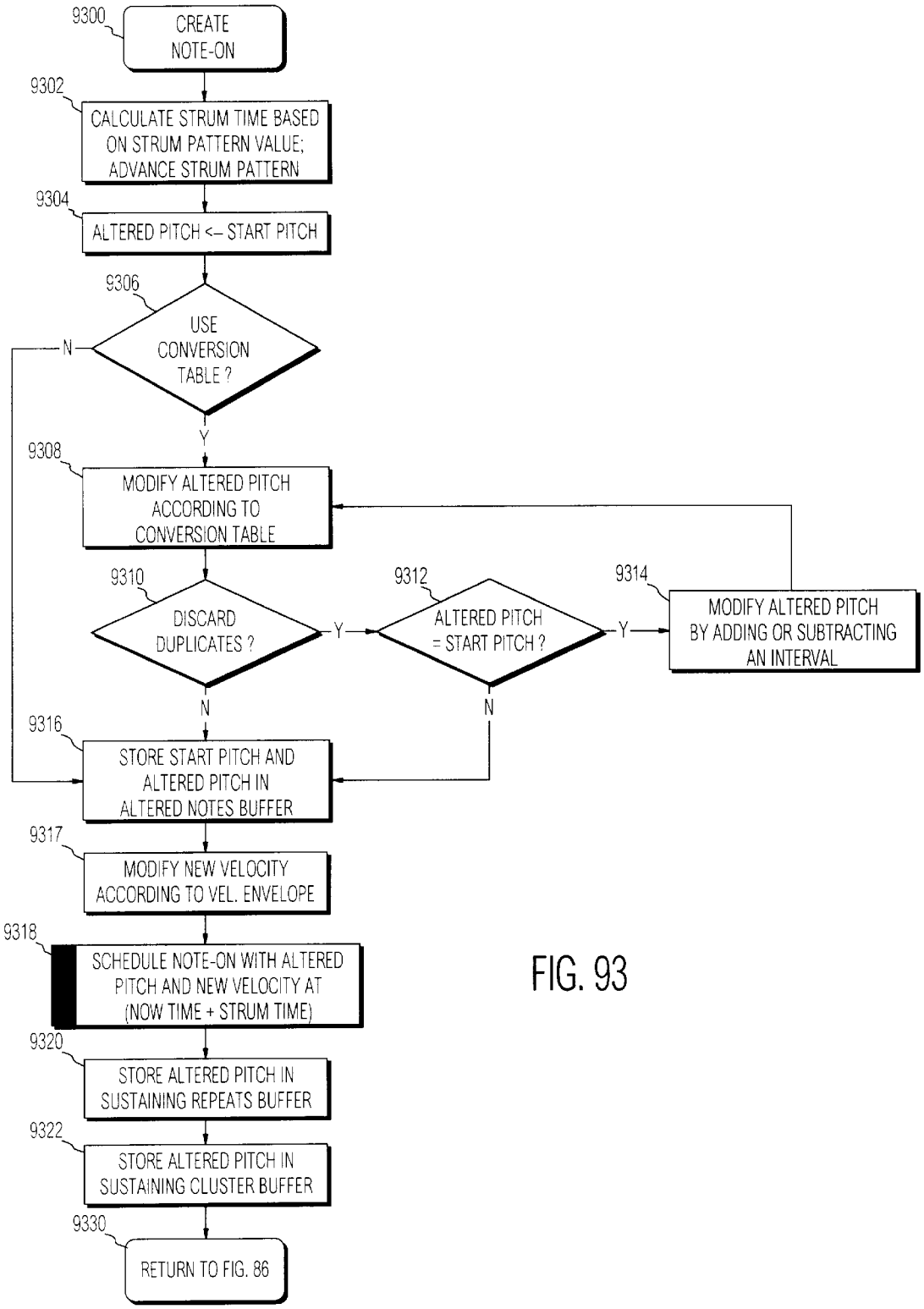
FIG. 93 is a flowchart showing the operation of a create note-on routine.

The [Create Note-On] routine shown in FIG. 93 schedules a note-on for eventual output (based on a strum pattern) with a pre-calculated pitch, optionally modifying the pitch before sending by a conversion table, and optionally suppressing duplicate pitches which may result. The velocity of the note-on may be modified by a velocity envelope. The pitch is stored in several buffers so that note-offs can locate the correct pitch to send out later on, and so other parts of the procedure may determine which notes are sustaining.

First, a strum time in memory may be calculated for each note in the cluster (if the current cluster target is greater than 1) 9302. This is done by using the stored strum pattern index to derive a strum pattern direction from the step indicated by the index, after which the index is advanced to another location. The retrieval of the value and advancement of the index is done once per cluster at the beginning (e.g. when the cluster loop count is 1). As previously described in the reading out of data, the calculation may be done by using the loop index (in this case the cluster loop count), the cluster size, the strum direction, and a predetermined time in milliseconds. The resulting strum time may then be used to cause a delay between each of the repeated notes in the cluster. Although not specifically shown, the strum pattern's associated strum modifier and strum offset can be used to further modify the strum time in a manner similar to the other patterns previously described.

An altered pitch value in memory receives the current value of start pitch 9304. If a parameter memory location indicates that the operation is to include the optional step of using conversion tables to transpose the pitch 9306, then the altered pitch is modified according to a currently selected conversion table 9308 as described in earlier embodiments. The conversion table can be part of a predetermined collection of parameters loaded as a whole by the user, or can be individually selected from a plurality of conversion tables stored elsewhere in memory, where the selection means could be one or more of the following: the operation of a chord analysis routine on input notes, or on a certain range of input notes; the operation of a chord analysis routine on an area of a musical controller such as a keyboard or guitar; the operation of a chord analysis routine performed on sections of a background track of music; markers or data types at various locations in a background track of music; or user operations.

If a parameter memory location indicates the operation is to include the additional optional step of discarding duplicate pitches 9310, the altered pitch is tested to see if it is the same as the start pitch 9312. If so, the altered pitch is further modified by the addition or subtraction of a predetermined interval 9314, after which execution loops back to 9308, and the altered pitch is again modified by the conversion table. If the altered pitch is not equal to the previous pitch 9312, or the additional step of discarding duplicates is not being taken 9310, or conversion tables are not being used 9306, the start pitch and its corresponding altered pitch are stored in the altered notes buffer 9316. This pair of stored values shall be used later to determine the correct note-offs to send out.

The value currently contained in the new velocity location of the note location may be further optionally modified or replaced by the current envelope value of a velocity envelope 9317, such envelope having been triggered by one of the means previously described. In this example, this is done by scaling the envelope value of {0–100} into an offset of {−127–0} and adding it to the new velocity, with other ranges possible.

A note-on is then scheduled to be output at a time in the future of (now time+strum time), with the pitch specified by altered pitch, and the velocity specified by new velocity 9318. The altered pitch is then stored in the sustaining repeats buffer 9320, and the sustaining cluster buffer 9322. The routine then returns 9330 to the [Process Note-On] routine of FIG. 86, where the [Replicate Note-On] routine is then entered 8620.

Figure 94:
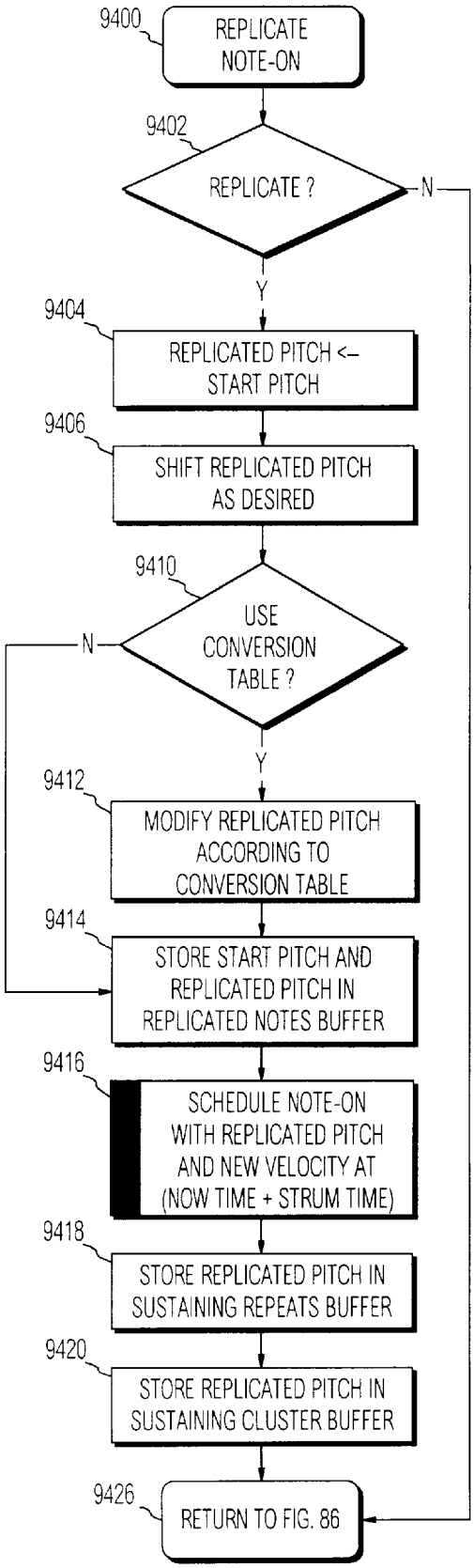
FIG. 94 is a flowchart showing the operation of a replicate note-on routine.

The [Replicate Note-On] routine shown in FIG. 94 allows a note-on to be replicated according to one or more replication algorithms, creating additional note-ons. If a parameter memory location indicates that replication is to be performed 9402, a replicated pitch value in memory gets the current value of start pitch 9404. The replicated pitch is then shifted as desired 9406. This may be done by adding or subtracting an interval to transpose the pitch. This may alternately be done by inverting the pitch with regards to a maximum pitch, such as (replicated pitch=maximum pitch−replicated pitch) or other such mathematical operation. If a parameter memory location indicates that the operation is to include the optional step of using conversion tables to transpose the pitch 9410, then the replicated pitch is modified according to a currently selected conversion table 9412.

If not using conversion tables 9410 or continuing from 9412, the start pitch and its corresponding replicated pitch are then stored in the replicated notes buffer 9414. This pair of stored values shall be used later to determine the correct note-offs to send out. A note-on is then scheduled to be output at a time in the future of (now time+strum time), with the pitch specified by replicated pitch, and the velocity value currently contained in the new velocity location of the note location 9416. The replicated pitch is then stored in the sustaining repeats buffer 9418, the sustaining cluster buffer 9420, and the routine returns 9426. If replication is not to be performed 9402, the routine also returns 9426 with no additional note-ons being generated.

Although in this example only one replicated note is created, this routine may optionally be performed more than one time, with different intervals or replication algorithms, as many times as desired. Furthermore, this routine could included a duplicate suppression system similar to the one employed in the [Create Note-On] routine (FIG. 93) if desired.

Returning to the [Process Note-On] routine of FIG. 86, the cluster loop count is checked to see if it is equal to the cluster target 8622. If not, then there are more repetitions of the loop to perform, and the [Modify Cluster Pitch] routine is entered 8624.

Figure 95:
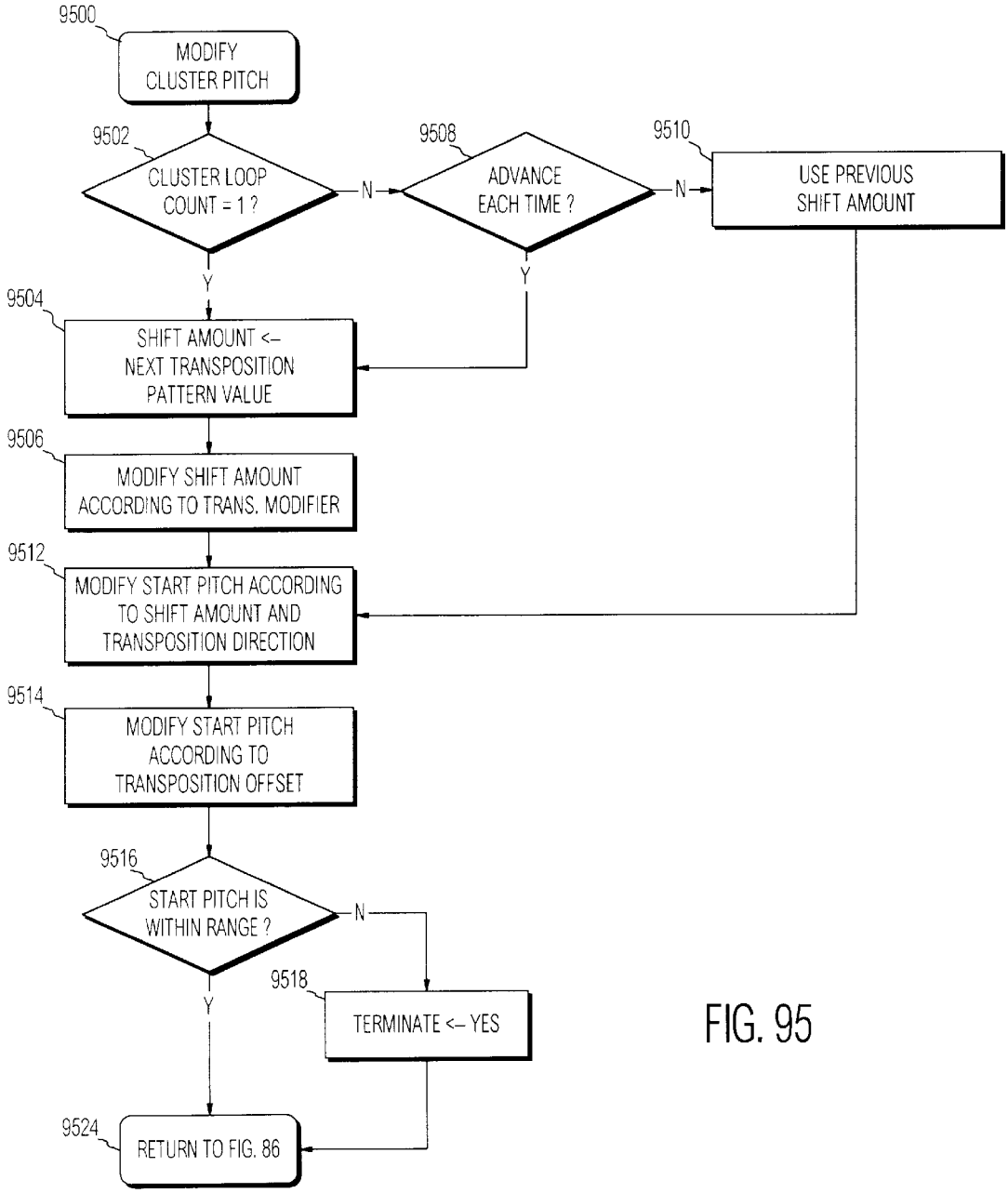
FIG. 95 is a flowchart showing the operation of a modify cluster pitch routine.

The [Modify Cluster Pitch] routine shown in FIG. 95 modifies the current value of start pitch using a transposition pattern, transposition modifier, and transposition offset. Therefore, for each note-on generated by the cluster loop a potentially different pitch may be generated.

If the cluster loop count is equal to "1" 9502, then the first cycle of the loop is in progress, and a shift amount value in memory receives the next value derived from the transposition pattern 9504. This is done by using the stored transposition pattern index to derive a transposition pattern value from the step indicated by the index, after which the index is advanced to another location. The value of shift amount may then be optionally modified by the transposition pattern's associated transposition modifier 9506. In this example this is a percentage so that the values retrieved from the pattern may be compressed or expanded in real-time, similar to the cluster pattern modifier previously described.

If the cluster loop count does not equal "1" 9502, then an advance each time parameter memory location must be checked that indicates whether to advance for each repetition of the loop (and calculate a different shift amount for each note generated), or to use the same value for all notes generated. If advance each time is "yes" 9508, then a new shift amount is calculated each time through the loop 9504. If "no," then for subsequent passes through the loop the previously calculated shift amount is used 9510.

The value of start pitch is now modified by the shift amount and the transposition direction (stored in the note-on location) 9512. One may employ the following formula to modify the pitch:

start pitch=start pitch+(shift amount*transposition direction)

The transposition direction parameter was initialized to 1 as previously described, and will optionally be changed at different times in the following procedures to −1. This influences the positive/negative sign of the current pattern value. For example, if a shift amount of 3 was calculated, and the transposition direction was −1, the resulting value used to shift the pitch would be (−3). Other methods of indicating an inversion of the mathematical procedure may be employed.

The resulting start pitch may then be further modified the transposition pattern's associated transposition offset 9514. In this example this can be an interval to be added to or subtracted from the start pitch, so that even while using a pattern a gradual overall raising or lowering of the pitch may take place. The resulting value of start pitch may then be optionally tested 9516. If not within a predetermined range of pitches, the terminate flag in the note-on location may be set to "yes" 9518. If the value is within the range, or this test is not utilized, the terminate flag remains at its current state of "no," and the routine returns 9524.

Returning to the [Process Note-On] routine of FIG. 86, if the terminate flag has not been set to "yes" 8626, the cluster loop count is incremented 8628 and execution loops back to the [Create Note-On] routine 8618. In this manner, for the current cluster target a number of note-ons with potentially different pitches will be generated. If the terminate flag has been set to "yes" 8626, or the cluster loop count is equal to the cluster target 8622, the loop is finished and the transposition pattern may be optionally restored 8630 to the previous value saved earlier in this routine. If this step is not performed, then the transposition pattern index may be advanced more quickly due to the use of clusters. This option may be offered as a predetermined parameter or a user operated choice. Finally, the [Repeat Note-On] routine is reached 8632, after which the routine is finished 8640.

Figure 96:
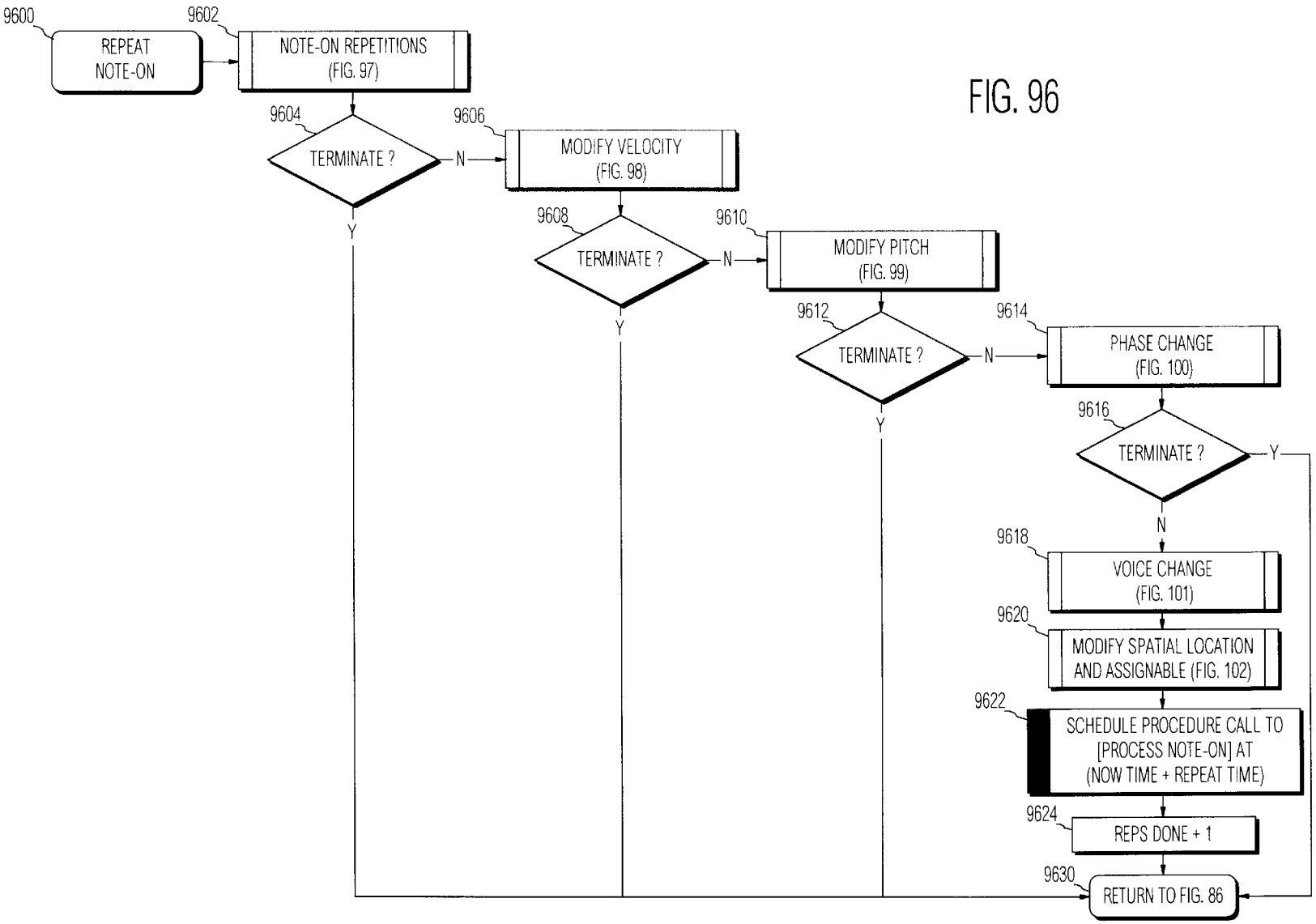
FIG. 96 is a flowchart showing the operation of a repeat note-on routine.

The [Repeat Note-On] routine shown in FIG. 96 is where a number of changes will be performed to the data stored in the note-on location, after which another call to the [Process Note-On] routine that is currently being described will occur at a point in the future, and the precalculated values then sent out or used as just described. Therefore, the [Process Note-On Routine] ultimately calls itself over and over, scheduling the calls at timed intervals in the future according to the rhythm pattern. Within the [Repeat Note-On] routine, several options for terminating the effect are also provided, so that future calls to the [Process Note-On] routine will not occur and the effect will end. Referring to FIG. 96, the first step is to enter the [Note-On Repetitions] routine 9602.

Figure 97:
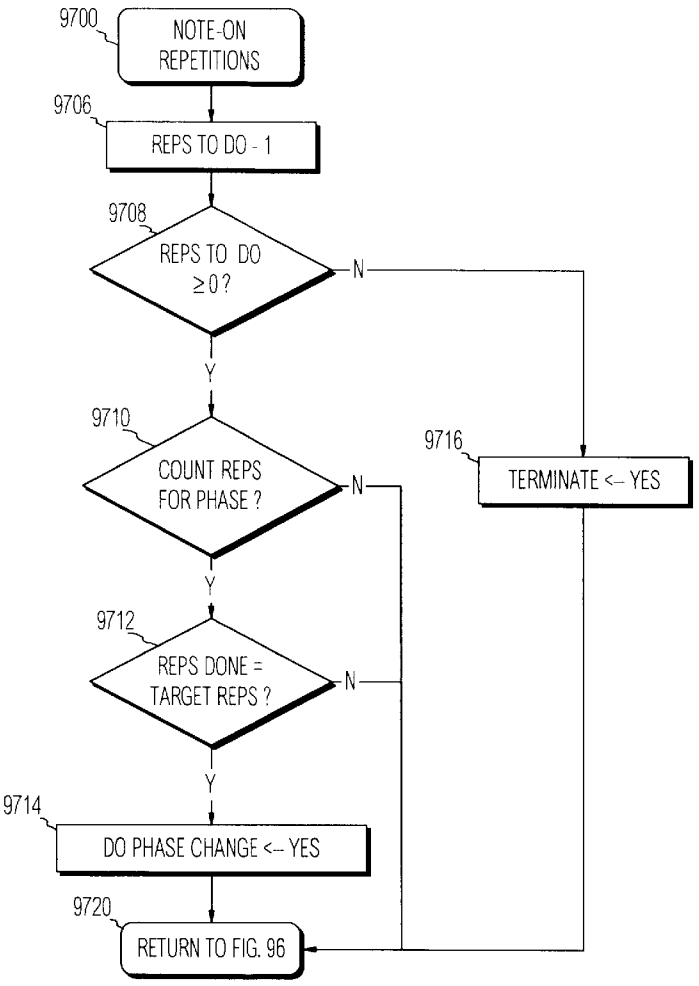
FIG. 97 is a flowchart showing the operation of a note-on repetitions routine.

The [Note-On Repetitions] routine shown in FIG. 97 counts the number of repetitions that have been completed, and if the required number has been met, provides for eventual termination of the effect. It also allows a certain number of completed repetitions to signal an upcoming phase change. First, the reps to do value in the note-on location is decremented by one 9706. In this manner, every time the note-on is repeated the number of note-on repetitions to produce is decremented by one from the value that the note-on location was initialized to. It is then checked whether reps to do is greater than or equal to "0" 9708. If not, the terminate flag will be set to "yes" 9716, and the routine will return 9720. If reps to do is greater than or equal to "0" 9708, there are still repetitions to produce, and a test is made for whether an optional setting in the parameter memory indicates that repetitions are being counted to produce a phase change 9710. If so, it is checked to see if the required number of target reps in the note location has been reached 9712. If reps done is equal to target reps, then the do phase change flag is set to "yes" 9714; if not, then the flag is left in its current state of "no" and the routine returns 9720.

Returning to the [Repeat Note-On] routine of FIG. 96, if the terminate flag has not been set to "yes" 9604, execution enters the [Modify Velocity] routine 9606.

Figure 98:
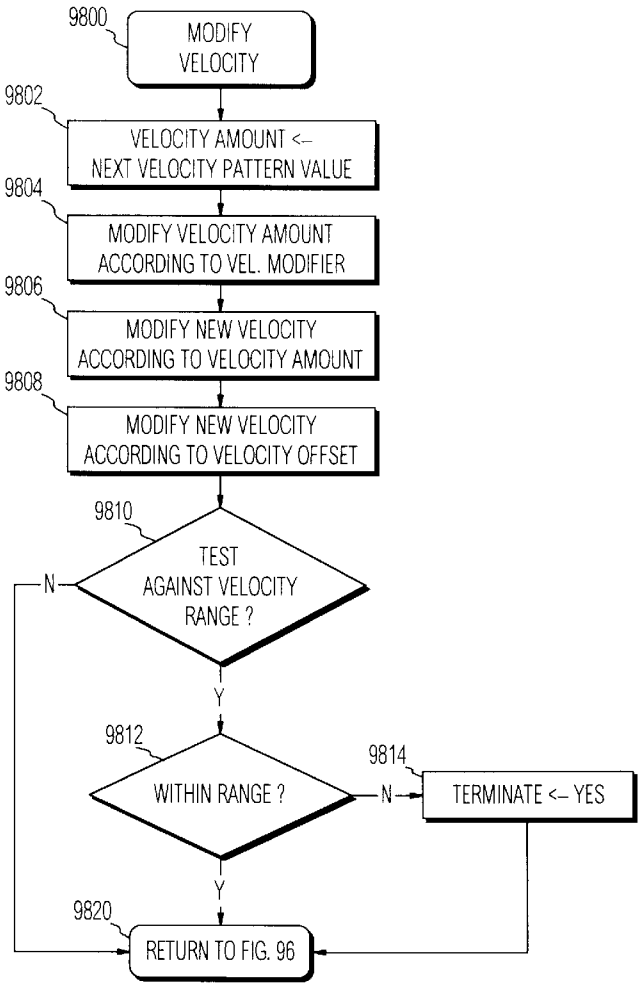
FIG. 98 is a flowchart showing the operation of a modify velocity routine.

The [Modify Velocity] routine shown in FIG. 98 modifies the stored velocity with a velocity pattern value, velocity modifier and velocity offset, so that the next scheduled procedure call to the [Process Note-On] routine will generate note-on(s) with different velocities, and allows for termination of the effect if the new velocity is outside of a predetermined range.

A velocity amount value in memory receives the next value derived from the velocity pattern 9802. This is done by using the stored velocity pattern index to derive a velocity pattern value from the step indicated by the index, after which the index is advanced to another location. In this embodiment, the velocity pattern is a modify velocity pattern as previously described, although an absolute velocity pattern could also be used. An example value might be {−20}. The value of velocity amount may then be optionally modified by the velocity pattern's associated modifier velocity modifier 9804. In this example this is a percentage so that the values retrieved from the pattern may be compressed or expanded in real-time. For example, if the velocity modifier is 150%, then the example value of {−20} would become (−20*1.5)={−30}.

The stored new velocity (in the note location) is then modified by replacing it with a value 9806, calculated from the stored initial velocity (in the note location). One may employ the following formula:

new velocity=initial velocity+velocity amount.

As previously described in the [Create Note-On] routine, notes are generated using the new velocity value, which is calculated here. In this manner, the new velocity is always replaced with the stored initial velocity modified by a value derived from the velocity pattern, providing accents in the repeated notes. Instead of replacing the value, it could be added to it or subtracted from it to provide a cumulative effect. The value of new velocity may then be optionally further modified by an associated velocity offset to cause an overall increase or decrease over time 9808. In this example, this is done by taking a predetermined or user determined velocity offset, which may be positive or negative, multiplying it by the number of reps done, and adding it again to the new velocity.

If a parameter memory location setting indicates an optional testing of the velocity 9810, the resulting new velocity value is tested against a predetermined minimum and/or maximum range 9812 in parameter memory. If the velocity is within the range 9812, or the testing is not being done, the routine returns 9820 with the terminate flag set to its current value of "no". If the velocity is out of range, the terminate flag is set to "yes" 9814 before returning 9820.

Returning to the [Repeat Note-On] routine of FIG. 96, if the terminate flag has not been set to "yes" 9608, execution enters the [Modify Pitch] routine 9610.

Figure 99:
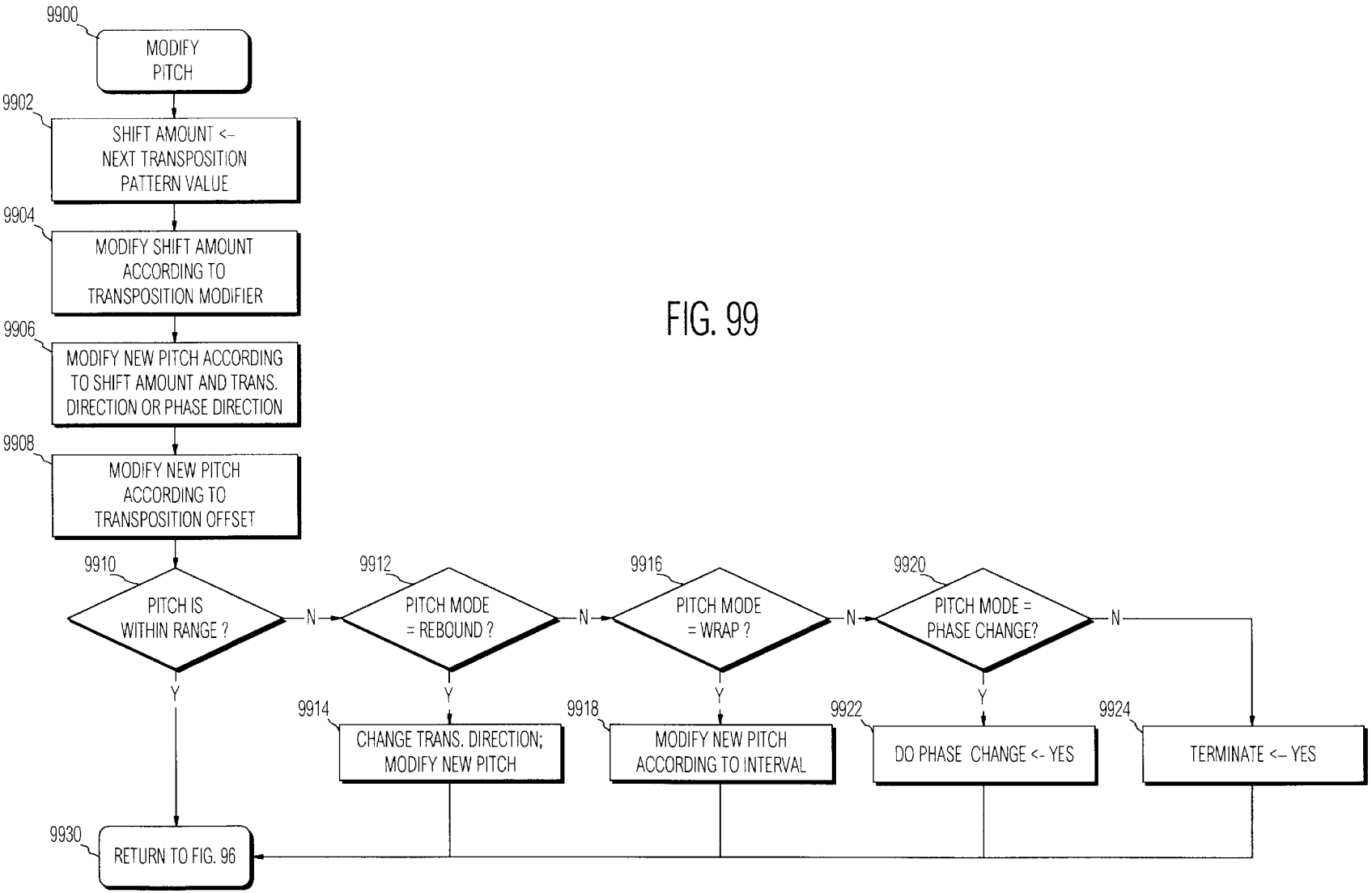
FIG. 99 is a flowchart showing the operation of a modify pitch routine.

The [Modify Pitch] routine shown in FIG. 99 modifies the stored pitch with a transposition pattern value, transposition modifier and transposition offset, so that the next scheduled procedure call to the [Process Note-On] routine will generate note-on(s) with different pitches. Options are provided to either terminate the effect, change certain operational parameters, or further modify the pitch if the pitch is outside of a predetermined range.

A pitch mode in parameter memory provides for several different options to either terminate the effect, change certain operational parameters, or further modify the pitch if the pitch is outside of a predetermined range after transposition. The pitch modes include:

stop:
- terminate the repeating effect if a pitch is transposed outside of a predetermined range.

wrap:
- transpose the pitch up or down by a predetermined interval until it is no longer outside of the predetermined range.

rebound:
- change the transposition direction, and utilize the calculated transposition value in a different fashion as shall be described.

phase change:
- cause a phase change as shall be described.

Referring to FIG. 99, a shift amount value in memory receives the next value derived from the transposition pattern 9902. This is done by using the stored transposition pattern index to derive a transposition pattern value from the step indicated by the index, after which the index is advanced to another location. The value of shift amount may then be optionally modified by the transposition pattern's associated transposition modifier 9904, already described in the [Modify Cluster Pitch] routine.

The value of new pitch in the note-on location is now modified by the shift amount and the transposition direction 9906. The transposition direction parameter was also previously explained and indicates an inversion of the shift amount. Here, one may employ the following formula:

$$\text{new pitch}=\text{new pitch}+(\text{shift amount}*\text{transposition direction})$$

Alternately, the phase direction stored in each phase in parameter memory may be used in a similar fashion to the transposition direction, where the phase direction of "up" indicates using the shift amount as is, and the phase direction of "down" indicates inverting the shift amount. The resulting new pitch may then be optionally further modified by an associated transposition offset 9908, also as previously described.

The resulting value of new pitch may then be optionally tested against a predetermined range 9910. The range can be an absolute range, such as predetermined minimum/maximum pitches in parameter memory, or a sliding range, where the minimum and maximum notes will be a certain value above and below the stored original pitch in the note location. For example, if the original pitch was a C4 (60), the sliding range might specify {4 below to 2 above}, so that the sliding range would be from (56–62). A sliding range can be used separately or in conjunction with an absolute range.

If outside of the range(s), the previously described pitch mode indicates one of a number of options for modifying the processing. If the pitch mode is "rebound" 9912, then the current value of transposition direction is inverted 9914 (e.g. 1 to −1, −1 to 1), which will cause the transposition pattern values to be applied in an opposite direction with future repeated notes. The new pitch may then be modified to stay within the predetermined range, either by adding or subtracting an interval, or by reapplying the previous shift amount with the new transposition direction, after which the routine returns 9930. If the pitch mode is "wrap" 9916, then new pitch is modified 9918 by adding or subtracting a predetermined interval stored in parameter memory, such as an octave or a fifth until the pitch is once again within range. If the pitch mode is "phase change" 9920, then the do phase change flag is set to "yes" 9922, which will cause a phase change at the appropriate place later on.

If not within a predetermined range of pitches and none of the previously described options were selected, then the pitch mode is assumed to be "stop," and the terminate flag is set to "yes" 9924 before returning 9930. If the pitch was within the predetermined range 9910, or one of the previous options other than "stop" was selected, or the range test was not utilized, then the terminate flag remains at its current state of "no" before returning 9930.

Although the previous pitch mode options are shown as individual choices, they could be combined. For example, a pitch going outside of a predetermined range could trigger both the rebound and phase change options. Furthermore, the effect of rebound could be accomplished alternately by reversing the direction of movement of the pattern index through the transposition pattern, rather than inverting the value selected.

Returning to the [Repeat Note-On] routine of FIG. 96, if the terminate flag has not been set to "yes" 9612, execution enters the [Phase Change] routine 9614.

Figure 100:
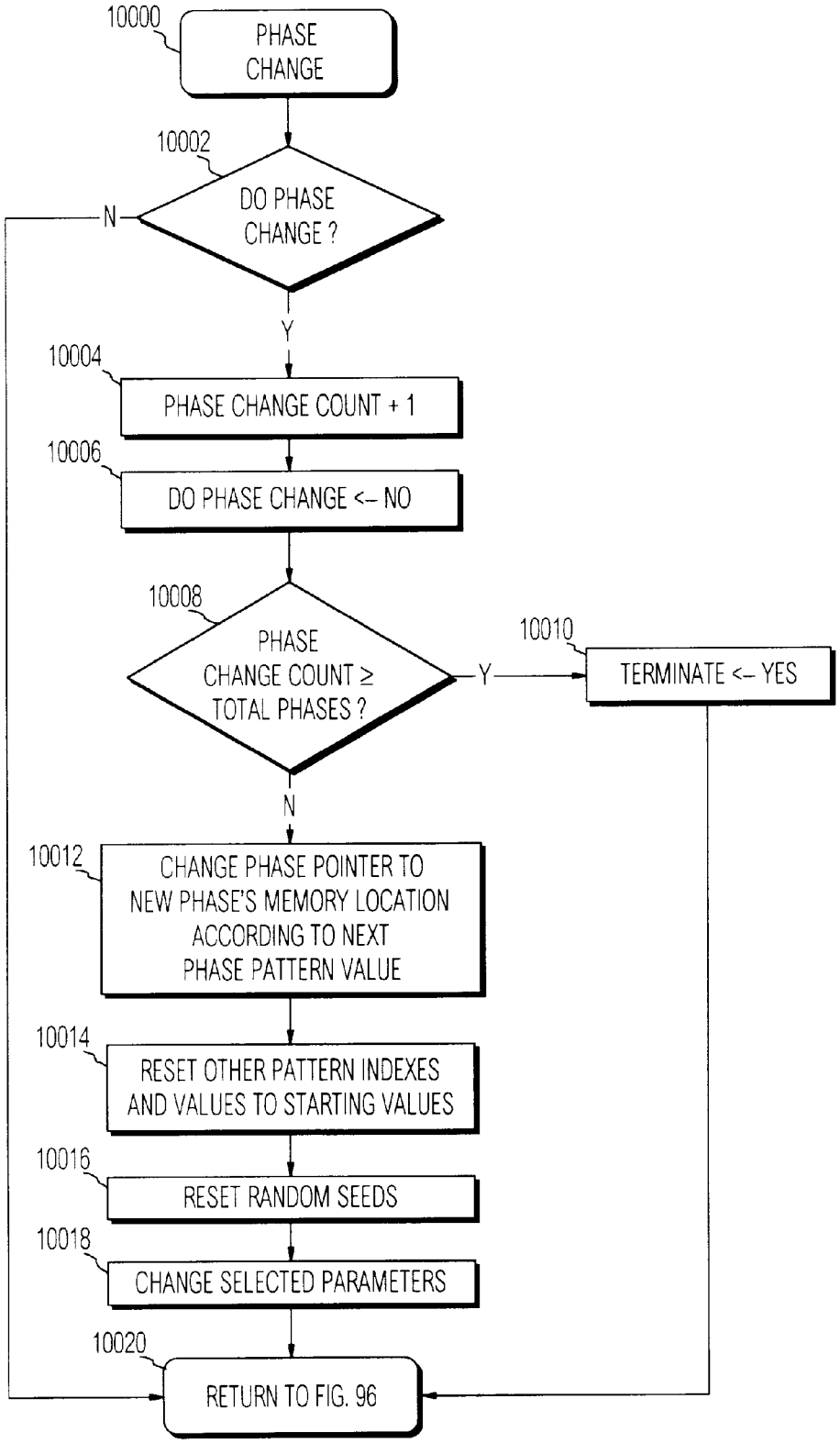
FIG. 100 is a flowchart showing the operation of a phase change routine.

In the [Phase Change] routine shown in FIG. 100, the pointer to the phase's memory locations to use during processing may be changed according to a phase pattern, a count of the total number of phases completed is maintained, and termination of the effect may be allowed if a specified number of phases has been completed. If the do phase change flag has not been set to "yes" by previously described operations 10002, it is not time for a phase change and the routine returns immediately 10020. If the flag is "yes," then the phase change count (in the note-on location) is incremented 10004, indicating that another phase has been completed, and the do phase change flag is reset to "no" 10006. If the phase change count is now greater than or equal to total phases 10008 (a predetermined number of phases to perform in parameter memory), the terminate flag is set to "yes" 10010 and the routine returns 10020. If the count is not greater than or equal to total phases, the phase pointer is changed to point to the phase's memory locations specified by the next value derived from the phase pattern 10012. This is done by using the stored phase pattern index to derive a phase pattern value from the step indicated by the index, after which the index is advanced to another location. From this point forward, all processing described will now use the memory locations pointed to by the phase pointer (which may be the same phase or a different phase). Other pattern indexes, flags and values may be optionally and selectively reset at this point 10014, so that the various other patterns will start at predetermined points and with predetermined values when the next repeat occurs, or may be selectively left at their current values. Optionally, if utilizing random pool patterns, various random seeds may be selectively and independently reset to their stored values 10016, so that repeatable random number sequences are generated. Optionally, if the phase pattern contains data indicating various parameters should be changed, the indicated parameters may then be changed to new values 10018. The routine then returns 10020 with the terminate flag at its current value of "no."

Returning to the [Repeat Note-On] routine of FIG. 96, if the terminate flag has not been set to "yes" 9616, execution enters the [Voice Change] routine 9618.

Figure 101:
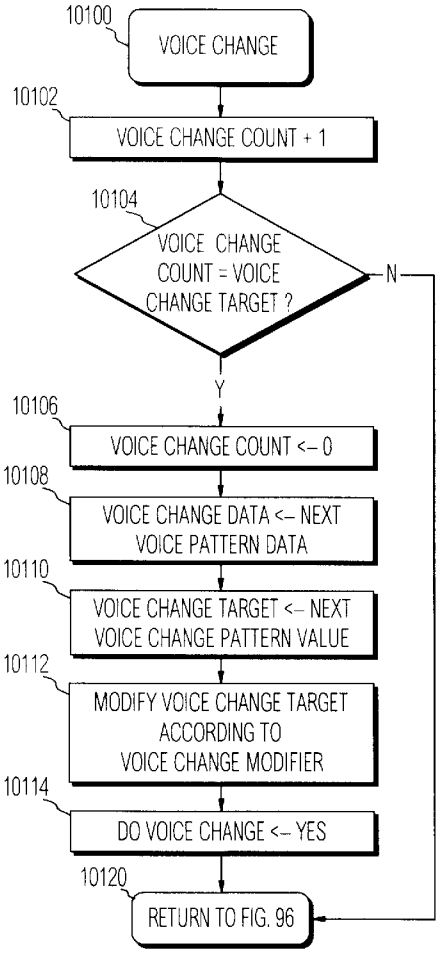
FIG. 101 is a flowchart showing the operation of a voice change routine.

In the [Voice Change] routine shown in FIG. 101, a count of when to make a voice change is maintained, and when the count is equal to a predetermined value, a pending voice change may be flagged. A voice change pattern is used to select voice change data for sending out next time the [Process Note-On] routine is called, and a new voice change target value is calculated for the next voice change. First, the voice change count is incremented for each time through this routine 10102. If the voice change count is not yet equal to the stored voice change target 10104, the routine returns immediately 10120. If the count is equal to the stored target, the voice change count is reset to "0" 10106. The voice change data location (in the note location) then receives data derived from the next step of the voice pattern 10108, and the voice change target receives a value derived from the next step of the voice pattern 10110. These steps are done by using the stored voice change pattern index to derive a pair of values from the voice change pattern at the step indicated by the index, after which the index is advanced to another location. In this example, the voice change data is a MIDI program change number, and the voice change target is a number of repetitions to generate before causing a voice change. The value of the voice change target may then be optionally modified by the voice change pattern's associated voice change modifier 10112. In this example, this is a percentage so that the values retrieved from the pattern may be compressed or expanded in real-time, causing voice changes to happen faster or slower. The do voice change flag is then set to "yes" 10114, which will cause the voice change data to be sent out in the [Send Out Other Data] routine as previously described, and the routine returns 10120. Although not shown, a voice change offset could be further used to modify the voice change target or voice change data in a similar fashion to examples already provided.

Figure 102:
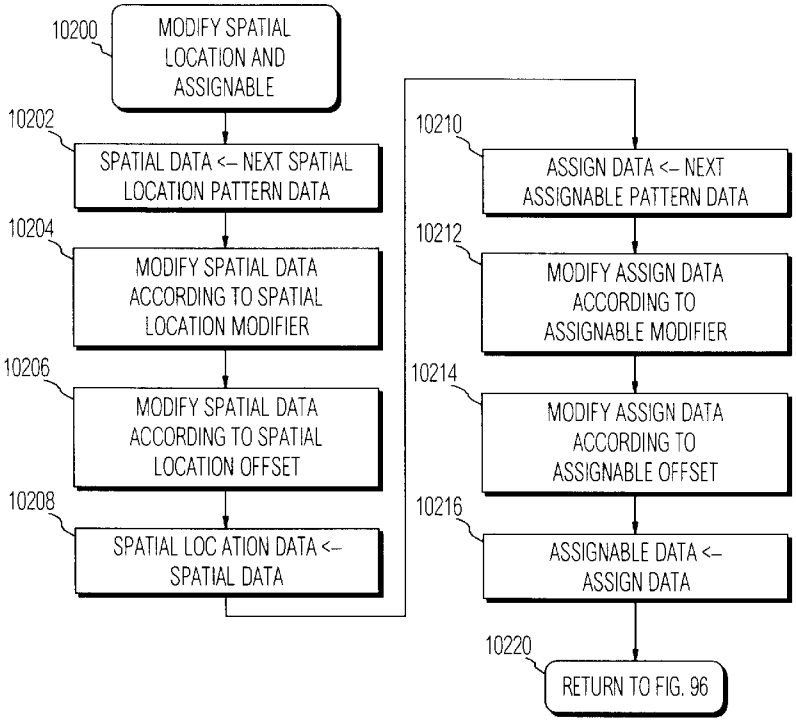
FIG. 102 is a flowchart showing the operation of a modify spatial location and assignable routine.

Returning to the [Repeat Note-On] routine of FIG. 96, execution proceeds to the [Modify Spatial Location/Assignable] routine 9620, shown in FIG. 102. This routine stores pre-calculated spatial location data using a spatial location pattern, spatial location modifier and spatial location offset, and stores pre-calculated assignable data using an assignable pattern, assignable modifier, and assignable offset, so that the next scheduled procedure call to the [Process Note-On] routine will cause the spatial location data and assignable data to be sent out.

A memory location spatial data receives the next data derived from the spatial location pattern 10202. This is done by using the stored spatial location pattern index to derive data from the spatial location pattern at the step indicated by the index, after which the index is advanced to another location. In this example the spatial data is arbitrarily a MIDI pan value. The value of spatial data may then be optionally modified by the spatial location pattern's associated spatial location modifier 10204. Again, in this example this is a percentage so that the values retrieved from the pattern may be compressed or expanded in real-time.

The value of spatial data may then be optionally further modified by an associated spatial location offset to cause an overall spatial movement over time 10206. In this example, this may be done by taking a predetermined or user determined spatial location offset, which may be positive or negative, multiplying it by the number of reps done, and adding it to the spatial data. The spatial data is then stored in the note-on location's spatial location data area 10208, where it will be sent out in the [Send Out Other Data] routine as previously described.

In the same fashion, a memory location assign data receives the next data derived from the assignable pattern 10210. In this example the assign data is arbitrarily a MIDI controller 17 value. The value of assign data may then be optionally modified by the assignable pattern's associated assignable modifier 10212. The value of assign data may then be optionally further modified by an associated assignable offset to cause an overall change over time 10214. The assign data is then stored in the note-on location's assignable data area 10216, where it will be sent out in the [Send Out Other Data] routine as previously described, and the routine returns 10220.

Returning to the [Repeat Note-On] routine of FIG. 96, at 9622 a new procedure call to this same [Process Note-On] routine (within which execution is currently happening) is scheduled in the future for (now time+repeat time), so that one or more note-ons will be put out some time in the future. (Repeat time was previously calculated in the [Calculate Repeat Time] routine according to the rhythm pattern.) When this occurs, the procedure will receive a pointer to this current note-on location, and will process the data contained therein again as has just been described. Then, reps done is incremented by "1" 9624, indicating that a repetition has been successfully completed, and the routine returns 9630. In this manner, the [Process Note-On Routine] ultimately calls itself over and over, scheduling the calls at timed intervals in the future according to the rhythm pattern.

If the terminate flag had been "yes" at 9604, 9608, 9612 or 9616, then the routine returns 9630 without any further repeated note-ons being scheduled for generation, and the repeated effect is thereby terminated. This concludes the description of the note-on processing chain.

NOTE-OFF PROCESSING CHAIN

A similar, although less complicated separate processing chain exists for note-offs. Since many of the steps are exactly the same and use the same routines as previously described, only the differences shall be described here.

The note-on processing chain starts with the [Process Note-Off] routine, which is either called directly (e.g. from within the [Allocate Note Location] routine in FIG. 84, 8420), or by scheduled procedure calls. It is passed a pointer to the address in memory of a note-off location, and those parameters and variables are used during processing. The memory locations of the parent note location can also be accessed. Note that this will therefore be inside a note location that has a corresponding note-on location that is undergoing the note-on processing chain just described. Therefore, unlike the previous description, the parameter and variable names that are not in the current parent note location are referring to variables and parameters in the note-off location, not the note-on location. For example, when a step indicates an operation such as "reps done+1," this means that the reps done value in the note-off location is being incremented, and not the corresponding same location in the note-on location, which was utilized by the note-on processing chain.

Figure 103:
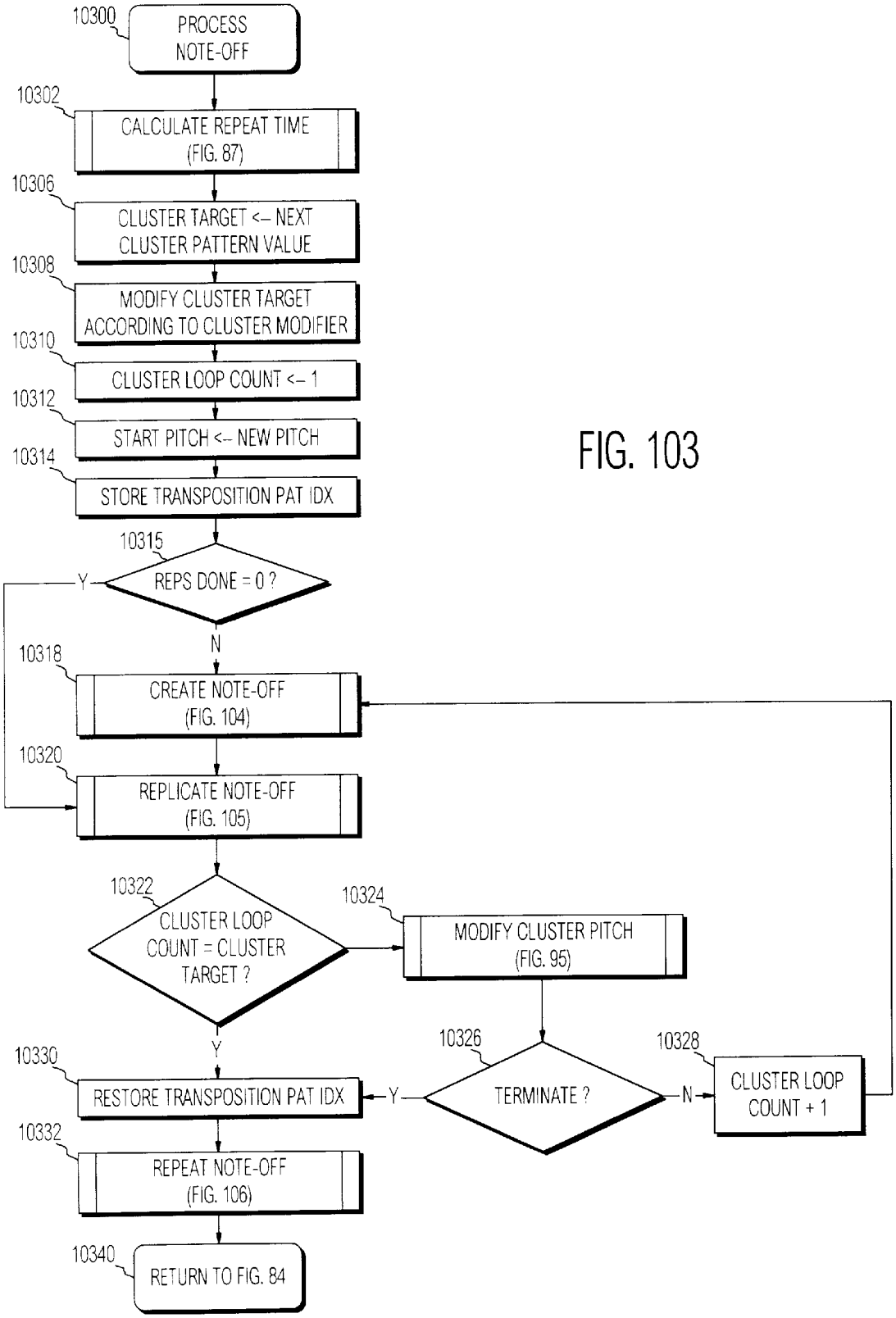
FIG. 103 is a flowchart showing the operation of a process note-off routine.

The [Process Note-Off] routine is shown in FIG. 103, which is nearly identical to the [Process Note-On] routine (FIG. 86), with the removal of several steps, and the substitution of several note-off routines for like-named note-on routines.

Steps 10302 through 10315 operate the same as 8602 through 8615 (with the exception that the procedures return to this procedure and utilize note-off location values), up until the [Create Note-Off] routine 10318.

Figure 104:
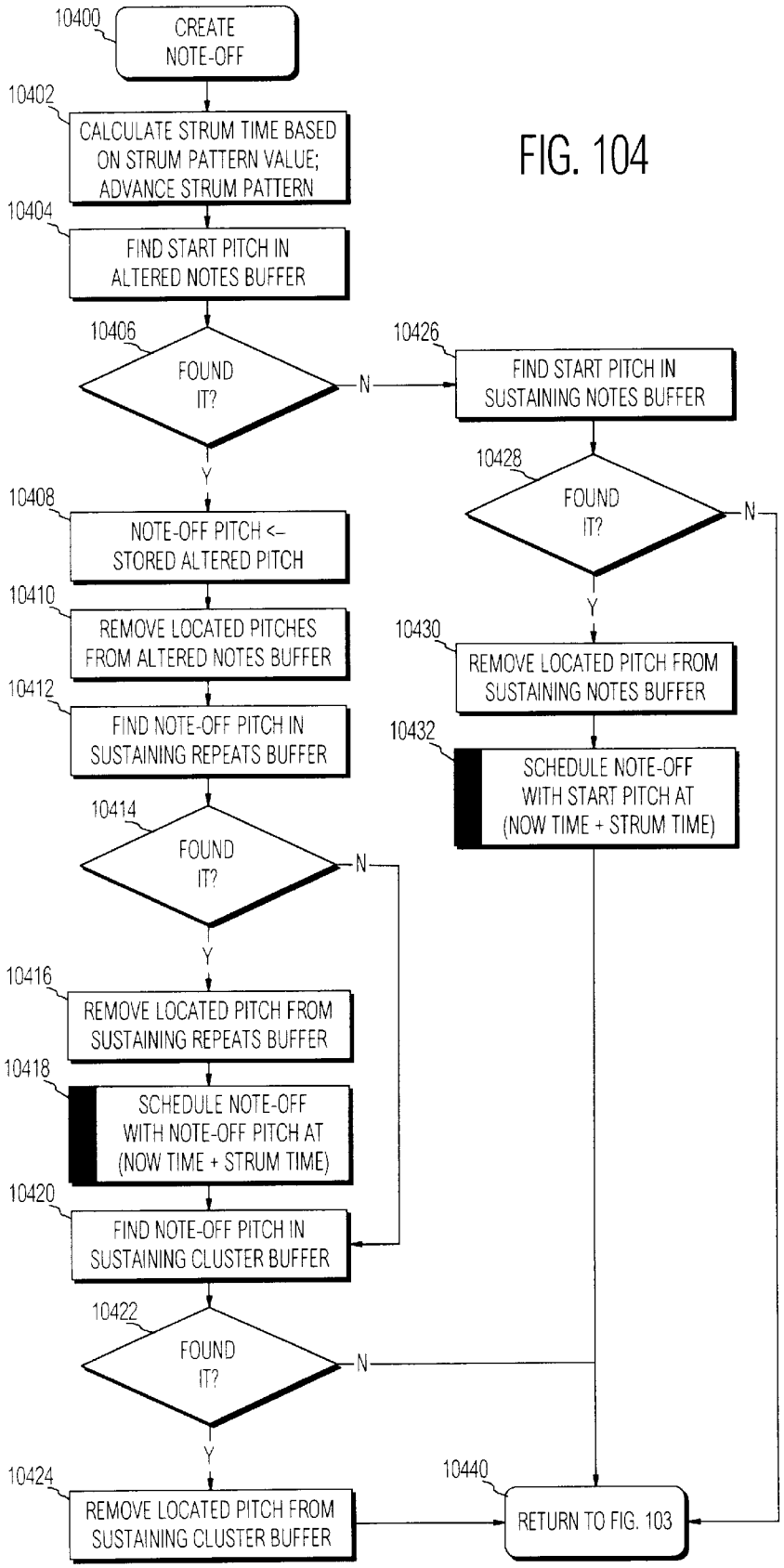
FIG. 104 is a flowchart showing the operation of a create note-off routine.

The [Create Note-Off] routine shown in FIG. 104 locates the current value of the pitch that is being processed in one of the buffers that has stored outgoing note-ons, and if located sends out a corresponding note-off with the correct pitch value. It also removes the note from the various buffers of sustaining notes if the note-on is sent out.

As already described for the [Create Note-On] routine, a strum time may be calculated for each note in the cluster (if the current cluster target is greater than 1) 10402. The current value of start pitch is then located in the altered notes buffer 10404. This is done by looping through all the stored pairs of values, and comparing the start pitch with the first value of each pair. If it is located 10406, a memory location note-off pitch receives the second value (stored altered pitch) 10408 associated with the located first value. The located pair of pitches are then removed from the altered notes buffer 10410. The note-off pitch is then located in the sustaining repeats buffer 10412. If found 10414, the pitch is removed from the buffer 10416, and a note-off with the note-off pitch is scheduled to be output at a time in the future of (now time+strum time) 10418. If not found 10414, or continuing from 10418, the note-off pitch is then located in the sustaining cluster buffer 10420. If found 10422, the pitch is removed from the buffer 10424, and the routine returns 10440. If not found at 10422, the routine also returns.

If the start pitch was not located in the altered notes buffer 10406, it is then located 10428 in the sustaining notes buffer 10426. If not located, the routine returns 10440. If located, the pitch is removed from the buffer 10430, and a note-off with the start pitch is scheduled to be output at a time in the future of (now time+strum time) 10432. The routine then returns 10440 to the [Process Note-Off] routine of FIG. 103, where the [Replicate Note-Off] routine is then entered 10320.

Figure 105:
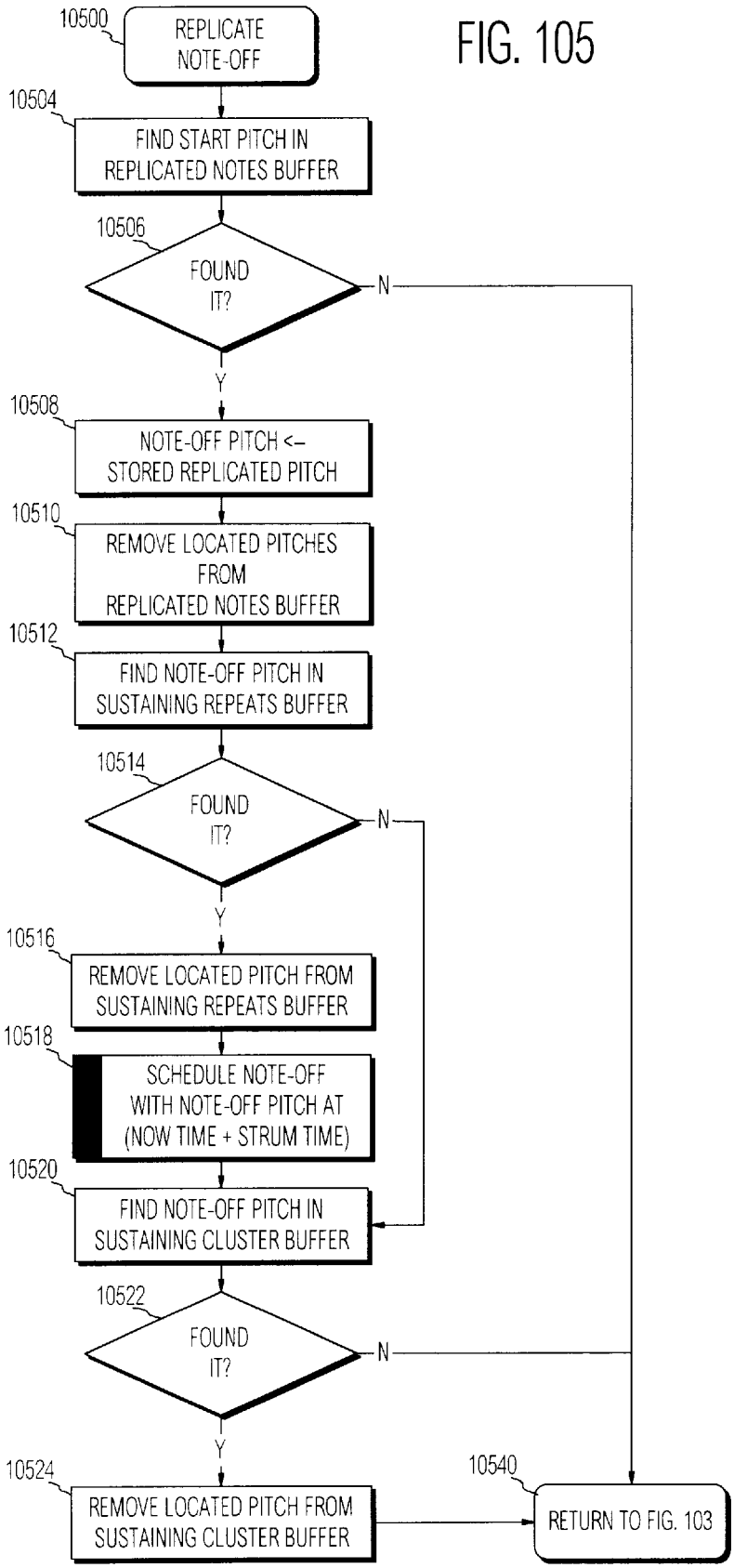
FIG. 105 is a flowchart showing the operation of a replicate note-off routine.

The [Replicate Note-Off] routine shown in FIG. 105 operates in a similar fashion to the routine just described. In particular, the routine locates the current value of the pitch that is being processed in the replicated notes buffer, and if located, sends out a corresponding note-off with the correct pitch value. It also removes the note from the various buffers of sustaining notes if the note-on is sent out.

The current value of start pitch is located in the replicated notes buffer 10504. This is done by looping through all the stored pairs of values, and comparing the start pitch with the first value of each pair. If it is located 10506, a note-off pitch value in memory receives the second value (stored replicated pitch) 10508 associated with the located first value. The located pair of pitches are then removed from the replicated notes buffer 105 10. The note-off pitch is then located in the sustaining repeats buffer 10512. If found 10514, the pitch is removed from the buffer 10516, and a note-off with the note-off pitch is scheduled to be output at a time in the future of (now time+strum time) 10518. If not found 10514, or continuing from 10518, the note-off pitch is then located in the sustaining cluster buffer 10520. If found 10522, the pitch is removed from the buffer 10524, and the routine returns 10540. If not found 10522 or 10506 the routine also returns.

Returning to the [Process Note-Off] routine of FIG. 103, steps 10322–10330 again operate in the same fashion as FIG. 86, steps 8622–8630, except the loop consisting of the steps 10318 through 10328 sends out as many note-offs as are required by the cluster target (not note-ons), and the routines return to this procedure. Again, the memory locations utilized during processing belong to the note-off location, not the note-on location. Since the note-on location and the note-off location each maintain separate pattern indexes, this routine will access patterns like the cluster pattern in the same order as they were accessed by the [Process Note-On] routine previously described.

Once the cluster loop has completed 10322, and the transposition pattern index optionally restored 10330, the [Repeat Note-Off] routine is entered 10332, after which the routine is finished 10340.

Figure 106:
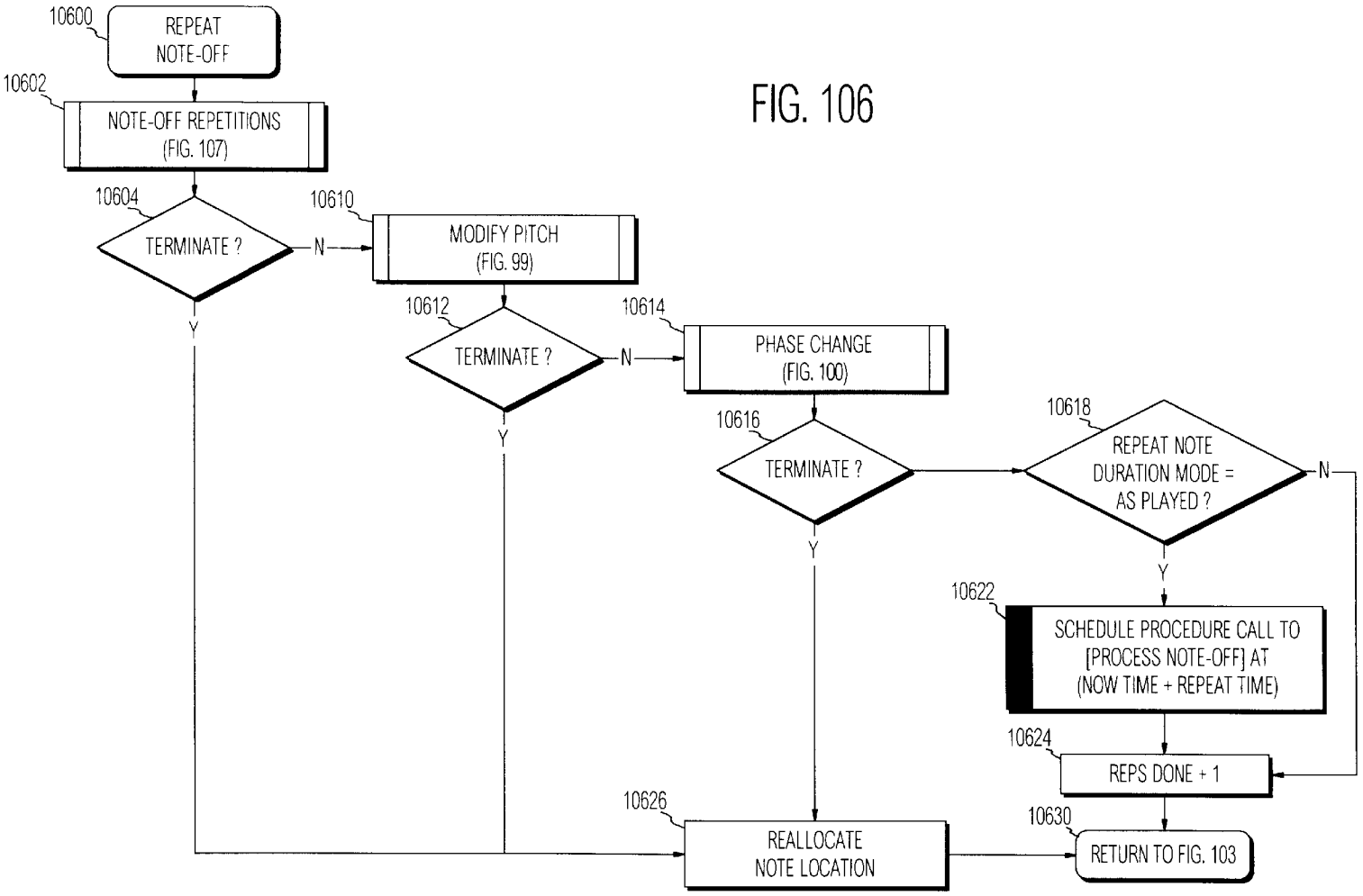
FIG. 106 is a flowchart showing the operation of a repeat note-off routine.

The [Repeat Note-Off] routine shown in FIG. 106 is where a number of changes will be performed to the data stored in the note-off location in a similar fashion to changes which were made to the data in the note-on location by the [Repeat Note-On] routine. After these changes, another call to the [Process Note-Off] routine that is currently being described will occur at a point in the future, and the precalculated values then sent out or used as already described. Therefore, the [Process Note-Off Routine] ultimately calls itself over and over, scheduling the calls at timed intervals in the future according to the rhythm pattern. Within the [Repeat Note-Off] routine, several options for terminating the effect are also provided, so that future calls to the [Process Note-Off] routine will not occur and the effect will end. Referring to FIG. 106, the first step is to enter the [Note-Off Repetitions] routine 10602.

Figure 107:
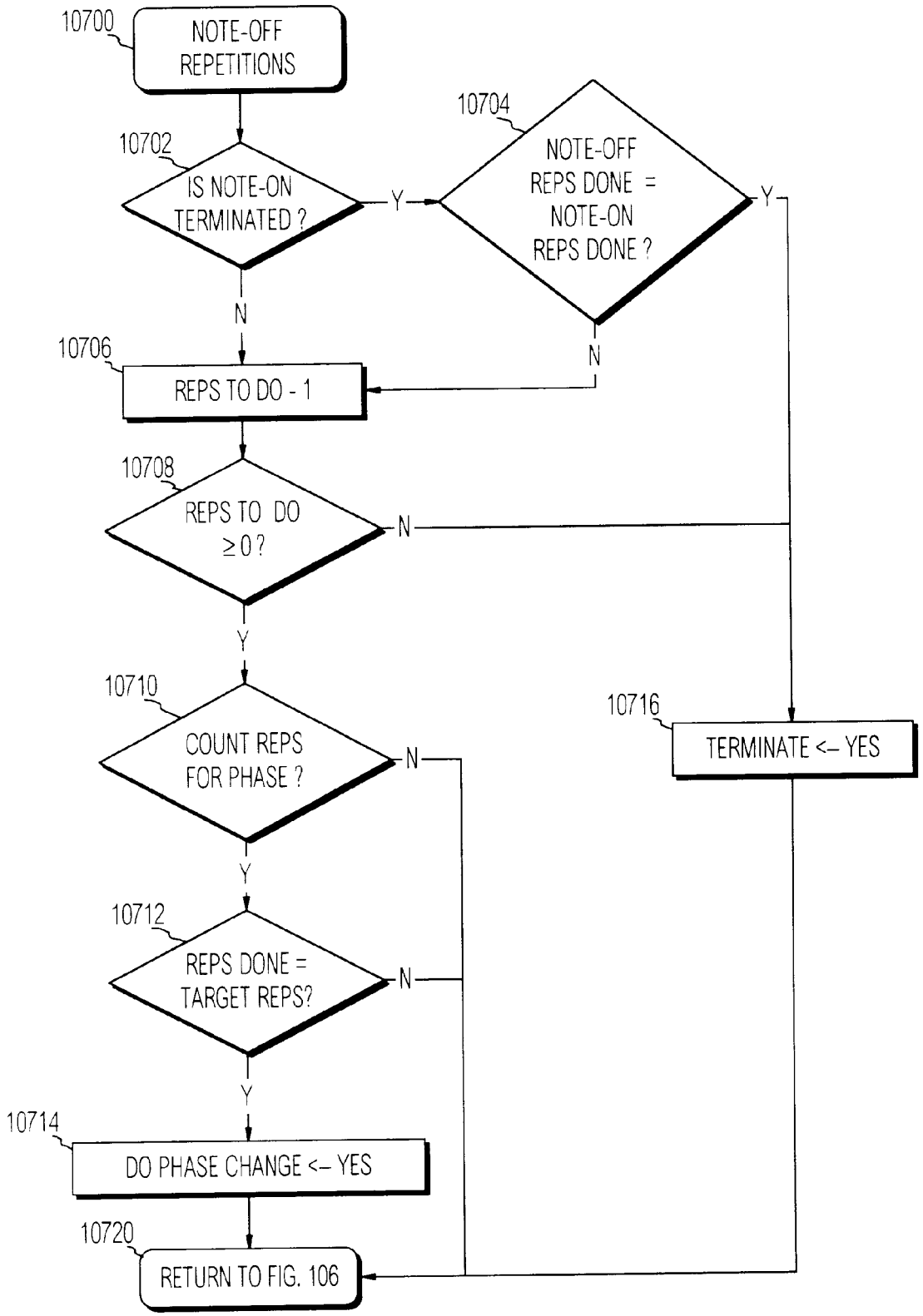
FIG. 107 is a flowchart showing the operation of a note-off repetitions routine.

The [Note-Off Repetitions] routine shown in FIG. 107 counts the number of repetitions that have been completed, and if the required number has been met, provides for eventual termination of the effect. It also allows a certain number of completed repetitions to signal an upcoming phase change. It is first checked whether the corresponding note-on location's terminate flag is set to "yes" 10702. (This will be the note-on location within the same parent note location that the current note-off location is in.) The note-on's terminate flag may have been set to "yes" as a result of one of the operations previously described in the note-on processing chain. If it was terminated, then the note-off processing chain must be terminated at the same number of repetitions. Therefore, it is checked whether the note-off location's reps done value is equal to the note-on location's reps done value 10704. If so, then the note-off processing chain can be terminated by setting the note-off location's terminate flag to "yes" 10716, and the routine returns 10720. If the same number of repetitions has not yet been completed 10704 or the note-on's terminate flag is not "yes" 10702, then steps 10706–10720 are performed in the same fashion as steps 9706–9720 of FIG. 97 (the [Note-On Repetitions] routine). The only difference is that the memory locations being described reside in the note-off location.

Returning to the [Repeat Note-Off] routine of FIG. 106, if the terminate flag has not been set to "yes" 10604, execution passes to the [Modify Pitch] routine 10610, which operates in the same fashion as previously described in FIG. 99, except that the memory locations being described reside in the note-off location and the routine returns to this procedure. If the terminate flag has not been set to "yes" after the [Modify Pitch] routine 10612, execution passes to the [Phase Change] routine 10614, which operates in the same fashion as previously described in FIG. 100, except that the memory locations being described reside in the note-off location and the routine returns to this procedure.

If the terminate flag is not set to "yes" after the [Phase Change] routine 10616, the repeat note duration mode is checked 10618. If it is not "as played" (meaning a duration pattern is being used), then it is not necessary to schedule a new procedure call at this time since that will have been handled in the [Schedule Note-Off] routine (FIG. 88, step 8820). This contributes to achieving the duration effects (4) through (8) of FIG. 79 (for repeated notes). Reps done is then incremented by "1" 10624, indicating that a repetition has been successfully completed, and the routine returns 10630.

If the repeat note duration mode is "as played" 10618, then note-off processing is being dealt with inside this routine. A new procedure call to this same [Process Note-Off] routine (within which execution is currently happening) is scheduled in the future for (now time+repeat time) 10622, so that one or more note-offs will be put out some time in the future. When this occurs, the procedure will receive a pointer to the current note-off location, and will process the data contained therein again as has just been described. This contributes to achieving the duration effects (1) through (3) of FIG. 79 (for repeated notes). Then, reps done is incremented by "1" 10624 and the routine returns 10630. In this manner, the [Process Note-Off Routine] ultimately calls itself over and over, scheduling the calls at timed intervals in the future according to the rhythm pattern.

If the terminate flag had been "yes" at 10604, 10612, or 10616, then the note-off processing chain (and corresponding note-on processing chain) is completed for this note location, and it is reallocated for use 10626. This is done by removing it from the in use list, and setting its reserved flag to "no," indicating it is again available. The routine then returns 10630 and no further repeated note-offs are scheduled for generation.

EXAMPLE OF GENERATING A REPEATED EFFECT

Figure 108:
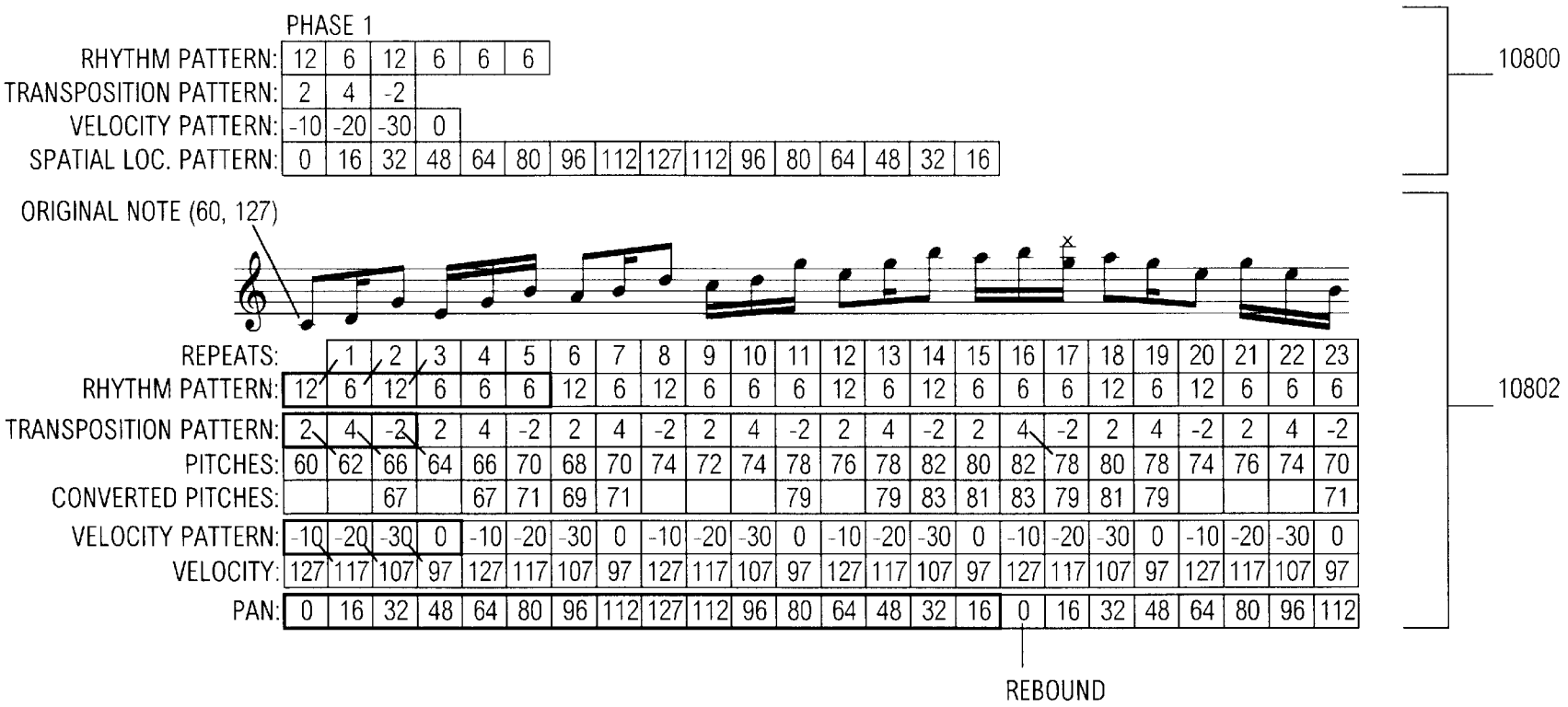
FIG. 108 is an example of the process of generating a repeated effect.

FIG. 108 is a diagram showing an example of the generation of a repeated effect according to the previously described process. A single phase consisting of a variety of patterns are shown 10800. These are not necessarily representations of the exact patterns, since specific value patterns or random pool patterns could be utilized; rather, these are the values that will be derived from the patterns during processing. For purposes of clarity, the cluster pattern is not shown, and may be assumed to be the value {1} or to not be utilized at all, so that only one note at a time is generated. Also, other various patterns are not included in this example for clarity although they could have been utilized. The transposition direction previously described is assumed to be 1, so that transposition pattern values are utilized without inversion.

The input of an original note with a pitch of 60 and a velocity of 127 is shown 10802. The resulting rhythm and pitches for 23 repetitions are shown in musical notation and chart form. As previously described, this input note reserves a note location and initializes the values. As shown in the column beneath the original note, the original pitch and velocity are then sent out, along with the first value of the spatial location pattern (in this example a MIDI pan value). The first rhythm pattern value of 12 is calculated (an 8th note at 24 cpq), the first value of the transposition pattern 2 is used to modify the pitch to 62, and the first value of the velocity pattern −10 is used to modify the velocity to 117. The first repeat is then scheduled to be output an 8th note in the future. When repeat one is therefore generated, the pitch, velocity, and pan values shown in the column beneath it are first put out. Then, the next value of transposition pattern modifies the pitch, the next velocity pattern value modifies the velocity, and the next rhythm pattern value is used to schedule the output of the note in the future, this time a 16th note.

The converted pitches row shows the optional use of a conversion table. At repeat 2, when the pitch is to be output, a conversion table is utilized to constrain the pitches to a certain scale or chord, as previously described. In this example, a table corresponding to a C Major scale is utilized, in the form {0, 0, 2, 4, 4, 7, 77, 9, 9, 11, 11}. Therefore, the repeated pitch of 66 is reduced to a pitch class of 6 in the 5th octave, the 6th value in the table 7 is retrieved, the value is placed back in the 5th octave and the note 67 is issued.

In this example, it has been arbitrarily decided that a minimum pitch of 24 and a maximum pitch of 84 will be used to cause the effect previously described as a pitch mode of "rebound". At repeat 16, when the pitch is modified by the next value of the transposition pattern 4, it would become 86, which is greater than the maximum pitch. This results in the transposition direction being flipped, and the transposition pattern value is thereby inverted to −4, and the pitch becomes (82+−4)=78. From that point forward, the transposition pattern values are inverted at each repeat, with the pitches now traveling in a downward direction.

While this example uses a modify transposition pattern according to the conventions employed herein, as previously described an absolute transposition pattern may be used, so that the pitch of the input note(s) that start the repeating effect are not stored or taken into account whatsoever. For example, if the absolute transposition pattern were {60, 64, 67, 71}, then the effect would start with the pitch 60 being issued regardless of what the input note was, with each repeated note using the next pitch in the transposition pattern.

DETAILED DESCRIPTION OF ANOTHER EMBODIMENT OF GENERATING A REPEATED EFFECT

Another embodiment of generating a repeated effect provides a means for storing the input notes as they are received, and selectively allowing several different types of actions to trigger or repeatedly trigger the start of the repeated effect with the stored input notes, or terminate the repeated effect.

Triggering means have already been explained in detail. Only the differences as they apply here will be discussed. The present embodiment provides for several additional trigger modes that can be set to utilize the same type of trigger events as previously described during the reading out of data:

start trigger mode: start the repeated effect.

terminate trigger mode: stop the repeated effect.

Figure 109:
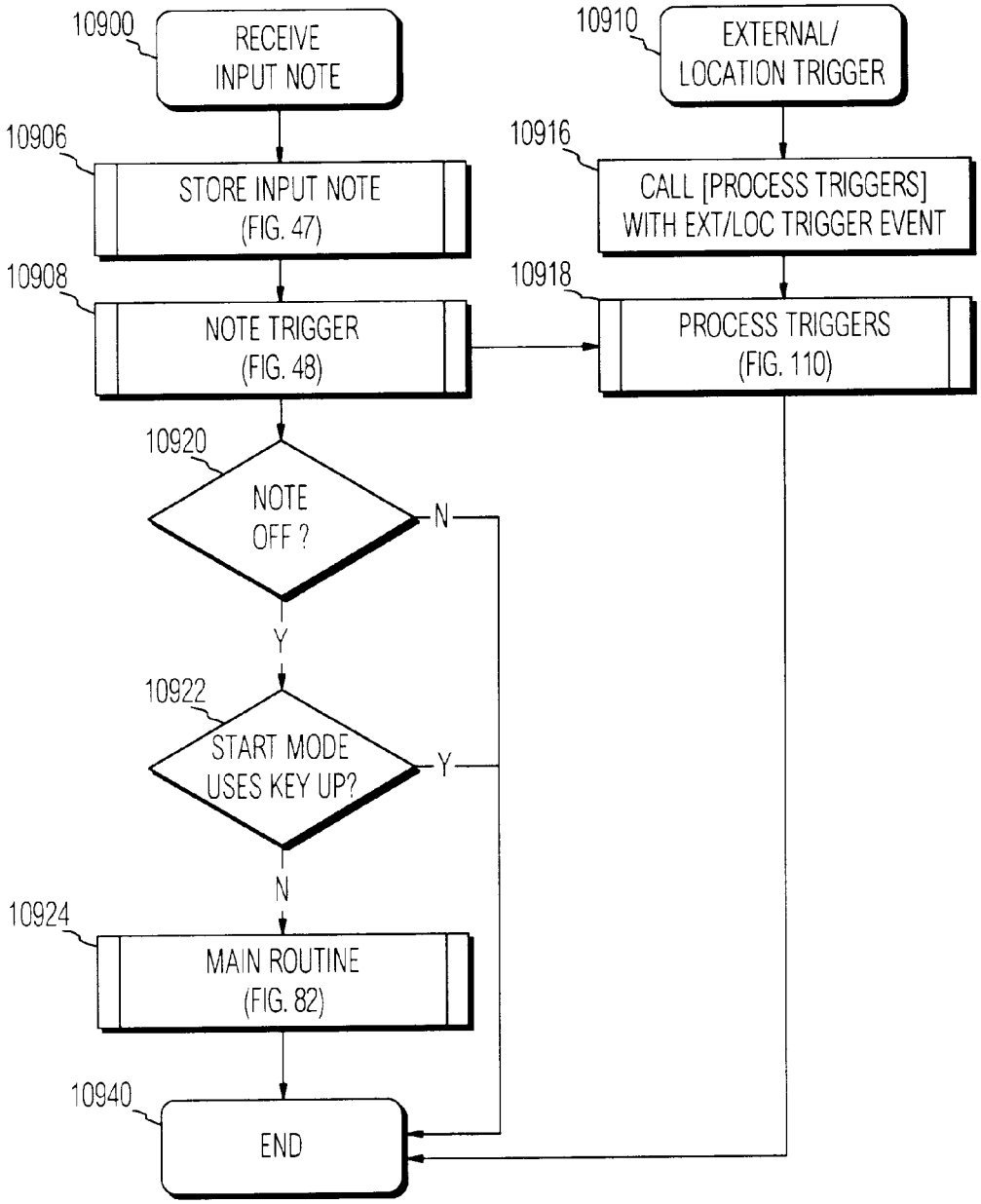
FIG. 109 is a flowchart showing the process of generating a repeated effect according to a second embodiment.

The [Receive Input Note] routine is shown in FIG. 109. Steps 10906, 10908, 10910 and 10916 are performed in the same fashion as previously described in FIG. 46, 4606, 4608, 4610, and 4616, with the exception that all flowchart diagrams return to this procedure. As a result, the [Process Triggers] routine 10918 (which is different for this embodiment) may have been called with one or more trigger events, starting or stopping the repeated effect under the proper circumstances.

Figure 110:
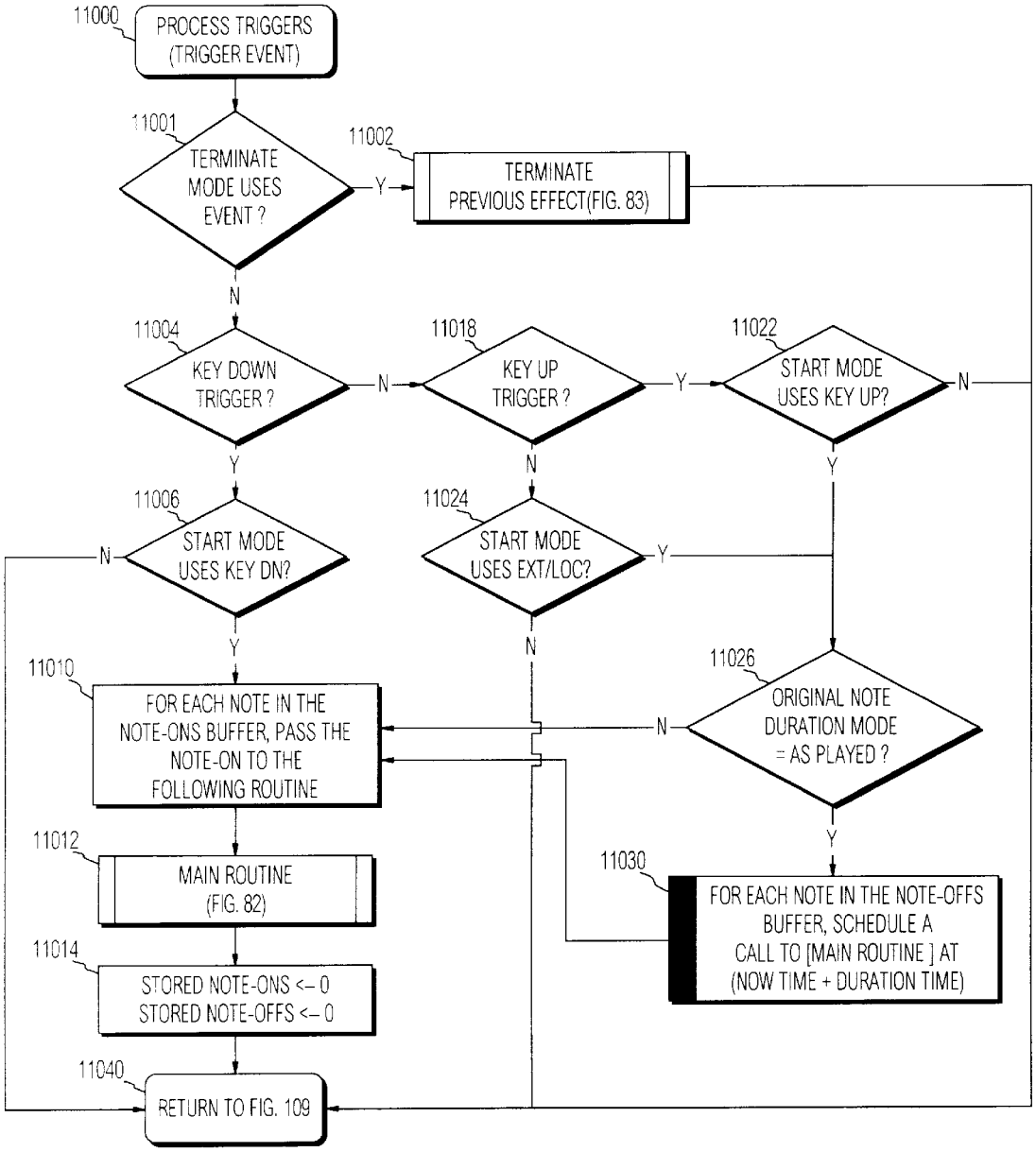
FIG. 110 is a flowchart showing the operation of a process triggers routine.

As shown in FIG. 110, the [Process Triggers] routine is called with one of the trigger event types 11000. If the terminate trigger mode uses the trigger event type 11001, the previously described [Terminate Previous Effect] routine is called 11002. This would be performed as previously described, with the exception of skipping step 8302, FIG. 83. After this, the routine is finished 11040. The effect may alternately be terminated by looping through every note location in the in use list, and setting the note-on location's terminate flag to "yes." This would have the effect of allowing the note-off processing chains to continue for a time as previously described, preserving the intended durations rather than immediately ending all notes.

If the terminate trigger mode does not utilize the event type 1100, it is checked whether a key down trigger event called the routine 11004. If so, it is checked whether the start trigger mode utilizes key down events 11006. If not, the routine ends with no starting of the effect taking place 11040. If the key down events are utilized, the [Main Routine] of FIG. 82 is called with each note-on currently in the note-ons buffer being sent as the input notes 11010–11012. In this manner, repeated effects may be started for each of the notes in the buffer. After this, the note-ons buffer and note-offs buffer can be optionally reset by setting stored note-ons and stored note-offs to "0" 11014. It could also be arranged that the reset of the buffer was accomplished by other means, so that more note-ons and note-offs could be added to those already stored, and this routine called again. In this manner, note-ons are only allowed to trigger the start of the repeated effect if the start trigger mode utilizes key down trigger events, and a key down trigger has been determined.

If it was not a key down trigger event 11004, it is checked whether the routine was called by a key up trigger event 11018. If so, it is checked whether the start trigger mode utilizes key up events 11022. If not, the routine ends with no starting of the effect taking place 11040. If key up events are being utilized, the original note duration mode is then checked 11026. If it is "as played," then the durations of the stored note-offs will be used to generate note-offs for the stored note-ons 11030. This is done by scheduling a call to the [Main Routine] at (now time+duration time) for each note currently in the note-offs buffer. When the routine is eventually executed one or more times, it will be passed pointer(s) to the note-on(s) and use them as the input note(s). The duration time is calculated by locating the same pitch in the note-ons buffer, and subtracting the note-on time stamp from the note-off time stamp, giving each note the duration with which it was originally played. Alternately, it can be calculated by finding the durations of all of the note-offs in the buffer using the same method, and selecting the shortest, longest, or average value. The resulting duration can then be used so that all calls to the [Main Routine] are scheduled to happen at the same time. After this, or if the original note duration mode is not "as played" 11026, the [Main Routine] is called for all note-ons in the note-ons buffer as previously described 11010–11012, the buffers are optionally reset 11014, and the routine ends 11040. In this manner, note-offs are only allowed to trigger the start of the repeated effect if the start trigger mode utilizes key up trigger events, and a key up trigger has been determined.

If this procedure was not called by a key up trigger 11018, it is assumed that an ext/loc trigger event was received, and it is checked whether the start trigger mode utilizes ext/loc trigger events 11024. If not, the routine ends with no starting of the effect taking place 11040. If ext/loc trigger events are being utilized, the routine continues from step 11026 as previously described. In this manner, the receipt of external or location triggers can start the repeated effect, but only if the start trigger mode utilizes ext/loc trigger events.

It could also be configured so that both key down trigger events and key up trigger events are used at the same time. In this case, it could be configured so that the note-ons buffer and note-offs buffer were only reset after a key up trigger was determined, or vice versa. It could also be configured that any combination of the three trigger event types could be used at the same time, and that each method selectively did or did not reset the note-ons buffer and note-offs buffer (so that the same effect can be repeatedly triggered).

Returning to the [Receive Input Note] routine of FIG. 109, if a note-off has called the routine 10920, it is checked to see if the start trigger mode utilizes key up trigger events 10922. If so, then note-offs have already been sent to the [Main Routine] as previously described, and the routine is finished 10940. If the key up trigger events are not being utilized, then the actual note-off may still need to be received, and it is sent to the [Main Routine] 10924. The main routine will ignore note-offs for note-ons it has not received.

A modification to one of the routines previously described in the first embodiment is desirable for the second embodiment. The Calculate Repeat Time] routine (FIG. 87) would be modified with the addition of several tests. For example, if the start trigger mode is utilizing key up trigger events, then the start of the effect will happen on the release of the keys or buttons. In this case, the repeat time calculated in FIG. 87 would be set to 0 for the first repetition only, so that it happens immediately. This is because the original note-ons would already have been sent out by the note-ons (key downs). Therefore when releasing the keys and causing the start of the effect, it is desirable to hear the first repeat immediately.

Although not shown in this description, the starting and releasing of various envelopes may be achieved through the triggering means in the same fashion as previously described during the reading out of the data. The [Process Triggers] routine here can have steps similar to the [Process Triggers] routine of FIG. 54 which deal with the selective triggering of envelopes. In this case, the step of starting envelopes in the [Allocate Note Location] routine may be skipped (FIG. 84, 8407). The [Phase Change] routine of FIG. 100 may include an additional step whereby the [Process Triggers] routine is called with phase trigger events, in the same fashion as FIG. 55, step 5579. Furthermore, the additional steps of testing for key down conditions of FIG. 54 may also be included in this embodiment.

DETAILED DESCRIPTION OF ANOTHER EMBODIMENT OF GENERATING A REPEATED EFFECT

Rather than using the starting pitch of the input note, and then transposing it with each repetition according to a transposition pattern, the pitch of the input note is used to find a location in a pitch table of stored musical pitches, which may be selected from a plurality of pitch tables in memory. The means of selecting the table could be one or more of the following: the operation of a chord analysis routine on input notes, or on a certain range of input notes; the operation of a chord analysis routine on an area of a musical controller such as a keyboard or guitar; the operation of a chord analysis routine performed on sections of a background track of music; markers stored at various locations in a background track of music; or user operations.

If the pitch does not exist in the table, the nearest one in either direction may be chosen. Alternately, some other method of locating a suitable starting point may be used, such as finding the nearest note in either direction with the same pitch class (determined by modulo 12 division). From that start index, either an index can be moved sequentially backwards and forwards through the table, or an index pattern as previously described in other embodiments is used to move to a different location in the table, and a note with the pitch selected at that location in the table will be produced as the next repeated note. This may be done by storing the start index in the note-on and note-off locations, rather than the original pitch.

Figure 111:
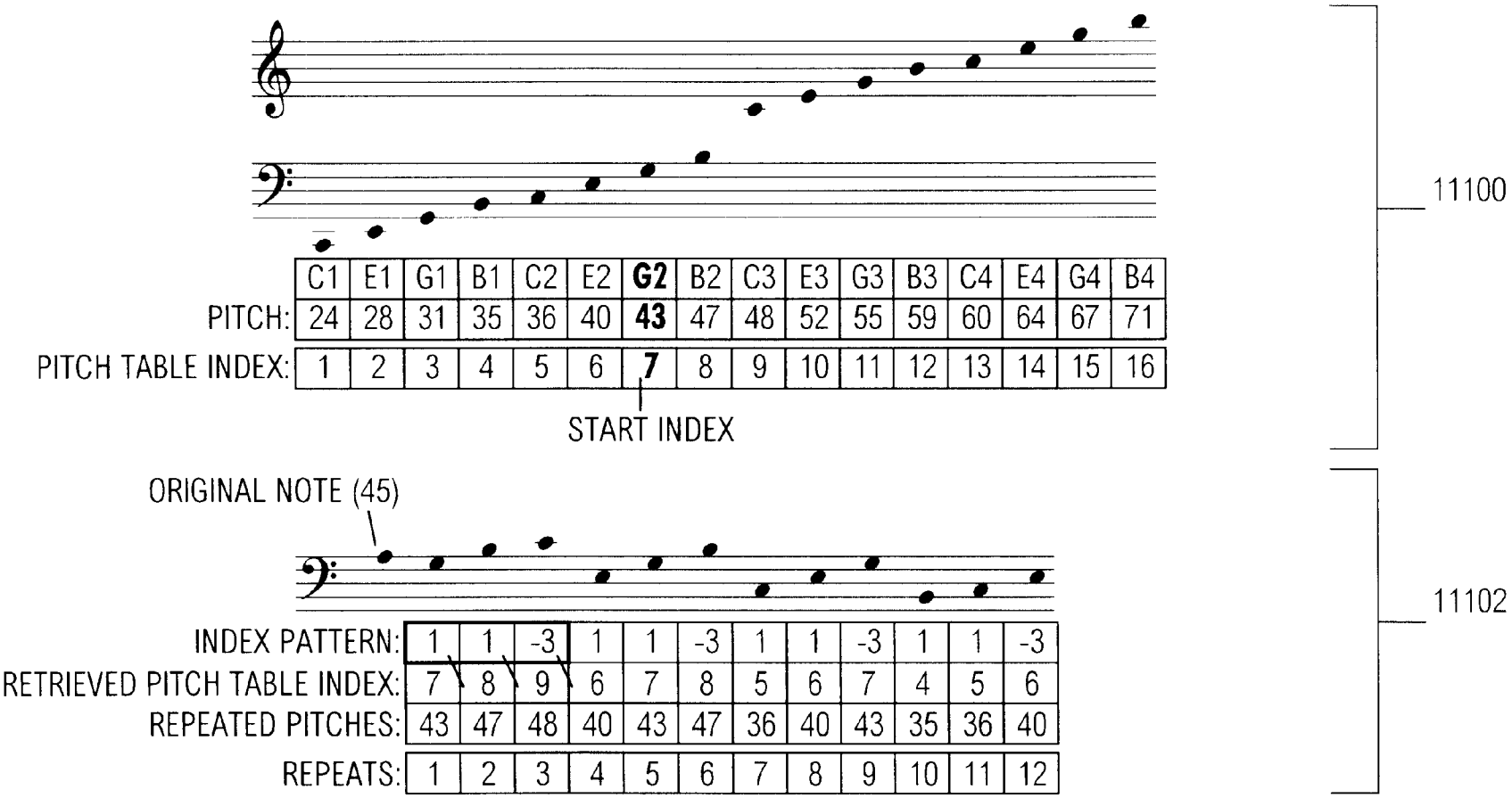
FIG. 111 is an example of generating a repeated effect according to a third embodiment.

FIG. 111 shows an example pitch table, comprised of 16 steps 11100, indicating a four octave CMaj7 arpeggio shown in musical notation. This example only explains the use of the pitch table and index pattern, so other patterns and parameters used during processing are not shown.

The input of an original note with a pitch of 45 is shown 11102. Since 45 does not exist in the pitch table, the nearest pitch is located. In this case, both 43 and 47 are 2 semitones away. It has arbitrarily been decided in this example to select the lower of the two when there are two possibilities. Therefore, pitch table index 7 with the value 43 is the start index 11100.

As shown in 11102, the input note is produced immediately as played. The start index is stored in the note location, and the first repeat is scheduled. An example of values derived from an index pattern {1, 1, −3} is shown. When the first repeated note is generated, the stored index of 7 is used to retrieve the pitch 43 which is then sent out. The first value of the index pattern 1 is then used to modify the index to 8, and the next repeat is scheduled. At repeat 2, the pitch at index 8 of the pitch table is retrieved and sent out, the next value of the index pattern is used to modify the stored index, and so on.

Alternately, the start index could be used to replace the original input note, so that the original pitch is not put out, but the nearest located pitch in the pitch table. In this example, the pitch 43 at the start index 7 would be put out immediately instead of the original pitch, the index 7 would be modified immediately by the next index pattern value, the first repeated note would retrieve the pitch at index 8, and so on.

All other operations of producing the repeated notes may be performed as previously disclosed. Furthermore, in this example the index pattern could indicate absolute distances from the start index, rather than traveling distances, as was also previously disclosed. Alternately, the use of an index pattern may be omitted, and a constant positive or negative value added to move the index around (e.g. 1, or 2, or −1).

GENERATING A REPEATED EFFECT WITH DIGITAL AUDIO

In a similar fashion to the methods described during the creation of a digital audio notes series, and the reading out of data from a digital audio note series, a repeated effect may also be generated using digital audio data, by any of the preceding embodiments of generating a repeated effect.

An example system utilizing an electric guitar with a hex pickup has already been described, whereby a number of discrete channels of digital audio data are recorded into separate DALs. When generating a repeated effect utilizing the digital audio data, the system also provides for a number of playback voices, which can be the same as the number of DALs, but is generally a higher number. The digital audio in each DAL buffer is capable of being played back by one or more playback voices at the same time, at different pitches and amplitudes.

Rather than an input note-on being used as previously described, the start of a note is used (as determined by an input note exceeding a predetermined amplitude threshold). Rather than an input note-off indicating the end of a note, and the subsequent duration of that note, the end of the input note is used (as determined once again by the volume of the input note passing below a predetermined amplitude threshold). Alternately, rather than using amplitude to determine the start and the end points for recording, a user operated key, button or switch can be used, or a marker or data location in a pre-recorded background track of music.

When audio is received on a particular channel as an input note, if a note start has been indicated, the start of recording the digital audio data into the DAL is begun. A running average velocity may be calculated and constantly updated, and stored in a location as the velocity of the note (although in this case it could be either the peak amplitude received so far, or the average amplitude of the recording so far). When a note end is received on that particular channel, the recording of the digital audio data in that particular DAL is ended, and the duration is stored (in this case, the length of the digital audio recording in milliseconds).

At the start of the repeated effect, the original pitch and velocity are analyzed from the digital audio as previously described and stored in the note location, along with the associated dal id of the DAL where the audio data is being recorded. Then, the note-on processing chain is utilized to initiate instances of playback of the digital audio data in the DAL indicated by the dal id, utilizing one or more of the playback voices. The note-off processing chain (in conjunction with the note-on processing chain) is utilized to end instances of playback of the digital audio data. The differences between the original pitch and the new pitch at each repeat may be used to pitch-shift the digital audio data, and the differences between the original velocity and the new velocity at each repeat may be used to vary the volume of the playback voice. Both operate as previously described in the reading out of data. Therefore, for all of the places in the preceding descriptions where note-ons and note-offs are used, the steps can be modified to refer to the start and end of playback of digital audio data.

The previous discussions of generating a repeated effect have shown a majority of values being precalculated and modified in advance, after which a call to a procedure is scheduled in the future. The precalculated data is then sent out, and the values are once again precalculated in advance for the next repetition. It could alternately be done by having the values calculated at the time the procedure call is actually made, before any data is sent out, after which the data is sent out and a call to the procedure is again scheduled in the future.

Automatic pitch-bending effects discussed in prior embodiments may also be utilized in conjunction with the generation of a repeated effect. In this case, the [Start Pitch Bend] routine of FIG. 70 may be inserted into the [Process Note-On] routine of FIG. 86, between steps 8604 and 8606.

While the examples show each pattern using its own pattern index, patterns may use the index of another pattern, so that one or more patterns are locked at the same position in processing. This is particularly useful if the rhythm pattern being utilized is a random tie rhythm pattern. As the randomly chosen ties cause the rhythm pattern to skip indexes as previously described, other patterns using the rhythm pattern index instead of their own index will track the position of the rhythm pattern and therefore maintain a logical correspondence.

While the examples shows the use of a phase pattern, a user may directly specify a phase change and/or a new phase to change to, in which case the do phase change flag will be set to "yes". A user specified choice of phase or the next phase pattern derived value may be employed. Alternately, the use of a phase pattern may be omitted if desired, with all phase changes occurring due to user actions and choices.

The examples show a system clock running in 1 ms increments, and the calculation of a millisecond time in the future at which to schedule the next call to a procedure which produces a note, and other such calculations. The examples can be easily modified to produce the same results with a system clock that does not run in absolute time increments, but one in which the clock occurs a number of times per beat, for example 24 clocks per quarter (MIDI Clock), or 96 clocks per quarter (another popular resolution). In this case, the time calculations would be modified to calculate a number of clocks at the current resolution, events would be scheduled a number of clock ticks in the future, and the CPU's event loop would check the task list of events to be processed every tick of the system clock.

ELECTRONIC MUSICAL INSTRUMENTS

Figure 112:
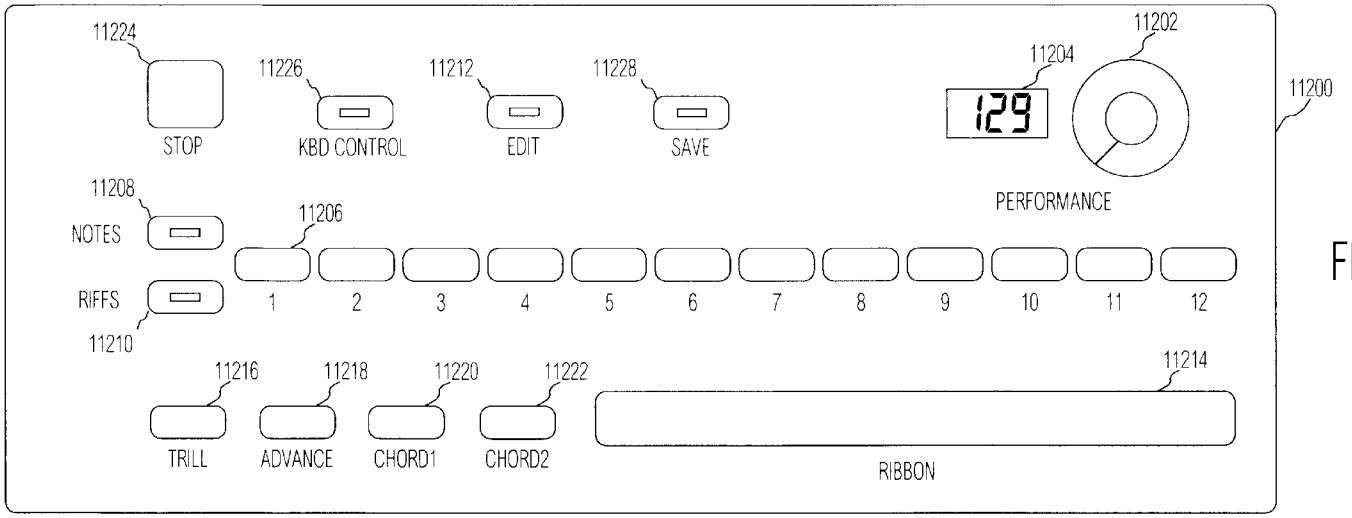
FIGS. 112 and 113 are diagrams of user interfaces for two versions of an electronic musical instrument.

FIG. 112 is a diagram of a control panel of an electronic musical instrument 12000 using the processes described herein. A keyboard or other MIDI or musical code generating device may be attached as an input device. A rotary dial 11202 selects from one of many stored groups of settings which loads various parameters and patterns into the memory. An LED display 11204 shows the current performance number, and other information depending on the mode of operation.

Twelve effect buttons (1 through 12) 11206 have several different functions depending on the mode of operation, which is selected by a notes mode button 11208, a riffs mode button 11210, and/or an edit button 11212. LEDs on the panel can indicate which of these have been selected.

In the riffs mode, the twelve buttons 11206 each change a preselected group of parameters in memory to different values and set a flag allowing the counting of clock events to start (or resume), thereby triggering an effect which reads data out of one or more note series according to the settings in memory. In the notes mode, the twelve buttons 11206 perform the reading out of data using the direct indexing method, thereby selecting individual notes from the note series for generation. In the edit mode, the twelve buttons 11206 allow selection of various individual parameters or groups of parameters for editing by the user, in conjunction with the rotary dial 11202 and display 11204. A ribbon controller 11214 performs the direct indexing method as a MIDI controller, thereby sweeping through the note series.

A trill button 11216, when used in the notes mode, provides a trill centered around the last pressed effect button 11206 to be generated by repeatedly performing the direct indexing method with that button's value (which as previously described can alter repeated indexes to adjacent indexes). In the riffs mode, the trill button causes the currently generating effect to cycle around adjacent note series indexes at the current location rather than continue advancing, by utilizing only a portion of the note series.

An advance button 1218 stops the internal or external master clock that is generating clock events and generates one or more clock events each time it is pressed, manually advancing the reading out of the data. Two chord buttons 11220 and 11222 perform the direct indexing method as direct index chords, sending pre-configured groups of values to the direct index routine.

A stop button 11224 stops the processing of data by suspending the counting of clock events. A keyboard control button 11226 allows the keys and controllers of an external keyboard to be used in place of or in addition to the effect buttons, the trill advance, chord 1, and chord 2 buttons, thereby allowing the keys of the keyboard to perform the direct indexing method. A save button 11228 allows the saving of any changes made by the user to the same or a different memory location, in conjunction with the rotary dial and display.

Figure 113:
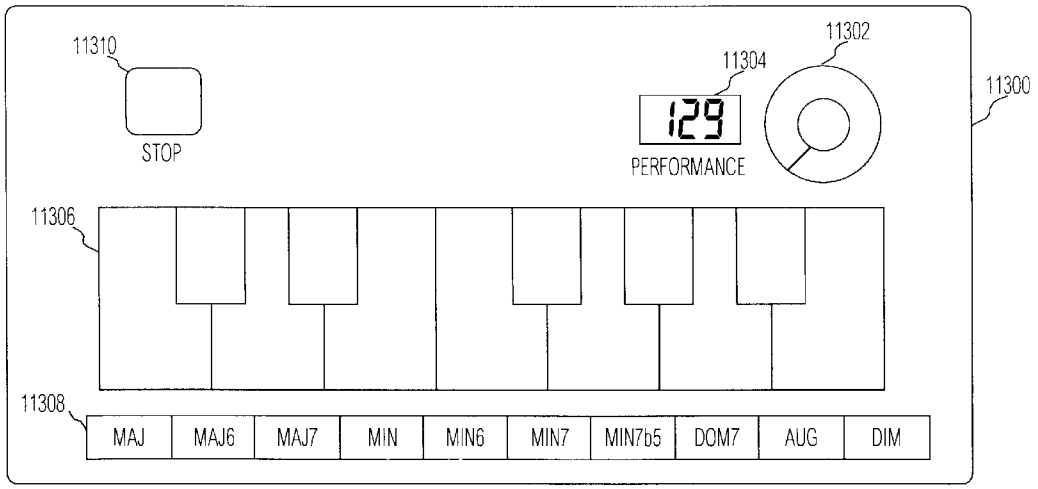

FIG. 113 is a diagram of a control panel of another electronic musical instrument 11300. A rotary dial 11302 selects from one of many stored groups of settings which loads various parameters and patterns into the memory. An LED display 11304 shows the current performance number, and other information. A stop button 11310 stops the processing of data by suspending the counting of clock events. A row of buttons or keys 11306 sets the current chord root of a chord (with 0 being C, 1 being C♯, and so on), and a row of buttons or keys 11308 sets the current chord type. The buttons are used together to specify a certain note set to retrieve and create the initial note series from as previously described.

The electronic musical instrument can be configured so that keys on a keyboard or perhaps buttons on the control panel can be assigned to advance the strum pattern individually. Further, certain keys can call specific strum patterns such as up strums, down strums, mute strums, and portions thereof.

OTHER EMBODIMENTS AND VARIATIONS

It is not necessary to use all of the patterns together discussed in these explanations, as they may each be used individually or in any combination. For example, the notes may be generated or repeated without the use of a velocity pattern to impart accents to them. The notes may be generated or repeated without the use of a spatial location pattern, so that no MIDI pan data is sent out. The notes may be generated or repeated without the use of a cluster pattern, and so on. The steps in the previous routines that handle the applicable operations of such patterns may be removed without affecting the processing of the invention. In its simplest form the process can use only a single patterns of any of the pattern shown and achieve greater diversity over existing methods. Alternately, it is possible to combine one or more of the various elements of the individual patterns into a composite pattern, so that each step for example contains data for the rhythm, data for the transposition, data for the velocity, and so on.

The pattern offsets described during the explanation of the generation of a repeated effect could also be employed in a similar fashion in the reading out of data, and remain within the scope of the invention.

While the indexes and locations of various buffers, patterns, and arrays in all of the previous descriptions have been described as being from {1–"n"} for clarity, it is common knowledge that in computer language these locations are typically addressed from {0–("n"–1)}.

Resetting the current seed of a pseudo-random number generator to a stored seed at musical intervals of time is not limited to only being utilized in the selection of data items from pools, or pools within pattern steps. Persons of skill in the art will recognize that the repeatable sequence of random numbers thereby realized may be utilized to control other functions of the processing (e.g. parameter changes or selections of processing options), and still remain within the scope of the invention.

While the methods and devices previously described may receive MIDI notes and other data from an external device, and produce MIDI data that is sent out to the same or different external MIDI device containing a tone generator where the data produces audio output, these methods and devices could be incorporated into such devices in any number of combinations, including a device with a keyboard, a MIDI guitar, a device with pads, switches or buttons, or any or all such devices also in conjunction with an internal tone generator. Further, while the previous discussion used the convention of a MIDI note-on message with a velocity of 0 as a note-off message, the MIDI specification provides for a separate note-off message. Thus, the note-off message could be used instead of the note-on message with a velocity of 0. Finally, the time intervals, tick counts, and all other numerical examples were arbitrarily chosen for purposes of discussion and, therefore, other values can be used as required by the application or user's preferences. The apparatus can be a general purpose computer programmed to perform the method or dedicated hardware specifically configured to perform the process. Moreover, the method and hardware may be used in a stand alone fashion or as part of a system. In lieu of the MIDI standard, other electronic musical standards and conventions could be employed according to the present invention.

While particular embodiments and applications of the invention have been shown and described, it will be obvious to those skilled in the art that the specific terms and figures are employed in a generic and descriptive sense only and not for the purposes of limiting or reducing the scope of the broader inventive aspects herein. By disclosing the preferred embodiments of the present invention above, it is not intended to limit or reduce the scope of coverage for the general applicability of the present invention. Persons of skill in the art will easily recognize the substitution of similar components and steps in the apparatus and methods of the present invention.

APPENDIX A

```
  // calculate and store a table of values (x, y)
void CalcTable(Byte *table, Byte tab_curve, char tab_weight)
{
register Byte i;
double input;
double weight;
short tableval;
long y1,y2;
double d;
  if(tab_weight==0){
    for(i = 0; i < 128; i++)
    {
     table[i] = i;
    }
  }else{
    switch(tab_curve)
    {
```

APPENDIX A-continued

```
    default:
    case EXP:
      weight = ((double) tab_weight)/4.9864747;
      d = 1 - exp(weight);
      y1 = 0;
      if(tab_weight>0)
        y2 = 127;
      else
        y2 = 128;
      for(i = 0; i < 128; ++i)
      {
        input = (double)(i/127.0);
        tableval = (Byte)y1 + (y2 - y1)*((1 - exp(input*weight))/d);
        if(tableval > 127)
          tableval = 127;
        table[i] = tableval;
      }
      break;
    case EXP_S:
      weight = ((double) tab_weight)/4.9864747;
      d = 1 - exp(weight);
      y1 = 0;
      if(tab_weight>0)
        y2 = 64;
      else
        y2 = 64;
      for(i = 0; i < 65; ++i){
        input = (double) (i/64.0);
        tableval = (Byte) y1 + (y2 - y1)*((1 - exp(input*weight))/d);
        if(tableval > 63)
          tableval = 63;
        table[i] = tableval;
      }
      d = 1 - exp(-weight);
      y1 = 64;
      y2 = 128;
      for (i = 0; i < 64; ++i)
      {
        input = (double) (i/63.0);
        tableval = (Byte) y1 + (y2 - y1)*((1 - exp(input*(-weight)))/d);
        if(tableval > 127)
          tableval = 127;
        table[i+64] = tableval;
      }
      break;
    case LOG:
      weight = (double) (100000**((exp((((double)tab_weight
        *2)/100.)*log(100000.)-1)/(100000.-1))) + .96;
      if(tab_weight > 0){
        for(i = 0; i < 128; i++)
        {
          input = (double) ((i)/128.0);
          tableval = (Byte)(128 * ((log((input * (weight - 1)) + 1))/
            log(weight)));
          table[i] = tableval;
        }
      }else{
        weight = (double) (100000*((exp((((double)-tab_weight
          *2)/100.)*log(100000.))-1)/(100000.-1))) + .96;
        for(i = 0; i < 128; i++)
        {
          input = (double) ((127 - i)/128.0);
          tableval = (Byte)(128 + (128 * ((-log((input * (weight - 1))
+1))/
            log(weight))))
          if(tableval > 127)
          tableval = 127;
          table[i] = tableval;
        }
      }
      break;
    case LOG S:
      if (tab_weight > 0){
        weight = (double) (100000*((exp((((double)tab_weight
          *2)/100.)*log(100000.))-1)/(100000.-1))) + .96;
        for(i = 0; i < 64; i++)
        {
          input = (double) ((i)/64.0);
          tableval = (Byte)(64 * ((log((input * (weight - 1)) + 1))/
```

APPENDIX A-continued

```
            log(weight)));
          table[i] = tableval;
        }
        for(i = 0; i < 64; i++)
        {
          input = (double) ((63 − i)/64.0);
          tableval = (Byte)(128 + (64 * ((−log((input * (weight − 1)) +
1))/
            log(weight))));
          if(tableval > 127)
            tableval = 127;
          table[i+64] = tableval;
        {
      }else{
        weight = (double) (100000*((exp((((double)−tab_weight
          *2)/100.)*log(100000.))−1)/(100000.−1))) + .96;
        for(i = 0; i < 64; i++)
        {
          input = (double) ((64 − i)/64.0);
          tableval = (Byte)(64 + (64 * ((−log((input * (weight − 1)) +
1))/
            log(weight))));
          if(tableval > 63)
            tableval = 63;
          table[i] = tableval;
        }
        for(i = 0; i < 64; i++)
        {
          input = (double) ((i)/64.0);
          tableval = (Byte)(64 + (64 * (log((input * (weight − 1)) +
1))/
            log(weight))));
          table[i+64] = tableval;
        }
      }
      break;
    }
  }
}
```

APPENDIX B

```
  // Precalculate and store an adjusted weight for GetCurveValue().
double SetCurveWeight(Byte tab_curve, char tab_weight)
{
double weight;
  if (tab_weight == 0){
    return (0.0);
  }else{
    switch (tab_curve)
    {
      default:
      case EXP:
      case EXP_S:
        weight = ((double) tab_weight)/4.9864747;
        return (weight);
      case LOG:
      case LOG_S:
        if(tab_weight > 0){
          weight = (double) (100000*((exp((((double)tab_weight
            *2)/100.)*log(100000.))−1)/(100000.−1))) + .96;
        }else{
          weight = (double) (100000*((exp((((double)−tab_weight
            *2)/100.)*log(100000.))−1)/(100000.−1))) + .96;
        }
        return (weight);
    }
  }
}
  // return a "y" value for an "x" value.
  // uses a precalculated (double) weight
Byte GetCurveValue(Byte rand_idx, Byte tab_curve, char tab_weight,
double weight)
{
double input;
Byte curve_val;
```

APPENDIX B-continued

```
long y1, y2;
double d;
  if (tab_weight == 0){
    return (rand_idx);
  }else{
    switch (tab_curve)
    {
      default:
      case EXP:
        d = 1 − exp(weight);
        y1 = 0;
        if(tab_weight > 0)
          y2 = 127;
        else
          y2 = 128;
        input = (double) (rand_idx/127.0);
        curve_val = (Byte) y1 + (y2 − y1)*((1 − exp(input*weight))/d);
        if(curve_val > 127)
          curve_val = 127;
        return (curve_val);
      case EXP_S:
        if (rand_idx < 64){
          d = 1 − exp(weight);
          y1 = 0;
          y2 = 64;
          input = (double) (rand_idx/64.0);
          curve_val = (Byte) y1 + (y2 − y1)*((1 − exp(input*weight))/d);
          if(curve_val > 63)
            curve_val = 63;
        }else{
          d = 1 − exp(−weight);
          y1 = 64;
          y2 = 128;
          rand_idx −= 64;
          input = (double) (rand_idx/63.0);
          curve_val = (Byte) y1 + (y2 − y1)*((1 − exp(input*(−
weight)))/d);
          if(curve_val > 127)
            curve_val = 127;
        }
        return (curve_val);
      case LOG:
        if(tab_weight > 0){
          input = (double) (rand_idx/128.0);
          curve_val = (Byte)(128 * ((log((input * (weight − 1)) + 1))/
            log(weight)));
        }else{
          input = (double) ((127 − rand_idx)/128.0);
          curve_val = (Byte)(128 + (128 * ((−log((input * (weight −1)) +
1))/
            log(weight))));
          if(curve_val > 127)
            curve_val = 127;
        }
        return (curve_val);
      case LOG_S:
        if (tab_weight > 0){
          if(rand_idx < 64){
            input = (double) (rand_idx/64.0);
            curve_val = (Byte)(64 * ((log((input * (weight − 1)) + 1))/
              log(weight)));
          }else{
            rand_idx −= 64;
            input = (double) ((63 − rand_idx)/64.0);
            curve_val = (Byte)(128 + (64 * ((−log((input * (weight −1))
+ 1))/
              log(weight))));
            if(curve_val > 127)
              curve_val = 127;
          }
        }else{
          if(rand_idx < 64){
            input = (double) ((63 − rand_idx)/64.0);
            curve_val = (Byte)(64 + (64 * ((−log((input * (weight − 1))
+ 1))/
              log(weight))));
            if(curve_val > 63)
              curve val = 63;
          }else{
```

APPENDIX B-continued

```
        rand_idx -= 64;
        input = (double) ((rand_idx)/64.0);
        curve_val = (Byte)(64 + (64 * ((log((input * (weight - 1)) + 1))/
          log(weight))));
      }
    }
    return (curve_val);
  }
 }
}
```

APPENDIX C

```
Byte RandomByte(long *the_seed, Byte bot, Byte top)
{
short i;
  *the_seed = *the_seed * 1103515245 + 12345;
  i = (*the_seed >> 16) & 0x7FFF;
  return((Byte)((i % ((top + 1) - bot)) + bot));
}
```

What is claimed is:

1. A general purpose computer-based system for generating musical information including at least one computer memory, said system comprising:

a set of data items stored in said at least one computer memory, said data items representing a characteristic of said musical information;

a pool indicating a plurality of said data items, each of said data items being independently selectable to appear within said pool;

a random number generator for generating a random number;

a weighting module for weighting said random number according to a mathematical function; and a processor for selecting a data item within said pool using said weighted random number, said data item being used in generating said musical information.

2. The system of claim 1 wherein said mathematical function is a logarithmic function.

3. The system of claim 1 wherein said mathematical function is an exponential function.

4. The system of claim 1 wherein said mathematical function weights some of said data items within said pool with a zero probability such that said processor selects said data item from a subset of said pool.

5. The system of claim 1 wherein said weighting module includes a lookup table stored in said at least one computer memory, said mathematical function being stored within said lookup table.

6. The system of claim 1 wherein said random number generator comprises a pseudo-random number generator, said pseudo-random number generator having a seed, said seed causing said pseudo random number generator to generate a specific sequence of random numbers.

7. The system of claim 6 wherein said seed is selected by a system user from a plurality of seeds stored in said at least one computer memory.

8. The system of claim 6 further comprising a reset module for reseeding said pseudo-random number generator with said seed so as to cause said pseudo-random number generator to repetitively generate said specific sequence of random numbers.

9. The system of claim 1 wherein said musical characteristic is rhythm and said data items comprise rhythm values.

10. The system of claim 1 wherein said musical characteristic is duration and said data items comprise duration values.

11. The system of claim 1 wherein said musical characteristic is pitch and said data items comprise pitch values.

12. The system of claim 1 wherein said musical characteristic is percussive sounds and said data items comprise percussion instrument identifiers.

13. The system of claim 1 wherein said musical characteristic is amplitude and said data items comprise velocity values.

14. The system of claim 1 wherein said musical characteristic is spatial location and said data items comprise spatial location values.

15. The system of claim 1 wherein said musical characteristic is musical instrument sounds and said data items comprise voice change values.

16. The system of claim 1 wherein said musical characteristic is a pitch offset of a note and said data items comprise pitch bend values.

17. The system of claim 1 wherein said musical characteristic is a MIDI controlled characteristic and said data items comprise MIDI control values.

18. The system of claim 1 wherein said musical characteristic is audio sound and said data items comprise digital audio samples.

19. The system of claim 1 further comprising notes to be output, wherein said musical characteristic is a number of notes to be output and said data items comprise cluster values.

20. The system of claim 1 further comprising notes to be output, wherein said musical characteristic is an output note order and said data items comprise strum values.

21. The system of claim 20 wherein said musical characteristic is further defined by a temporal separation between said notes to be output and said set of data items further comprises temporal separation values.

22. The system of claim 1 wherein said musical characteristic is pitch transposition and said set of data items comprises transposition values.

23. The system of claim 1 further comprising:

a plurality of said pools, each of said pools capable of indicating a different plurality of said data items within said set of data items; and an index stored in said at least one computer memory, said index indicating one of said pools as a current pool from which said processor selects said data item.

24. The system of claim 23 further comprising a user control for advancing said index to a next pool.

25. The system of claim 23 wherein said processor advances said index to a next pool.

26. The system of claim 23 further comprising a poly mode flag for indicating that all of said data items within said current pool, including said data item selected using said weighted random number, are to be selected by said processor for use in generating said musical information.

27. The system of claim 1 further comprising:

a plurality of said pools, each of said pools capable of indicating a different plurality of said data items within said set of data items, each of said pools being included within a step;

a step not including one of said pools and including a single data item independently selected to appear within said step;

a sequence of said steps indicating a progression in generating said musical information; and an index stored in said at least one computer memory, said index indicating one of said steps as a current step, said processor selecting said data item from said pool when said current step contains a pool, said processor selecting said single data item when said current step includes said single data item.

28. The system of claim 27, further comprising a user control for advancing said index to a next step.

29. The system of claim 27 wherein said processor advances said index to a next step.

30. The system of claim 27 further comprising a poly mode flag for indicating that all of said data items within said pool within said current step, including said data item selected using said weighted random number, are to be selected by said processor for use in generating said musical information when said current step contains a pool.

31. The system of claim 1 further comprising:

a plurality of said sets of data items stored in said at least one computer memory, each of said sets containing data items representing a different characteristic of said musical information, each of said sets being associated with a pattern;

a plurality of said pools, each of said patterns including one of said pools, each of said pools capable of indicating a different plurality of said data items associated with said pattern; and a plurality of indices stored in said at least one computer memory, each of said indices associated with one of said patterns and indicating a current pool within said pattern from which said processor selects said data item.

32. The system of claim 31 wherein one of said sets of data items comprises index movement values and said patterns include an index pattern associated with said set of index movement values, said data item selected by said processor being from said current pool of said index pattern, said processor advancing one of said indices to a next pool according to said selected data item.

33. The system of claim 31 wherein one of said sets of data items comprises cluster values indicating a quantity of pools within one of said patterns and said patterns include a cluster pattern associated with said set of cluster values, said data item selected by said processor being from said current pool of said cluster pattern, said processor selecting a plurality of data items from said quantity of pools according to said selected data item.

34. The system of claim 1 further comprising an always flag indicating an additional data item within said pool to be selected by said processor for use in generating said musical information with said data item selected using said weighted random number.

35. The system of claim 1 further comprising a null data item indicating an absence of musical information, said null data item also being independently selectable to appear within said pool, said generation of musical information being suppressed upon selection of said null data item by said processor using said weighted random number.

36. The system of claim 35 wherein said musical characteristic is pitch and said set of data items comprises pitch values.

37. The system of claim 1 wherein said system generates an additional weighted random number, said system further comprising:

a null data item indicating an absence of musical information, said additional weighted random number being used by said processor to select between said null data item and said data item selected using said weighted random number, said generation of musical information being suppressed upon selection of said null data item by said processor using said additional weighted random number.

38. A method for generating musical information using a general purpose computer-based system having at least one computer memory, said method comprising:

storing a set of data items in said at least one computer memory, said data items representing a characteristic of said musical information;

selecting a plurality of said data items to comprise a pool, each of said data items being independently selectable to appear within said pool;

generating a random number;

weighting said random number according to a mathematical function;

selecting one of said data items within said pool according to said weighted random number, and generating said musical information using said selected data item.

39. The method of claim 38 wherein said system further comprises a processor and said step of selecting one of said data items within said pool is performed by said processor.

40. The method of claim 38 wherein said weighting step includes assigning a zero probability of selection to one of said data items within said pool.

41. The method of claim 38 further comprising:

storing a lookup table in said at least one computer memory, and storing said mathematical function within said lookup table.

42. The method of claim 38 wherein said random number generator comprises a pseudo random number generator, the method further comprising:

seeding said pseudo random number generator with a seed, and generating a sequence of musical information based on said seed.

43. The method of claim 42 further comprising:

storing a plurality of seeds in said at least one computer memory; and selecting said seed for seeding said pseudo random number generator from said plurality of seeds.

44. The method of claim 42 further comprising reseeding said pseudo random number generator with said seed so as to repetitively generate said sequence of musical information.

45. The method of claim 44 wherein said reseeding is repeatedly performed at specific musical time intervals.

46. The method of claim 38 wherein said step of generating musical information includes specifying a musical rhythm according to said selected data item.

47. The method of claim 38 wherein said step of generating musical information includes specifying a note pitch according to said selected data item.

48. The method of claim 38 wherein said step of generating musical information includes specifying a note duration according to said selected data item.

49. The method of claim 38 wherein said step of generating musical information includes specifying a percussive sound according to said selected data item.

50. The method of claim 38 wherein said step of generating musical information includes specifying a note velocity according to said selected data item.

51. The method of claim 38 wherein said step of generating musical information includes specifying a spatial location according to said selected data item.

52. The method of claim 38 wherein said step of generating musical information includes specifying an instrument voice according to said selected data item.

53. The method of claim 38 wherein said step of generating musical information includes bending a pitch of a note according to said selected data item.

54. The method of claim 38 wherein said step of generating musical information includes varying a MIDI controllable characteristic according to said selected data item.

55. The method of claim 38 wherein said data items comprise digital audio samples and said step of generating musical information includes producing an audio sound according to said selected data item.

56. The method of claim 38 wherein said system includes notes to be output and said method further includes outputting a number of said notes according to said selected data item.

57. The method of claim 38 wherein said system includes notes to be output and said method further includes outputting a number of said notes in a specific order according to said selected data item.

58. The method of claim 57 wherein said step of outputting further includes separating said output notes with a time interval according to said selected data item.

59. The method of claim 38 wherein said step of generating musical information includes transposing a pitch of a note according to said selected data item.

60. The method of claim 38 further including selecting all of said data items within said pool according to a poly mode flag.

61. The method of claim 38 wherein said step of selecting a plurality of said data items is performed repeatedly to create a plurality of said pools, each of said pools capable of indicating a different plurality of said data items within said set of data items, said method further comprising:

storing an index within said at least one computer memory;

indicating with said index one of said plurality of pools as a current pool from which said data item is selected according to said weighted random number, and advancing said index to indicate a next pool.

62. The method of claim 61 wherein said step of advancing said index to indicate a next step is performed with a user-operated control.

63. The method of claim 61 wherein said system further comprises a processor and said step of advancing said index to indicate a next step is performed by said processor.

64. The method of claim 38 wherein said step of selecting a plurality of said data items is performed repeatedly to create a plurality of said pools, each of said pools capable of indicating a different plurality of said data items within said set of data items, a plurality of steps indicating a progression in generating said musical information, said method further comprising:

associating each of said pools with one of said steps;

selecting one of said data items as an unpooled data item to appear within one of said steps not including a pool;

storing an index in said at least one computer memory;

indicating with said index one of said steps as a current step from which said data item is selected according to said weighted random number when said step contains a pool and said unpooled data item is selected when said current step does not contain a pool, and advancing said index to indicate a next step.

65. The method of claim 64 wherein said step of advancing said index to indicate a next step is performed with a user-operated control.

66. The method of claim 64 wherein said system further comprises a processor and said step of advancing said index to indicate a next step is performed by said processor.

67. The method of claim 38 wherein said computer-based system further comprises a plurality of said sets of data items, each set of data items representing a different characteristic of said musical information, and wherein said steps of storing said data items and selecting a plurality of said data items are repeatedly performed to create a plurality of said pools, each of said pools capable of indicating a different plurality of said data items within said plurality of sets of data items, said method further comprising:

associating each of said sets of data items with a pattern;

associating each of said pools with one pattern step of each pattern, said pattern steps indicating a progression in generating said musical information;

storing an index within said at least one computer memory;

indicating with said index one of said plurality of pools as a current pool from which said data item is selected, and advancing said index to indicate a next pool.

68. The method of claim 67 wherein one of said sets contains data items comprising index movement values, said step of advancing said index to indicate a next pool being performed according to an index movement value when said index movement value is said selected data item.

69. The method of claim 67 wherein said computer-based system comprises a plurality of said indices, said method further comprising:

associating each of said indices with a different one of said patterns, each of said associated indices indicating a current pool within said associated pattern from which said data item is selected.

70. The method of claim 69 wherein said steps of generating and weighting said random number are performed repeatedly and said step of selecting one of said data items is performed repeatedly so as to select one data item from each of said current pools according to a different one of said weighted random numbers.

71. The method of claim 38 further comprising selecting an additional data item within said pool according to an always flag, said always flag indicating that said additional data item and said selected data item are both used in generating said musical information.

72. The method of claim 38 wherein one of said data items within said pool is a null data item, said null data item indicating that no musical information is generated when selected according to said weighted random number.

73. The method of claim 38 wherein and said steps of generating and weighting said random number are repeated to generate an additional weighted random number, said method further comprising:

storing a null data item in said at least one computer memory, said null data item indicating that no musical information is generated when selected; and selecting one of said null data item or said selected data item according to said additional weighted random number.

74. A computer-readable media for storing instructions for generating musical output data comprising instructions for:

storing a set of data items in at least one computer memory, said data items representing a characteristic of said musical information;

selecting a plurality of said data items to comprise a pool, each of said data items being independently selectable to appear within said pool;

generating a random number;

weighting said random number according to a mathematical function;

selecting one of said data items within said pool according to said weighted random number, and generating said musical information using said selected data item.

* * * * *

UNITED STATES PATENT AND TRADEMARK OFFICE

CERTIFICATE OF CORRECTION

PATENT NO. : 6,121,533

DATED : September 19, 2000

INVENTOR(S) : Stephen Kay

It is certified that error appears in the above-identified patent and that said Letters Patent is hereby corrected as shown below:

Column 22, line 23, after "in" insert --318 Fig. 3. In this matter, a pattern will have a finite number of--.
Column 26, line 5, after "routine" insert --when this routine--.
Column 38, line 3, after "," insert --extraction--.
Column 57, line 21, "12division" should read --12 division--.
Column 65, line 57, "noteons" should read --note-ons--.
Column 70, line 8, after "or" insert --external clock--.
Column 70, line 31, after "that" cancel --,--.
Column 92, line 18, after "size" insert --may--.
Column 120, line 3, "105 10" should read --10510--.
Column 120, line 11, after "10506" insert --,--.
Column 123, line 24, "1100" should read --11001--.
Column 124, line 34, "Calculate" should read --[Calculate--.
Column 128, line 56, "pattern" should read --patterns--.
Columns 130 thru 133 in Appendices A and B, after "(weight - 1))" text and numbers should not be separated.
Columns 130 thru 133 in Appendices A and B, after "(weight - 1+))" text and numbers should not be separated.

Signed and Sealed this

Eighth Day of May, 2001

*Attest:*

Nicholas P. Godici

NICHOLAS P. GODICI

*Attesting Officer*

*Acting Director of the United States Patent and Trademark Office*